US010625137B2

(12) United States Patent
Dalebout et al.

(10) Patent No.: US 10,625,137 B2
(45) **Date of Patent: *Apr. 21, 2020**

(54) COORDINATED DISPLAYS IN AN EXERCISE DEVICE

(71) Applicant: ICON Health & Fitness, Inc., Logan, UT (US)

(72) Inventors: William T. Dalebout, North Logan, UT (US); Gordon Cutler, Providence, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 273 days.

This patent is subject to a terminal disclaimer.

(21) Appl. No.: 15/460,946

(22) Filed: Mar. 16, 2017

(65) Prior Publication Data

US 2017/0266533 A1 Sep. 21, 2017

Related U.S. Application Data

(60) Provisional application No. 62/310,343, filed on Mar. 18, 2016.

(51) Int. Cl.
*A63B 22/02* (2006.01)
*A63B 22/00* (2006.01)
(Continued)

(52) U.S. Cl.
CPC ..... *A63B 71/0622* (2013.01); *A63B 22/0285* (2013.01); *A63B 21/225* (2013.01);
(Continued)

(58) Field of Classification Search
CPC ..... A63B 71/0622; A63B 71/0619; A63B 22/0664; A63B 22/0242; A63B 22/0605; A63B 22/0285; A63B 22/0076; A63B 2220/78; A63B 2220/808; A63B 2220/30; A63B 2220/70; A63B 2220/806; A63B 2220/20; A63B 22/0023; A63B 24/0087; A63B 2225/50; A63B 2225/20; A63B 2071/065; A63B 69/0057; A63B 21/225; A63B 2022/0688; A63B 2071/0625; A63B 2071/0638; A63B 2071/0658;
(Continued)

(56) References Cited

U.S. PATENT DOCUMENTS 105,055 A 7/1870 Dulij
232,022 A 9/1880 Gifford
(Continued)

FOREIGN PATENT DOCUMENTS

WO 2009014330 1/2009

OTHER PUBLICATIONS

U.S. Appl. No. 10/949,271, filed Jul. 18, 2002, Krull Mark A.
U.S. Appl. No. 15/461,119, dated Sep. 11, 2018, Non-final Rejection.

*Primary Examiner* — Sundhara M Ganesan
*Assistant Examiner* — Shila Jalalzadeh Abyaneh
(74) *Attorney, Agent, or Firm* — Maschoff Brennan

(57) ABSTRACT

An exercise device includes a frame, an upright portion of the frame, a movable element connected to the frame and movable in the performance of an exercise, a first display connected to the upright portion of the frame, and a second display connected to the frame.

18 Claims, 10 Drawing Sheets

(51) Int. Cl.

| | |
|---|---|
| ***A63B 24/00*** | (2006.01) |
| ***A63B 71/06*** | (2006.01) |
| *A63B 22/06* | (2006.01) |
| *A63B 69/00* | (2006.01) |
| *A63B 21/22* | (2006.01) |

(52) U.S. Cl.

CPC ..... *A63B 22/0023* (2013.01); *A63B 22/0076* (2013.01); *A63B 22/0242* (2013.01); *A63B 22/0605* (2013.01); *A63B 22/0664* (2013.01); *A63B 24/0087* (2013.01); *A63B 69/0057* (2013.01); *A63B 2022/0688* (2013.01); *A63B 2071/065* (2013.01); *A63B 2071/0625* (2013.01); *A63B 2071/0638* (2013.01); *A63B 2071/0658* (2013.01); *A63B 2220/20* (2013.01); *A63B 2220/30* (2013.01); *A63B 2220/70* (2013.01); *A63B 2220/78* (2013.01); *A63B 2220/806* (2013.01); *A63B 2220/808* (2013.01); *A63B 2225/20* (2013.01); *A63B 2225/50* (2013.01)

(58) Field of Classification Search

CPC .... A63B 2071/0636; A63B 2071/0644; A63B 2071/0691; A63B 2071/0694; A63B 2024/009; A63B 2024/0096; A63B 2069/0055; A63B 24/00; A63B 2024/0015; A63B 2071/0677; A63B 22/02; A63B 69/0028; A63B 2022/0271; A63B 2022/0278; A61H 2201/5043; A61H 2201/5046

See application file for complete search history.

(56) References Cited

U.S. PATENT DOCUMENTS 284,294 A 9/1883 Graves
321,388 A 6/1885 Ruebsam
339,638 A 4/1886 Goldie
348,493 A 8/1886 Greene
421,779 A 2/1890 Steven
447,780 A 3/1891 Luge
450,792 A 4/1891 Dodd
470,837 A 3/1892 Hart
549,084 A 10/1895 Whitaker
601,307 A 3/1898 Salisbury
659,216 A 10/1900 Dowling
663,486 A 12/1900 Boren
674,391 A 5/1901 Baker
683,284 A 9/1901 Honey
766,930 A 8/1904 Clemons
801,582 A 10/1905 Funke
881,521 A 3/1908 Wilson
897,722 A 9/1908 Day
931,394 A 8/1909 Day
937,795 A 10/1909 Hackney
1,015,071 A 1/1912 Reach
1,016,729 A 2/1912 Barrett
1,020,777 A 3/1912 Peterson
1,064,968 A 6/1913 Hagen
1,082,940 A 12/1913 Flora
1,211,765 A 1/1917 Schmidt
1,570,482 A 1/1926 Hale
1,580,530 A 4/1926 Rambo
1,585,748 A 5/1926 Wendelken
1,715,870 A 6/1929 Augustine
1,766,089 A 6/1930 Wood
1,778,635 A 10/1930 Heisler
1,824,406 A 9/1931 Petersime
1,850,530 A 3/1932 Brown
1,893,728 A 1/1933 Bullis
1,902,694 A 3/1933 Edwards
1,919,627 A 7/1933 Fitz Gerald
1,928,089 A 9/1933 Blickman
1,930,416 A 10/1933 Chauvot
1,969,901 A 8/1934 Pilates
1,973,945 A 9/1934 Chavin
1,978,579 A 10/1934 Hooks
1,982,843 A 12/1934 Traver
2,067,136 A 1/1937 Bridenbaugh
2,079,594 A 5/1937 Hall
2,117,957 A 5/1938 Ritter
2,145,940 A 2/1939 Marlowe
2,165,700 A 7/1939 Henry
2,177,957 A 10/1939 Stewart
2,209,034 A 7/1940 Rene
2,219,219 A 10/1940 Boger
2,247,946 A 7/1941 Hein et al.
2,255,864 A 9/1941 Stephens
2,261,155 A 11/1941 Simon
2,315,485 A 4/1943 Le Roy
2,399,915 A 5/1946 Drake
2,413,841 A 1/1947 Minuto
2,440,644 A 4/1948 Powell
2,544,106 A 3/1951 Ray
2,553,912 A 5/1951 Gervais
2,569,007 A 9/1951 Klyce
2,607,816 A 8/1952 Ryder
2,632,645 A 3/1953 Barkschat
2,645,539 A 7/1953 Thompson
2,646,282 A 7/1953 Ringman
2,648,540 A 8/1953 Hunter
2,674,453 A 4/1954 Hummert
2,743,623 A 5/1956 Wells
2,746,822 A 5/1956 Copenhaver
2,771,968 A 11/1956 Mercier
2,779,139 A 1/1957 Boettcher
2,842,365 A 7/1958 Kelley
2,855,200 A 10/1958 Blickman
2,874,971 A 2/1959 Devry
2,906,532 A 9/1959 Echols
2,969,060 A 1/1961 Swanda
2,984,594 A 5/1961 Runton
3,008,265 A 11/1961 Converse
3,035,671 A 5/1962 Sicherman
3,059,312 A 10/1962 Jamieson
3,068,950 A 12/1962 Davidson
3,072,426 A 1/1963 Gilbert
3,100,640 A 8/1963 Weitzel
3,112,108 A 11/1963 Hanke
3,127,171 A 3/1964 Noland et al.
3,179,071 A 4/1965 Johnston
3,190,675 A 6/1965 Tang
3,193,287 A 7/1965 Robinson
3,205,888 A 9/1965 Stroop
3,227,447 A 1/1966 Baker
3,312,466 A 4/1967 Melchiona
3,316,898 A 5/1967 Brown
3,319,273 A 5/1967 Solin
3,342,485 A 9/1967 Gaul
3,345,067 A 10/1967 Smith
3,358,813 A 12/1967 Kohlhagen
3,378,259 A 4/1968 Kupchinski
3,394,934 A 7/1968 Petros
3,408,067 A 10/1968 Armstrong
3,408,069 A 10/1968 Lewis
3,411,497 A 11/1968 Rickey et al.
3,416,174 A 12/1968 Novitske
3,424,005 A 1/1969 Brown
3,425,523 A 2/1969 Robinette
3,430,084 A 2/1969 Hall
3,430,507 A 3/1969 Hurst et al.
3,432,164 A 3/1969 Deeks
3,438,627 A 4/1969 La Lanne
3,444,830 A 5/1969 Doetsch
3,446,503 A 5/1969 Lawton
3,465,592 A 9/1969 Perrine
3,473,843 A 10/1969 Hart
3,501,140 A 3/1970 Eichorn
3,506,311 A 4/1970 Nobach
3,511,500 A 5/1970 Dunn
3,514,110 A 5/1970 Thomander

(56) References Cited

U.S. PATENT DOCUMENTS 3,518,985 A 7/1970 Quinton
3,522,947 A 8/1970 Anderson
3,529,474 A 9/1970 Olson
3,547,435 A 12/1970 Scott
3,554,541 A 1/1971 Spoth
3,563,541 A 2/1971 Sanquist
3,566,861 A 3/1971 Weiss
3,567,219 A 3/1971 Foster
3,568,669 A 3/1971 Stites
3,572,700 A 3/1971 Mastropaolo
3,583,465 A 6/1971 Youngs et al.
3,586,322 A 6/1971 Kverneland
3,589,193 A 6/1971 Thornton
3,589,715 A 6/1971 Mark
3,592,466 A 7/1971 Parsons
3,598,404 A 8/1971 Bowman
3,602,502 A 8/1971 Jaegar
3,606,320 A 9/1971 Erwin, Jr.
3,608,898 A 9/1971 Berlin
3,614,097 A 10/1971 Blickman
3,622,179 A 11/1971 Pfersick
3,628,654 A 12/1971 Haracz
3,628,791 A 12/1971 Garcia
3,634,895 A 1/1972 Childers
3,636,577 A 1/1972 Nissen
3,638,941 A 2/1972 Kulkens
3,640,528 A 2/1972 Proctor
3,640,530 A 2/1972 Henson et al.
3,641,601 A 2/1972 Sieg
3,642,279 A 2/1972 Cutter
3,643,943 A 2/1972 Erwin, Jr. et al.
3,647,209 A 3/1972 La Lanne
3,650,529 A 3/1972 Salm
3,658,327 A 4/1972 Thiede
3,659,845 A 5/1972 Quinton
3,664,666 A 5/1972 Lloyd
3,686,776 A 8/1972 Dahl
3,689,066 A 9/1972 Hagen
3,703,284 A 11/1972 Hesen
3,708,166 A 1/1973 Annas
3,709,197 A 1/1973 Moseley
3,709,487 A 1/1973 Walker
3,728,940 A 4/1973 Peterson
3,731,917 A 5/1973 Townsend
3,738,649 A 6/1973 Miller
3,738,661 A 6/1973 Moller
3,741,538 A 6/1973 Useldinger
3,744,480 A 7/1973 Gause et al.
3,744,712 A 7/1973 Papadopoulos
3,744,794 A 7/1973 Gause et al.
3,751,033 A 8/1973 Rosenthal
3,756,595 A 9/1973 Hague
3,759,511 A 9/1973 Zinkin
3,760,905 A 9/1973 Dower
3,767,195 A 10/1973 Dimick
3,770,267 A 11/1973 Carthy
3,782,718 A 1/1974 Saylor
3,788,412 A 1/1974 Vincent
3,792,860 A 2/1974 Selnes
3,802,698 A 4/1974 Burian et al.
3,809,393 A 5/1974 Jones
3,814,420 A 6/1974 Encke
3,818,194 A 6/1974 Biro
3,820,617 A 6/1974 Groff
3,822,488 A 7/1974 Johnson
3,822,599 A 7/1974 Brentham
3,824,994 A 7/1974 Soderberg, Sr.
3,826,491 A 7/1974 Elder
3,833,216 A 9/1974 Philbin
3,834,696 A 9/1974 Spector
3,845,756 A 11/1974 Olsson
3,848,467 A 11/1974 Flavell
3,851,874 A 12/1974 Wilkin
3,858,873 A 1/1975 Jones
3,858,938 A 1/1975 Kristensson et al.
3,859,840 A 1/1975 Gause
3,861,215 A 1/1975 Bradley
3,869,121 A 3/1975 Flavell
3,870,297 A 3/1975 Elder
3,874,657 A 4/1975 Niebojewski
3,880,274 A 4/1975 Bechtloff
3,883,922 A 5/1975 Fleischhauer
3,892,404 A 7/1975 Martucci
3,895,825 A 7/1975 Sink
3,901,379 A 8/1975 Bruhm
3,902,480 A 9/1975 Wilson
3,903,613 A 9/1975 Bisberg
3,904,196 A 9/1975 Berlin
3,909,857 A 10/1975 Herrera
3,912,263 A 10/1975 Yatso
3,918,710 A 11/1975 Niebojewski
3,926,430 A 12/1975 Good
3,929,026 A 12/1975 Hofmann
3,938,400 A 2/1976 Konyha
3,941,377 A 3/1976 Lie
3,948,513 A 4/1976 Pfotenhauer
3,957,266 A 5/1976 Rice
3,963,101 A 6/1976 Stadelmann et al.
3,967,503 A 7/1976 Svensson
3,970,302 A 7/1976 McFee
3,974,491 A 8/1976 Sipe
3,977,451 A 8/1976 Duba
3,981,500 A 9/1976 Ryan
3,990,136 A 11/1976 Hishida
4,007,927 A 2/1977 Proctor
4,012,015 A 3/1977 Nelson et al.
4,020,795 A 5/1977 Marks
4,023,466 A 5/1977 Strassheimer
4,024,949 A 5/1977 Kleysteuber et al.
4,026,545 A 5/1977 Schonenberger
4,027,531 A 6/1977 Dawson
4,033,567 A 7/1977 Lipfert
4,045,096 A 8/1977 Lidov
4,056,265 A 11/1977 Ide
4,063,726 A 12/1977 Wilson
4,063,727 A 12/1977 Hall
4,066,257 A 1/1978 Moller
4,066,259 A 1/1978 Brentham
4,067,372 A 1/1978 Masson
4,071,235 A 1/1978 Zent
4,072,309 A 2/1978 Wilson
4,074,903 A 2/1978 Diez de Aux
4,077,278 A 3/1978 Combastet
4,077,626 A 3/1978 Newman
4,082,267 A 4/1978 Flavell
4,093,196 A 6/1978 Bauer
4,094,330 A 6/1978 Jong
4,101,124 A 7/1978 Mahnke
4,111,417 A 9/1978 Gardner
4,112,928 A 9/1978 Putsch
4,113,071 A 9/1978 Muller et al.
4,114,873 A 9/1978 Jones
4,120,294 A 10/1978 Wolfe
4,120,924 A 10/1978 Rainville
4,131,266 A 12/1978 Carter
4,138,286 A 2/1979 Chevrolat et al.
4,140,312 A 2/1979 Buchmann
4,141,158 A 2/1979 Benseler et al.
4,146,222 A 3/1979 Hribar
4,148,478 A 4/1979 Moyski et al.
4,149,714 A 4/1979 Lambert, Jr.
4,151,988 A 5/1979 Nabinger
4,151,994 A 5/1979 Stalberger, Jr.
4,157,179 A 6/1979 Ecklor, Jr.
4,161,998 A 7/1979 Trimble
4,167,938 A 9/1979 Remih
4,168,061 A 9/1979 Gordon
4,171,805 A 10/1979 Abbott
4,179,134 A 12/1979 Atkinson
4,183,156 A 1/1980 Rudy
4,183,494 A 1/1980 Cleveland
4,188,030 A 2/1980 Hooper
4,199,139 A 4/1980 Mahnke
4,204,673 A 5/1980 Speer, Sr.

(56) References Cited

U.S. PATENT DOCUMENTS 4,208,049 A 6/1980 Wilson
4,208,921 A 6/1980 Keyes
4,215,516 A 8/1980 Huschle et al.
4,216,856 A 8/1980 Moring et al.
4,220,996 A 9/1980 Searcy
4,222,376 A 9/1980 Praprotnik
4,227,689 A 10/1980 Keiser
4,235,437 A 11/1980 Ruis et al.
4,236,239 A 11/1980 Imgruth et al.
4,239,092 A 12/1980 Janson
4,240,627 A 12/1980 Brentham
4,248,476 A 2/1981 Phelps
4,249,725 A 2/1981 Mattox
4,251,932 A 2/1981 Love
4,253,661 A 3/1981 Russell
4,258,821 A 3/1981 Wendt
4,258,913 A 3/1981 Brentham
4,274,625 A 6/1981 Gaetano
4,278,095 A 7/1981 Lapeyre
4,278,249 A 7/1981 Forrest
4,286,696 A 9/1981 Szymski et al.
4,286,782 A 9/1981 Fuhrhop
4,290,601 A 9/1981 Mittelstadt
4,291,872 A 9/1981 Brilando et al.
4,298,893 A 11/1981 Holmes
4,300,760 A 11/1981 Bobroff
4,300,761 A 11/1981 Howard
4,301,808 A 11/1981 Taus
4,313,602 A 2/1982 Sullivan
4,313,603 A 2/1982 Simjian
4,316,609 A 2/1982 Silberman
4,319,747 A 3/1982 Rogers
4,322,609 A 3/1982 Kato
4,323,237 A 4/1982 Jungerwirth
4,324,501 A 4/1982 Herbenar
4,333,978 A 6/1982 Kocher
4,334,676 A 6/1982 Schonenberger
4,334,695 A 6/1982 Ashby
4,337,283 A 6/1982 Haas, Jr.
4,337,529 A 6/1982 Morokawa
4,340,214 A 7/1982 Schuetzer
4,342,452 A 8/1982 Summa
4,344,616 A 8/1982 Ogden
4,349,597 A 9/1982 Fine et al.
4,350,336 A 9/1982 Hanford
4,354,675 A 10/1982 Barclay et al.
4,354,676 A 10/1982 Ariel
4,355,645 A 10/1982 Mitani et al.
4,358,105 A 11/1982 Sweeney, Jr.
4,363,480 A 12/1982 Fisher et al.
4,363,486 A 12/1982 Chaudhry
4,367,895 A 1/1983 Pacitti et al.
4,369,081 A 1/1983 Curry et al.
4,369,966 A 1/1983 Silberman et al.
4,370,766 A 2/1983 Teague, Jr.
4,374,587 A 2/1983 Ogden
4,377,045 A 3/1983 Aurensan
4,378,111 A 3/1983 Tsuchida et al.
4,383,684 A 5/1983 Schliep
4,383,714 A 5/1983 Ishida
4,389,047 A 6/1983 Hall
4,390,177 A 6/1983 Biran et al.
4,397,462 A 8/1983 Wilmarth
4,406,451 A 9/1983 Gaetano
4,408,613 A 10/1983 Relyea
4,411,342 A 10/1983 Katsumori et al.
4,417,574 A 11/1983 Talonn et al.
4,422,635 A 12/1983 Herod
4,422,636 A 12/1983 de Angeli
4,423,630 A 1/1984 Morrison
4,423,864 A 1/1984 Wiik
4,426,077 A 1/1984 Becker
4,431,181 A 2/1984 Baswell
4,434,981 A 3/1984 Norton
4,441,708 A 4/1984 Brentham
4,445,684 A 5/1984 Ruff
4,452,448 A 6/1984 Ausherman
4,453,766 A 6/1984 DiVito
4,461,472 A 7/1984 Martinez
4,462,252 A 7/1984 Smidt et al.
4,465,277 A 8/1984 Dittrich
4,476,582 A 10/1984 Strauss et al.
4,477,071 A 10/1984 Brown et al.
4,480,831 A 11/1984 Muller-Deinhardt
4,480,832 A 11/1984 Bulmash
4,489,933 A 12/1984 Fisher
4,491,318 A 1/1985 Francke
4,492,375 A 1/1985 Connelly
4,493,561 A 1/1985 Bouchet
4,494,662 A 1/1985 Clymer
4,495,560 A 1/1985 Sugimoto et al.
4,496,147 A 1/1985 DeCloux et al.
4,499,784 A 2/1985 Shum
4,502,679 A 3/1985 De Lorenzo
4,504,055 A 3/1985 Wells
4,504,968 A 3/1985 Kaneko et al.
4,505,473 A 3/1985 Pro
4,505,474 A 3/1985 Mattox
4,505,475 A 3/1985 Olschansky et al.
4,507,120 A 3/1985 Paradis
4,509,510 A 4/1985 Hook
4,509,742 A 4/1985 Cones
4,511,137 A 4/1985 Jones
4,512,566 A 4/1985 Bicocchi
4,512,567 A 4/1985 Phillips
4,512,571 A 4/1985 Hermelin
4,515,988 A 5/1985 Bayer et al.
4,519,603 A 5/1985 Decloux
4,521,013 A 6/1985 Dofel
4,522,394 A 6/1985 Broussard
4,529,194 A 7/1985 Haaheim
4,529,196 A 7/1985 Logan
4,533,136 A 8/1985 Smith et al.
4,536,244 A 8/1985 Greci et al.
4,537,396 A 8/1985 Hooper
4,538,805 A 9/1985 Parviainen
4,542,897 A 9/1985 Melton
4,542,899 A 9/1985 Hendricks
4,544,152 A 10/1985 Taitel
4,544,153 A 10/1985 Babcock
4,546,971 A 10/1985 Raasoch
4,548,405 A 10/1985 Lee
4,549,044 A 10/1985 Durham
4,549,733 A 10/1985 Salyer
4,555,108 A 11/1985 Monteiro
4,556,216 A 12/1985 Pitkanen
4,558,696 A 12/1985 Eiserman
4,563,001 A 1/1986 Terauds
4,563,003 A 1/1986 Bugallo et al.
4,564,193 A 1/1986 Stewart
4,566,461 A 1/1986 Lubell et al.
4,566,689 A 1/1986 Ogden
4,566,692 A 1/1986 Brentham
4,566,732 A 1/1986 Ostergaard, Sr.
4,569,518 A 2/1986 Fulks
4,571,682 A 2/1986 Silverman et al.
4,572,500 A 2/1986 Weiss
4,572,504 A 2/1986 DiBartolo
4,573,449 A 3/1986 Warnke
4,576,352 A 3/1986 Ogden
4,576,376 A 3/1986 Miller
4,577,860 A 3/1986 Matias et al.
4,577,865 A 3/1986 Shishido
4,580,983 A 4/1986 Cassini et al.
4,581,269 A 4/1986 Tilman
4,582,320 A 4/1986 Shaw
4,586,495 A 5/1986 Petrofsky
4,588,232 A 5/1986 Kim et al.
4,589,656 A 5/1986 Baldwin
4,591,147 A 5/1986 Smith et al.
4,592,544 A 6/1986 Smith et al.
4,600,187 A 7/1986 Schenker
4,600,188 A 7/1986 Bangerter et al.
4,600,196 A 7/1986 Jones

(56) References Cited

U.S. PATENT DOCUMENTS 4,601,142 A 7/1986 Frommelt
4,602,779 A 7/1986 Ogden
4,602,781 A 7/1986 La Marsh et al.
4,605,220 A 8/1986 Troxel
4,607,841 A 8/1986 Gala
4,609,190 A 9/1986 Brentham
4,610,449 A 9/1986 Diercks, Jr.
4,611,807 A 9/1986 Castillo
4,614,337 A 9/1986 Schonenberger
4,616,822 A 10/1986 Trulaske
4,618,139 A 10/1986 Haaheim
4,618,140 A 10/1986 Brown
4,618,144 A 10/1986 Gibson
4,619,454 A 10/1986 Walton
4,621,623 A 11/1986 Wang
4,624,457 A 11/1986 Silberman et al.
4,625,962 A 12/1986 Street
4,627,614 A 12/1986 De Angeli
4,627,615 A 12/1986 Nurkowski
4,627,616 A 12/1986 Kauffman
4,627,619 A 12/1986 Rockwell et al.
4,630,817 A 12/1986 Buckley
4,632,385 A 12/1986 Geraci
4,632,386 A 12/1986 Beech
4,632,390 A 12/1986 Richey
4,634,127 A 1/1987 Rockwell
4,635,927 A 1/1987 Shu
4,635,928 A 1/1987 Ogden et al.
4,637,605 A 1/1987 Ritchie
4,638,523 A 1/1987 Todd
4,638,969 A 1/1987 Brown
4,641,833 A 2/1987 Trethewey
4,642,080 A 2/1987 Takano et al.
4,642,769 A 2/1987 Petrofsky
4,643,418 A 2/1987 Bart
4,645,197 A 2/1987 Mcfee
4,645,199 A 2/1987 Bloemendaal
4,645,200 A 2/1987 Hix
4,645,201 A 2/1987 Evans
4,645,917 A 2/1987 Penney et al.
4,647,037 A 3/1987 Donohue
4,647,041 A 3/1987 Whiteley
4,650,067 A 3/1987 Brule
4,650,184 A 3/1987 Brebner
4,650,185 A 3/1987 Cartwright
4,651,446 A 3/1987 Yukawa et al.
4,651,581 A 3/1987 Svensson
4,655,447 A 4/1987 Dubrinsky et al.
4,659,074 A 4/1987 Taitel et al.
4,659,077 A 4/1987 Stropkay
4,659,078 A 4/1987 Blome
4,662,630 A 5/1987 Dignard et al.
4,664,371 A 5/1987 Viander
4,664,373 A 5/1987 Hait
4,664,646 A 5/1987 Rorabaugh
4,665,388 A 5/1987 Ivie et al.
4,671,257 A 6/1987 Kaiser et al.
4,673,177 A 6/1987 Szymski
4,674,740 A 6/1987 Iams et al.
4,674,743 A 6/1987 Hirano
4,678,182 A 7/1987 Nakao et al.
4,678,185 A 7/1987 Mahnke
4,679,786 A 7/1987 Rodgers
4,679,787 A 7/1987 Guilbault
4,684,121 A 8/1987 Nestegard
4,685,669 A 8/1987 Decloux
4,685,670 A 8/1987 Zinkin
4,687,195 A 8/1987 Potts
4,690,398 A 9/1987 Smith
4,697,809 A 10/1987 Rockwell
4,700,946 A 10/1987 Breunig
4,700,962 A 10/1987 Salmon
4,702,475 A 10/1987 Elstein et al.
4,705,028 A 11/1987 Melby
4,705,267 A 11/1987 Jackson
4,705,269 A 11/1987 DeBoer et al.
4,708,337 A 11/1987 Shyu
4,708,338 A 11/1987 Potts
4,708,837 A 11/1987 Baxter et al.
4,709,917 A 12/1987 Yang
4,709,918 A 12/1987 Grinblat
4,709,920 A 12/1987 Schnell
4,711,447 A 12/1987 Mansfield
4,712,790 A 12/1987 Szymski
4,714,244 A 12/1987 Kolomayets et al.
4,714,248 A 12/1987 Koss
4,718,207 A 1/1988 Frommelt
4,720,093 A 1/1988 Del Mar
4,720,099 A 1/1988 Carlson
4,720,789 A 1/1988 Hector et al.
4,721,303 A 1/1988 Fitzpatrick
4,723,786 A 2/1988 Buchanan
4,725,057 A 2/1988 Shifferaw
4,726,581 A 2/1988 Chang
4,726,582 A 2/1988 Fulks
4,728,099 A 3/1988 Pitre
4,729,558 A 3/1988 Kuo
4,729,562 A 3/1988 Pipasik
4,730,828 A 3/1988 Lane
4,730,829 A 3/1988 Carlson
4,733,858 A 3/1988 Lan
4,733,860 A 3/1988 Steffee
4,736,944 A 4/1988 Johnson et al.
4,741,578 A 5/1988 Viellard
4,743,009 A 5/1988 Beale
4,743,015 A 5/1988 Marshall
4,744,559 A 5/1988 Mahnke et al.
4,746,112 A 5/1988 Fayal
4,746,115 A 5/1988 Lahman
4,749,184 A 6/1988 Tobin
4,750,735 A 6/1988 Furgerson et al.
4,750,736 A 6/1988 Watterson
4,750,738 A 6/1988 Dang
4,751,755 A 6/1988 Carey, Jr. et al.
4,756,098 A 7/1988 Boggia
4,757,495 A 7/1988 Decker et al.
4,757,987 A 7/1988 Allemand
4,759,540 A 7/1988 Yu et al.
4,762,317 A 8/1988 Camfield et al.
4,763,284 A 8/1988 Carlin
4,765,613 A 8/1988 Voris
4,770,411 A 9/1988 Armstrong et al.
4,771,148 A 9/1988 Bersonnet
4,771,577 A 9/1988 Abe
4,772,015 A 9/1988 Carlson et al.
4,773,170 A 9/1988 Moore et al.
4,774,679 A 9/1988 Carlin
4,776,582 A 10/1988 Ramhorst
4,779,884 A 10/1988 Minati
4,786,049 A 11/1988 Lautenschlager
4,786,050 A 11/1988 Geschwender
4,786,069 A 11/1988 Tang
4,789,153 A 12/1988 Brown
4,790,522 A 12/1988 Drutchas
4,790,528 A 12/1988 Nakao et al.
4,792,134 A 12/1988 Chen
4,796,881 A 1/1989 Watterson
4,797,968 A 1/1989 Wenzlick
4,798,377 A 1/1989 White
4,798,760 A 1/1989 Diaz-Kotti
4,799,475 A 1/1989 Iams et al.
4,799,671 A 1/1989 Hoggan et al.
4,801,079 A 1/1989 Gonella
4,804,178 A 2/1989 Friedebach
4,805,901 A 2/1989 Kulick
4,807,874 A 2/1989 Little
4,809,804 A 3/1989 Houston et al.
4,809,972 A 3/1989 Rasmussen et al.
4,813,665 A 3/1989 Carr
4,813,667 A 3/1989 Watterson
4,813,668 A 3/1989 Solloway
4,813,743 A 3/1989 Mizelle
4,814,661 A 3/1989 Ratzlaff et al.
4,817,938 A 4/1989 Nakao et al.

(56) References Cited

U.S. PATENT DOCUMENTS 4,817,939 A 4/1989 Augspurger et al.
4,817,940 A 4/1989 Shaw et al.
4,818,175 A 4/1989 Kimura
4,818,234 A 4/1989 Redington
4,819,583 A 4/1989 Guerra
4,819,818 A 4/1989 Simkus
4,822,029 A 4/1989 Sarno
4,822,034 A 4/1989 Shields
4,824,102 A 4/1989 Lo
4,824,104 A 4/1989 Bloch
4,824,132 A 4/1989 Moore
4,826,150 A 5/1989 Minoura
4,826,152 A 5/1989 Lo
4,826,153 A 5/1989 Schalip
4,826,157 A 5/1989 Fitzpatrick
4,826,158 A 5/1989 Fields, Jr.
4,826,159 A 5/1989 Hersey
4,828,255 A 5/1989 Lahman
4,828,257 A 5/1989 Dyer et al.
4,828,522 A 5/1989 Santos
4,828,713 A 5/1989 McDonald et al.
4,830,362 A 5/1989 Bull
4,830,363 A 5/1989 Kennedy
4,832,332 A 5/1989 Dumbser
4,836,530 A 6/1989 Stanley, Jr.
4,836,543 A 6/1989 Holzer
4,837,157 A 6/1989 Turnell et al.
4,838,543 A 6/1989 Armstrong et al.
4,838,544 A 6/1989 Sasakawa et al.
4,840,372 A 6/1989 Oglesby et al.
4,842,266 A 6/1989 Sweeney, Sr.
4,842,268 A 6/1989 Jenkins
4,842,274 A 6/1989 Oosthuizen
4,844,449 A 7/1989 Truslaske
4,844,450 A 7/1989 Rodgers, Jr.
4,844,456 A 7/1989 Habing et al.
4,846,693 A 7/1989 Baer
4,848,737 A 7/1989 Ehrenfield
4,850,585 A 7/1989 Dalebout
4,852,874 A 8/1989 Sleichter, III et al.
4,854,578 A 8/1989 Fulks
4,855,942 A 8/1989 Bianco
4,860,763 A 8/1989 Schminke
4,861,023 A 8/1989 Wedman
4,861,025 A 8/1989 Rockwell
4,863,157 A 9/1989 Mendel et al.
4,863,161 A 9/1989 Telle
4,865,344 A 9/1989 Romero, Sr. et al.
4,866,704 A 9/1989 Bergman
4,867,153 A 9/1989 Lorenzen et al.
4,867,442 A 9/1989 Matthews
4,867,443 A 9/1989 Jensen
4,869,493 A 9/1989 Johnston
4,869,494 A 9/1989 Lambert, Sr.
4,869,497 A 9/1989 Stewart et al.
4,872,668 A 10/1989 McGillis et al.
4,875,676 A 10/1989 Zimmer
4,877,239 A 10/1989 Dela Rosa
4,878,662 A 11/1989 Chern
4,878,663 A 11/1989 Luquette
4,880,225 A 11/1989 Lucas et al.
4,880,227 A 11/1989 Sowell
4,880,230 A 11/1989 Cook
4,883,272 A 11/1989 Lay
4,886,266 A 12/1989 Trulaske
4,889,108 A 12/1989 Bond et al.
4,889,131 A 12/1989 Salem et al.
4,891,764 A 1/1990 Hush et al.
4,891,785 A 1/1990 Donohoo
4,894,933 A 1/1990 Tonkel et al.
4,898,379 A 2/1990 Kenzo
4,898,381 A 2/1990 Gordon
4,900,012 A 2/1990 Fu
4,900,013 A 2/1990 Rodgers, Jr.
4,900,017 A 2/1990 Bold, Jr.
4,900,018 A 2/1990 Ish, III
4,902,006 A 2/1990 Stallings, Jr.
4,904,829 A 2/1990 Berthaud et al.
4,905,330 A 3/1990 Jacobs
4,907,795 A 3/1990 Shaw et al.
4,907,797 A 3/1990 Gezari et al.
4,907,798 A 3/1990 Burchatz
4,907,973 A 3/1990 Hon
4,909,504 A 3/1990 Yang
4,911,427 A 3/1990 Matsumoto et al.
4,911,438 A 3/1990 Van Straaten
4,912,638 A 3/1990 Pratt, Jr.
4,913,396 A 4/1990 Dalebout et al.
4,913,423 A 4/1990 Farran
4,915,377 A 4/1990 Malnke et al.
4,915,379 A 4/1990 Sapp
4,917,376 A 4/1990 Lo
4,917,377 A 4/1990 Chen
4,919,418 A 4/1990 Miller
4,919,419 A 4/1990 Houston
4,921,242 A 5/1990 Watterson
4,921,247 A 5/1990 Sterling
4,923,193 A 5/1990 Pitzen et al.
4,925,183 A 5/1990 Kim
4,925,189 A 5/1990 Braeunig
4,925,724 A 5/1990 Ogden
4,927,136 A 5/1990 Leask
4,928,546 A 5/1990 Walters
4,928,957 A 5/1990 Lanier et al.
4,930,768 A 6/1990 Lapcevic
4,930,769 A 6/1990 Nenoff
4,930,770 A 6/1990 Baker
4,934,690 A 6/1990 Bull
4,934,692 A 6/1990 Owens
4,934,694 A 6/1990 Mcintosh
4,938,469 A 7/1990 Crandell
4,938,473 A 7/1990 Lee
4,938,474 A 7/1990 Sweeney et al.
4,940,233 A 7/1990 Bull
4,941,652 A 7/1990 Nagano et al.
4,941,673 A 7/1990 Bennett
4,944,518 A 7/1990 Flynn
4,948,121 A 8/1990 Haaheim et al.
4,949,951 A 8/1990 Deola
4,949,954 A 8/1990 Hix
4,949,958 A 8/1990 Richey
4,949,959 A 8/1990 Stevens
4,949,993 A 8/1990 Stark et al.
4,952,265 A 8/1990 Yamanaka et al.
4,953,415 A 9/1990 Lehtonen
4,953,855 A 9/1990 Shields
4,953,858 A 9/1990 Zelli
4,955,466 A 9/1990 Almes et al.
4,958,832 A 9/1990 Kim
4,959,713 A 9/1990 Morotomi et al.
4,960,276 A 10/1990 Feuer et al.
4,961,569 A 10/1990 Roberge
4,962,925 A 10/1990 Chang
4,964,632 A 10/1990 Rockwell
4,968,028 A 11/1990 Wehrell
4,971,316 A 11/1990 Dalebout et al.
4,974,831 A 12/1990 Dunham
4,974,832 A 12/1990 Dalebout
4,976,424 A 12/1990 Sargeant et al.
4,976,428 A 12/1990 Ghazi
4,976,435 A 12/1990 Shatford
4,977,794 A 12/1990 Metcalf
4,981,199 A 1/1991 Tsai
4,981,294 A 1/1991 Dalebout et al.
4,983,847 A 1/1991 Bryan
4,984,810 A 1/1991 Stearns
4,986,261 A 1/1991 Iams et al.
4,986,534 A 1/1991 Meier et al.
4,986,689 A 1/1991 Drutchas
4,989,858 A 2/1991 Young et al.
4,989,860 A 2/1991 Wagner
4,992,190 A 2/1991 Shtarkman
4,998,725 A 3/1991 Watterson et al.
5,000,440 A 3/1991 Lynch

(56) References Cited

U.S. PATENT DOCUMENTS 5,000,442 A 3/1991 Dalebout et al.
5,000,443 A 3/1991 Dalebout et al.
5,000,444 A 3/1991 Dalebout et al.
5,001,632 A 3/1991 Hall Tipping
5,002,271 A 3/1991 Gonzales
5,004,224 A 4/1991 Wang
5,004,229 A 4/1991 Lind
5,007,630 A 4/1991 Real et al.
5,007,631 A 4/1991 Wang
5,013,031 A 5/1991 Bull
5,015,926 A 5/1991 Casler
5,016,870 A 5/1991 Bulloch et al.
5,020,793 A 6/1991 Loane
5,020,794 A 6/1991 Englehardt et al.
5,020,795 A 6/1991 Airy et al.
5,024,441 A 6/1991 Rousseau
5,026,049 A 6/1991 Goodman
5,027,303 A 6/1991 Witte
5,029,801 A 7/1991 Dalebout et al.
5,031,455 A 7/1991 Cline
5,031,901 A 7/1991 Saarinen
5,034,576 A 7/1991 Dalebout et al.
5,035,418 A 7/1991 Harabayashi
RE33,662 E 8/1991 Blair et al.
5,037,084 A 8/1991 Flor
5,037,089 A 8/1991 Spagnuolo
5,037,090 A 8/1991 Fitzpatrick
5,039,088 A 8/1991 Shifferaw
5,039,089 A 8/1991 Lapcevic
5,039,091 A 8/1991 Johnson
5,040,786 A 8/1991 Jou
5,042,799 A 8/1991 Stanley
5,044,614 A 9/1991 Rau
5,046,382 A 9/1991 Steinberg
5,046,722 A 9/1991 Antoon
5,048,823 A 9/1991 Bean
5,048,824 A 9/1991 Chen
5,048,891 A 9/1991 Yach
5,051,638 A 9/1991 Pyles
5,052,375 A 10/1991 Stark
5,052,684 A 10/1991 Kosuge et al.
5,054,770 A 10/1991 Bull
5,054,774 A 10/1991 Belsito
5,056,779 A 10/1991 Webb
5,058,881 A 10/1991 Measom
5,058,882 A 10/1991 Dalebout et al.
5,058,888 A 10/1991 Walker et al.
5,062,626 A 11/1991 Dalebout et al.
5,062,627 A 11/1991 Bingham
5,062,629 A 11/1991 Vaughan
5,062,632 A 11/1991 Dalebout et al.
5,066,000 A 11/1991 Dolan
5,067,710 A 11/1991 Watterson et al.
5,071,115 A 12/1991 Welch
5,072,928 A 12/1991 Stearns et al.
5,072,929 A 12/1991 Peterson et al.
5,074,550 A 12/1991 Sloan
5,077,916 A 1/1992 Beneteau
5,078,152 A 1/1992 Bond et al.
5,078,389 A 1/1992 Chen
5,080,353 A 1/1992 Tench
5,081,991 A 1/1992 Chance
5,085,426 A 2/1992 Wanzer et al.
5,085,427 A 2/1992 Finn
5,086,385 A 2/1992 Launey et al.
5,087,047 A 2/1992 McConnell
5,088,729 A 2/1992 Dalebout
5,089,960 A 2/1992 Sweeney, Jr.
5,094,249 A 3/1992 Marras et al.
5,094,447 A 3/1992 Wang
5,094,449 A 3/1992 Stearns
5,096,225 A 3/1992 Osawa
5,102,122 A 4/1992 Piane, Jr.
5,102,380 A 4/1992 Jacobson et al.
5,104,119 A 4/1992 Lynch
5,104,120 A 4/1992 Watterson
5,108,093 A 4/1992 Watterson
5,109,778 A 5/1992 Berkowitz et al.
5,110,117 A 5/1992 Fisher et al.
5,112,045 A 5/1992 Mason et al.
5,113,427 A 5/1992 Ryoichi et al.
5,114,388 A 5/1992 Trulaske
5,114,391 A 5/1992 Pitzen et al.
5,117,674 A 6/1992 Howard
5,118,112 A 6/1992 Bregman et al.
5,123,629 A 6/1992 Takeuchi
5,123,885 A 6/1992 Shields
5,123,886 A 6/1992 Cook
5,129,450 A 7/1992 Hung
5,129,872 A 7/1992 Dalton et al.
5,129,873 A 7/1992 Henderson et al.
5,131,895 A 7/1992 Rogers, Jr.
5,135,216 A 8/1992 Bingham et al.
5,135,447 A 8/1992 Robards, Jr. et al.
5,135,458 A 8/1992 Huang
5,137,501 A 8/1992 Mertesdorf
5,138,730 A 8/1992 Masuda
5,139,261 A 8/1992 Openiano
5,139,469 A 8/1992 Hennessey et al.
5,141,480 A 8/1992 Lennox et al.
5,142,358 A 8/1992 Jason
5,145,475 A 9/1992 Cares
5,145,481 A 9/1992 Friedebach
5,147,266 A 9/1992 Ricard
5,149,084 A 9/1992 Dalebout et al.
5,149,312 A 9/1992 Croft et al.
5,152,210 A 10/1992 Chen
5,154,684 A 10/1992 Delf
5,158,093 A 10/1992 Shvartz
5,158,520 A 10/1992 Lemke et al.
5,161,652 A 11/1992 Suzuki
5,162,029 A 11/1992 Schine
5,163,885 A 11/1992 Wanzer et al.
5,163,888 A 11/1992 Stearns
5,167,159 A 12/1992 Lucking
5,167,596 A 12/1992 Ferber
5,167,597 A 12/1992 David
5,167,850 A 12/1992 Shtarkman
5,171,196 A 12/1992 Lynch
5,176,602 A 1/1993 Roberts
5,178,593 A 1/1993 Roberts
5,178,599 A 1/1993 Scott
5,179,792 A 1/1993 Brantingham
5,180,347 A 1/1993 Chen
5,180,351 A 1/1993 Ehrenfried
5,180,353 A 1/1993 Snyderman
5,180,647 A 1/1993 Rowland et al.
5,181,894 A 1/1993 Shieng
5,183,448 A 2/1993 Wang
5,183,449 A 2/1993 Decloux
5,184,295 A 2/1993 Mann
5,184,988 A 2/1993 Dunham
5,186,471 A 2/1993 Vancraeynest
5,186,697 A 2/1993 Rennex
5,188,577 A 2/1993 Young
5,190,505 A 3/1993 Dalebout et al.
5,192,255 A 3/1993 Dalebout et al.
5,192,257 A 3/1993 Panasewicz
5,192,258 A 3/1993 Keller
5,195,664 A 3/1993 Rhea
5,195,781 A 3/1993 Osawa
5,195,935 A 3/1993 Fencel
5,195,937 A 3/1993 Engel et al.
5,199,931 A 4/1993 Easley et al.
5,201,333 A 4/1993 Shalmon et al.
5,201,694 A 4/1993 Zappel
5,201,772 A 4/1993 Maxwell
5,202,424 A 4/1993 Vlassara et al.
5,203,229 A 4/1993 Chen
5,203,800 A 4/1993 Meredith
5,203,826 A 4/1993 Dalebout
5,204,670 A 4/1993 Stinton
5,205,798 A 4/1993 Lekhtman
5,205,800 A 4/1993 Grant

(56) References Cited

U.S. PATENT DOCUMENTS 5,206,671 A 4/1993 Eydelman et al.
5,207,489 A 5/1993 Miller
5,207,622 A 5/1993 Wilkinson et al.
5,207,625 A 5/1993 White
5,207,628 A 5/1993 Graham
5,209,715 A 5/1993 Walker et al.
5,211,617 A 5/1993 Millen
5,213,555 A 5/1993 Hood
5,215,510 A 6/1993 Baran
5,217,422 A 6/1993 Domzalski
5,217,486 A 6/1993 Rice et al.
5,222,928 A 6/1993 Yacullo
5,224,909 A 7/1993 Hamilton
5,226,866 A 7/1993 Engel et al.
5,230,672 A 7/1993 Brown et al.
5,230,673 A 7/1993 Maeyama et al.
5,230,676 A 7/1993 Terauds
5,232,422 A 8/1993 Bishop, Jr.
5,233,520 A 8/1993 Kretsch et al.
5,234,392 A 8/1993 Clark
5,234,395 A 8/1993 Miller et al.
5,236,407 A 8/1993 Wang
5,240,417 A 8/1993 Smithson et al.
5,242,339 A 9/1993 Thornton
5,242,340 A 9/1993 Jerome
5,242,343 A 9/1993 Miller
5,242,347 A 9/1993 Keeton
5,243,998 A 9/1993 Silverman et al.
5,244,444 A 9/1993 Wostry
5,246,411 A 9/1993 Rackman
5,247,853 A 9/1993 Dalebout
5,250,012 A 10/1993 Whitcomb, Jr.
5,250,013 A 10/1993 Brangi
5,254,059 A 10/1993 Arthur et al.
5,254,066 A 10/1993 Brown et al.
5,254,067 A 10/1993 Habing et al.
5,256,115 A 10/1993 Scholder
5,256,117 A 10/1993 Potts et al.
5,256,118 A 10/1993 Chen
5,256,126 A 10/1993 Grotstein
5,257,084 A 10/1993 Marsh
5,257,701 A 11/1993 Edelson
5,257,964 A 11/1993 Petters
5,260,870 A 11/1993 Tsuchiya et al.
5,261,864 A 11/1993 Fitzpatrick
5,261,867 A 11/1993 Chen
5,263,910 A 11/1993 Yang
5,263,914 A 11/1993 Simonson et al.
5,267,922 A 12/1993 Robinson
5,267,925 A 12/1993 Boyd
5,267,930 A 12/1993 Henes
5,269,081 A 12/1993 Gray
5,269,519 A 12/1993 Malone
5,269,736 A 12/1993 Roberts
5,271,416 A 12/1993 Lepley
5,273,285 A 12/1993 Long
5,277,677 A 1/1994 Terauds
5,277,678 A 1/1994 Friedebach et al.
5,277,681 A 1/1994 Holt
5,277,683 A 1/1994 Wilkins
5,279,528 A 1/1994 Dalebout et al.
5,279,529 A 1/1994 Eschenbach
5,279,531 A 1/1994 Jen Huey
5,282,776 A 2/1994 Dalebout
5,284,460 A 2/1994 Miller et al.
5,284,461 A 2/1994 Wilkinson et al.
5,290,204 A 3/1994 Lee
5,290,205 A 3/1994 Densmore et al.
5,290,211 A 3/1994 Stearns
5,290,212 A 3/1994 Metcalf
5,290,214 A 3/1994 Chen
5,292,293 A 3/1994 Schumacher
5,295,927 A 3/1994 Easley
5,295,928 A 3/1994 Rennex
5,295,931 A 3/1994 Dreibelbis et al.
5,295,935 A 3/1994 Wang
5,299,810 A 4/1994 Pierce et al.
5,299,992 A 4/1994 Wilkinson
5,299,993 A 4/1994 Habing
5,299,994 A 4/1994 Chen
5,301,154 A 4/1994 Suga
5,302,161 A 4/1994 Loubert et al.
5,302,162 A 4/1994 Pasero
5,306,220 A 4/1994 Kearney
5,306,221 A 4/1994 Itaru
5,308,075 A 5/1994 Theriault
5,308,296 A 5/1994 Eckstein
5,308,300 A 5/1994 Chino et al.
5,308,304 A 5/1994 Habing
5,309,355 A 5/1994 Lockwood
5,310,392 A 5/1994 Lo
5,313,852 A 5/1994 Arena
5,313,942 A 5/1994 Platzker
5,314,389 A 5/1994 Dotan
5,314,390 A 5/1994 Westing et al.
5,314,391 A 5/1994 Potash et al.
5,314,392 A 5/1994 Hawkins et al.
5,314,394 A 5/1994 Ronan
5,316,534 A 5/1994 Dalebout et al.
5,318,487 A 6/1994 Golen et al.
5,318,490 A 6/1994 Henderson et al.
5,318,491 A 6/1994 Houston
5,320,343 A 6/1994 McKinney
5,320,588 A 6/1994 Wanzer et al.
5,320,591 A 6/1994 Harmon et al.
5,320,641 A 6/1994 Riddle
5,322,491 A 6/1994 Wanzer et al.
5,323,650 A 6/1994 Fullen et al.
5,323,784 A 6/1994 Shu
5,324,060 A 6/1994 Van Vooren et al.
5,324,242 A 6/1994 Lo
5,328,420 A 7/1994 Allen
5,328,421 A 7/1994 Stanalajczo
5,328,422 A 7/1994 Nichols
5,328,429 A 7/1994 Potash et al.
5,330,401 A 7/1994 Walstead
5,330,402 A 7/1994 Johnson
5,330,404 A 7/1994 Lopeteguy et al.
5,334,118 A 8/1994 Dantolan
5,334,120 A 8/1994 Rasmussen
5,335,188 A 8/1994 Brisson
5,336,141 A 8/1994 Vittone
5,336,142 A 8/1994 Dalebout et al.
5,336,144 A 8/1994 Rodden
5,336,145 A 8/1994 Keiser
5,336,146 A 8/1994 Piaget et al.
5,342,264 A 8/1994 Gordon
5,342,271 A 8/1994 Long
RE34,728 E 9/1994 Hall-Tipping
5,344,372 A 9/1994 Hung
5,346,445 A 9/1994 Chang
5,348,524 A 9/1994 Grant
5,350,344 A 9/1994 Kissel
5,352,166 A 10/1994 Chang
5,352,167 A 10/1994 Ulicny
5,352,169 A 10/1994 Eschenbach
5,353,452 A 10/1994 Rulis
5,354,063 A * 10/1994 Curchod ..... A63B 24/0021 473/155
5,354,248 A 10/1994 Rawls et al.
5,354,251 A 10/1994 Sleamaker
5,356,356 A 10/1994 Hildebrandt et al.
5,356,357 A 10/1994 Wang et al.
5,357,696 A 10/1994 Gray
5,358,461 A 10/1994 Bailey, Jr.
5,359,986 A 11/1994 Magrath, III et al.
5,361,091 A 11/1994 Hoarty et al.
5,361,778 A 11/1994 Seitz
5,362,069 A 11/1994 Hall-Tipping
5,362,295 A 11/1994 Nurge
5,362,298 A 11/1994 Brown et al.
5,364,271 A 11/1994 Aknin et al.
5,364,327 A 11/1994 Graham
5,368,532 A 11/1994 Farnet et al.

(56) References Cited

U.S. PATENT DOCUMENTS

| | | | |
|---|---|---|---|
| 5,370,592 | A | 12/1994 | Wu |
| 5,372,556 | A | 12/1994 | Ropp |
| 5,372,559 | A | 12/1994 | Dalebout et al. |
| 5,372,560 | A | 12/1994 | Chang |
| 5,372,564 | A | 12/1994 | Spirito |
| 5,374,227 | A | 12/1994 | Webb |
| 5,375,068 | A | 12/1994 | Palmer et al. |
| 5,377,171 | A | 12/1994 | Schlup |
| 5,377,258 | A | 12/1994 | Bro |
| 5,378,212 | A | 1/1995 | Pin-Kuo |
| 5,380,258 | A | 1/1995 | Hawley, Jr. |
| 5,382,207 | A | 1/1995 | Skowronski et al. |
| 5,382,208 | A | 1/1995 | Hu |
| 5,382,209 | A | 1/1995 | Pasier |
| 5,383,715 | A | 1/1995 | Homma et al. |
| 5,383,827 | A | 1/1995 | Stern |
| 5,383,828 | A | 1/1995 | Sands et al. |
| 5,383,829 | A | 1/1995 | Miller |
| 5,385,346 | A | 1/1995 | Carroll et al. |
| 5,385,519 | A | 1/1995 | Hsu |
| 5,385,520 | A | 1/1995 | Lepine et al. |
| 5,387,164 | A | 2/1995 | Brown, Jr. |
| 5,387,169 | A | 2/1995 | Wang |
| 5,387,170 | A | 2/1995 | Rawls et al. |
| 5,387,171 | A | 2/1995 | Casey et al. |
| 5,391,080 | A | 2/1995 | Bernacki |
| 5,391,130 | A | 2/1995 | Green |
| 5,394,922 | A | 3/1995 | Colson et al. |
| 5,396,340 | A | 3/1995 | Ishii et al. |
| 5,396,876 | A | 3/1995 | Liscio et al. |
| 5,398,948 | A | 3/1995 | Mathis |
| 5,401,226 | A | 3/1995 | Stearns |
| 5,403,251 | A | 4/1995 | Belsito et al. |
| 5,403,252 | A | 4/1995 | Leon et al. |
| 5,403,253 | A | 4/1995 | Gaylord |
| 5,403,254 | A | 4/1995 | Lundin et al. |
| 5,403,255 | A | 4/1995 | Johnston |
| 5,406,661 | A | 4/1995 | Pekar |
| 5,407,402 | A | 4/1995 | Brown et al. |
| 5,407,403 | A | 4/1995 | Coleman |
| 5,407,408 | A | 4/1995 | Wilkinson |
| 5,407,409 | A | 4/1995 | Tang |
| 5,409,435 | A | 4/1995 | Daniels |
| 5,410,471 | A | 4/1995 | Alyfuku et al. |
| 5,410,472 | A | 4/1995 | Anderson |
| RE34,959 | E | 5/1995 | Potts |
| 5,410,971 | A | 5/1995 | Golden et al. |
| 5,415,607 | A | 5/1995 | Carpenter |
| 5,417,222 | A | 5/1995 | Dempsey et al. |
| 5,417,643 | A | 5/1995 | Taylor |
| 5,419,562 | A | 5/1995 | Cromarty |
| 5,419,570 | A | 5/1995 | Bollotte |
| 5,419,571 | A | 5/1995 | Vaughan |
| 5,419,619 | A | 5/1995 | Lew |
| 5,419,747 | A | 5/1995 | Piaget |
| 5,419,751 | A | 5/1995 | Byrd et al. |
| 5,421,801 | A | 6/1995 | Davies, III et al. |
| 5,423,728 | A | 6/1995 | Goldberg |
| 5,423,729 | A | 6/1995 | Eschenbach |
| 5,423,730 | A | 6/1995 | Hirsch |
| 5,429,563 | A | 7/1995 | Engel et al. |
| 5,429,569 | A | 7/1995 | Gunnari |
| 5,431,612 | A | 7/1995 | Holden |
| 5,433,679 | A | 7/1995 | Szymczak et al. |
| 5,433,687 | A | 7/1995 | Hinzman et al. |
| 5,435,315 | A | 7/1995 | McPhee et al. |
| 5,435,798 | A | 7/1995 | Habing et al. |
| 5,435,799 | A | 7/1995 | Lundin |
| 5,435,801 | A | 7/1995 | Hung |
| 5,437,289 | A | 8/1995 | Liverance |
| 5,439,225 | A | 8/1995 | Gvoich et al. |
| 5,441,467 | A | 8/1995 | Stevens |
| 5,441,468 | A | 8/1995 | Deckers et al. |
| 5,443,434 | A | 8/1995 | Buchanan et al. |
| 5,445,583 | A | 8/1995 | Habing |
| 5,449,334 | A | 9/1995 | Kingsbury |
| 5,451,070 | A | 9/1995 | Lindsay |
| 5,451,922 | A | 9/1995 | Hamilton |
| 5,452,269 | A | 9/1995 | Cherdak |
| 5,453,065 | A | 9/1995 | Lien et al. |
| 5,454,550 | A | 10/1995 | Christopherson |
| 5,454,772 | A | 10/1995 | Rodden |
| 5,454,773 | A | 10/1995 | Blanchard et al. |
| 5,456,262 | A | 10/1995 | Birnbaum |
| 5,456,644 | A | 10/1995 | Hecox et al. |
| 5,456,648 | A | 10/1995 | Edinburg |
| 5,460,379 | A | 10/1995 | Cleland |
| 5,460,586 | A | 10/1995 | Wilkinson |
| 5,462,051 | A | 10/1995 | Oka et al. |
| 5,462,503 | A | 10/1995 | Benjamin et al. |
| 5,462,504 | A | 10/1995 | Trulaske et al. |
| 5,466,203 | A | 11/1995 | Chen |
| 5,469,740 | A | 11/1995 | French et al. |
| 5,470,298 | A | 11/1995 | Curtis |
| 5,471,405 | A | 11/1995 | Marsh |
| 5,472,205 | A | 12/1995 | Bouton |
| 5,472,392 | A | 12/1995 | Haan et al. |
| 5,474,077 | A | 12/1995 | Suga |
| 5,474,087 | A | 12/1995 | Nashner |
| 5,474,090 | A | 12/1995 | Begun et al. |
| 5,474,510 | A | 12/1995 | Chen |
| 5,476,428 | A | 12/1995 | Potash et al. |
| 5,476,430 | A | 12/1995 | Lee et al. |
| 5,478,295 | A | 12/1995 | Fracchia |
| 5,482,472 | A | 1/1996 | Garoni et al. |
| 5,484,151 | A | 1/1996 | Tholkes |
| 5,484,358 | A | 1/1996 | Wang et al. |
| 5,484,362 | A | 1/1996 | Skowronski et al. |
| 5,484,363 | A | 1/1996 | Creelman |
| 5,484,389 | A | 1/1996 | Stark |
| 5,486,001 | A | 1/1996 | Baker |
| 5,486,150 | A | 1/1996 | Randolph |
| 5,487,707 | A | 1/1996 | Sharf et al. |
| 5,489,249 | A | 2/1996 | Brewer et al. |
| 5,489,250 | A | 2/1996 | Densmore et al. |
| 5,490,818 | A | 2/1996 | Haber et al. |
| 5,492,514 | A | 2/1996 | Daum |
| 5,492,520 | A | 2/1996 | Brown |
| 5,493,127 | A | 2/1996 | Lloyd et al. |
| 5,496,235 | A | 3/1996 | Stevens |
| 5,496,236 | A | 3/1996 | Buonauito |
| 5,496,238 | A | 3/1996 | Taylor |
| 5,496,239 | A | 3/1996 | Kallman |
| 5,499,956 | A | 3/1996 | Habing et al. |
| 5,499,958 | A | 3/1996 | Hess |
| 5,503,043 | A | 4/1996 | Olbrich |
| 5,505,011 | A | 4/1996 | Bleimhofer |
| 5,505,678 | A | 4/1996 | Johnston |
| 5,507,271 | A | 4/1996 | Actor |
| 5,507,709 | A | 4/1996 | Wu |
| 5,509,870 | A | 4/1996 | Lloyd |
| 5,510,828 | A | 4/1996 | Lutterbach |
| 5,512,025 | A | 4/1996 | Dalebout et al. |
| 5,512,029 | A | 4/1996 | Barnard |
| 5,513,586 | A | 5/1996 | Neely et al. |
| 5,514,053 | A | 5/1996 | Hawkins et al. |
| 5,516,334 | A | 5/1996 | Easton |
| 5,518,471 | A | 5/1996 | Hettinger et al. |
| 5,518,473 | A | 5/1996 | Miller |
| 5,518,481 | A | 5/1996 | Darkwah |
| 5,519,189 | A | 5/1996 | Gibisch |
| 5,520,599 | A | 5/1996 | Chen |
| 5,522,783 | A | 6/1996 | Gordon |
| 5,524,110 | A | 6/1996 | Danneels et al. |
| 5,524,637 | A | 6/1996 | Erickson |
| 5,527,239 | A | 6/1996 | Abbondanza |
| 5,527,243 | A | 6/1996 | Chen |
| 5,527,245 | A | 6/1996 | Dalebout et al. |
| 5,527,246 | A | 6/1996 | Rodgers, Jr. |
| 5,529,554 | A | 6/1996 | Eschenbach |
| 5,529,555 | A | 6/1996 | Rodgers, Jr. |
| 5,531,658 | A | 7/1996 | L. S. C. |
| 5,533,899 | A | 7/1996 | Young |
| 5,533,948 | A | 7/1996 | Wilkinson |

(56) References Cited

U.S. PATENT DOCUMENTS 5,533,951 A 7/1996 Chang
5,535,664 A 7/1996 Rokowski
5,536,225 A 7/1996 Neuberg et al.
5,538,486 A 7/1996 France et al.
5,538,489 A 7/1996 Magid
5,540,637 A 7/1996 Rodgers, Jr.
5,542,420 A 8/1996 Goldman
5,542,503 A 8/1996 Dunn et al.
5,542,672 A 8/1996 Meredith
5,542,892 A 8/1996 Buhler
5,545,112 A 8/1996 Densmore et al.
5,545,114 A 8/1996 Gvoich
5,547,439 A 8/1996 Rawls et al.
5,549,052 A 8/1996 Hoffman
5,549,526 A 8/1996 Rodgers, Jr.
5,549,536 A 8/1996 Clark
5,551,934 A 9/1996 Binette
5,551,937 A 9/1996 Kwo
5,554,033 A 9/1996 Bizzi et al.
5,554,083 A 9/1996 Chen
5,556,362 A 9/1996 Whipps
5,562,572 A 10/1996 Carmein
5,562,574 A 10/1996 Miller
5,562,577 A 10/1996 Nichols, Sr. et al.
5,563,487 A 10/1996 Davis
5,568,993 A 10/1996 Potzick
5,569,120 A 10/1996 Anjanappa et al.
5,569,128 A 10/1996 Dalebout
5,569,138 A 10/1996 Wang et al.
5,572,643 A 11/1996 Judson
5,573,480 A 11/1996 Rodgers, Jr.
5,573,485 A 11/1996 Geschwender
5,575,740 A 11/1996 Piaget
5,575,745 A 11/1996 Lin
5,576,951 A 11/1996 Lockwood
5,577,186 A 11/1996 Mann, II et al.
5,577,981 A 11/1996 Jarvik
5,577,985 A 11/1996 Miller
5,577,987 A 11/1996 Brown
5,580,340 A 12/1996 Yu
5,582,563 A 12/1996 Fan
5,584,700 A 12/1996 Feldman et al.
5,584,779 A 12/1996 Knecht
5,584,780 A 12/1996 Lin
5,584,781 A 12/1996 Chen
5,584,784 A 12/1996 Wu
5,585,583 A 12/1996 Owen
5,586,736 A 12/1996 Mollet
5,586,961 A 12/1996 Quint
5,586,962 A 12/1996 Hallmark
5,588,938 A 12/1996 Schneider et al.
5,590,128 A 12/1996 Maloney et al.
5,590,181 A 12/1996 Hogan et al.
5,590,893 A 1/1997 Robinson et al.
5,591,104 A 1/1997 Andrus et al.
5,591,105 A 1/1997 Dalebout et al.
5,591,106 A 1/1997 Dalebout et al.
5,591,107 A 1/1997 Rodgers, Jr.
5,591,908 A 1/1997 Reid et al.
5,593,371 A 1/1997 Rodgers, Jr.
5,593,372 A 1/1997 Rodgers, Jr.
5,593,380 A 1/1997 Bittikofer
5,595,553 A 1/1997 Rodgers, Jr.
5,595,554 A 1/1997 Maresh
5,595,556 A 1/1997 Dalebout et al.
5,598,849 A 2/1997 Browne
5,599,261 A 2/1997 Easley et al.
5,600,310 A 2/1997 Whipple, III et al.
5,601,301 A 2/1997 Liu
5,603,281 A 2/1997 Harvey et al.
5,603,675 A 2/1997 Wu
5,603,678 A 2/1997 Wilson
5,605,149 A 2/1997 Warters
5,605,336 A 2/1997 Gaoiran
5,605,521 A 2/1997 Hsieh
5,607,375 A 3/1997 Dalebout
5,611,756 A 3/1997 Miller
5,611,757 A 3/1997 Rodgers, Jr.
5,611,758 A 3/1997 Rodgers, Jr.
5,613,216 A 3/1997 Galler
5,613,856 A 3/1997 Hoover
5,616,103 A 4/1997 Lee
5,618,245 A 4/1997 Trulaske et al.
5,618,250 A 4/1997 Butz
5,619,412 A 4/1997 Hapka
5,619,991 A 4/1997 Sloane
5,620,400 A 4/1997 Foster
5,622,527 A 4/1997 Watterson et al.
5,624,353 A 4/1997 Naidus
5,625,577 A 4/1997 Kunii et al.
5,626,401 A 5/1997 Terry, Sr. et al.
5,626,539 A 5/1997 Piaget
5,626,542 A 5/1997 Dalebout et al.
5,630,566 A 5/1997 Case
5,632,209 A 5/1997 Sakakibara
5,632,711 A 5/1997 Hwang
5,634,870 A 6/1997 Wilkinson
5,638,343 A 6/1997 Ticknor
5,643,142 A 7/1997 Bruce et al.
5,643,144 A 7/1997 Trulaske
5,643,146 A 7/1997 Stark et al.
5,643,147 A 7/1997 Huang
5,643,152 A 7/1997 Simonson
5,643,153 A 7/1997 Nylen et al.
5,643,157 A 7/1997 Seliber
5,643,162 A 7/1997 Landers et al.
5,645,509 A 7/1997 Brewer et al.
5,645,513 A 7/1997 Haydocy et al.
5,645,914 A 7/1997 Horowitz
5,649,882 A 7/1997 Parikh et al.
5,650,709 A 7/1997 Rotunda et al.
5,651,754 A 7/1997 Chen
5,652,304 A 7/1997 Calderon et al.
5,652,824 A 7/1997 Hirayama et al.
5,653,662 A 8/1997 Rodgers, Jr.
5,655,945 A 8/1997 Jani
5,655,997 A 8/1997 Greenberg et al.
5,656,003 A 8/1997 Robinson et al.
5,658,227 A 8/1997 Stearns
5,659,691 A 8/1997 Durward et al.
5,660,167 A 8/1997 Ryder
5,662,555 A 9/1997 Cloutier
5,662,556 A 9/1997 Gangloff
5,662,557 A 9/1997 Watterson et al.
5,665,031 A 9/1997 Hsieh
5,665,033 A 9/1997 Palmer
5,667,459 A 9/1997 Su
5,667,464 A 9/1997 Simonson
5,669,833 A 9/1997 Stone
5,669,857 A 9/1997 Watterson et al.
5,669,865 A 9/1997 Gordon
5,672,140 A 9/1997 Watterson et al.
5,674,156 A 10/1997 Watterson et al.
5,674,161 A 10/1997 Lin
5,674,165 A 10/1997 Cohen et al.
5,674,453 A 10/1997 Watterson et al.
5,676,138 A 10/1997 Zawilinski
5,676,624 A 10/1997 Watterson et al.
5,679,047 A 10/1997 Engel
5,679,100 A 10/1997 Charnitski
5,679,101 A 10/1997 Magid
5,681,250 A 10/1997 Hoover et al.
5,683,332 A 11/1997 Watterson et al.
5,685,804 A 11/1997 Whan-Tong et al.
5,688,209 A 11/1997 Trulaske et al.
5,688,216 A 11/1997 Mauriello
5,690,582 A 11/1997 Ulrich et al.
5,690,587 A 11/1997 Gruenangerl
5,690,589 A 11/1997 Rodgers, Jr.
5,690,852 A 11/1997 Saito et al.
5,692,994 A 12/1997 Eschenbach
5,693,004 A 12/1997 Carlson et al.
5,694,150 A * 12/1997 Sigona ..... G06F 3/038
715/856

(56) References Cited

U.S. PATENT DOCUMENTS 5,695,400 A 12/1997 Fennell, Jr. et al.
5,695,434 A 12/1997 Dalebout et al.
5,695,435 A 12/1997 Dalebout et al.
5,695,436 A 12/1997 Huang
5,697,834 A 12/1997 Heumann et al.
5,702,323 A 12/1997 Poulton
5,702,325 A 12/1997 Watterson et al.
5,704,875 A 1/1998 Tanabe
5,704,879 A 1/1998 Watterson et al.
5,707,319 A 1/1998 Riley
5,707,320 A 1/1998 Yu
5,707,321 A 1/1998 Maresh
5,708,355 A 1/1998 Schrey
5,709,631 A 1/1998 Kleinsasser
5,709,632 A 1/1998 Socwell
5,709,633 A 1/1998 Sokol
5,710,884 A 1/1998 Dedrick
5,711,745 A 1/1998 Yang
5,711,746 A 1/1998 Carlson
5,711,749 A 1/1998 Miller
5,713,549 A 2/1998 Shieh
5,713,794 A 2/1998 Shimojima et al.
5,713,821 A 2/1998 Nissen
5,716,308 A 2/1998 Lee
5,718,657 A 2/1998 Dalebout et al.
5,718,660 A 2/1998 Chen
5,719,825 A 2/1998 Dotter
5,720,200 A 2/1998 Anderson et al.
5,720,474 A 2/1998 Sugiyama
5,720,698 A 2/1998 Dalebout et al.
5,720,771 A 2/1998 Snell
5,721,539 A 2/1998 Goetzl
5,722,418 A 3/1998 Bro
5,722,420 A 3/1998 Lee
5,722,917 A 3/1998 Olschansky et al.
5,722,918 A 3/1998 Lee
5,722,920 A 3/1998 Bauer
5,722,921 A 3/1998 Simonson
5,722,922 A 3/1998 Watterson et al.
5,724,025 A 3/1998 Tavori
5,725,457 A 3/1998 Maresh
5,725,459 A 3/1998 Rexach
5,730,236 A 3/1998 Miller et al.
5,733,227 A 3/1998 Lee
5,733,228 A 3/1998 Stevens
5,733,229 A 3/1998 Dalebout et al.
5,734,625 A 3/1998 Kondo
5,735,586 A 4/1998 Cheng
5,735,773 A 4/1998 Vittone
5,735,774 A 4/1998 Maresh
5,735,776 A 4/1998 Swezey
5,738,611 A 4/1998 Ehrenfried
5,738,612 A 4/1998 Tsuda
5,738,614 A 4/1998 Rodgers, Jr.
5,739,457 A 4/1998 Devecka
5,741,205 A 4/1998 Doll et al.
5,743,193 A 4/1998 Kakuta et al.
5,743,832 A 4/1998 Sands et al.
5,743,833 A 4/1998 Watterson et al.
5,743,834 A 4/1998 Rodgers, Jr.
5,743,835 A 4/1998 Trotter
5,746,681 A 5/1998 Bull
5,746,682 A 5/1998 Hung
5,746,683 A 5/1998 Lee
5,746,688 A 5/1998 Prager
5,749,372 A 5/1998 Allen
5,749,787 A 5/1998 Jank
5,749,807 A 5/1998 Webb
5,749,809 A 5/1998 Lin
5,749,813 A 5/1998 Domzalski
5,752,879 A 5/1998 Berdut
5,752,883 A 5/1998 Butcher et al.
5,752,897 A 5/1998 Skowronski et al.
5,754,765 A 5/1998 Danneels et al.
5,755,642 A 5/1998 Miller
5,755,643 A 5/1998 Sands
5,755,645 A 5/1998 Miller et al.
5,755,651 A 5/1998 Homyonfer
5,759,136 A 6/1998 Chen
5,759,199 A 6/1998 Snell et al.
5,760,353 A 6/1998 Rapp
5,761,831 A 6/1998 Cho
5,762,503 A 6/1998 Hoo et al.
5,762,587 A 6/1998 Dalebout et al.
5,762,588 A 6/1998 Chen
5,766,113 A 6/1998 Rodgers, Jr.
5,769,755 A 6/1998 Henry et al.
5,769,757 A 6/1998 Fulks
5,769,759 A 6/1998 Alter
5,769,760 A 6/1998 Lin
5,769,766 A 6/1998 Huang
5,771,152 A 6/1998 Crompton et al.
5,771,354 A 6/1998 Crawford
5,772,508 A 6/1998 Sugita et al.
5,772,522 A 6/1998 Nesbit
5,772,558 A 6/1998 Rodgers, Jr.
5,772,560 A 6/1998 Watterson et al.
5,776,582 A 7/1998 Needham
5,777,678 A 7/1998 Ogata et al.
5,779,596 A 7/1998 Weber
5,779,598 A 7/1998 Lee
5,779,599 A 7/1998 Chen
5,779,607 A 7/1998 Harris
5,782,639 A 7/1998 Beal
5,782,722 A 7/1998 Sands
5,782,723 A 7/1998 Kuo
5,785,630 A 7/1998 Bobick et al.
5,785,631 A 7/1998 Heidecke
5,785,632 A 7/1998 Greenberg et al.
5,788,609 A 8/1998 Miller
5,788,610 A 8/1998 Eschenbach
5,788,611 A 8/1998 Kuo
5,788,617 A 8/1998 Paris
5,790,785 A 8/1998 Klug et al.
5,792,026 A 8/1998 Maresh
5,792,027 A 8/1998 Gvoich
5,792,028 A 8/1998 Jarvie
5,792,029 A 8/1998 Gordon
5,792,031 A 8/1998 Alton
5,794,210 A 8/1998 Goldhaber et al.
5,795,268 A 8/1998 Husted
5,795,270 A 8/1998 Woods et al.
5,797,578 A 8/1998 Graffeo
5,797,805 A 8/1998 Lubell et al.
5,799,281 A 8/1998 Login et al.
5,800,323 A 9/1998 Ansel
5,803,870 A 9/1998 Buhler
5,803,871 A 9/1998 Stearns et al.
5,803,874 A 9/1998 Wilkinson
5,803,877 A 9/1998 Franey
5,803,882 A 9/1998 Habing et al.
5,807,210 A 9/1998 Devlin
5,810,696 A 9/1998 Webb
5,810,697 A 9/1998 Joiner
5,810,698 A 9/1998 Hullett et al.
5,810,747 A 9/1998 Brudny et al.
5,813,142 A 9/1998 Demon
5,813,864 A 9/1998 Ikuta et al.
5,813,945 A 9/1998 Bernacki
5,813,947 A 9/1998 Densmore
5,813,949 A 9/1998 Rodgers, Jr.
5,813,953 A 9/1998 Whipple
5,816,372 A 10/1998 Carlson et al.
5,816,443 A 10/1998 Bustos
5,816,981 A 10/1998 Hung
5,820,478 A 10/1998 Wood et al.
5,820,525 A 10/1998 Riley
5,823,618 A 10/1998 Fox et al.
5,823,913 A 10/1998 Aruin
5,823,917 A 10/1998 Chen
5,825,983 A 10/1998 Park et al.
5,826,575 A 10/1998 Lall
5,826,898 A 10/1998 Fortier et al.
5,827,154 A 10/1998 Gill

(56) References Cited

U.S. PATENT DOCUMENTS

| | | | |
|---|---|---|---|
| 5,827,155 | A | 10/1998 | Jensen et al. |
| 5,827,158 | A | 10/1998 | Drecksel |
| 5,830,107 | A | 11/1998 | Brigliadoro |
| 5,830,113 | A | 11/1998 | Coody et al. |
| 5,830,114 | A | 11/1998 | Halfen et al. |
| 5,833,577 | A | 11/1998 | Hurt |
| 5,833,582 | A | 11/1998 | Chen |
| 5,833,583 | A | 11/1998 | Chuang |
| 5,833,584 | A | 11/1998 | Piaget et al. |
| 5,833,587 | A | 11/1998 | Strong et al. |
| 5,836,770 | A | 11/1998 | Powers |
| 5,836,854 | A | 11/1998 | Kuo |
| 5,836,855 | A | 11/1998 | Eschenbach |
| 5,836,856 | A | 11/1998 | Mattoo |
| 5,836,858 | A | 11/1998 | Sharff |
| 5,838,906 | A | 11/1998 | Doyle et al. |
| 5,839,990 | A | 11/1998 | Virkkala |
| 5,839,993 | A | 11/1998 | Fox |
| 5,842,961 | A | 12/1998 | Davis |
| 5,845,230 | A | 12/1998 | Lamberson |
| 5,846,166 | A | 12/1998 | Kuo |
| 5,848,396 | A | 12/1998 | Gerace |
| 5,848,954 | A | 12/1998 | Stearns et al. |
| 5,852,264 | A | 12/1998 | Muller |
| 5,854,833 | A | 12/1998 | Hogan et al. |
| 5,855,537 | A | 1/1999 | Coody et al. |
| 5,855,538 | A | 1/1999 | Argabright |
| 5,857,939 | A | 1/1999 | Kaufman |
| 5,857,940 | A | 1/1999 | Husted |
| 5,857,941 | A | 1/1999 | Maresh |
| 5,857,943 | A | 1/1999 | Murray |
| 5,860,893 | A | 1/1999 | Watterson et al. |
| 5,860,894 | A | 1/1999 | Dalebout et al. |
| 5,860,895 | A | 1/1999 | Lee |
| 5,860,899 | A | 1/1999 | Rassman |
| 5,862,892 | A | 1/1999 | Conley |
| 5,864,018 | A | 1/1999 | Morser et al. |
| 5,865,710 | A | 2/1999 | Wilson-Hyde |
| 5,865,711 | A | 2/1999 | Chen |
| 5,865,733 | A | 2/1999 | Malinouskas et al. |
| 5,868,108 | A | 2/1999 | Schmitz et al. |
| 5,868,333 | A | 2/1999 | Nayak |
| 5,868,648 | A | 2/1999 | Coody et al. |
| 5,871,421 | A | 2/1999 | Trulaske et al. |
| 5,871,425 | A | 2/1999 | Gvoich |
| 5,873,369 | A | 2/1999 | Laniado et al. |
| 5,873,608 | A | 2/1999 | Tharp |
| 5,876,095 | A | 3/1999 | Johnston |
| 5,876,307 | A | 3/1999 | Stearns |
| 5,876,308 | A | 3/1999 | Jarvie |
| 5,878,479 | A | 3/1999 | Dickerson et al. |
| 5,879,270 | A | 3/1999 | Huish et al. |
| 5,879,271 | A | 3/1999 | Stearns et al. |
| 5,879,273 | A | 3/1999 | Wei |
| 5,879,276 | A | 3/1999 | Miller |
| 5,880,677 | A | 3/1999 | Lestician |
| 5,882,281 | A | 3/1999 | Stearns et al. |
| 5,884,735 | A | 3/1999 | Eckel et al. |
| 5,885,197 | A | 3/1999 | Barton |
| 5,888,172 | A | 3/1999 | Andrus et al. |
| 5,890,149 | A | 3/1999 | Schmonsees |
| 5,890,562 | A | 4/1999 | Bartels et al. |
| 5,890,906 | A | 4/1999 | Macri |
| 5,890,995 | A | 4/1999 | Bobick et al. |
| 5,890,996 | A | 4/1999 | Frame et al. |
| 5,890,997 | A | 4/1999 | Roth |
| 5,891,001 | A | 4/1999 | Carnes et al. |
| 5,891,003 | A | 4/1999 | Deac et al. |
| 5,891,042 | A | 4/1999 | Tanimura et al. |
| 5,893,820 | A | 4/1999 | Maresh et al. |
| 5,895,339 | A | 4/1999 | Maresh |
| 5,895,340 | A | 4/1999 | Keller |
| 5,897,457 | A | 4/1999 | Paul Mackovjak |
| 5,897,459 | A | 4/1999 | Habing et al. |
| 5,897,460 | A | 4/1999 | McBride et al. |
| 5,897,461 | A | 4/1999 | Socwell |
| 5,897,463 | A | 4/1999 | Maresh |
| 5,899,833 | A | 5/1999 | Ryan et al. |
| 5,899,834 | A | 5/1999 | Dalebout et al. |
| 5,899,963 | A | 5/1999 | Hutchings |
| 5,902,214 | A | 5/1999 | Makikawa et al. |
| 5,904,398 | A | 5/1999 | Farricielli |
| 5,904,636 | A | 5/1999 | Chen |
| 5,904,637 | A | 5/1999 | Kuo |
| 5,904,641 | A | 5/1999 | Huang |
| 5,905,442 | A | 5/1999 | Mosebrook et al. |
| 5,906,269 | A | 5/1999 | Zabron et al. |
| 5,906,494 | A | 5/1999 | Ogawa et al. |
| 5,906,564 | A | 5/1999 | Jacobsen |
| 5,906,581 | A | 5/1999 | Tsuda |
| 5,909,544 | A | 6/1999 | Anderson, II et al. |
| 5,910,070 | A | 6/1999 | Henry et al. |
| 5,910,072 | A | 6/1999 | Rawls et al. |
| 5,911,044 | A | 6/1999 | Lo et al. |
| 5,911,132 | A | 6/1999 | Sloane |
| 5,911,649 | A | 6/1999 | Miller |
| 5,911,687 | A | 6/1999 | Sato et al. |
| 5,913,310 | A | 6/1999 | Brown |
| 5,913,751 | A | 6/1999 | Eschenbach |
| 5,913,752 | A | 6/1999 | Bolf |
| 5,913,830 | A | 6/1999 | Miles |
| 5,916,063 | A | 6/1999 | Alessandri |
| 5,916,064 | A | 6/1999 | Eschenbach |
| 5,916,065 | A | 6/1999 | McBride et al. |
| 5,916,069 | A | 6/1999 | Wang |
| 5,917,405 | A | 6/1999 | Joao |
| 5,917,692 | A | 6/1999 | Schmitz et al. |
| 5,919,117 | A | 7/1999 | Thompson et al. |
| 5,919,118 | A | 7/1999 | Stearns |
| 5,919,174 | A | 7/1999 | Hanson |
| 5,921,891 | A | 7/1999 | Browne |
| 5,921,892 | A | 7/1999 | Easton |
| 5,921,894 | A | 7/1999 | Eschenbach |
| 5,921,896 | A | 7/1999 | Boland |
| 5,924,962 | A | 7/1999 | Rodgers, Jr. |
| 5,924,963 | A | 7/1999 | Maresh |
| 5,925,001 | A | 7/1999 | Hoyt et al. |
| 5,929,748 | A | 7/1999 | Odinak |
| 5,929,782 | A | 7/1999 | Stark |
| 5,929,848 | A | 7/1999 | Albukerk et al. |
| 5,931,763 | A | 8/1999 | Alessandri |
| 5,937,387 | A | 8/1999 | Summerell et al. |
| 5,938,551 | A | 8/1999 | Warner |
| 5,938,565 | A | 8/1999 | Bernacki |
| 5,938,568 | A | 8/1999 | Maresh |
| 5,938,570 | A | 8/1999 | Maresh |
| 5,938,571 | A | 8/1999 | Stevens |
| 5,938,575 | A | 8/1999 | Stearns |
| 5,940,502 | A | 8/1999 | Hirai et al. |
| 5,940,911 | A | 8/1999 | Wang |
| 5,941,797 | A | 8/1999 | Kashiwaguchi |
| 5,941,807 | A | 8/1999 | Cassidy |
| 5,943,794 | A | 8/1999 | Gelsomini |
| 5,944,638 | A | 8/1999 | Maresh |
| 5,944,641 | A | 8/1999 | Habing |
| 5,947,868 | A | 9/1999 | Dugan |
| 5,947,869 | A | 9/1999 | Shea |
| 5,947,872 | A | 9/1999 | Ryan et al. |
| 5,951,444 | A | 9/1999 | Webber |
| 5,951,447 | A | 9/1999 | Butler |
| 5,951,449 | A | 9/1999 | Oppriecht |
| 5,956,509 | A | 9/1999 | Kevner |
| 5,957,699 | A | 9/1999 | Peterson et al. |
| 5,957,814 | A | 9/1999 | Eschenbach |
| 5,961,423 | A | 10/1999 | Sellers |
| 5,961,430 | A | 10/1999 | Zuckerman et al. |
| 5,961,561 | A | 10/1999 | Wakefield, II |
| 5,961,593 | A | 10/1999 | Gabber et al. |
| 5,964,684 | A | 10/1999 | Sokol |
| 5,964,701 | A | 10/1999 | Asada et al. |
| 5,967,944 | A | 10/1999 | Vittone et al. |
| 5,967,954 | A | 10/1999 | Habing |
| 5,967,955 | A | 10/1999 | Westfall et al. |
| 5,967,975 | A | 10/1999 | Ridgeway |

(56) References Cited

U.S. PATENT DOCUMENTS 5,970,340 A 10/1999 Edgar
5,971,902 A 10/1999 Robertson et al.
5,973,696 A 10/1999 Agranat et al.
5,976,039 A 11/1999 Epel et al.
5,976,061 A 11/1999 Moon et al.
5,976,083 A 11/1999 Richardson et al.
5,980,429 A 11/1999 Nashner
5,980,430 A 11/1999 Wang
5,980,432 A 11/1999 Ahman
5,981,168 A 11/1999 Reiner et al.
5,984,798 A 11/1999 Gilmour
5,984,839 A 11/1999 Corkum
5,989,159 A 11/1999 Chen
5,989,161 A 11/1999 Wang et al.
5,989,163 A 11/1999 Rodgers, Jr.
5,989,168 A 11/1999 See
5,990,405 A 11/1999 Auten et al.
5,991,143 A 11/1999 Wright et al.
5,993,356 A 11/1999 Houston et al.
5,993,358 A 11/1999 Gureghian et al.
5,993,359 A 11/1999 Eschenbach
5,993,362 A 11/1999 Ghobadi
5,995,868 A 11/1999 Dorfmeister et al.
5,997,445 A 12/1999 Maresh
5,997,446 A 12/1999 Stearns
5,997,447 A 12/1999 Giannelli et al.
5,997,450 A 12/1999 Wilkinson
5,997,476 A 12/1999 Brown
6,001,046 A 12/1999 Chang
6,002,982 A 12/1999 Fry
6,003,481 A 12/1999 Pischinger et al.
6,004,243 A 12/1999 Ewert
6,004,244 A 12/1999 Simonson
6,006,379 A 12/1999 Hensley
6,007,462 A 12/1999 Chen
6,010,432 A 1/2000 Vawter
6,010,451 A 1/2000 Clawson
6,012,591 A 1/2000 Brandenberg
6,012,772 A 1/2000 Conde et al.
6,013,007 A 1/2000 Root et al.
6,013,009 A 1/2000 Karkanen
6,013,011 A 1/2000 Moore et al.
6,014,432 A 1/2000 Modney
6,014,634 A 1/2000 Scroggie et al.
6,014,913 A 1/2000 Masahiro
6,015,367 A 1/2000 Scaramucci
6,015,368 A 1/2000 Clem
6,017,294 A 1/2000 Eschenbach
6,017,295 A 1/2000 Eschenbach
6,018,705 A 1/2000 Gaudet et al.
6,019,710 A 2/2000 Dalebout et al.
6,022,296 A 2/2000 Yu
6,024,676 A 2/2000 Eschenbach
6,027,428 A 2/2000 Thomas et al.
6,027,429 A 2/2000 Daniels
6,027,430 A 2/2000 Stearns et al.
6,027,431 A 2/2000 Stearns
6,027,432 A 2/2000 Cheng
6,029,858 A 2/2000 Srokose
6,030,319 A 2/2000 Wu
6,030,320 A 2/2000 Stearns
6,030,321 A 2/2000 Fuentes
6,030,323 A 2/2000 Fontenot
6,033,227 A 3/2000 Ishige
6,033,344 A 3/2000 Trulaske et al.
6,033,347 A 3/2000 Dalebout et al.
6,033,350 A 3/2000 Krull
6,036,622 A 3/2000 Gordon
6,039,677 A 3/2000 Spletzer
6,042,510 A 3/2000 Miller
6,042,512 A 3/2000 Eschenbach
6,042,514 A 3/2000 Abelbeck
6,042,515 A 3/2000 Wang
6,042,516 A 3/2000 Norton
6,042,518 A 3/2000 Hildebrandt et al.
6,042,519 A 3/2000 Shea
6,042,523 A 3/2000 Graham
6,045,487 A 4/2000 Miller
6,045,488 A 4/2000 Eschenbach
6,045,490 A 4/2000 Shafer
6,045,491 A 4/2000 McNergney
6,050,822 A 4/2000 Faughn
6,050,920 A 4/2000 Ehrenfried
6,050,921 A 4/2000 Wang
6,050,922 A 4/2000 Wang
6,050,923 A 4/2000 Yu
6,050,924 A 4/2000 Shea
6,050,942 A 4/2000 Rust et al.
6,053,737 A 4/2000 Babbitt et al.
6,053,844 A 4/2000 Clem
6,053,847 A 4/2000 Stearns et al.
6,053,848 A 4/2000 Eschenbach
6,055,513 A 4/2000 Katz et al.
6,055,573 A 4/2000 Gardenswartz et al.
6,055,747 A 5/2000 Lombardino
6,056,670 A 5/2000 Shu et al.
6,056,678 A 5/2000 Giannelli et al.
6,059,576 A 5/2000 Brann
6,059,692 A 5/2000 Hickman
6,059,695 A 5/2000 Hung
6,063,008 A 5/2000 McBride
6,063,009 A 5/2000 Stearns
6,063,013 A 5/2000 Vathappallil
6,065,572 A 5/2000 Schober et al.
6,066,075 A 5/2000 Poulton
6,066,077 A 5/2000 Horst
6,066,705 A 5/2000 Calderon et al.
6,068,578 A 5/2000 Wang
6,068,579 A 5/2000 Killian et al.
6,071,031 A 6/2000 Bailey
6,071,215 A 6/2000 Raffo
6,071,216 A 6/2000 Giannelli et al.
6,074,328 A 6/2000 Johnson
6,075,525 A 6/2000 Hsieh
6,077,196 A 6/2000 Eschenbach
6,077,198 A 6/2000 Eschenbach
6,077,199 A 6/2000 Hsu
6,077,200 A 6/2000 Lin
6,077,202 A 6/2000 Gray
6,080,091 A 6/2000 Habing et al.
6,086,379 A 7/2000 Pendergast et al.
6,086,520 A 7/2000 Rodriquez
6,090,013 A 7/2000 Eschenbach
6,090,014 A 7/2000 Eschenbach
6,090,016 A 7/2000 Kuo
6,090,017 A 7/2000 Wang
6,092,822 A 7/2000 Salmon
6,095,951 A 8/2000 Skowronski et al.
6,099,439 A 8/2000 Ryan et al.
6,102,412 A 8/2000 Staffaroni
6,102,846 A 8/2000 Patton et al.
6,103,203 A 8/2000 Fischer
6,106,297 A 8/2000 Pollak et al.
6,106,439 A 8/2000 Boland
6,106,441 A 8/2000 Chen
6,110,076 A 8/2000 Hurt
6,110,077 A 8/2000 Yu
6,113,188 A 9/2000 Stewart et al.
6,113,518 A 9/2000 Maresh
6,113,522 A 9/2000 Montgomery
6,113,537 A 9/2000 Castano
6,117,049 A 9/2000 Lowe
6,117,055 A 9/2000 Boland
6,120,421 A 9/2000 Kuo
6,122,340 A 9/2000 Darley et al.
6,123,646 A 9/2000 Colassi
6,123,647 A 9/2000 Mitchell
6,123,648 A 9/2000 Stevens
6,123,649 A 9/2000 Lee
6,123,650 A 9/2000 Birrell
6,125,851 A 10/2000 Walker et al.
6,126,573 A 10/2000 Eschenbach
6,126,574 A 10/2000 Stearns et al.
6,126,575 A 10/2000 Wang

(56) References Cited

U.S. PATENT DOCUMENTS

| | | | |
|---|---|---|---|
| 6,126,576 | A | 10/2000 | Wang |
| 6,126,577 | A | 10/2000 | Chang |
| 6,128,663 | A | 10/2000 | Thomas |
| 6,129,962 | A | 10/2000 | Quigley et al. |
| 6,132,314 | A | 10/2000 | Aiki |
| 6,132,337 | A | 10/2000 | Krupka et al. |
| 6,132,340 | A | 10/2000 | Wang |
| 6,133,610 | A | 10/2000 | Bolam et al. |
| 6,135,923 | A | 10/2000 | Stearns |
| 6,135,924 | A | 10/2000 | Gibbs et al. |
| 6,135,925 | A | 10/2000 | Liu |
| 6,135,926 | A | 10/2000 | Lee |
| 6,135,927 | A | 10/2000 | Lo |
| 6,142,870 | A | 11/2000 | Wada et al. |
| 6,142,912 | A | 11/2000 | Profaci |
| 6,142,913 | A | 11/2000 | Ewert |
| 6,142,914 | A | 11/2000 | Crawford et al. |
| 6,142,915 | A | 11/2000 | Eschenbach |
| 6,146,313 | A | 11/2000 | Whan-Tong et al. |
| 6,146,314 | A | 11/2000 | Lee |
| 6,146,315 | A | 11/2000 | Schonenberger |
| 6,148,262 | A | 11/2000 | Fry |
| 6,149,551 | A | 11/2000 | Pyles et al. |
| 6,149,552 | A | 11/2000 | Chen |
| 6,151,586 | A | 11/2000 | Brown |
| 6,152,854 | A | 11/2000 | Carmein |
| 6,152,859 | A | 11/2000 | Stearns |
| 6,159,131 | A | 12/2000 | Pfeffer |
| 6,162,151 | A | 12/2000 | Tani et al. |
| 6,162,153 | A | 12/2000 | Perez, Jr. |
| 6,162,183 | A | 12/2000 | Hoover |
| 6,162,189 | A | 12/2000 | Girone et al. |
| 6,163,451 | A | 12/2000 | Chiu |
| 6,164,423 | A | 12/2000 | Dickerson |
| 6,165,107 | A | 12/2000 | Birrell |
| 6,168,551 | B1 | 1/2001 | Mcguinness |
| 6,168,552 | B1 | 1/2001 | Eschenbach |
| 6,171,186 | B1 | 1/2001 | Kurosawa et al. |
| 6,171,216 | B1 | 1/2001 | Wang |
| 6,171,217 | B1 | 1/2001 | Cutler |
| 6,171,218 | B1 | 1/2001 | Shea |
| 6,174,267 | B1 | 1/2001 | Dalebout |
| 6,174,268 | B1 | 1/2001 | Novak |
| 6,175,608 | B1 | 1/2001 | Pyles et al. |
| 6,176,241 | B1 | 1/2001 | Blau et al. |
| 6,176,814 | B1 | 1/2001 | Ryan et al. |
| 6,179,746 | B1 | 1/2001 | Delman |
| 6,179,753 | B1 | 1/2001 | Barker et al. |
| 6,181,647 | B1 | 1/2001 | Tipton et al. |
| 6,182,531 | B1 | 2/2001 | Gallagher et al. |
| 6,183,259 | B1 | 2/2001 | Macri et al. |
| 6,183,397 | B1 | 2/2001 | Stearns et al. |
| 6,183,398 | B1 | 2/2001 | Rufino et al. |
| 6,183,425 | B1 | 2/2001 | Whalen |
| 6,186,145 | B1 | 2/2001 | Brown |
| 6,186,290 | B1 | 2/2001 | Carlson |
| 6,186,460 | B1 | 2/2001 | Lin |
| 6,186,926 | B1 | 2/2001 | Ellis |
| 6,186,929 | B1 | 2/2001 | Endelman et al. |
| 6,189,846 | B1 | 2/2001 | Wang |
| 6,190,289 | B1 | 2/2001 | Pyles et al. |
| 6,193,631 | B1 | 2/2001 | Hickman |
| 6,193,635 | B1 | 2/2001 | Webber et al. |
| 6,196,948 | B1 | 3/2001 | Stearns |
| 6,196,954 | B1 | 3/2001 | Chen |
| 6,198,394 | B1 | 3/2001 | Jacobsen et al. |
| 6,203,474 | B1 | 3/2001 | Jones |
| 6,206,795 | B1 | 3/2001 | Ou |
| 6,206,804 | B1 | 3/2001 | Maresh |
| 6,206,806 | B1 | 3/2001 | Chu |
| 6,210,305 | B1 | 4/2001 | Eschenbach |
| 6,211,451 | B1 | 4/2001 | Tohgi et al. |
| 6,213,919 | B1 | 4/2001 | Wang |
| 6,213,962 | B1 | 4/2001 | Shimizu |
| 6,215,870 | B1 | 4/2001 | Hirai et al. |
| 6,217,483 | B1 | 4/2001 | Kallassy |
| 6,217,486 | B1 | 4/2001 | Rosenow |
| 6,217,487 | B1 | 4/2001 | Reinert |
| 6,220,865 | B1 | 4/2001 | Macri et al. |
| 6,220,990 | B1 | 4/2001 | Crivello |
| 6,220,991 | B1 | 4/2001 | Sellers |
| 6,220,995 | B1 | 4/2001 | Chen |
| 6,221,451 | B1 | 4/2001 | Lauer et al. |
| 6,221,667 | B1 | 4/2001 | Reiner et al. |
| 6,224,080 | B1 | 5/2001 | Ross |
| 6,224,387 | B1 | 5/2001 | Jones |
| 6,224,516 | B1 | 5/2001 | Disch |
| 6,224,519 | B1 | 5/2001 | Doolittle |
| 6,225,977 | B1 | 5/2001 | Li |
| 6,227,200 | B1 | 5/2001 | Crump et al. |
| 6,227,968 | B1 | 5/2001 | Suzuki et al. |
| 6,230,047 | B1 | 5/2001 | McHugh |
| 6,230,460 | B1 | 5/2001 | Huyett |
| 6,230,501 | B1 | 5/2001 | Bailey, Sr. et al. |
| 6,231,481 | B1 | 5/2001 | Brock |
| 6,231,482 | B1 | 5/2001 | Thompson |
| 6,231,946 | B1 | 5/2001 | Brown, Jr. et al. |
| 6,234,935 | B1 | 5/2001 | Chu |
| 6,234,936 | B1 | 5/2001 | Wang |
| 6,234,938 | B1 | 5/2001 | Chen |
| 6,237,583 | B1 | 5/2001 | Ripley et al. |
| 6,238,321 | B1 | 5/2001 | Arnold et al. |
| 6,238,323 | B1 | 5/2001 | Simonson |
| 6,241,524 | B1 | 6/2001 | Aoshima et al. |
| 6,241,638 | B1 | 6/2001 | Hurt |
| 6,244,987 | B1 | 6/2001 | Ohsuga et al. |
| 6,244,988 | B1 | 6/2001 | Delman |
| 6,244,992 | B1 | 6/2001 | James |
| 6,245,001 | B1 | 6/2001 | Siaperas |
| 6,248,044 | B1 | 6/2001 | Stearns et al. |
| 6,248,045 | B1 | 6/2001 | Stearns et al. |
| 6,251,047 | B1 | 6/2001 | Stearns et al. |
| 6,251,048 | B1 | 6/2001 | Kaufman |
| 6,252,153 | B1 | 6/2001 | Toyama |
| 6,254,513 | B1 | 7/2001 | Takenaka et al. |
| 6,254,514 | B1 | 7/2001 | Maresh et al. |
| 6,254,515 | B1 | 7/2001 | Carman et al. |
| 6,254,516 | B1 | 7/2001 | Giannelli et al. |
| 6,259,944 | B1 | 7/2001 | Margulis et al. |
| 6,260,970 | B1 | 7/2001 | Horn |
| 6,261,209 | B1 | 7/2001 | Coody |
| 6,264,586 | B1 | 7/2001 | Webber |
| 6,264,588 | B1 | 7/2001 | Ellis |
| 6,267,710 | B1 | 7/2001 | Liu |
| 6,273,842 | B1 | 8/2001 | Wang |
| 6,273,843 | B1 | 8/2001 | Lo |
| 6,276,749 | B1 | 8/2001 | Okazawa et al. |
| 6,277,054 | B1 | 8/2001 | Kuo |
| 6,277,055 | B1 | 8/2001 | Birrell et al. |
| 6,277,056 | B1 | 8/2001 | McBride et al. |
| 6,278,378 | B1 | 8/2001 | Feiner et al. |
| 6,280,361 | B1 | 8/2001 | Harvey et al. |
| 6,280,362 | B1 | 8/2001 | Dalebout et al. |
| 6,280,367 | B1 | 8/2001 | Arsenault |
| 6,282,816 | B1 | 9/2001 | Rosendahl |
| 6,283,760 | B1 | 9/2001 | Wakamoto |
| 6,283,859 | B1 | 9/2001 | Carlson et al. |
| 6,283,896 | B1 | 9/2001 | Grunfeld |
| 6,287,239 | B1 | 9/2001 | Hernandez |
| 6,287,240 | B1 | 9/2001 | Trabbic |
| 6,292,688 | B1 | 9/2001 | Patton |
| 6,293,375 | B1 | 9/2001 | Chen |
| 6,293,802 | B1 | 9/2001 | Ahlgren |
| 6,299,959 | B1 | 10/2001 | Squires et al. |
| 6,302,815 | B1 | 10/2001 | Shishido et al. |
| 6,302,826 | B1 | 10/2001 | Lee |
| 6,302,828 | B1 | 10/2001 | Martin et al. |
| 6,302,829 | B1 | 10/2001 | Schmidt |
| 6,302,830 | B1 | 10/2001 | Stearns |
| 6,302,833 | B1 | 10/2001 | Ellis et al. |
| 6,306,108 | B1 | 10/2001 | Butler |
| 6,307,167 | B1 | 10/2001 | Kajio et al. |
| 6,308,565 | B1 | 10/2001 | French |
| 6,312,363 | B1 | 11/2001 | Watterson et al. |

(56) References Cited

U.S. PATENT DOCUMENTS

| | | | |
|---|---|---|---|
| 6,312,366 | B1 | 11/2001 | Prusick |
| 6,313,363 | B1 | 11/2001 | Joly et al. |
| 6,314,058 | B1 | 11/2001 | Lee |
| 6,314,667 | B1 | 11/2001 | Rife et al. |
| 6,315,486 | B1 | 11/2001 | Lunz |
| 6,315,702 | B1 | 11/2001 | Ikonomopoulos |
| 6,317,151 | B1 | 11/2001 | Ohsuga et al. |
| 6,322,059 | B1 | 11/2001 | Kelm et al. |
| 6,322,451 | B1 | 11/2001 | Miura |
| 6,322,481 | B1 | 11/2001 | Krull |
| 6,325,745 | B1 | 12/2001 | Yu |
| 6,325,746 | B1 | 12/2001 | Wang |
| 6,328,676 | B1 | 12/2001 | Alessandri |
| 6,328,677 | B1 | 12/2001 | Drapeau |
| 6,334,624 | B1 | 1/2002 | Giglio |
| 6,336,891 | B1 | 1/2002 | Fedrigon et al. |
| 6,338,698 | B1 | 1/2002 | Stearns et al. |
| 6,340,340 | B1 | 1/2002 | Stearns |
| 6,342,028 | B1 | 1/2002 | De Sane |
| 6,344,986 | B1 | 2/2002 | Jain et al. |
| 6,345,197 | B1 | 2/2002 | Fabrizio |
| 6,347,603 | B1 | 2/2002 | Felger |
| 6,348,028 | B1 | 2/2002 | Cragg |
| 6,350,218 | B1 | 2/2002 | Dalebout et al. |
| 6,352,494 | B2 | 3/2002 | McAlonan |
| 6,356,856 | B1 | 3/2002 | Damen et al. |
| 6,357,077 | B1 | 3/2002 | Jones, Jr. et al. |
| 6,358,187 | B1 | 3/2002 | Smith |
| 6,361,476 | B1 | 3/2002 | Eschenbach |
| 6,361,477 | B1 | 3/2002 | Kolda |
| 6,368,251 | B1 | 4/2002 | Casler |
| 6,368,252 | B1 | 4/2002 | Stearns |
| 6,368,254 | B1 | 4/2002 | Wall |
| 6,369,313 | B2 | 4/2002 | Devecka |
| 6,371,123 | B1 | 4/2002 | Stark et al. |
| 6,371,738 | B2 | 4/2002 | Jones |
| 6,371,850 | B1 | 4/2002 | Sonoda |
| 6,371,895 | B1 | 4/2002 | Endelman et al. |
| 6,375,580 | B1 | 4/2002 | Schmidt |
| 6,379,289 | B1 | 4/2002 | Gossie |
| 6,382,627 | B1 | 5/2002 | Lundberg |
| 6,383,120 | B1 | 5/2002 | Lo |
| 6,385,651 | B2 | 5/2002 | Dancs et al. |
| 6,387,015 | B1 | 5/2002 | Watson |
| 6,387,016 | B1 | 5/2002 | Lo |
| 6,390,923 | B1 | 5/2002 | Yoshitomi et al. |
| 6,390,953 | B1 | 5/2002 | Maresh |
| 6,390,955 | B1 | 5/2002 | Wang |
| 6,394,239 | B1 | 5/2002 | Carlson |
| 6,397,797 | B1 | 6/2002 | Kolmanovsky et al. |
| 6,398,695 | B2 | 6/2002 | Miller |
| 6,402,520 | B1 | 6/2002 | Freer |
| 6,402,558 | B1 | 6/2002 | Hung-Ju et al. |
| 6,402,666 | B2 | 6/2002 | Krull |
| 6,404,418 | B1 | 6/2002 | Leem |
| 6,405,077 | B1 | 6/2002 | Birnbaum et al. |
| 6,409,513 | B1 | 6/2002 | Kawamura et al. |
| 6,409,632 | B1 | 6/2002 | Eschenbach |
| 6,409,633 | B1 | 6/2002 | Abelbeck |
| 6,413,197 | B2 | 7/2002 | McKechnie et al. |
| 6,416,442 | B1 | 7/2002 | Stearns et al. |
| 6,416,444 | B1 | 7/2002 | Lim |
| 6,418,394 | B1 | 7/2002 | Puolakanaho et al. |
| 6,419,611 | B1 | 7/2002 | Levine et al. |
| 6,421,358 | B1 | 7/2002 | Stimmel et al. |
| 6,422,957 | B1 | 7/2002 | Winter et al. |
| 6,422,976 | B1 | 7/2002 | Eschenbach |
| 6,422,977 | B1 | 7/2002 | Eschenbach |
| 6,422,983 | B1 | 7/2002 | Weck |
| 6,430,997 | B1 | 8/2002 | French et al. |
| 6,432,026 | B1 | 8/2002 | Wang |
| 6,435,466 | B1 | 8/2002 | Adams |
| 6,436,007 | B1 | 8/2002 | Eschenbach |
| 6,436,008 | B1 | 8/2002 | Skowronski et al. |
| 6,440,013 | B1 | 8/2002 | Brown |
| 6,440,042 | B2 | 8/2002 | Eschenbach |
| 6,443,875 | B1 | 9/2002 | Golen, Jr. et al. |
| 6,446,745 | B1 | 9/2002 | Lee |
| 6,447,424 | B1 | 9/2002 | Ashby et al. |
| 6,447,430 | B1 | 9/2002 | Webb et al. |
| 6,450,284 | B1 | 9/2002 | Sakyo et al. |
| 6,450,922 | B1 | 9/2002 | Henderson et al. |
| 6,450,923 | B1 | 9/2002 | Vatti |
| 6,450,925 | B1 | 9/2002 | Kuo |
| 6,454,679 | B1 | 9/2002 | Radow |
| 6,454,682 | B1 | 9/2002 | Kuo |
| 6,455,960 | B1 | 9/2002 | Trago et al. |
| 6,458,060 | B1 | 10/2002 | Watterson et al. |
| 6,458,061 | B2 | 10/2002 | Simonson |
| 6,461,275 | B1 | 10/2002 | Wang et al. |
| 6,461,279 | B1 | 10/2002 | Kuo |
| 6,463,385 | B1 | 10/2002 | Fry |
| 6,464,618 | B1 | 10/2002 | Shea |
| 6,466,460 | B1 | 10/2002 | Rein et al. |
| 6,468,184 | B1 | 10/2002 | Lee |
| 6,468,188 | B1 | 10/2002 | Koenig |
| 6,468,189 | B2 | 10/2002 | Alessandri |
| 6,471,622 | B1 | 10/2002 | Hammer et al. |
| 6,473,483 | B2 | 10/2002 | Pyles |
| 6,474,193 | B1 | 11/2002 | Farney |
| 6,475,115 | B1 | 11/2002 | Candito |
| 6,475,121 | B2 | 11/2002 | Wang |
| 6,475,122 | B2 | 11/2002 | Wu |
| 6,478,721 | B1 | 11/2002 | Hunter |
| 6,478,736 | B1 | 11/2002 | Mault |
| 6,482,128 | B1 | 11/2002 | Michalow |
| 6,482,130 | B1 | 11/2002 | Pasero et al. |
| 6,482,132 | B2 | 11/2002 | Eschenbach |
| 6,484,062 | B1 | 11/2002 | Kim |
| 6,485,041 | B1 | 11/2002 | Janssen |
| 6,485,395 | B1 | 11/2002 | Stearns |
| 6,485,397 | B1 | 11/2002 | Manderbacka |
| 6,488,020 | B1 | 12/2002 | Rosas-Magallan |
| 6,488,612 | B2 | 12/2002 | Sechrest et al. |
| 6,491,609 | B2 | 12/2002 | Webber |
| 6,491,610 | B1 | 12/2002 | Henn |
| 6,493,652 | B1 | 12/2002 | Ohlenbusch et al. |
| 6,494,814 | B1 | 12/2002 | Wang |
| 6,494,817 | B2 | 12/2002 | Lake |
| 6,497,426 | B2 | 12/2002 | Vanpelt |
| 6,500,096 | B1 | 12/2002 | Farney |
| 6,500,097 | B1 | 12/2002 | Hall |
| 6,500,099 | B1 | 12/2002 | Eschenbach |
| 6,503,173 | B2 | 1/2003 | Clem |
| 6,505,503 | B1 | 1/2003 | Teresi et al. |
| 6,505,845 | B1 | 1/2003 | Fong |
| 6,506,142 | B2 | 1/2003 | Itoh et al. |
| 6,511,402 | B2 | 1/2003 | Shu et al. |
| 6,513,381 | B2 | 2/2003 | Fyfe et al. |
| 6,513,532 | B2 | 2/2003 | Mault et al. |
| 6,513,669 | B2 | 2/2003 | Ozawa et al. |
| 6,514,180 | B1 | 2/2003 | Rawls |
| 6,515,593 | B1 | 2/2003 | Stark et al. |
| 6,520,891 | B1 | 2/2003 | Stephens, Jr. |
| 6,527,674 | B1 | 3/2003 | Clem |
| 6,527,677 | B2 | 3/2003 | Maresh |
| 6,527,678 | B1 | 3/2003 | Wang |
| 6,527,685 | B2 | 3/2003 | Endelman et al. |
| 6,527,711 | B1 | 3/2003 | Stivoric et al. |
| 6,527,712 | B1 | 3/2003 | Brown et al. |
| 6,527,796 | B1 | 3/2003 | Magovern |
| 6,530,864 | B1 | 3/2003 | Parks |
| 6,533,707 | B2 | 3/2003 | Wang |
| 6,537,184 | B2 | 3/2003 | Kim |
| 6,539,931 | B2 | 4/2003 | Trajkovic et al. |
| 6,540,646 | B2 | 4/2003 | Stearns |
| 6,543,247 | B2 | 4/2003 | Strauss |
| 6,544,146 | B1 | 4/2003 | Stearns et al. |
| 6,544,147 | B1 | 4/2003 | Wang |
| 6,544,154 | B2 | 4/2003 | Forcillo |
| 6,547,701 | B1 | 4/2003 | Eschenbach |
| 6,547,702 | B1 | 4/2003 | Heidecke |
| 6,551,217 | B2 | 4/2003 | Kaganovsky |
| 6,551,218 | B2 | 4/2003 | Goh |

(56) References Cited

U.S. PATENT DOCUMENTS 6,551,220 B1 4/2003 Schroeder
6,551,223 B2 4/2003 Cheng
6,554,749 B2 4/2003 Iund et al.
6,554,750 B2 4/2003 Stearns et al.
6,558,299 B1 5/2003 Slattery
6,558,301 B1 5/2003 Jackson
6,560,903 B1 5/2003 Darley
6,561,951 B2 5/2003 Cannon et al.
6,561,955 B1 5/2003 Dreissigacker et al.
6,561,960 B2 5/2003 Webber
6,563,489 B1 5/2003 Latypov et al.
6,565,486 B2 5/2003 Stearns
6,569,061 B2 5/2003 Stearns et al.
6,569,062 B2 5/2003 Wang
6,572,511 B1 6/2003 Volpe
6,572,512 B2 6/2003 Anderson et al.
6,572,513 B1 6/2003 Whan-Tong et al.
6,575,877 B2 6/2003 Rufino et al.
6,575,878 B1 6/2003 Choy
6,575,884 B1 6/2003 Eazor
6,579,210 B1 6/2003 Stearns et al.
6,579,214 B2 6/2003 Crump
6,582,342 B2 6/2003 Kaufman
6,582,343 B2 6/2003 Lin
6,582,344 B2 6/2003 Tang
6,585,622 B1 7/2003 Shum et al.
6,585,624 B1 7/2003 Chen
6,585,626 B2 7/2003 McBride
6,585,647 B1 7/2003 Winder
6,589,138 B2 7/2003 Dekker et al.
6,589,139 B1 7/2003 Butterworth
6,592,136 B2 7/2003 Becker et al.
6,592,502 B1 7/2003 Phillips
6,595,905 B2 7/2003 McBride
6,599,223 B2 7/2003 Wang
6,601,016 B1 7/2003 Brown et al.
6,601,358 B2 8/2003 Panatta
6,601,825 B2 8/2003 Bressner et al.
6,602,191 B2 8/2003 Quy
6,604,008 B2 8/2003 Chudley et al.
6,604,023 B1 8/2003 Brown et al.
6,604,419 B2 8/2003 Guzman
6,605,020 B1 8/2003 Huang
6,605,038 B1 8/2003 Teller et al.
6,605,044 B2 8/2003 Bimbaum
6,606,374 B1 8/2003 Rokoff et al.
6,606,994 B1 8/2003 Clark
6,609,478 B2 8/2003 Del Valle
6,610,063 B2 8/2003 Kumar et al.
6,611,789 B1 8/2003 Darley
6,612,170 B2 9/2003 Brown
6,612,492 B1 9/2003 Yen
6,612,969 B2 9/2003 Eschenbach
6,612,971 B1 9/2003 Morris
6,616,578 B2 9/2003 Alessandri
6,619,681 B2 9/2003 Gutierrez
6,619,835 B2 9/2003 Kita
6,620,079 B2 9/2003 Kuo
6,620,080 B1 9/2003 Gray
6,623,407 B2 9/2003 Novak
6,623,409 B1 9/2003 Abelbeck
6,626,799 B2 9/2003 Watterson et al.
6,626,800 B1 9/2003 Casler
6,626,802 B1 9/2003 Rodgers, Jr.
6,626,803 B1 9/2003 Oglesby et al.
6,629,902 B2 10/2003 Murphy et al.
6,629,909 B1 10/2003 Stearns et al.
6,629,910 B1 10/2003 Krull
6,632,161 B1 10/2003 Nir
6,634,992 B1 10/2003 Ogawa
6,634,996 B2 10/2003 Jacobsen
6,635,015 B2 10/2003 Sagel
6,637,811 B2 10/2003 Zheng
6,637,818 B2 10/2003 Williams
6,638,160 B2 10/2003 Yoshitomi
6,645,124 B1 11/2003 Clem
6,645,125 B1 11/2003 Stearns et al.
6,645,126 B1 11/2003 Martin et al.
6,645,130 B2 11/2003 Webber
6,647,826 B2 11/2003 Okajima et al.
6,648,353 B1 11/2003 Cabal
6,648,798 B2 11/2003 Yoo
6,648,800 B2 11/2003 Stearns et al.
6,648,801 B2 11/2003 Stearns et al.
6,648,802 B2 11/2003 Ware
6,652,424 B2 11/2003 Dalebout
6,652,425 B1 11/2003 Martin et al.
6,652,426 B2 11/2003 Carter
6,652,429 B2 11/2003 Bushnell
6,656,091 B1 12/2003 Abelbeck
6,659,916 B1 12/2003 Shea
6,659,918 B2 12/2003 Schiessl
6,659,946 B1 12/2003 Batchelor et al.
6,660,949 B2 12/2003 Kamino et al.
6,661,136 B1 12/2003 Lee
6,663,127 B2 12/2003 Miller
6,663,498 B2 12/2003 Stipan
6,663,500 B2 12/2003 Huang
6,666,800 B2 12/2003 Krull
6,666,801 B1 12/2003 Michalow
6,668,678 B1 12/2003 Baba et al.
6,669,600 B2 12/2003 Warner
6,669,609 B2 12/2003 Gerschefske et al.
6,671,975 B2 1/2004 Hennessey
6,672,991 B2 1/2004 O'Malley
6,672,992 B1 1/2004 Lo et al.
6,672,994 B1 1/2004 Stearns et al.
6,675,041 B2 1/2004 Dickinson
6,676,530 B2 1/2004 Lochtefeld
6,676,569 B1 1/2004 Radow
6,676,572 B2 1/2004 Wang
6,676,579 B1 1/2004 Lin
6,677,299 B2 1/2004 Stern et al.
6,679,813 B1 1/2004 Gray
6,679,816 B1 1/2004 Krull
6,679,820 B2 1/2004 Barkus et al.
6,681,014 B1 1/2004 Ghassabian
6,681,704 B1 1/2004 Brookhiser
6,681,728 B2 1/2004 Haghgooie
6,682,460 B2 1/2004 Lo
6,682,461 B2 1/2004 Wang
6,685,480 B2 2/2004 Nishimoto et al.
6,685,601 B1 2/2004 Knapp
6,685,602 B2 2/2004 Colosky, Jr. et al.
6,685,607 B1 2/2004 Olson
6,687,535 B2 2/2004 Hautala et al.
6,688,624 B2 2/2004 Christensen et al.
6,689,019 B2 2/2004 Ohrt et al.
6,689,020 B2 2/2004 Stearns
6,689,057 B1 2/2004 Shinsel et al.
6,691,839 B1 2/2004 El-Kassouf
6,692,412 B2 2/2004 Chen et al.
6,692,414 B1 2/2004 Gelbart
6,692,417 B2 2/2004 Burrell
6,695,694 B2 2/2004 Ishikawa et al.
6,695,749 B2 2/2004 Kuo
6,695,751 B1 2/2004 Hsu
6,695,799 B2 2/2004 Kitadou et al.
6,698,110 B1 3/2004 Robbins
6,699,159 B2 3/2004 Rouse
6,699,162 B2 3/2004 Chen
6,700,788 B2 3/2004 Matsushita et al.
6,701,271 B2 3/2004 Willner et al.
6,702,719 B1 3/2004 Brown et al.
6,705,977 B1 3/2004 Ziak
6,708,427 B2 3/2004 Sussmann et al.
6,709,368 B1 3/2004 Chue
6,712,737 B1 3/2004 Nusbaum
6,715,779 B2 4/2004 Eschenbach
6,716,139 B1 4/2004 Hosseinzadeh-Dolkhani
6,716,142 B2 4/2004 Kuo
6,716,144 B1 4/2004 Shifferaw
6,719,665 B1 4/2004 Lai
6,719,667 B2 4/2004 Wong et al.

(56) References Cited

U.S. PATENT DOCUMENTS

| | | | |
|---|---|---|---|
| 6,719,669 | B1 | 4/2004 | Wang |
| 6,722,888 | B1 | 4/2004 | Macri et al. |
| 6,723,413 | B2 | 4/2004 | Walters |
| 6,726,113 | B2 | 4/2004 | Guo |
| 6,726,600 | B2 | 4/2004 | Miller |
| 6,726,601 | B1 | 4/2004 | Beutel |
| 6,726,602 | B2 | 4/2004 | Chang |
| 6,726,606 | B2 | 4/2004 | Jacobsen |
| 6,729,342 | B2 | 5/2004 | Serhan |
| 6,730,002 | B2 | 5/2004 | Hald et al. |
| 6,733,423 | B1 | 5/2004 | Chang |
| 6,733,424 | B2 | 5/2004 | Krull |
| 6,736,360 | B1 | 5/2004 | Buczek |
| 6,736,759 | B1 | 5/2004 | Stubbs et al. |
| 6,738,274 | B2 | 5/2004 | Prasad et al. |
| 6,740,007 | B2 | 5/2004 | Gordon et al. |
| 6,740,009 | B1 | 5/2004 | Hall |
| 6,741,052 | B2 | 5/2004 | Fitzgibbon |
| 6,743,153 | B2 | 6/2004 | Watterson et al. |
| 6,743,155 | B2 | 6/2004 | Pan |
| 6,746,247 | B2 | 6/2004 | Barton |
| 6,746,371 | B1 | 6/2004 | Brown et al. |
| 6,747,427 | B1 | 6/2004 | Carson |
| 6,749,432 | B2 | 6/2004 | French et al. |
| 6,749,536 | B1 | 6/2004 | Cuskaden et al. |
| 6,749,537 | B1 | 6/2004 | Hickman |
| 6,749,540 | B1 | 6/2004 | Pasero et al. |
| 6,749,542 | B2 | 6/2004 | Wu |
| 6,749,546 | B2 | 6/2004 | Yang |
| 6,751,439 | B2 | 6/2004 | Tice et al. |
| 6,752,744 | B2 | 6/2004 | Arnold et al. |
| 6,757,572 | B1 | 6/2004 | Forest |
| 6,758,790 | B1 | 7/2004 | Ellis |
| 6,758,791 | B1 | 7/2004 | Kuo |
| 6,758,792 | B1 | 7/2004 | Chang |
| 6,761,387 | B2 | 7/2004 | Sloss |
| 6,761,665 | B2 | 7/2004 | Nguyen |
| 6,761,667 | B1 | 7/2004 | Cutler et al. |
| 6,764,088 | B2 | 7/2004 | Hung |
| 6,764,429 | B1 | 7/2004 | Michalow |
| 6,764,430 | B1 | 7/2004 | Fencel |
| 6,764,431 | B2 | 7/2004 | Yoss |
| 6,765,726 | B2 | 7/2004 | French et al. |
| 6,767,314 | B2 | 7/2004 | Thompson |
| 6,769,689 | B1 | 8/2004 | Shimomura et al. |
| 6,770,015 | B2 | 8/2004 | Simonson |
| 6,773,022 | B2 | 8/2004 | Janssen |
| 6,776,740 | B1 | 8/2004 | Anderson et al. |
| 6,778,938 | B1 | 8/2004 | Ng et al. |
| 6,783,481 | B2 | 8/2004 | Stearns |
| 6,783,482 | B2 | 8/2004 | Oglesby et al. |
| 6,786,415 | B2 | 9/2004 | Yiu |
| 6,786,669 | B2 | 9/2004 | Tsui et al. |
| 6,786,821 | B2 | 9/2004 | Nobe et al. |
| 6,786,847 | B1 | 9/2004 | Morgan et al. |
| 6,786,848 | B2 | 9/2004 | Yamashita et al. |
| 6,786,850 | B2 | 9/2004 | Nizamuddin |
| 6,786,852 | B2 | 9/2004 | Watterson et al. |
| 6,790,162 | B1 | 9/2004 | Ellis et al. |
| 6,790,163 | B1 | 9/2004 | Van De Laarschot |
| 6,790,178 | B1 | 9/2004 | Mault et al. |
| 6,793,607 | B2 | 9/2004 | Neil |
| 6,793,609 | B1 | 9/2004 | Fan |
| 6,796,159 | B2 | 9/2004 | Kelm et al. |
| 6,796,927 | B2 | 9/2004 | Toyama |
| 6,796,928 | B1 | 9/2004 | Christopher |
| 6,798,378 | B1 | 9/2004 | Walters |
| 6,807,869 | B2 | 10/2004 | Farringdon et al. |
| 6,808,458 | B1 | 10/2004 | Jung |
| 6,808,472 | B1 | 10/2004 | Hickman |
| 6,808,473 | B2 | 10/2004 | Hisano et al. |
| 6,808,475 | B2 | 10/2004 | Kehrbaum |
| 6,811,516 | B1 | 11/2004 | Dugan |
| 6,811,517 | B1 | 11/2004 | Eschenbach |
| 6,811,519 | B2 | 11/2004 | Kuo |
| 6,811,520 | B2 | 11/2004 | Wu |
| 6,817,117 | B1 | 11/2004 | Campbell |
| 6,817,968 | B2 | 11/2004 | Galbraith et al. |
| 6,817,979 | B2 | 11/2004 | Nihtilä |
| 6,821,230 | B2 | 11/2004 | Dalebout et al. |
| 6,821,232 | B1 | 11/2004 | Wang |
| 6,823,036 | B1 | 11/2004 | Chen |
| 6,823,327 | B1 | 11/2004 | Klug |
| 6,824,210 | B2 | 11/2004 | Zheng |
| 6,824,502 | B1 | 11/2004 | Huang |
| 6,825,164 | B1 | 11/2004 | Stern et al. |
| 6,825,876 | B1 | 11/2004 | Easwar et al. |
| 6,827,669 | B2 | 12/2004 | Cohen et al. |
| 6,827,670 | B1 | 12/2004 | Stark et al. |
| 6,827,822 | B2 | 12/2004 | Tao et al. |
| 6,830,538 | B2 | 12/2004 | Eschenbach |
| 6,830,540 | B2 | 12/2004 | Watterson |
| 6,830,541 | B2 | 12/2004 | Wu |
| 6,837,827 | B1 | 1/2005 | Lee et al. |
| 6,837,829 | B2 | 1/2005 | Eschenbach |
| 6,837,830 | B2 | 1/2005 | Eldridge |
| 6,837,838 | B2 | 1/2005 | List |
| 6,840,892 | B1 | 1/2005 | Wu |
| 6,840,904 | B2 | 1/2005 | Goldberg |
| 6,842,928 | B2 | 1/2005 | Yang et al. |
| 6,843,732 | B1 | 1/2005 | Huang |
| 6,846,270 | B1 | 1/2005 | Etnyre |
| 6,846,272 | B2 | 1/2005 | Rosenow et al. |
| 6,849,032 | B2 | 2/2005 | Chu |
| 6,849,034 | B2 | 2/2005 | Eschenbach |
| 6,852,068 | B2 | 2/2005 | Ogawa |
| 6,852,069 | B2 | 2/2005 | Park |
| 6,855,093 | B2 | 2/2005 | Anderson et al. |
| 6,855,097 | B2 | 2/2005 | Krull |
| 6,857,993 | B2 | 2/2005 | Yeh |
| 6,859,215 | B1 | 2/2005 | Brown et al. |
| 6,860,836 | B1 | 3/2005 | Wu |
| 6,860,839 | B1 | 3/2005 | Dice |
| 6,863,641 | B1 | 3/2005 | Brown et al. |
| 6,866,613 | B1 | 3/2005 | Brown et al. |
| 6,872,077 | B2 | 3/2005 | Yeager |
| 6,872,168 | B2 | 3/2005 | Wang et al. |
| 6,872,175 | B2 | 3/2005 | Lin |
| 6,872,187 | B1 | 3/2005 | Stark et al. |
| 6,875,157 | B1 | 4/2005 | Wang |
| 6,875,160 | B2 | 4/2005 | Watterson et al. |
| 6,876,496 | B2 | 4/2005 | French et al. |
| 6,876,947 | B1 | 4/2005 | Darley et al. |
| 6,878,099 | B2 | 4/2005 | Corbalis et al. |
| 6,878,101 | B2 | 4/2005 | Colley |
| 6,878,102 | B1 | 4/2005 | Commisso |
| 6,880,487 | B2 | 4/2005 | Reinkensmeyer et al. |
| 6,881,176 | B2 | 4/2005 | Oishi et al. |
| 6,882,955 | B1 | 4/2005 | Ohlenbusch et al. |
| 6,885,971 | B2 | 4/2005 | Vock et al. |
| 6,886,613 | B1 | 5/2005 | Zahdeh |
| 6,887,185 | B1 | 5/2005 | Kuo |
| 6,887,190 | B1 | 5/2005 | Azari |
| 6,893,383 | B1 | 5/2005 | Chang et al. |
| 6,895,834 | B1 | 5/2005 | Baatz |
| 6,896,645 | B1 | 5/2005 | Krull |
| 6,899,657 | B2 | 5/2005 | Chuang |
| 6,899,659 | B2 | 5/2005 | Anderson et al. |
| 6,902,513 | B1 | 6/2005 | Mcclure |
| 6,902,515 | B2 | 6/2005 | Howell et al. |
| 6,905,440 | B2 | 6/2005 | Heppert |
| 6,905,446 | B2 | 6/2005 | Greenland |
| 6,908,416 | B2 | 6/2005 | Mercado et al. |
| 6,908,417 | B2 | 6/2005 | Jackson |
| 6,913,562 | B2 | 7/2005 | Chen |
| 6,913,563 | B2 | 7/2005 | Chen |
| 6,915,271 | B1 | 7/2005 | Meyer et al. |
| 6,916,278 | B2 | 7/2005 | Webber |
| 6,918,858 | B2 | 7/2005 | Watterson et al. |
| 6,918,859 | B1 | 7/2005 | Yeh |
| 6,918,860 | B1 | 7/2005 | Nusbaum |
| 6,921,351 | B1 | 7/2005 | Hickman et al. |
| 6,921,354 | B1 | 7/2005 | Shifferaw |
| 6,921,355 | B2 | 7/2005 | Campanaro et al. |

(56) References Cited

U.S. PATENT DOCUMENTS

| | | | |
|---|---|---|---|
| 6,923,746 | B1 | 8/2005 | Skowronski et al. |
| 6,923,747 | B1 | 8/2005 | Chu |
| 6,926,644 | B2 | 8/2005 | Chen |
| 6,926,646 | B1 | 8/2005 | Nguyen |
| 6,932,745 | B1 | 8/2005 | Ellis |
| 6,934,658 | B2 | 8/2005 | Clabes et al. |
| 6,936,007 | B2 | 8/2005 | Quy |
| 6,937,289 | B1 | 8/2005 | Ranta et al. |
| 6,939,271 | B1 | 9/2005 | Whan-Tong et al. |
| 6,942,599 | B1 | 9/2005 | Racine |
| 6,944,294 | B2 | 9/2005 | Tsay |
| 6,945,912 | B2 | 9/2005 | Levi |
| 6,945,916 | B2 | 9/2005 | Schroeder |
| 6,945,917 | B1 | 9/2005 | Baatz |
| 6,949,053 | B1 | 9/2005 | Stearns |
| 6,952,221 | B1 | 10/2005 | Holtz et al. |
| 6,953,418 | B1 | 10/2005 | Chen |
| 6,954,261 | B2 | 10/2005 | McClurg |
| 6,955,542 | B2 | 10/2005 | Roncalez et al. |
| 6,960,156 | B2 | 11/2005 | Smith |
| 6,964,632 | B1 | 11/2005 | Ko |
| 6,966,082 | B2 | 11/2005 | Bloemer et al. |
| 6,966,872 | B2 | 11/2005 | Eschenbach |
| 6,971,972 | B1 | 12/2005 | Mcgovern |
| 6,971,973 | B2 | 12/2005 | Cohen et al. |
| 6,971,976 | B2 | 12/2005 | Endelman et al. |
| 6,974,403 | B2 | 12/2005 | Wong et al. |
| 6,974,404 | B1 | 12/2005 | Watterson et al. |
| 6,975,910 | B1 | 12/2005 | Brown et al. |
| 6,976,624 | B2 | 12/2005 | Hsiao |
| 6,976,698 | B2 | 12/2005 | Kuiken |
| 6,976,958 | B2 | 12/2005 | Quy |
| 6,979,283 | B2 | 12/2005 | Pan |
| 6,991,586 | B2 | 1/2006 | Lapcevic |
| 6,991,588 | B1 | 1/2006 | Adams |
| 6,994,306 | B1 | 2/2006 | Sweere et al. |
| 6,994,656 | B2 | 2/2006 | Liao et al. |
| 6,994,657 | B1 | 2/2006 | Eschenbach |
| 6,996,852 | B1 | 2/2006 | Cabrera |
| 6,997,853 | B1 | 2/2006 | Cuskaden et al. |
| 6,997,856 | B1 | 2/2006 | Krull |
| 7,001,288 | B2 | 2/2006 | Harrell |
| 7,003,122 | B2 | 2/2006 | Chen |
| 7,004,271 | B1 | 2/2006 | Kamen et al. |
| 7,004,887 | B2 | 2/2006 | Pan et al. |
| 7,004,888 | B1 | 2/2006 | Weng |
| 7,004,895 | B2 | 2/2006 | Perry |
| 7,008,356 | B2 | 3/2006 | Hung |
| 7,008,359 | B2 | 3/2006 | Fan et al. |
| 7,011,326 | B1 | 3/2006 | Schroeder et al. |
| 7,011,607 | B2 | 3/2006 | Kolda et al. |
| 7,011,609 | B1 | 3/2006 | Kuo |
| 7,015,950 | B1 | 3/2006 | Pryor |
| 7,016,812 | B2 | 3/2006 | Aritsuka et al. |
| 7,020,508 | B2 | 3/2006 | Stivoric |
| 7,022,047 | B2 | 4/2006 | Cohen et al. |
| 7,022,048 | B1 | 4/2006 | Fernandez |
| 7,022,049 | B2 | 4/2006 | Ryan et al. |
| 7,022,051 | B2 | 4/2006 | Ota |
| 7,025,710 | B2 | 4/2006 | Corbalis et al. |
| 7,025,711 | B2 | 4/2006 | Eschenbach |
| 7,032,870 | B2 | 4/2006 | Sweere et al. |
| 7,033,176 | B2 | 4/2006 | Feldman |
| 7,033,305 | B1 | 4/2006 | Stearns |
| 7,033,306 | B2 | 4/2006 | Graber |
| 7,035,936 | B2 | 4/2006 | Fouquet |
| 7,037,241 | B2 | 5/2006 | Kuo |
| 7,038,855 | B2 | 5/2006 | French et al. |
| 7,039,263 | B2 | 5/2006 | Towle |
| 7,041,034 | B1 | 5/2006 | Stearns et al. |
| 7,041,038 | B2 | 5/2006 | Smith |
| 7,041,041 | B1 | 5/2006 | Evans |
| 7,041,049 | B1 | 5/2006 | Raniere |
| 7,044,891 | B1 | 5/2006 | Rivera |
| 7,051,049 | B2 | 5/2006 | Samn |
| 7,052,426 | B2 | 5/2006 | Battat et al. |
| 7,052,440 | B2 | 5/2006 | Pyles et al. |
| 7,052,444 | B2 | 5/2006 | Webber |
| 7,052,446 | B2 | 5/2006 | Morris et al. |
| 7,055,899 | B2 | 6/2006 | Zhurong et al. |
| 7,056,224 | B1 | 6/2006 | Keyes |
| 7,056,265 | B1 | 6/2006 | Shea |
| 7,060,005 | B2 | 6/2006 | Carlsen et al. |
| 7,060,006 | B1 | 6/2006 | Watterson et al. |
| 7,060,008 | B2 | 6/2006 | Watterson et al. |
| 7,060,031 | B2 | 6/2006 | Webb et al. |
| 7,063,644 | B2 | 6/2006 | Albert et al. |
| 7,065,768 | B1 | 6/2006 | Janzig et al. |
| 7,066,865 | B2 | 6/2006 | Radow |
| 7,070,415 | B2 | 7/2006 | Hojo et al. |
| 7,070,539 | B2 | 7/2006 | Brown et al. |
| 7,070,542 | B2 | 7/2006 | Reyes et al. |
| 7,070,545 | B2 | 7/2006 | Lull et al. |
| 7,072,789 | B2 | 7/2006 | Vock et al. |
| 7,073,852 | B1 | 7/2006 | Zheng |
| 7,077,788 | B2 | 7/2006 | Chang |
| 7,077,791 | B2 | 7/2006 | Krull |
| 7,081,073 | B1 | 7/2006 | Smith |
| 7,082,703 | B2 | 8/2006 | Greene et al. |
| 7,083,549 | B1 | 8/2006 | Fan |
| 7,086,993 | B1 | 8/2006 | Maresh |
| 7,086,994 | B2 | 8/2006 | Turak et al. |
| 7,087,001 | B1 | 8/2006 | Ihli |
| 7,090,621 | B2 | 8/2006 | Loane |
| 7,090,622 | B2 | 8/2006 | Hetrick |
| 7,091,635 | B1 | 8/2006 | Gilliland et al. |
| 7,094,184 | B1 | 8/2006 | Chen et al. |
| 7,094,185 | B2 | 8/2006 | Greenland |
| 7,097,591 | B2 | 8/2006 | Moon |
| 7,097,592 | B2 | 8/2006 | Wang |
| 7,097,593 | B2 | 8/2006 | Chang |
| 7,097,600 | B2 | 8/2006 | Gray |
| 7,100,517 | B1 | 9/2006 | Godwin |
| 7,101,319 | B1 | 9/2006 | Potts |
| 7,101,322 | B2 | 9/2006 | Carle |
| 7,101,330 | B2 | 9/2006 | Elbaz et al. |
| 7,104,926 | B2 | 9/2006 | Carlson |
| 7,104,929 | B1 | 9/2006 | Eschenbach |
| 7,104,937 | B2 | 9/2006 | Arbuckle |
| 7,108,641 | B2 | 9/2006 | Pertegaz-Esteban |
| 7,108,644 | B2 | 9/2006 | Clark, III |
| 7,108,659 | B2 | 9/2006 | Ross et al. |
| 7,113,166 | B1 | 9/2006 | Rosenberg et al. |
| 7,115,073 | B2 | 10/2006 | Nizamuddin |
| 7,115,076 | B2 | 10/2006 | Oglesby et al. |
| 7,121,980 | B2 | 10/2006 | Chen |
| 7,125,371 | B2 | 10/2006 | Henderson |
| 7,128,692 | B2 | 10/2006 | Black |
| 7,128,693 | B2 | 10/2006 | Brown et al. |
| 7,132,939 | B2 | 11/2006 | Tyndall et al. |
| 7,137,938 | B2 | 11/2006 | Gottlieb |
| 7,139,835 | B2 | 11/2006 | Fouquet et al. |
| 7,140,626 | B1 | 11/2006 | Keay |
| 7,141,008 | B2 | 11/2006 | Krull et al. |
| 7,148,879 | B2 | 12/2006 | Amento et al. |
| 7,151,214 | B2 | 12/2006 | Barry |
| 7,153,238 | B2 | 12/2006 | Anderson et al. |
| 7,156,776 | B2 | 1/2007 | Maser |
| 7,156,808 | B2 | 1/2007 | Quy |
| 7,156,809 | B2 | 1/2007 | Quy |
| 7,158,938 | B2 | 1/2007 | Labbe et al. |
| 7,163,489 | B1 | 1/2007 | Nelson |
| 7,163,490 | B2 | 1/2007 | Chen |
| 7,163,493 | B1 | 1/2007 | Kuo |
| 7,163,498 | B1 | 1/2007 | Abelbeck |
| 7,163,500 | B2 | 1/2007 | Endelman et al. |
| 7,166,062 | B1 | 1/2007 | Watterson et al. |
| 7,166,064 | B2 | 1/2007 | Watterson et al. |
| 7,166,067 | B2 | 1/2007 | Talish et al. |
| 7,168,668 | B2 | 1/2007 | Coyle |
| 7,169,087 | B2 | 1/2007 | Ercanbrack et al. |
| 7,169,088 | B2 | 1/2007 | Rodgers, Jr. |
| 7,169,089 | B2 | 1/2007 | Rodgers, Jr. |
| 7,169,090 | B1 | 1/2007 | Maresh |

(56) References Cited

U.S. PATENT DOCUMENTS

| | | | |
|---|---|---|---|
| 7,169,093 | B2 | 1/2007 | Simonson et al. |
| 7,170,016 | B2 | 1/2007 | Dumornay |
| 7,171,331 | B2 | 1/2007 | Vock et al. |
| 7,172,531 | B2 | 2/2007 | Rodgers, Jr. |
| 7,175,193 | B2 | 2/2007 | Wu |
| 7,179,205 | B2 | 2/2007 | Schmidt |
| 7,179,207 | B2 | 2/2007 | Gerschefske |
| 7,179,208 | B1 | 2/2007 | Nalley |
| 7,179,209 | B2 | 2/2007 | Sechrest et al. |
| 7,182,714 | B2 | 2/2007 | Moon |
| 7,182,738 | B2 | 2/2007 | Bonutti et al. |
| 7,186,189 | B2 | 3/2007 | Huang |
| 7,186,270 | B2 | 3/2007 | Elkins |
| 7,187,961 | B2 | 3/2007 | Yamashita et al. |
| 7,188,439 | B2 | 3/2007 | DiBenedetto et al. |
| 7,191,383 | B2 | 3/2007 | Lin et al. |
| 7,192,387 | B2 | 3/2007 | Mendel |
| 7,192,388 | B2 | 3/2007 | Dalebout et al. |
| 7,195,568 | B2 | 3/2007 | Huang |
| 7,197,029 | B1 | 3/2007 | Osterhout et al. |
| 7,198,590 | B1 | 4/2007 | Nicholas |
| 7,200,517 | B2 | 4/2007 | Darley et al. |
| 7,201,705 | B2 | 4/2007 | Rodgers, Jr. |
| 7,201,706 | B1 | 4/2007 | Lee |
| 7,201,707 | B1 | 4/2007 | Moon |
| 7,204,041 | B1 | 4/2007 | Bailey, Sr. et al. |
| 7,204,328 | B2 | 4/2007 | LoPresti |
| 7,207,925 | B2 | 4/2007 | Moon |
| 7,207,930 | B2 | 4/2007 | Bonutti |
| 7,211,029 | B2 | 5/2007 | Kau |
| 7,214,167 | B2 | 5/2007 | Stearns |
| 7,214,168 | B2 | 5/2007 | Rodgers |
| 7,217,225 | B2 | 5/2007 | Husted et al. |
| 7,220,219 | B2 | 5/2007 | Papadopoulos et al. |
| 7,220,221 | B2 | 5/2007 | Mosimann et al. |
| 7,223,209 | B2 | 5/2007 | Lee |
| 7,223,213 | B2 | 5/2007 | Golesh |
| 7,223,216 | B1 | 5/2007 | McBride |
| 7,224,326 | B2 | 5/2007 | Sefton |
| 7,225,282 | B1 | 5/2007 | Lyle |
| 7,225,565 | B2 | 6/2007 | DiBenedetto et al. |
| 7,225,694 | B2 | 6/2007 | Said |
| 7,226,394 | B2 | 6/2007 | Johnson |
| 7,226,399 | B2 | 6/2007 | Lanoue |
| 7,226,402 | B1 | 6/2007 | Joya |
| 7,235,942 | B2 | 6/2007 | Nagaoka et al. |
| 7,236,154 | B1 | 6/2007 | Kerr et al. |
| 7,238,146 | B1 | 7/2007 | Chen |
| 7,238,147 | B2 | 7/2007 | Mills et al. |
| 7,244,217 | B2 | 7/2007 | Rodgers, Jr. |
| 7,247,128 | B2 | 7/2007 | Oga |
| 7,250,022 | B2 | 7/2007 | Dalebout |
| 7,252,627 | B2 | 8/2007 | Carter |
| 7,254,516 | B2 | 8/2007 | Case, Jr. et al. |
| 7,257,468 | B1 | 8/2007 | Costa et al. |
| 7,258,651 | B2 | 8/2007 | Clarke |
| 7,259,906 | B1 | 8/2007 | Islam |
| 7,264,554 | B2 | 9/2007 | Bentley |
| 7,264,576 | B2 | 9/2007 | Gerschefske et al. |
| 7,267,638 | B2 | 9/2007 | Wang |
| 7,269,038 | B2 | 9/2007 | Shekhawat |
| 7,270,625 | B2 | 9/2007 | Miller |
| RE39,904 | E | 10/2007 | Lee |
| 7,276,017 | B2 | 10/2007 | Lin |
| 7,278,934 | B2 | 10/2007 | McBride et al. |
| 7,278,955 | B2 | 10/2007 | Giannelli et al. |
| 7,278,958 | B2 | 10/2007 | Morgan |
| 7,278,966 | B2 | 10/2007 | Hjelt et al. |
| 7,279,868 | B2 | 10/2007 | Lanni |
| 7,285,075 | B2 | 10/2007 | Cutler et al. |
| 7,285,090 | B2 | 10/2007 | Stivoric et al. |
| 7,287,770 | B2 | 10/2007 | Drabant et al. |
| 7,290,760 | B1 | 11/2007 | Lindsay |
| 7,291,096 | B2 | 11/2007 | Ho |
| 7,292,151 | B2 | 11/2007 | Ferguson |
| 7,293,510 | B1 | 11/2007 | Siao |
| 7,294,094 | B1 | 11/2007 | Howle |
| 7,294,095 | B2 | 11/2007 | Charnitski |
| 7,294,100 | B2 | 11/2007 | Bull |
| 7,303,508 | B2 | 12/2007 | Toyama et al. |
| 7,303,510 | B2 | 12/2007 | Gebhardt |
| 7,308,818 | B2 | 12/2007 | Considine et al. |
| 7,311,640 | B2 | 12/2007 | Baatz |
| 7,316,632 | B2 | 1/2008 | Rodgers |
| 7,316,633 | B2 | 1/2008 | Liao et al. |
| 7,319,457 | B2 | 1/2008 | Lin et al. |
| 7,322,907 | B2 | 1/2008 | Bowser |
| 7,328,119 | B1 | 2/2008 | Pryor |
| 7,329,684 | B2 | 2/2008 | Mjalli et al. |
| 7,334,350 | B2 | 2/2008 | Ellis, III |
| 7,335,139 | B2 | 2/2008 | Bartholomew et al. |
| 7,335,140 | B2 | 2/2008 | Webber et al. |
| 7,335,147 | B2 | 2/2008 | Jones |
| 7,336,178 | B2 | 2/2008 | Le |
| 7,341,542 | B2 | 3/2008 | Ohrt et al. |
| 7,344,481 | B2 | 3/2008 | Watterson et al. |
| 7,346,935 | B1 | 3/2008 | Patterson |
| 7,347,806 | B2 | 3/2008 | Nakano et al. |
| 7,350,787 | B2 | 4/2008 | Voss |
| 7,351,187 | B2 | 4/2008 | Seliber |
| 7,352,365 | B2 | 4/2008 | Trachte |
| 7,354,380 | B2 | 4/2008 | Volpe, Jr. |
| 7,357,756 | B2 | 4/2008 | Demas |
| 7,357,758 | B2 | 4/2008 | Polk, III |
| 7,359,121 | B2 | 4/2008 | French et al. |
| 7,361,122 | B2 | 4/2008 | Porth |
| 7,361,125 | B2 | 4/2008 | Webber et al. |
| 7,364,538 | B2 | 4/2008 | Aucamp |
| 7,365,647 | B2 | 4/2008 | Nativ |
| 7,366,921 | B2 | 4/2008 | Ranganathan |
| 7,367,925 | B2 | 5/2008 | Hsu |
| 7,367,926 | B2 | 5/2008 | Clark |
| 7,369,121 | B2 | 5/2008 | Lane |
| 7,372,485 | B1 | 5/2008 | Bodnar et al. |
| 7,373,510 | B2 | 5/2008 | Lamberton et al. |
| 7,373,820 | B1 | 5/2008 | James |
| 7,374,519 | B2 | 5/2008 | Naidus |
| 7,374,522 | B2 | 5/2008 | Arnold |
| 7,375,450 | B2 | 5/2008 | Tanaka et al. |
| 7,377,879 | B1 | 5/2008 | Lin |
| 7,377,881 | B2 | 5/2008 | Moon |
| 7,383,081 | B2 | 6/2008 | Butt et al. |
| 7,384,013 | B2 | 6/2008 | Yen |
| 7,393,308 | B1 | 7/2008 | Huang |
| 7,398,151 | B1 | 7/2008 | Burrell et al. |
| 7,401,918 | B2 | 7/2008 | Howell et al. |
| 7,402,125 | B2 | 7/2008 | Wang |
| 7,402,145 | B1 | 7/2008 | Woggon |
| 7,412,206 | B1 | 8/2008 | Hutchings et al. |
| 7,413,532 | B1 | 8/2008 | Monsrud et al. |
| 7,416,537 | B1 | 8/2008 | Stark et al. |
| 7,418,862 | B2 | 9/2008 | Gruben et al. |
| 7,425,188 | B2 | 9/2008 | Ercanbrack |
| 7,425,189 | B1 | 9/2008 | Eschenbach |
| 7,428,760 | B2 | 9/2008 | McCrimmon |
| 7,429,236 | B2 | 9/2008 | Dalebout et al. |
| 7,432,184 | B2 | 10/2008 | Hosokawa et al. |
| 7,432,454 | B1 | 10/2008 | Sze et al. |
| 7,432,677 | B2 | 10/2008 | Heydt et al. |
| 7,435,202 | B2 | 10/2008 | Daly et al. |
| 7,435,205 | B2 | 10/2008 | Reyes et al. |
| 7,438,670 | B2 | 10/2008 | Gray et al. |
| 7,438,673 | B1 | 10/2008 | Jones |
| 7,452,336 | B2 | 11/2008 | Thompson |
| 7,454,002 | B1 | 11/2008 | Gardner et al. |
| 7,455,621 | B1 | 11/2008 | Anthony |
| 7,455,622 | B2 | 11/2008 | Watterson et al. |
| 7,455,624 | B2 | 11/2008 | Liao Lai |
| 7,455,626 | B2 | 11/2008 | Trevino et al. |
| 7,455,628 | B1 | 11/2008 | Stearns |
| 7,462,134 | B2 | 12/2008 | Lull et al. |
| 7,462,135 | B2 | 12/2008 | Lo |
| 7,462,141 | B1 | 12/2008 | Raboin et al. |
| 7,465,257 | B1 | 12/2008 | Morgan, Jr. |

(56) References Cited

U.S. PATENT DOCUMENTS

| | | | |
|---|---|---|---|
| 7,468,021 | B2 | 12/2008 | Moon |
| 7,470,234 | B1 | 12/2008 | Elhag et al. |
| 7,475,613 | B2 | 1/2009 | Bailey |
| 7,477,890 | B1 | 1/2009 | Naryanaswami |
| 7,479,093 | B1 | 1/2009 | Immordino et al. |
| 7,480,512 | B2 | 1/2009 | Graham et al. |
| 7,485,072 | B2 | 2/2009 | Chuang |
| 7,488,277 | B1 | 2/2009 | Knapp |
| 7,489,979 | B2 | 2/2009 | Rosenberg |
| 7,491,159 | B2 | 2/2009 | Patterson |
| 7,494,447 | B2 | 2/2009 | Eschenbach |
| 7,494,448 | B2 | 2/2009 | Eschenbach |
| 7,494,450 | B2 | 2/2009 | Solomon |
| 7,497,784 | B2 | 3/2009 | Henry |
| 7,503,476 | B2 | 3/2009 | Bhavnani |
| 7,503,878 | B1 | 3/2009 | Amsbury et al. |
| 7,507,183 | B2 | 3/2009 | Anderson |
| 7,507,184 | B2 | 3/2009 | Rodgers, Jr. |
| 7,507,186 | B2 | 3/2009 | Stearns |
| 7,507,187 | B2 | 3/2009 | Dyer et al. |
| 7,507,189 | B2 | 3/2009 | Heibert et al. |
| 7,507,190 | B2 | 3/2009 | Piane, Jr. |
| 7,510,509 | B2 | 3/2009 | Hickman |
| 7,510,511 | B2 | 3/2009 | Von Detten |
| 7,513,853 | B1 | 4/2009 | Russ |
| 7,513,854 | B1 | 4/2009 | Stearns |
| 7,513,855 | B1 | 4/2009 | Yeh |
| 7,517,303 | B2 | 4/2009 | Crawford et al. |
| 7,519,327 | B2 | 4/2009 | White |
| 7,519,537 | B2 | 4/2009 | Rosenberg |
| 7,520,839 | B2 | 4/2009 | Rodgers |
| 7,520,840 | B2 | 4/2009 | Shifferaw |
| 7,521,623 | B2 | 4/2009 | Bowen |
| 7,524,272 | B2 | 4/2009 | Bruck et al. |
| 7,525,293 | B1 | 4/2009 | Notohamiprodjo et al. |
| 7,530,926 | B2 | 5/2009 | Rodgers, Jr. |
| 7,532,977 | B2 | 5/2009 | Chen |
| 7,534,206 | B1 | 5/2009 | Lovitt et al. |
| 7,537,546 | B2 | 5/2009 | Watterson et al. |
| 7,537,549 | B2 | 5/2009 | Nelson et al. |
| 7,537,550 | B1 | 5/2009 | Krull |
| 7,537,552 | B2 | 5/2009 | Dalebout et al. |
| 7,539,487 | B2 | 5/2009 | Sinclair et al. |
| 7,540,828 | B2 | 6/2009 | Watterson et al. |
| 7,540,829 | B1 | 6/2009 | Lin |
| 7,542,040 | B2 | 6/2009 | Templeman |
| 7,542,816 | B2 | 6/2009 | Rosenberg |
| 7,543,934 | B2 | 6/2009 | Howell et al. |
| 7,544,153 | B2 | 6/2009 | Trevino et al. |
| 7,547,267 | B1 | 6/2009 | Wang |
| 7,549,947 | B2 | 6/2009 | Hickman et al. |
| 7,553,260 | B2 | 6/2009 | Piaget et al. |
| 7,553,262 | B2 | 6/2009 | Piane, Jr. |
| 7,556,590 | B2 | 7/2009 | Watterson et al. |
| 7,556,591 | B2 | 7/2009 | Chuang |
| 7,559,879 | B2 | 7/2009 | Anderson et al. |
| 7,561,989 | B2 | 7/2009 | Banks et al. |
| 7,562,117 | B2 | 7/2009 | Rosenberg |
| 7,563,203 | B2 | 7/2009 | Dalebout et al. |
| 7,563,205 | B2 | 7/2009 | Alling |
| 7,569,000 | B2 | 8/2009 | Wang |
| 7,569,004 | B2 | 8/2009 | Kolomeir |
| 7,575,536 | B1 | 8/2009 | Hickman |
| 7,575,537 | B2 | 8/2009 | Ellis |
| 7,575,538 | B1 | 8/2009 | Clark |
| 7,577,522 | B2 | 8/2009 | Rosenberg |
| 7,578,770 | B2 | 8/2009 | Kuivala |
| 7,579,946 | B2 | 8/2009 | Case, Jr. |
| 7,585,251 | B2 | 9/2009 | Doody, Jr. et al. |
| 7,585,254 | B1 | 9/2009 | Vittone |
| 7,585,258 | B2 | 9/2009 | Watson et al. |
| 7,586,032 | B2 | 9/2009 | Louis |
| 7,591,761 | B1 | 9/2009 | Ellis |
| 7,591,770 | B2 | 9/2009 | Stewart et al. |
| 7,591,795 | B2 | 9/2009 | Whalen et al. |
| 7,594,877 | B2 | 9/2009 | Anderson et al. |
| 7,594,878 | B1 | 9/2009 | Joannou |
| 7,594,879 | B2 | 9/2009 | Johnson |
| 7,598,255 | B2 | 10/2009 | Dvorak |
| 7,601,096 | B2 | 10/2009 | Negrin |
| 7,601,097 | B2 | 10/2009 | Miyamaru et al. |
| 7,601,101 | B2 | 10/2009 | Jackson et al. |
| 7,602,301 | B1 | 10/2009 | Stirling et al. |
| 7,603,255 | B2 | 10/2009 | Case, Jr. et al. |
| 7,604,571 | B2 | 10/2009 | Wilkins et al. |
| 7,604,572 | B2 | 10/2009 | Stanford |
| 7,604,573 | B2 | 10/2009 | Dalebout et al. |
| 7,607,243 | B2 | 10/2009 | Berner, Jr. et al. |
| 7,608,015 | B2 | 10/2009 | Radow |
| 7,608,018 | B2 | 10/2009 | Chuang |
| 7,608,019 | B1 | 10/2009 | Stearns |
| 7,608,021 | B1 | 10/2009 | Nalley |
| 7,608,023 | B2 | 10/2009 | Casagrande |
| 7,611,446 | B2 | 11/2009 | Chuang |
| 7,614,639 | B2 | 11/2009 | Tholkes et al. |
| 7,614,981 | B2 | 11/2009 | Cao |
| 7,616,097 | B1 | 11/2009 | Whang |
| 7,618,345 | B2 | 11/2009 | Corbalis et al. |
| 7,618,346 | B2 | 11/2009 | Crawford et al. |
| 7,618,350 | B2 | 11/2009 | Dalebout et al. |
| 7,618,351 | B2 | 11/2009 | Kwon |
| 7,619,514 | B1 | 11/2009 | Stone |
| 7,621,850 | B2 | 11/2009 | Piaget et al. |
| 7,621,855 | B1 | 11/2009 | Krull |
| 7,625,315 | B2 | 12/2009 | Hickman |
| 7,625,316 | B1 | 12/2009 | Amsbury et al. |
| 7,625,320 | B2 | 12/2009 | Wehrell |
| 7,625,323 | B1 | 12/2009 | Lin |
| 7,628,730 | B1 | 12/2009 | Watterson et al. |
| 7,628,732 | B1 | 12/2009 | Porszasz et al. |
| 7,628,737 | B2 | 12/2009 | Kowallis et al. |
| 7,631,382 | B2 | 12/2009 | DiBenedetto et al. |
| 7,632,220 | B2 | 12/2009 | Nelson et al. |
| 7,637,847 | B1 | 12/2009 | Hickman |
| 7,637,850 | B2 | 12/2009 | Lin |
| 7,639,520 | B1 | 12/2009 | Zansky et al. |
| 7,641,592 | B2 | 1/2010 | Roche |
| 7,641,598 | B2 | 1/2010 | Rodgers, Jr. |
| 7,643,895 | B2 | 1/2010 | Gupta et al. |
| 7,645,212 | B2 | 1/2010 | Ashby et al. |
| 7,645,213 | B2 | 1/2010 | Watterson |
| 7,645,214 | B2 | 1/2010 | Lull |
| 7,645,215 | B2 | 1/2010 | Gordon |
| 7,645,218 | B2 | 1/2010 | Potok et al. |
| 7,647,196 | B2 | 1/2010 | Kahn et al. |
| 7,648,443 | B2 | 1/2010 | Schenk |
| 7,648,446 | B2 | 1/2010 | Chiles et al. |
| 7,648,463 | B1 | 1/2010 | Elhag et al. |
| 7,648,858 | B2 | 1/2010 | Tang et al. |
| 7,651,442 | B2 | 1/2010 | Carlson |
| 7,651,450 | B2 | 1/2010 | Wehrell |
| 7,654,229 | B2 | 2/2010 | Smith |
| 7,654,948 | B2 | 2/2010 | Kaplan et al. |
| 7,658,694 | B2 | 2/2010 | Ungari |
| 7,658,695 | B1 | 2/2010 | Amsbury et al. |
| 7,658,698 | B2 | 2/2010 | Pacheco et al. |
| 7,662,065 | B1 | 2/2010 | Kahn et al. |
| 7,662,282 | B2 | 2/2010 | Lee et al. |
| 7,665,388 | B2 | 2/2010 | Lin |
| 7,670,263 | B2 | 3/2010 | Ellis |
| 7,674,205 | B2 | 3/2010 | Dalebout et al. |
| 7,674,206 | B2 | 3/2010 | Jones |
| 7,676,332 | B2 | 3/2010 | Damen |
| 7,677,518 | B2 | 3/2010 | Chouinard et al. |
| 7,677,723 | B2 | 3/2010 | Howell et al. |
| 7,678,023 | B1 | 3/2010 | Shea |
| 7,678,025 | B2 | 3/2010 | Rodgers, Jr. |
| 7,682,286 | B2 | 3/2010 | Badarneh et al. |
| 7,682,287 | B1 | 3/2010 | Hsieh |
| 7,682,288 | B1 | 3/2010 | Stearns |
| 7,682,289 | B2 | 3/2010 | Chen |
| 7,682,290 | B2 | 3/2010 | Liao et al. |
| 7,682,291 | B2 | 3/2010 | Gill et al. |
| 7,683,252 | B2 | 3/2010 | Oliver et al. |

(56) References Cited

U.S. PATENT DOCUMENTS

| | | | |
|---|---|---|---|
| 7,689,437 | B1 | 3/2010 | Teller et al. |
| 7,690,556 | B1 | 4/2010 | Kahn et al. |
| 7,691,031 | B2 | 4/2010 | Toyama et al. |
| 7,695,409 | B2 | 4/2010 | Helie et al. |
| 7,698,101 | B2 | 4/2010 | Alten et al. |
| 7,698,359 | B2 | 4/2010 | Wray et al. |
| 7,699,752 | B1 | 4/2010 | Anderson |
| 7,699,753 | B2 | 4/2010 | Daikeler |
| 7,699,754 | B2 | 4/2010 | Schneider |
| 7,699,755 | B2 | 4/2010 | Feldman et al. |
| 7,702,781 | B2 | 4/2010 | Devolites |
| 7,703,974 | B2 | 4/2010 | Bouille |
| 7,704,191 | B2 | 4/2010 | Smith et al. |
| 7,704,192 | B2 | 4/2010 | Dyer et al. |
| 7,705,230 | B2 | 4/2010 | Bowen |
| 7,708,668 | B2 | 5/2010 | Rodgers, Jr. |
| 7,708,672 | B2 | 5/2010 | Gibson et al. |
| 7,713,171 | B1 | 5/2010 | Hickman |
| 7,713,172 | B2 | 5/2010 | Watterson et al. |
| 7,713,177 | B2 | 5/2010 | Lo |
| 7,717,825 | B2 | 5/2010 | Van Der Hoeven |
| 7,717,826 | B2 | 5/2010 | Cox et al. |
| 7,717,827 | B2 | 5/2010 | Kurunmäki et al. |
| 7,717,828 | B2 | 5/2010 | Simonson et al. |
| 7,717,830 | B1 | 5/2010 | Charniga et al. |
| 7,717,866 | B2 | 5/2010 | Damen |
| 7,722,503 | B1 | 5/2010 | Smith et al. |
| 7,722,505 | B2 | 5/2010 | Liao et al. |
| 7,722,509 | B2 | 5/2010 | Eder |
| 7,725,362 | B2 | 5/2010 | Weathers, Jr. |
| 7,727,117 | B2 | 6/2010 | Feldman et al. |
| 7,727,120 | B2 | 6/2010 | Smith |
| 7,727,125 | B2 | 6/2010 | Day |
| 7,728,214 | B2 | 6/2010 | Oliver et al. |
| 7,731,634 | B2 | 6/2010 | Stewart et al. |
| 7,731,635 | B2 | 6/2010 | Dyer |
| 7,736,272 | B2 | 6/2010 | Martens |
| 7,736,273 | B2 | 6/2010 | Cox et al. |
| 7,736,278 | B2 | 6/2010 | Lull et al. |
| 7,736,279 | B2 | 6/2010 | Dalebout et al. |
| 7,736,280 | B2 | 6/2010 | Weier et al. |
| 7,736,281 | B2 | 6/2010 | Corbalis et al. |
| 7,739,076 | B1 | 6/2010 | Vock et al. |
| 7,740,562 | B2 | 6/2010 | Jones |
| 7,740,563 | B2 | 6/2010 | Dalebout et al. |
| 7,740,588 | B1 | 6/2010 | Sciarra |
| 7,745,716 | B1 | 6/2010 | Murphy |
| 7,747,671 | B2 | 6/2010 | Ku |
| 7,749,137 | B2 | 7/2010 | Watt et al. |
| 7,753,824 | B2 | 7/2010 | Wang |
| 7,753,825 | B2 | 7/2010 | Jaquish et al. |
| 7,753,830 | B1 | 7/2010 | Marsh et al. |
| 7,753,861 | B1 | 7/2010 | Kahn et al. |
| 7,758,469 | B2 | 7/2010 | Dyer et al. |
| 7,758,523 | B2 | 7/2010 | Collings et al. |
| 7,761,300 | B2 | 7/2010 | Klingler |
| 7,762,931 | B2 | 7/2010 | Fisher et al. |
| 7,762,934 | B1 | 7/2010 | Munson, Jr. et al. |
| 7,762,952 | B2 | 7/2010 | Lee et al. |
| 7,764,990 | B2 | 7/2010 | Martikka et al. |
| 7,765,348 | B2 | 7/2010 | Dybsetter |
| 7,766,794 | B2 | 8/2010 | Oliver et al. |
| 7,766,797 | B2 | 8/2010 | Dalebout |
| 7,766,798 | B2 | 8/2010 | Hamilton |
| 7,770,181 | B2 | 8/2010 | Snover et al. |
| 7,771,319 | B1 | 8/2010 | Lannon |
| 7,771,320 | B2 | 8/2010 | Riley et al. |
| 7,771,325 | B2 | 8/2010 | Baker |
| 7,771,329 | B2 | 8/2010 | Dalebout et al. |
| 7,775,128 | B2 | 8/2010 | Roessingh et al. |
| 7,775,936 | B2 | 8/2010 | Wilkinson |
| 7,775,940 | B2 | 8/2010 | Dalebout et al. |
| 7,775,943 | B2 | 8/2010 | Vittone |
| 7,775,947 | B2 | 8/2010 | Towley, III et al. |
| 7,780,578 | B2 | 8/2010 | Packham |
| 7,780,583 | B2 | 8/2010 | Brown |
| 7,785,235 | B2 | 8/2010 | Lull et al. |
| 7,789,800 | B1 | 9/2010 | Watterson et al. |
| 7,794,014 | B2 | 9/2010 | Beall et al. |
| 7,794,361 | B2 | 9/2010 | Wang |
| 7,794,363 | B2 | 9/2010 | Wang |
| 7,795,824 | B2 | 9/2010 | Shen et al. |
| 7,798,942 | B2 | 9/2010 | Digiulio |
| 7,803,096 | B2 | 9/2010 | Mehta |
| 7,805,149 | B2 | 9/2010 | Werner et al. |
| 7,806,780 | B1 | 10/2010 | Plunkett |
| 7,806,805 | B2 | 10/2010 | Barufka et al. |
| 7,806,806 | B2 | 10/2010 | Jaquish |
| 7,806,807 | B2 | 10/2010 | Genua |
| 7,806,815 | B2 | 10/2010 | Fernandez |
| 7,809,153 | B2 | 10/2010 | Bravomalo et al. |
| 7,811,200 | B2 | 10/2010 | Lai |
| 7,811,201 | B1 | 10/2010 | Mikan et al. |
| 7,811,206 | B2 | 10/2010 | Chuang |
| 7,811,207 | B2 | 10/2010 | Stearns |
| 7,811,209 | B2 | 10/2010 | Crawford et al. |
| 7,813,715 | B2 | 10/2010 | McKillop et al. |
| 7,815,549 | B2 | 10/2010 | Crawford et al. |
| 7,815,550 | B2 | 10/2010 | Watterson et al. |
| 7,815,554 | B2 | 10/2010 | Gibson et al. |
| 7,822,547 | B2 | 10/2010 | Lindroos |
| 7,824,314 | B2 | 11/2010 | Maresh |
| 7,825,319 | B2 | 11/2010 | Turner |
| 7,827,000 | B2 | 11/2010 | Stirling et al. |
| 7,830,570 | B2 | 11/2010 | Morita et al. |
| 7,833,129 | B2 | 11/2010 | Badarneh |
| 7,833,135 | B2 | 11/2010 | Radow |
| 7,837,161 | B2 | 11/2010 | Chase |
| 7,837,595 | B2 | 11/2010 | Rice |
| 7,837,596 | B2 | 11/2010 | Astilean |
| 7,837,599 | B2 | 11/2010 | Kowalczewski et al. |
| 7,839,058 | B1 | 11/2010 | Churchill et al. |
| 7,840,346 | B2 | 11/2010 | Huhtala et al. |
| 7,841,967 | B1 | 11/2010 | Kahn |
| 7,841,968 | B1 | 11/2010 | Eschenbach |
| 7,846,067 | B2 | 12/2010 | Hanoun |
| 7,846,070 | B2 | 12/2010 | Oglesby et al. |
| 7,846,071 | B2 | 12/2010 | Fenster et al. |
| 7,846,080 | B2 | 12/2010 | Boren |
| 7,854,669 | B2 | 12/2010 | Marty et al. |
| 7,854,691 | B2 | 12/2010 | Long et al. |
| 7,857,731 | B2 | 12/2010 | Hickman et al. |
| 7,857,732 | B2 | 12/2010 | Nielson |
| 7,862,476 | B2 | 1/2011 | Radow |
| 7,862,478 | B2 | 1/2011 | Watterson et al. |
| 7,862,483 | B2 | 1/2011 | Hendrickson et al. |
| 7,867,088 | B2 | 1/2011 | Prum |
| 7,871,355 | B2 | 1/2011 | Yeh |
| 7,871,356 | B2 | 1/2011 | Smith |
| 7,871,357 | B2 | 1/2011 | Gibson et al. |
| 7,874,957 | B2 | 1/2011 | Hurwitz et al. |
| 7,874,963 | B2 | 1/2011 | Grind |
| 7,878,950 | B1 | 2/2011 | Bastian |
| 7,878,951 | B2 | 2/2011 | Roman et al. |
| 7,883,448 | B2 | 2/2011 | Wang |
| 7,883,451 | B2 | 2/2011 | Hand |
| 7,887,465 | B2 | 2/2011 | Uffelman |
| 7,892,148 | B1 | 2/2011 | Stauffer et al. |
| 7,892,149 | B2 | 2/2011 | Wu |
| 7,892,150 | B1 | 2/2011 | Colley |
| 7,894,177 | B2 | 2/2011 | Rothkopf |
| 7,894,849 | B2 | 2/2011 | Kass et al. |
| 7,896,782 | B2 | 3/2011 | Tamari |
| 7,901,292 | B1 | 3/2011 | Uhlir et al. |
| 7,901,323 | B2 | 3/2011 | Olason et al. |
| 7,901,325 | B2 | 3/2011 | Henderson |
| 7,908,981 | B2 | 3/2011 | Agee |
| 7,909,739 | B2 | 3/2011 | Kwon et al. |
| 7,909,740 | B2 | 3/2011 | Dalebout et al. |
| 7,909,741 | B2 | 3/2011 | Kim et al. |
| 7,913,297 | B2 | 3/2011 | Wyld |
| 7,914,420 | B2 | 3/2011 | Daly et al. |
| 7,914,421 | B2 | 3/2011 | Weier et al. |
| 7,914,425 | B2 | 3/2011 | Hanoun |

(56) References Cited

U.S. PATENT DOCUMENTS

| | | | |
|---|---|---|---|
| 7,914,468 | B2 | 3/2011 | Shalon et al. |
| 7,917,148 | B2 | 3/2011 | Rosenberg |
| 7,918,732 | B2 | 4/2011 | Van Noland |
| 7,918,766 | B2 | 4/2011 | Lu et al. |
| 7,919,950 | B2 | 4/2011 | Uno et al. |
| 7,922,625 | B2 | 4/2011 | Grind |
| 7,922,635 | B2 | 4/2011 | Weier et al. |
| 7,927,253 | B2 | 4/2011 | Vincent |
| 7,927,258 | B2 | 4/2011 | Irving et al. |
| 7,931,563 | B2 | 4/2011 | Shaw et al. |
| 7,934,983 | B1 | 5/2011 | Eisner |
| 7,938,751 | B2 | 5/2011 | Nicolas et al. |
| 7,938,752 | B1 | 5/2011 | Wang |
| 7,938,755 | B1 | 5/2011 | Dyer et al. |
| 7,942,783 | B2 | 5/2011 | Ochi |
| 7,942,787 | B2 | 5/2011 | Ohrt et al. |
| 7,942,788 | B2 | 5/2011 | Wu |
| 7,946,959 | B2 | 5/2011 | Shum et al. |
| 7,946,961 | B2 | 5/2011 | Blum et al. |
| 7,946,962 | B2 | 5/2011 | Long |
| 7,946,968 | B2 | 5/2011 | Kjellberg |
| 7,949,295 | B2 | 5/2011 | Kumar et al. |
| 7,950,297 | B2 | 5/2011 | Moore et al. |
| 7,951,046 | B1 | 5/2011 | Barber, Jr. |
| 7,951,048 | B1 | 5/2011 | Hsiung |
| 7,953,549 | B2 | 5/2011 | Graham et al. |
| 7,955,219 | B2 | 6/2011 | Birrell et al. |
| 7,955,225 | B1 | 6/2011 | James |
| 7,955,234 | B1 | 6/2011 | Pursley |
| 7,959,124 | B2 | 6/2011 | Phifer |
| 7,959,567 | B2 | 6/2011 | Stivoric et al. |
| 7,963,889 | B2 | 6/2011 | Badarneh et al. |
| 7,967,709 | B2 | 6/2011 | Emura |
| 7,967,728 | B2 | 6/2011 | Zavadsky |
| 7,967,736 | B2 | 6/2011 | D'Silva et al. |
| 7,968,574 | B2 | 6/2011 | Hangauer, Jr. |
| 7,972,245 | B2 | 7/2011 | Temple et al. |
| 7,972,247 | B2 | 7/2011 | Daikeler |
| 7,972,249 | B1 | 7/2011 | Napalan |
| 7,973,231 | B2 | 7/2011 | Bowen |
| 7,974,889 | B2 | 7/2011 | Raimbeault |
| 7,976,437 | B1 | 7/2011 | Von Detten |
| 7,976,518 | B2 | 7/2011 | Shaughnessy et al. |
| 7,980,996 | B2 | 7/2011 | Hickman |
| 7,981,000 | B2 | 7/2011 | Watterson et al. |
| 7,981,015 | B2 | 7/2011 | Reed |
| 7,985,164 | B2 | 7/2011 | Ashby |
| 7,985,165 | B1 | 7/2011 | Lin et al. |
| 7,988,598 | B2 | 8/2011 | Trzecieski |
| 7,988,599 | B2 | 8/2011 | Ainsworth et al. |
| 7,988,600 | B2 | 8/2011 | Rodgers, Jr. |
| 7,993,251 | B1 | 8/2011 | Webber et al. |
| 8,001,472 | B2 | 8/2011 | Gilley et al. |
| 8,002,671 | B1 | 8/2011 | Vigilia |
| 8,002,674 | B2 | 8/2011 | Piaget et al. |
| 8,002,684 | B2 | 8/2011 | Laurent |
| 8,007,409 | B2 | 8/2011 | Elllis |
| RE42,698 | E | 9/2011 | Kuo et al. |
| 8,012,064 | B2 | 9/2011 | Martens |
| 8,012,067 | B2 | 9/2011 | Joannou |
| 8,012,068 | B1 | 9/2011 | Malcolm |
| 8,012,073 | B2 | 9/2011 | Barnett |
| 8,021,270 | B2 | 9/2011 | D Eredita |
| 8,021,275 | B2 | 9/2011 | Rodgers, Jr. |
| 8,021,277 | B2 | 9/2011 | Baudhuin |
| 8,025,607 | B2 | 9/2011 | Ranky et al. |
| 8,025,609 | B2 | 9/2011 | Giannelli et al. |
| 8,025,610 | B2 | 9/2011 | Chang |
| 8,025,612 | B1 | 9/2011 | Buzzanco |
| 8,028,443 | B2 | 10/2011 | Case, Jr. |
| 8,029,415 | B2 | 10/2011 | Ashby et al. |
| 8,033,959 | B2 | 10/2011 | Oleson et al. |
| 8,033,961 | B2 | 10/2011 | Kuo |
| 8,034,294 | B1 | 10/2011 | Goldberg |
| 8,037,017 | B2 | 10/2011 | Samn |
| 8,038,577 | B2 | 10/2011 | Mcintosh |
| 8,040,758 | B1 | 10/2011 | Dickinson |
| 8,043,173 | B2 | 10/2011 | Menalagha et al. |
| 8,046,803 | B1 | 10/2011 | Lee |
| 8,047,965 | B2 | 11/2011 | Shea |
| 8,047,966 | B2 | 11/2011 | Dorogusker et al. |
| 8,047,970 | B2 | 11/2011 | Nalley |
| 8,052,580 | B2 | 11/2011 | Saalasti et al. |
| 8,052,584 | B2 | 11/2011 | Keiser |
| 8,055,469 | B2 | 11/2011 | Kulach et al. |
| 8,056,687 | B2 | 11/2011 | Golden et al. |
| 8,057,360 | B2 | 11/2011 | Shea |
| 8,057,368 | B1 | 11/2011 | Lyszczarz |
| 8,062,182 | B2 | 11/2011 | Somers |
| 8,062,187 | B2 | 11/2011 | Lull et al. |
| 8,062,192 | B1 | 11/2011 | Arstein |
| 8,062,196 | B1 | 11/2011 | Khubani |
| 8,065,185 | B2 | 11/2011 | Foladare et al. |
| 8,066,514 | B2 | 11/2011 | Clarke |
| 8,070,655 | B1 | 12/2011 | Napolitano |
| 8,075,453 | B1 | 12/2011 | Wilkinson |
| 8,078,426 | B2 | 12/2011 | Pipinich et al. |
| 8,079,937 | B2 | 12/2011 | Bedell |
| 8,079,939 | B1 | 12/2011 | Wang |
| 8,082,029 | B2 | 12/2011 | Honda |
| 8,083,643 | B2 | 12/2011 | Ng et al. |
| 8,083,693 | B1 | 12/2011 | McKeon et al. |
| 8,086,421 | B2 | 12/2011 | Case, Jr. et al. |
| 8,088,043 | B2 | 1/2012 | Andren et al. |
| 8,088,044 | B2 | 1/2012 | Tchao et al. |
| 8,092,381 | B2 | 1/2012 | Edwards |
| 8,101,843 | B2 | 1/2012 | Turner |
| 8,103,379 | B2 | 1/2012 | Biba et al. |
| 8,103,517 | B2 | 1/2012 | Hinnebusch |
| 8,104,411 | B2 | 1/2012 | Fenton |
| 8,105,207 | B1 | 1/2012 | Lannon |
| 8,105,213 | B2 | 1/2012 | Stewart et al. |
| 8,106,563 | B2 | 1/2012 | Ritchey |
| 8,109,858 | B2 | 2/2012 | Redmann |
| 8,112,281 | B2 | 2/2012 | Yeung et al. |
| 8,113,990 | B2 | 2/2012 | Kolman et al. |
| 8,113,991 | B2 | 2/2012 | Kutliroff |
| 8,113,994 | B2 | 2/2012 | Piaget et al. |
| 8,113,995 | B1 | 2/2012 | Hsu |
| 8,116,841 | B2 | 2/2012 | Bly et al. |
| 8,121,785 | B2 | 2/2012 | Swisher et al. |
| 8,123,527 | B2 | 2/2012 | Holljes |
| 8,128,533 | B2 | 3/2012 | Nakagawa et al. |
| 8,137,247 | B2 | 3/2012 | Gerschefske et al. |
| 8,141,276 | B2 | 3/2012 | Ellis |
| 8,142,298 | B2 | 3/2012 | King et al. |
| 8,142,370 | B2 | 3/2012 | Weinberg et al. |
| 8,147,385 | B2 | 4/2012 | Crawford et al. |
| 8,152,693 | B2 | 4/2012 | Nurmela et al. |
| 8,152,695 | B2 | 4/2012 | Riley et al. |
| 8,157,706 | B2 | 4/2012 | Ainsworth et al. |
| 8,157,731 | B2 | 4/2012 | Teller et al. |
| 8,162,804 | B2 | 4/2012 | Tagliabue |
| 8,162,857 | B2 | 4/2012 | Lanfermann et al. |
| 8,165,893 | B1 | 4/2012 | Goldberg et al. |
| 8,167,734 | B2 | 5/2012 | Boldin |
| 8,167,776 | B2 | 5/2012 | Lannon |
| 8,172,723 | B1 | 5/2012 | Yanev et al. |
| 8,172,729 | B2 | 5/2012 | Ellis |
| 8,172,882 | B2 | 5/2012 | Klyce et al. |
| 8,176,101 | B2 | 5/2012 | Rosenberg |
| 8,177,688 | B2 | 5/2012 | Burnfield et al. |
| 8,182,399 | B2 | 5/2012 | Davis et al. |
| 8,188,700 | B2 | 5/2012 | Tseng et al. |
| 8,188,868 | B2 | 5/2012 | Case, Jr. |
| 8,192,332 | B2 | 6/2012 | Baker et al. |
| 8,200,323 | B2 | 6/2012 | Dibenedetto et al. |
| 8,210,993 | B2 | 7/2012 | Lee et al. |
| 8,213,908 | B2 | 7/2012 | Sangster et al. |
| 8,215,027 | B2 | 7/2012 | Kang |
| 8,221,290 | B2 | 7/2012 | Vincent et al. |
| 8,221,292 | B2 | 7/2012 | Barker et al. |
| 8,221,295 | B2 | 7/2012 | Wilkins |
| 8,224,429 | B2 | 7/2012 | Prstojevich et al. |

(56) References Cited

U.S. PATENT DOCUMENTS

| | | | |
|---|---|---|---|
| 8,225,024 | B2 | 7/2012 | Dybsetter |
| 8,231,506 | B2 | 7/2012 | Molyneux et al. |
| 8,235,724 | B2 | 8/2012 | Gilley et al. |
| 8,235,873 | B1 | 8/2012 | Stearns |
| 8,240,430 | B2 | 8/2012 | Downey |
| 8,241,118 | B2 | 8/2012 | Camhi |
| 8,241,186 | B2 | 8/2012 | Brodess et al. |
| 8,241,187 | B2 | 8/2012 | Moon et al. |
| 8,249,686 | B2 | 8/2012 | Libbus et al. |
| 8,251,874 | B2 | 8/2012 | Ashby et al. |
| 8,253,586 | B1 | 8/2012 | Matak |
| 8,257,228 | B2 | 9/2012 | Quatrochi et al. |
| 8,257,230 | B2 | 9/2012 | Chen et al. |
| 8,260,667 | B2 | 9/2012 | Graham et al. |
| 8,260,858 | B2 | 9/2012 | Belz et al. |
| 8,269,093 | B2 | 9/2012 | Naik et al. |
| 8,272,996 | B2 | 9/2012 | Weier |
| 8,275,143 | B2 | 9/2012 | Johnson |
| 8,275,265 | B2 | 9/2012 | Kobyakov et al. |
| 8,276,434 | B2 | 10/2012 | Senoo |
| 8,280,259 | B2 | 10/2012 | George et al. |
| 8,287,434 | B2 | 10/2012 | Zavadsky et al. |
| 8,296,172 | B2 | 10/2012 | Marci et al. |
| 8,298,123 | B2 | 10/2012 | Hickman |
| 8,306,635 | B2 | 11/2012 | Pryor |
| 8,308,794 | B2 | 11/2012 | Martinson et al. |
| 8,314,840 | B1 | 11/2012 | Funk |
| 8,315,823 | B2 | 11/2012 | Berme et al. |
| 8,320,578 | B2 | 11/2012 | Kahn et al. |
| 8,321,004 | B2 | 11/2012 | Moon et al. |
| 8,323,155 | B2 | 12/2012 | Ohrt et al. |
| 8,323,157 | B2 | 12/2012 | Campanaro et al. |
| 8,332,544 | B1 | 12/2012 | Ralls et al. |
| 8,333,681 | B2 | 12/2012 | Schmidt |
| 8,337,335 | B2 | 12/2012 | Dugan |
| 8,341,557 | B2 | 12/2012 | Pisula et al. |
| 8,343,016 | B1 | 1/2013 | Astilean |
| 8,348,840 | B2 | 1/2013 | Heit et al. |
| 8,360,785 | B2 | 1/2013 | Park et al. |
| 8,360,904 | B2 | 1/2013 | Oleson et al. |
| 8,360,935 | B2 | 1/2013 | Olsen et al. |
| 8,360,936 | B2 | 1/2013 | Dibenedetto et al. |
| 8,363,913 | B2 | 1/2013 | Boushey et al. |
| 8,364,250 | B2 | 1/2013 | Moon et al. |
| 8,364,389 | B2 | 1/2013 | Dorogusker et al. |
| 8,368,329 | B1 | 2/2013 | Depew et al. |
| 8,369,936 | B2 | 2/2013 | Farringdon et al. |
| 8,371,990 | B2 | 2/2013 | Shea |
| 8,374,688 | B2 | 2/2013 | Libbus et al. |
| 8,376,910 | B2 | 2/2013 | Cheung et al. |
| 8,376,913 | B2 | 2/2013 | Lee et al. |
| 8,378,647 | B2 | 2/2013 | Yonezawa et al. |
| 8,384,551 | B2 | 2/2013 | Ross et al. |
| 8,394,005 | B2 | 3/2013 | Solow et al. |
| 8,395,366 | B2 | 3/2013 | Uno |
| 8,398,546 | B2 | 3/2013 | Pacione et al. |
| 8,403,815 | B2 | 3/2013 | Liao et al. |
| 8,403,845 | B2 | 3/2013 | Stivoric et al. |
| 8,407,623 | B2 | 3/2013 | Kerr et al. |
| 8,409,058 | B2 | 4/2013 | Gordon et al. |
| 8,412,317 | B2 | 4/2013 | Mazar |
| 8,419,593 | B2 | 4/2013 | Ainsworth et al. |
| 8,419,598 | B2 | 4/2013 | Dyer et al. |
| 8,429,223 | B2 | 4/2013 | Gilley et al. |
| 8,430,770 | B2 | 4/2013 | Dugan |
| 8,435,160 | B1 | 5/2013 | Clum |
| 8,437,824 | B2 | 5/2013 | Moon et al. |
| 8,446,275 | B2 | 5/2013 | Utter, II |
| 8,449,620 | B2 | 5/2013 | Hakansson et al. |
| 8,452,259 | B2 | 5/2013 | Ellis et al. |
| 8,454,437 | B2 | 6/2013 | Dugan |
| 8,459,479 | B2 | 6/2013 | Yourist |
| 8,460,001 | B1 | 6/2013 | Chuang |
| 8,460,189 | B2 | 6/2013 | Libbus et al. |
| 8,469,861 | B1 | 6/2013 | McFee |
| 8,475,338 | B2 | 7/2013 | Greenhill et al. |
| 8,475,346 | B2 | 7/2013 | Gerschefske et al. |
| 8,475,367 | B1 | 7/2013 | Yuen et al. |
| 8,475,370 | B2 | 7/2013 | McCombie et al. |
| 8,480,541 | B1 | 7/2013 | Brunts |
| 8,485,944 | B2 | 7/2013 | Drazan |
| 8,485,945 | B2 | 7/2013 | Leonhard |
| 8,485,982 | B2 | 7/2013 | Gavish et al. |
| 8,485,996 | B2 | 7/2013 | Bluman |
| 8,487,759 | B2 | 7/2013 | Hill |
| 8,491,446 | B2 | 7/2013 | Hinds et al. |
| 8,491,572 | B2 | 7/2013 | Martinson et al. |
| 8,493,822 | B2 | 7/2013 | Lee et al. |
| 8,503,086 | B2 | 8/2013 | French et al. |
| 8,505,597 | B2 | 8/2013 | Sharperson |
| 8,506,370 | B2 | 8/2013 | Homsi |
| 8,506,457 | B2 | 8/2013 | Baudhuin |
| 8,506,458 | B2 | 8/2013 | Dugan |
| 8,512,210 | B2 | 8/2013 | Shauli |
| 8,515,930 | B2 | 8/2013 | Hong |
| 8,516,723 | B2 | 8/2013 | Ferrigan et al. |
| 8,517,896 | B2 | 8/2013 | Robinette et al. |
| 8,517,899 | B2 | 8/2013 | Zhou |
| 8,523,789 | B2 | 9/2013 | Keiser |
| 8,527,038 | B2 | 9/2013 | Moon et al. |
| 8,529,409 | B1 | 9/2013 | Lesea-Ames |
| 8,531,386 | B1 | 9/2013 | Kerr et al. |
| 8,533,007 | B2 | 9/2013 | Egami et al. |
| 8,533,620 | B2 | 9/2013 | Hoffman et al. |
| 8,535,247 | B2 | 9/2013 | Williams |
| 8,538,333 | B2 | 9/2013 | Jain et al. |
| 8,538,723 | B2 | 9/2013 | Chang |
| 8,540,560 | B2 | 9/2013 | Crowley et al. |
| 8,540,641 | B2 | 9/2013 | Kroll et al. |
| 8,543,185 | B2 | 9/2013 | Yuen et al. |
| 8,545,417 | B2 | 10/2013 | Banet et al. |
| 8,550,962 | B2 | 10/2013 | Piaget et al. |
| 8,554,214 | B2 | 10/2013 | Sweeney et al. |
| 8,554,802 | B1 | 10/2013 | Barden et al. |
| 8,556,778 | B1 | 10/2013 | Dugan |
| 8,556,779 | B2 | 10/2013 | Grind |
| 8,560,951 | B1 | 10/2013 | Snyder et al. |
| 8,562,491 | B2 | 10/2013 | Merli |
| 8,568,278 | B2 | 10/2013 | Riley et al. |
| 8,571,880 | B2 | 10/2013 | Goldberg |
| 8,572,576 | B2 | 10/2013 | Elvanoglu et al. |
| 8,573,982 | B1 | 11/2013 | Chuang |
| 8,579,767 | B2 | 11/2013 | Ellis et al. |
| 8,591,411 | B2 | 11/2013 | Banet et al. |
| 8,594,772 | B2 | 11/2013 | Eggenberger et al. |
| RE44,650 | E | 12/2013 | Anderson |
| 8,597,093 | B2 | 12/2013 | Engelberg et al. |
| 8,602,951 | B2 | 12/2013 | Morris |
| 8,602,997 | B2 | 12/2013 | Banet et al. |
| 8,603,017 | B2 | 12/2013 | Trandafir et al. |
| 8,605,048 | B2 | 12/2013 | Ye et al. |
| 8,608,624 | B2 | 12/2013 | Shabodyash et al. |
| 8,610,593 | B2 | 12/2013 | Van Acht et al. |
| 8,613,689 | B2 | 12/2013 | Dyer et al. |
| 8,614,595 | B2 | 12/2013 | Acatrinei |
| 8,614,902 | B2 | 12/2013 | Pansier et al. |
| 8,617,008 | B2 | 12/2013 | Marty et al. |
| 8,622,873 | B2 | 1/2014 | Mcgown |
| 8,628,333 | B2 | 1/2014 | Prinzel, III et al. |
| 8,628,453 | B2 | 1/2014 | Blaakrishnan et al. |
| 8,639,020 | B1 | 1/2014 | Kutliroff et al. |
| 8,647,239 | B1 | 2/2014 | Sokolovas |
| 8,647,240 | B2 | 2/2014 | Heidecke |
| 8,649,890 | B2 | 2/2014 | Martin |
| 8,652,010 | B2 | 2/2014 | Ellis et al. |
| 8,654,198 | B2 | 2/2014 | Pryor |
| 8,655,004 | B2 | 2/2014 | Prest et al. |
| 8,657,724 | B2 | 2/2014 | Yang |
| 8,662,901 | B2 | 3/2014 | Tzao et al. |
| 8,663,070 | B2 | 3/2014 | Long |
| 8,663,106 | B2 | 3/2014 | Stivoric et al. |
| 8,667,194 | B2 | 3/2014 | Dybsetter et al. |
| 8,668,627 | B2 | 3/2014 | Eschenbach |
| 8,670,222 | B2 | 3/2014 | Rothkopf |

(56) References Cited

U.S. PATENT DOCUMENTS

| | | | |
|---|---|---|---|
| 8,672,852 | B2 | 3/2014 | Gavish |
| 8,676,170 | B2 | 3/2014 | Porrati et al. |
| 8,676,541 | B2 | 3/2014 | Schrock et al. |
| 8,678,979 | B2 | 3/2014 | Stark et al. |
| 8,684,925 | B2 | 4/2014 | Manicka et al. |
| 8,690,578 | B1 | 4/2014 | Nusbaum et al. |
| 8,690,735 | B2 | 4/2014 | Watterson et al. |
| 8,690,738 | B1 | 4/2014 | Astilian |
| 8,701,567 | B1 | 4/2014 | Esfandiari et al. |
| 8,702,430 | B2 | 4/2014 | Dibenedetto et al. |
| 8,702,567 | B2 | 4/2014 | Hu |
| 8,704,068 | B2 | 4/2014 | Bowen |
| 8,706,530 | B2 | 4/2014 | Ohnemus et al. |
| 8,708,842 | B2 | 4/2014 | Ganuza |
| 8,708,870 | B2 | 4/2014 | Nalley |
| 8,712,510 | B2 | 4/2014 | Quy |
| 8,718,752 | B2 | 5/2014 | Libbus et al. |
| 8,719,202 | B1 | 5/2014 | Maeng |
| 8,724,037 | B1 | 5/2014 | Massey |
| 8,727,947 | B2 | 5/2014 | Tagliabue |
| 8,734,157 | B1 | 5/2014 | Hummel, III |
| 8,734,296 | B1 | 5/2014 | Brumback et al. |
| 8,734,301 | B2 | 5/2014 | Remelius |
| 8,734,302 | B2 | 5/2014 | Hsieh |
| 8,738,732 | B2 | 5/2014 | Karidi |
| 8,740,751 | B2 | 6/2014 | Shum |
| 8,740,754 | B2 | 6/2014 | Miller |
| 8,740,756 | B2 | 6/2014 | Shabodyash et al. |
| 8,740,802 | B2 | 6/2014 | Banet et al. |
| 8,740,807 | B2 | 6/2014 | Banet et al. |
| 8,744,803 | B2 | 6/2014 | Park et al. |
| 8,745,104 | B1 | 6/2014 | Rosenberg |
| 8,745,496 | B2 | 6/2014 | Gilley et al. |
| 8,747,330 | B2 | 6/2014 | Banet et al. |
| 8,749,380 | B2 | 6/2014 | Vock et al. |
| 8,758,201 | B2 | 6/2014 | Ashby et al. |
| 8,762,101 | B2 | 6/2014 | Yuen et al. |
| 8,762,167 | B2 | 6/2014 | Blander et al. |
| 8,762,313 | B2 | 6/2014 | Lahav et al. |
| 8,764,609 | B1 | 7/2014 | Elahmadie |
| 8,764,651 | B2 | 7/2014 | Tran |
| 8,768,769 | B2 | 7/2014 | Foladare et al. |
| 8,770,742 | B2 | 7/2014 | Howell et al. |
| 8,771,206 | B2 | 7/2014 | Gettelman et al. |
| 8,775,454 | B2 | 7/2014 | Geer |
| 8,776,264 | B2 | 7/2014 | Kiernan |
| 8,777,815 | B2 | 7/2014 | Case, Jr. et al. |
| 8,777,820 | B2 | 7/2014 | Lo |
| 8,781,568 | B2 | 7/2014 | Dugan |
| 8,783,326 | B1 | 7/2014 | Vaninger et al. |
| 8,784,271 | B2 | 7/2014 | Brumback et al. |
| 8,784,273 | B2 | 7/2014 | Dugan |
| 8,784,274 | B1 | 7/2014 | Chuang |
| 8,790,220 | B2 | 7/2014 | Karvonen |
| 8,790,222 | B2 | 7/2014 | Burger |
| 8,790,259 | B2 | 7/2014 | Katra et al. |
| 8,795,138 | B1 | 8/2014 | Yeh et al. |
| 8,795,139 | B2 | 8/2014 | Zhang et al. |
| 8,799,200 | B2 | 8/2014 | Lahav |
| 8,801,580 | B1 | 8/2014 | Maresh |
| 8,801,581 | B2 | 8/2014 | Lai et al. |
| 8,805,844 | B2 | 8/2014 | Schorzman et al. |
| 8,805,941 | B2 | 8/2014 | Barak et al. |
| 8,814,754 | B2 | 8/2014 | Weast et al. |
| 8,814,757 | B2 | 8/2014 | Eschenbach |
| 8,821,350 | B2 | 9/2014 | Maertz |
| 8,821,351 | B2 | 9/2014 | Abuelsaad et al. |
| 8,824,697 | B2 | 9/2014 | Christoph |
| 8,825,445 | B2 | 9/2014 | Hoffman et al. |
| 8,827,870 | B2 | 9/2014 | Dyer et al. |
| 8,831,407 | B2 | 9/2014 | Meschter et al. |
| 8,831,538 | B2 | 9/2014 | Yuen |
| 8,838,471 | B1 | 9/2014 | Shum et al. |
| 8,845,497 | B2 | 9/2014 | Turner |
| 8,851,565 | B2 | 10/2014 | Hontz et al. |
| 8,861,860 | B2 | 10/2014 | Gupta |
| 8,864,587 | B2 | 10/2014 | Framel |
| 8,864,627 | B2 | 10/2014 | Bayerlein et al. |
| 8,864,631 | B1 | 10/2014 | Stearns |
| 8,868,448 | B2 | 10/2014 | Freishtat et al. |
| 8,870,791 | B2 | 10/2014 | Sabatino |
| 8,876,661 | B2 | 11/2014 | Lu |
| 8,876,669 | B2 | 11/2014 | Vujicic |
| 8,882,637 | B2 | 11/2014 | Ainsworth et al. |
| 8,882,666 | B1 | 11/2014 | Goldberg et al. |
| 8,888,583 | B2 | 11/2014 | Dugan et al. |
| 8,888,660 | B1 | 11/2014 | Oteman |
| 8,888,700 | B2 | 11/2014 | Banet et al. |
| 8,894,549 | B2 | 11/2014 | Colledge |
| 8,894,551 | B2 | 11/2014 | Kerdjoudj |
| 8,897,868 | B2 | 11/2014 | Mazar et al. |
| 8,900,099 | B1 | 12/2014 | Boyette |
| 8,902,714 | B2 | 12/2014 | Gossweiler, III et al. |
| 8,903,671 | B2 | 12/2014 | Park et al. |
| 8,908,894 | B2 | 12/2014 | Amento et al. |
| 8,915,823 | B2 | 12/2014 | McKirdy et al. |
| 8,918,465 | B2 | 12/2014 | Barak |
| 8,918,543 | B2 | 12/2014 | Karstens |
| 8,920,291 | B2 | 12/2014 | Chen et al. |
| 8,920,332 | B2 | 12/2014 | Hong et al. |
| 8,920,343 | B2 | 12/2014 | Sabatino |
| 8,926,475 | B2 | 1/2015 | Lin et al. |
| 8,926,478 | B2 | 1/2015 | Huang et al. |
| 8,926,479 | B2 | 1/2015 | Chen et al. |
| 8,939,831 | B2 | 1/2015 | Dugan |
| 8,943,002 | B2 | 1/2015 | Zelenko et al. |
| 8,944,958 | B1 | 2/2015 | Brumback et al. |
| 8,944,968 | B2 | 2/2015 | Baudhuin |
| 8,945,328 | B2 | 2/2015 | Longinotti-Buitoni et al. |
| 8,947,226 | B2 | 2/2015 | Dugan |
| 8,951,106 | B2 | 2/2015 | Cowley |
| 8,951,164 | B2 | 2/2015 | Morris et al. |
| 8,951,168 | B2 | 2/2015 | Baudhuin |
| 8,954,135 | B2 | 2/2015 | Yuen et al. |
| 8,954,290 | B2 | 2/2015 | Yuen et al. |
| 8,956,268 | B2 | 2/2015 | Huang et al. |
| 8,956,290 | B2 | 2/2015 | Gilley et al. |
| 8,956,303 | B2 | 2/2015 | Hong et al. |
| 8,956,715 | B2 | 2/2015 | Kim |
| 8,958,631 | B2 | 2/2015 | Kutliroff et al. |
| 8,961,371 | B2 | 2/2015 | Sultan et al. |
| 8,961,413 | B2 | 2/2015 | Teller et al. |
| 8,961,414 | B2 | 2/2015 | Teller et al. |
| 8,965,348 | B1 | 2/2015 | Cronin |
| 8,965,498 | B2 | 2/2015 | Katra et al. |
| 8,965,541 | B2 | 2/2015 | Martinez et al. |
| 8,965,732 | B2 | 2/2015 | Robinette et al. |
| 8,968,161 | B2 | 3/2015 | Shapiro et al. |
| 8,968,163 | B1 | 3/2015 | Vidmar |
| 8,972,199 | B2 | 3/2015 | Liang |
| 8,974,352 | B2 | 3/2015 | Eschenbach |
| 8,976,007 | B2 | 3/2015 | Dugan |
| 8,977,194 | B2 | 3/2015 | Jain et al. |
| 8,979,709 | B2 | 3/2015 | Toback et al. |
| 8,979,765 | B2 | 3/2015 | Banet et al. |
| 8,986,165 | B2 | 3/2015 | Ashby |
| 8,992,364 | B2 | 3/2015 | Law et al. |
| 8,992,383 | B2 | 3/2015 | Bilang |
| 8,992,387 | B2 | 3/2015 | Watterson et al. |
| 9,005,085 | B2 | 4/2015 | Astilean |
| 9,005,129 | B2 | 4/2015 | Venkatraman et al. |
| 9,005,224 | B2 | 4/2015 | Euteneuer et al. |
| 9,011,291 | B2 | 4/2015 | Birrell |
| 9,011,292 | B2 | 4/2015 | Weast et al. |
| 9,011,293 | B2 | 4/2015 | Shavit et al. |
| 9,011,301 | B2 | 4/2015 | Balandis et al. |
| 9,015,952 | B2 | 4/2015 | Magosaki |
| 9,017,230 | B1 | 4/2015 | Pitts |
| 9,026,927 | B2 | 5/2015 | Brumback et al. |
| 9,028,368 | B2 | 5/2015 | Ashby et al. |
| 9,028,441 | B2 | 5/2015 | Kuhn |
| 9,031,812 | B2 | 5/2015 | Roberts et al. |
| 9,037,578 | B2 | 5/2015 | Brust et al. |
| 9,038,218 | B1 | 5/2015 | Heil et al. |

(56) References Cited

U.S. PATENT DOCUMENTS

| | | | |
|---|---|---|---|
| 9,039,578 | B2 | 5/2015 | Dalebout |
| 9,039,581 | B2 | 5/2015 | Chia et al. |
| 9,039,614 | B2 | 5/2015 | Yuen et al. |
| 9,042,596 | B2 | 5/2015 | Connor |
| 9,050,485 | B2 | 6/2015 | Huang et al. |
| 9,050,486 | B2 | 6/2015 | Reed |
| 9,050,491 | B2 | 6/2015 | Gordon et al. |
| 9,050,498 | B2 | 6/2015 | Lu et al. |
| 9,052,798 | B1 | 6/2015 | Klassen et al. |
| 9,055,868 | B2 | 6/2015 | Islam |
| 9,061,175 | B1 | 6/2015 | Miller et al. |
| 9,064,342 | B2 | 6/2015 | Yuen et al. |
| 9,069,380 | B2 | 6/2015 | Rahman et al. |
| 9,072,930 | B2 | 7/2015 | Ashby et al. |
| 9,072,932 | B2 | 7/2015 | Piaget et al. |
| 9,072,936 | B1 | 7/2015 | Miller et al. |
| 9,083,826 | B2 | 7/2015 | Lu et al. |
| 9,084,912 | B2 | 7/2015 | Jaquish et al. |
| 9,089,732 | B2 | 7/2015 | Andon et al. |
| 9,089,733 | B2 | 7/2015 | Fisbein et al. |
| 9,095,740 | B2 | 8/2015 | Wu |
| 9,107,586 | B2 | 8/2015 | Tran |
| 9,108,079 | B2 | 8/2015 | Solow et al. |
| 9,108,081 | B2 | 8/2015 | Giannelli et al. |
| 9,114,275 | B2 | 8/2015 | Lu et al. |
| 9,114,276 | B2 | 8/2015 | Bayerlein et al. |
| 9,119,983 | B2 | 9/2015 | Rhea |
| 9,123,317 | B2 | 9/2015 | Watterson et al. |
| 9,123,380 | B2 | 9/2015 | Holtz et al. |
| 9,128,981 | B1 | 9/2015 | Geer |
| 9,132,051 | B2 | 9/2015 | Heil et al. |
| 9,135,347 | B2 | 9/2015 | Damman et al. |
| 9,137,309 | B2 | 9/2015 | Ananny et al. |
| 9,138,614 | B2 | 9/2015 | Lu et al. |
| 9,138,615 | B2 | 9/2015 | Fukamizu et al. |
| 9,141,087 | B2 | 9/2015 | Brown et al. |
| 9,143,881 | B2 | 9/2015 | Fan et al. |
| 9,144,703 | B2 | 9/2015 | Dalebout et al. |
| 9,144,709 | B2 | 9/2015 | Reich |
| 9,146,147 | B1 | 9/2015 | Bakhsh |
| 9,162,102 | B1 | 10/2015 | Eder et al. |
| 9,162,106 | B1 | 10/2015 | Scheiman |
| 9,162,142 | B2 | 10/2015 | Shum et al. |
| 9,168,001 | B2 | 10/2015 | Stivoric et al. |
| 9,168,414 | B2 | 10/2015 | Liu et al. |
| 9,173,593 | B2 | 11/2015 | Banet et al. |
| 9,173,594 | B2 | 11/2015 | Banet et al. |
| 9,174,084 | B2 | 11/2015 | Morris et al. |
| 9,174,085 | B2 | 11/2015 | Foley |
| 9,178,635 | B2 | 11/2015 | Ben-Shlomo |
| 9,183,498 | B2 | 11/2015 | Landers |
| 9,186,537 | B2 | 11/2015 | Arnold et al. |
| 9,186,549 | B2 | 11/2015 | Watterson et al. |
| 9,186,552 | B1 | 11/2015 | Deal |
| 9,189,021 | B2 | 11/2015 | Jerauld |
| 9,192,800 | B1 | 11/2015 | Meyer et al. |
| 9,192,816 | B2 | 11/2015 | Molyneux et al. |
| 9,199,115 | B2 | 12/2015 | Yim et al. |
| 9,199,123 | B2 | 12/2015 | Solow |
| 9,201,405 | B2 | 12/2015 | Clarkson et al. |
| 9,201,458 | B2 | 12/2015 | Hunt et al. |
| 9,205,301 | B2 | 12/2015 | Cohen |
| 9,208,764 | B2 | 12/2015 | Ghosh et al. |
| 9,211,440 | B2 | 12/2015 | Lagree |
| 9,213,803 | B2 | 12/2015 | Rolley |
| 9,220,940 | B2 | 12/2015 | Al Kuwari |
| 9,221,545 | B2 | 12/2015 | Popescu et al. |
| 9,223,936 | B2 | 12/2015 | Aragones et al. |
| 9,224,291 | B2 | 12/2015 | Moll-Carrillo et al. |
| 9,226,692 | B2 | 1/2016 | Haas |
| 9,229,476 | B2 | 1/2016 | Yanev et al. |
| 9,230,064 | B2 | 1/2016 | Yanev et al. |
| 9,233,269 | B2 | 1/2016 | Lannon |
| 9,241,635 | B2 | 1/2016 | Yuen et al. |
| 9,245,428 | B2 | 1/2016 | Weddle et al. |
| 9,247,543 | B2 | 1/2016 | Berlin et al. |
| 9,248,071 | B1 | 2/2016 | Benda et al. |
| 9,248,338 | B2 | 2/2016 | Lo |
| 9,253,168 | B2 | 2/2016 | Panther |
| 9,254,099 | B2 | 2/2016 | Connor |
| 9,254,413 | B2 | 2/2016 | Chen et al. |
| 9,254,414 | B2 | 2/2016 | Liu et al. |
| 9,256,910 | B2 | 2/2016 | Goldberg |
| 9,257,054 | B2 | 2/2016 | Coza et al. |
| 9,258,670 | B2 | 2/2016 | Goyal et al. |
| 9,259,610 | B2 | 2/2016 | Huang et al. |
| 9,259,633 | B2 | 2/2016 | Meyers |
| 9,262,064 | B2 | 2/2016 | Yanev et al. |
| 9,269,119 | B2 | 2/2016 | Warner |
| 9,272,180 | B2 | 3/2016 | Eschenbach |
| 9,272,183 | B2 | 3/2016 | Quy |
| 9,272,186 | B2 | 3/2016 | Reich |
| 9,275,617 | B2 | 3/2016 | Regnier |
| 9,278,249 | B2 | 3/2016 | Watterson |
| 9,278,250 | B2 | 3/2016 | Buchanan |
| 9,279,734 | B2 | 3/2016 | Walker |
| 9,283,429 | B2 | 3/2016 | Aragones et al. |
| 9,288,298 | B2 | 3/2016 | Choudhary et al. |
| 9,289,063 | B2 | 3/2016 | Baugh et al. |
| 9,289,648 | B2 | 3/2016 | Watterson |
| 9,295,422 | B2 | 3/2016 | Tai |
| 9,295,894 | B2 | 3/2016 | Papadopolous |
| 9,302,148 | B1 | 4/2016 | Vujicic et al. |
| 9,305,141 | B2 | 4/2016 | Fabrizio |
| 9,308,415 | B2 | 4/2016 | Crawford et al. |
| 9,311,802 | B1 | 4/2016 | Chin et al. |
| 9,317,662 | B2 | 4/2016 | Bangera et al. |
| 9,318,030 | B2 | 4/2016 | Harris et al. |
| 9,329,053 | B2 | 5/2016 | Lakovic et al. |
| 9,332,363 | B2 | 5/2016 | Jain et al. |
| 9,333,388 | B2 | 5/2016 | Lee et al. |
| 9,339,209 | B2 | 5/2016 | Banet et al. |
| 9,339,681 | B1 | 5/2016 | Nalley |
| 9,339,683 | B2 | 5/2016 | Dilli et al. |
| 9,339,691 | B2 | 5/2016 | Brammer |
| 9,339,692 | B2 | 5/2016 | Hashish |
| 9,345,947 | B2 | 5/2016 | Harris et al. |
| 9,349,280 | B2 | 5/2016 | Baldwin et al. |
| 9,350,598 | B2 | 5/2016 | Barak et al. |
| 9,352,185 | B2 | 5/2016 | Hendrickson et al. |
| 9,352,186 | B2 | 5/2016 | Watterson |
| 9,352,187 | B2 | 5/2016 | Piaget et al. |
| 9,357,551 | B2 | 5/2016 | Gutman |
| 9,357,921 | B2 | 6/2016 | Chang et al. |
| 9,358,422 | B2 | 6/2016 | Brontman |
| 9,358,426 | B2 | 6/2016 | Aragones et al. |
| 9,364,158 | B2 | 6/2016 | Banet et al. |
| 9,364,706 | B2 | 6/2016 | Lo |
| 9,364,708 | B2 | 6/2016 | Luger et al. |
| 9,364,714 | B2 | 6/2016 | Koduri et al. |
| 9,367,668 | B2 | 6/2016 | Flynt et al. |
| 9,370,679 | B2 | 6/2016 | Lagree et al. |
| 9,370,687 | B2 | 6/2016 | Hao |
| 9,374,279 | B2 | 6/2016 | Yuen et al. |
| 9,375,606 | B1 | 6/2016 | Maresh |
| 9,375,629 | B2 | 6/2016 | Schieffer et al. |
| 9,377,314 | B2 | 6/2016 | Tseng et al. |
| 9,378,336 | B2 | 6/2016 | Ohnemus et al. |
| 9,381,420 | B2 | 7/2016 | Burroughs |
| 9,381,445 | B2 | 7/2016 | Ventura et al. |
| 9,385,810 | B2 | 7/2016 | Hazani |
| 9,387,387 | B2 | 7/2016 | Dalebout et al. |
| 9,389,057 | B2 | 7/2016 | Meschter et al. |
| 9,389,718 | B1 | 7/2016 | Letourneur |
| 9,389,754 | B2 | 7/2016 | Reese et al. |
| 9,390,229 | B1 | 7/2016 | Kahn et al. |
| 9,392,941 | B2 | 7/2016 | Powch et al. |
| 9,395,754 | B2 | 7/2016 | Cronin |
| 9,401,078 | B2 | 7/2016 | Barrett |
| 9,403,048 | B2 | 8/2016 | Balandis et al. |
| 9,403,053 | B2 | 8/2016 | Kaiser et al. |
| 9,405,892 | B2 | 8/2016 | Baldwin et al. |
| 9,409,050 | B2 | 8/2016 | Mintz |
| 9,409,052 | B2 | 8/2016 | Werner |

(56) References Cited

U.S. PATENT DOCUMENTS 9,411,936 B2 8/2016 Landrum et al.
9,411,940 B2 8/2016 Burroughs et al.
9,415,257 B2 8/2016 Habing
9,420,083 B2 8/2016 Roberts et al.
9,420,542 B2 8/2016 Henia
9,421,416 B2 8/2016 Mortensen et al.
9,421,422 B2 8/2016 Yuen et al.
9,421,448 B2 8/2016 Tropper et al.
9,422,018 B2 8/2016 Pelot et al.
9,430,043 B1 8/2016 Amento et al.
9,430,920 B2 8/2016 Munro et al.
9,439,574 B2 9/2016 McCombie et al.
9,440,134 B2 9/2016 Nicora
9,442,100 B2 9/2016 Connor
9,446,288 B1 9/2016 Pazan
9,451,897 B2 9/2016 Mazar et al.
9,452,315 B1 9/2016 Murray et al.
9,452,320 B2 9/2016 Yang
9,455,784 B2 9/2016 Cune et al.
9,457,222 B2 10/2016 Dalebout
9,457,223 B2 10/2016 Eschenbach
9,457,224 B2 10/2016 Giannelli et al.
9,457,256 B2 10/2016 Aragones et al.
9,460,421 B2 10/2016 Lai et al.
9,460,700 B2 * 10/2016 Smith ..... G10H 7/00
9,462,844 B2 10/2016 Schrock et al.
9,463,349 B1 10/2016 Chang
9,463,572 B2 10/2016 Parente
9,468,382 B2 10/2016 Hanoun
9,468,793 B2 10/2016 Salmon
9,468,794 B2 10/2016 Barton
9,468,797 B1 10/2016 Miller
9,473,593 B2 10/2016 Wallace
9,474,925 B1 10/2016 Hsiung
9,474,935 B2 10/2016 Abbondanza et al.
9,477,303 B2 10/2016 Fleischmann et al.
9,480,874 B2 11/2016 Cutler
9,486,070 B2 11/2016 Labrosse et al.
9,486,382 B1 11/2016 Boss
9,486,658 B2 11/2016 Alexander
9,491,562 B2 11/2016 Cronin
9,495,015 B1 11/2016 Kahn et al.
9,495,860 B2 11/2016 Lett
9,498,066 B2 11/2016 Christianson et al.
9,498,671 B1 11/2016 Softky
9,498,704 B1 11/2016 Cohen et al.
9,500,464 B2 11/2016 Coza
9,504,414 B2 11/2016 Coza et al.
9,505,241 B2 11/2016 Cuzin
9,509,269 B1 11/2016 Rosenberg
9,511,253 B1 12/2016 Miller
9,511,259 B2 12/2016 Mountain
9,517,378 B2 12/2016 Ashby et al.
9,517,406 B2 12/2016 Shum et al.
9,529,385 B2 12/2016 Connor
9,529,437 B2 12/2016 Kahn et al.
9,532,002 B2 12/2016 Glass et al.
9,532,734 B2 1/2017 Hoffman et al.
9,533,228 B2 1/2017 Dugan
9,535,505 B2 1/2017 Erkkila et al.
9,536,449 B2 1/2017 Connor
9,539,458 B1 1/2017 Ross
9,540,071 B2 1/2017 Jordan et al.
9,540,174 B2 1/2017 Josserond et al.
9,545,535 B2 1/2017 Lagree
9,545,540 B1 1/2017 Moschel
9,545,541 B2 1/2017 Aragones et al.
9,549,585 B2 1/2017 Amos et al.
9,560,917 B2 2/2017 Roslund, Jr.
9,563,336 B2 2/2017 Barak et al.
9,563,700 B2 2/2017 Garmark et al.
9,566,469 B1 2/2017 Rector
9,573,017 B2 2/2017 Chang
9,579,534 B2 2/2017 Sutkowski et al.
9,579,544 B2 2/2017 Watterson
9,582,071 B2 2/2017 Baldwin et al.
9,582,976 B2 2/2017 Chin et al.
9,585,563 B2 3/2017 Mensinger et al.
9,586,087 B1 3/2017 Lin
9,586,090 B2 3/2017 Watterson et al.
9,589,482 B2 3/2017 Baldwin et al.
9,594,433 B2 3/2017 Baldwin et al.
9,597,540 B2 3/2017 Arnold
9,599,981 B2 3/2017 Crabtree
9,600,079 B2 3/2017 Baldwin et al.
9,602,210 B2 3/2017 Berlin et al.
9,604,096 B2 3/2017 Arnold et al.
9,604,099 B2 3/2017 Taylor
9,610,475 B1 4/2017 DeKnock et al.
9,610,506 B2 4/2017 Dugan
9,615,215 B2 4/2017 Yuen et al.
9,615,785 B2 4/2017 Rocker et al.
9,616,281 B2 4/2017 Hsiung
9,621,959 B2 4/2017 Mountain
9,622,537 B2 4/2017 Amos et al.
9,623,286 B1 4/2017 Chen
9,625,091 B1 4/2017 Massey
9,628,286 B1 4/2017 Nguyen et al.
9,632,746 B2 4/2017 Keipert et al.
9,636,540 B2 5/2017 Mueller et al.
9,636,541 B1 5/2017 Hsu
9,636,543 B2 5/2017 Dyer et al.
9,636,567 B2 5/2017 Brammer et al.
9,642,764 B2 5/2017 Kuehne et al.
9,646,137 B2 5/2017 Gilley et al.
9,646,481 B2 5/2017 Sadanand
9,647,758 B2 5/2017 Hazani
9,649,529 B1 5/2017 Miller
9,655,053 B2 5/2017 Park et al.
9,658,066 B2 5/2017 Yuen et al.
9,661,355 B2 5/2017 Ho
9,661,781 B2 5/2017 Anolik et al.
9,669,261 B2 6/2017 Eder
9,672,196 B2 6/2017 Shachar et al.
9,672,754 B2 6/2017 Yuen et al.
9,673,904 B2 6/2017 Palanisamy et al.
9,678,626 B2 6/2017 Whang
9,681,313 B2 6/2017 Malach
9,682,306 B2 6/2017 Lin et al.
9,687,689 B2 6/2017 Lin
9,692,844 B2 6/2017 Messenger et al.
RE46,481 E 7/2017 Sako et al.
9,694,234 B2 7/2017 Dalebout et al.
9,694,247 B2 7/2017 Nurnberg
9,697,740 B2 7/2017 Zhang et al.
9,700,780 B2 7/2017 Riley et al.
9,700,802 B2 7/2017 Dugan
9,701,530 B2 7/2017 Kline
9,707,439 B2 7/2017 Lee et al.
9,707,441 B2 7/2017 Yang
9,707,447 B1 7/2017 Lopez Babodilla
9,710,711 B2 7/2017 Dibenedetto et al.
9,712,629 B2 7/2017 Molettiere et al.
9,713,739 B2 7/2017 Dalmia
9,715,774 B2 7/2017 Baldwin et al.
9,719,797 B2 8/2017 Fino et al.
9,720,443 B2 8/2017 Malhotra
9,723,393 B2 8/2017 Nguyen et al.
9,724,563 B2 8/2017 Schmidt
9,724,589 B2 8/2017 Baudhuin
9,728,059 B2 8/2017 Nakakura
9,729,921 B2 8/2017 Kim et al.
9,729,989 B2 8/2017 Marten
9,730,025 B2 8/2017 Yuen et al.
9,730,228 B2 8/2017 Harel
9,730,619 B2 8/2017 Messenger et al.
9,731,158 B1 8/2017 Lo
9,734,184 B1 8/2017 Lagace et al.
9,737,261 B2 8/2017 Coza et al.
9,737,747 B1 8/2017 Walsh et al.
9,743,861 B2 8/2017 Giedwoyn et al.
9,756,895 B2 9/2017 Rice et al.
9,757,605 B2 9/2017 Olson et al.
9,757,611 B1 9/2017 Colburn

(56) References Cited

U.S. PATENT DOCUMENTS

| | | | |
|---|---|---|---|
| 9,757,614 | B1 | 9/2017 | Giannelli et al. |
| 9,763,581 | B2 | 9/2017 | Bonutti et al. |
| 9,764,184 | B2 | 9/2017 | Kueker et al. |
| 9,767,212 | B2 | 9/2017 | Lavi et al. |
| 9,769,522 | B2 | 9/2017 | Richardson |
| 9,772,612 | B2 | 9/2017 | McCarthy, III et al. |
| 9,775,123 | B2 | 9/2017 | Harel |
| 9,776,039 | B1 | 10/2017 | Xu |
| 9,776,042 | B2 | 10/2017 | Prokhorov |
| 9,778,280 | B2 | 10/2017 | Yuen et al. |
| 9,782,125 | B2 | 10/2017 | Berner, Jr. et al. |
| 9,782,625 | B1 | 10/2017 | Blum et al. |
| 9,789,362 | B1 | 10/2017 | Su et al. |
| 9,792,361 | B1 | 10/2017 | Geer |
| 9,795,827 | B2 | 10/2017 | Bendersky et al. |
| 9,795,828 | B2 | 10/2017 | Andrade |
| 9,797,920 | B2 | 10/2017 | Kahn et al. |
| 9,798,309 | B2 | 10/2017 | Tirpak |
| 9,801,547 | B2 | 10/2017 | Yuen et al. |
| 9,802,081 | B2 | 10/2017 | Ridgel et al. |
| 9,808,202 | B2 | 11/2017 | Wu et al. |
| 9,808,667 | B2 | 11/2017 | Liao et al. |
| 9,808,673 | B2 | 11/2017 | Robinson |
| 9,811,639 | B2 | 11/2017 | Aragones et al. |
| 9,814,920 | B1 | 11/2017 | Monterrey |
| 9,814,927 | B2 | 11/2017 | Forystek |
| 9,814,928 | B2 | 11/2017 | Taylor |
| 9,814,929 | B2 | 11/2017 | Moser |
| 9,814,930 | B2 | 11/2017 | Manzke et al. |
| 9,818,285 | B2 | 11/2017 | Clarke et al. |
| 9,819,561 | B2 | 11/2017 | Fresihtat et al. |
| 9,819,754 | B2 | 11/2017 | Park et al. |
| 9,821,191 | B2 | 11/2017 | Abbondanza |
| 9,821,212 | B2 | 11/2017 | Kolman et al. |
| 9,824,110 | B2 | 11/2017 | Giudici et al. |
| 9,824,578 | B2 | 11/2017 | Burton et al. |
| 9,827,458 | B2 | 11/2017 | Dalton |
| 9,829,068 | B2 | 11/2017 | Marchetti |
| 9,829,327 | B2 | 11/2017 | Nagy et al. |
| 9,833,141 | B2 | 12/2017 | Kampman et al. |
| 9,833,658 | B2 | 12/2017 | Wiener et al. |
| 9,838,736 | B2 | 12/2017 | Smith et al. |
| 9,839,808 | B1 | 12/2017 | McNeil |
| 9,841,077 | B2 | 12/2017 | Modrezejewski et al. |
| 9,849,330 | B2 | 12/2017 | Lagree |
| 9,849,333 | B2 | 12/2017 | Fung |
| 9,849,361 | B2 | 12/2017 | Coza et al. |
| 9,852,271 | B2 | 12/2017 | Aragones et al. |
| 9,858,307 | B2 | 1/2018 | Sultan et al. |
| 9,861,300 | B2 | 1/2018 | Gettelman et al. |
| 9,864,844 | B2 | 1/2018 | Durham et al. |
| 9,866,596 | B2 | 1/2018 | Das et al. |
| 9,878,201 | B1 | 1/2018 | Moschel |
| 9,880,805 | B1 | 1/2018 | Guralnick |
| 9,881,326 | B2 | 1/2018 | Gilley et al. |
| 9,882,736 | B2 | 1/2018 | Lett |
| 9,882,992 | B2 | 1/2018 | Baldwin et al. |
| 9,886,309 | B2 | 2/2018 | Alles et al. |
| 9,886,871 | B1 | 2/2018 | Rauhala et al. |
| 9,889,334 | B2 | 2/2018 | Ashby et al. |
| 9,892,417 | B2 | 2/2018 | Shachar et al. |
| 9,901,767 | B2 | 2/2018 | Kuo |
| 9,901,772 | B2 | 2/2018 | Crowley et al. |
| 9,901,774 | B2 | 2/2018 | Miller et al. |
| 9,901,780 | B2 | 2/2018 | DeLuca et al. |
| 9,901,805 | B2 | 2/2018 | Hughes, Jr. |
| 9,906,572 | B2 | 2/2018 | Wang et al. |
| 9,907,396 | B1 | 3/2018 | Labrosse et al. |
| 9,910,498 | B2 | 3/2018 | Kutliroff et al. |
| 9,914,003 | B2 | 3/2018 | Kuehne et al. |
| 9,914,011 | B2 | 3/2018 | Downey et al. |
| 9,914,014 | B2 | 3/2018 | Lagree et al. |
| 9,919,183 | B1 | 3/2018 | Moschel |
| 9,919,198 | B2 | 3/2018 | Romeo et al. |
| 9,921,726 | B1 | 3/2018 | Sculley et al. |
| 9,925,411 | B2 | 3/2018 | Huang et al. |
| 9,937,375 | B2 | 4/2018 | Zhu |
| 9,937,376 | B2 | 4/2018 | McInelly et al. |
| 9,937,377 | B2 | 4/2018 | McInelly et al. |
| 9,937,378 | B2 | 4/2018 | Dalebout et al. |
| 9,937,380 | B2 | 4/2018 | Giannelli et al. |
| 9,940,161 | B1 | 4/2018 | Kahn et al. |
| 9,940,682 | B2 | 4/2018 | Hoffman et al. |
| 9,943,159 | B1 | 4/2018 | Novikova |
| 9,943,719 | B2 | 4/2018 | Benhase et al. |
| 9,943,722 | B2 | 4/2018 | Dalebout |
| 9,946,857 | B2 | 4/2018 | Beals |
| 9,948,349 | B2 | 4/2018 | Malach |
| 9,948,477 | B2 | 4/2018 | Marten |
| 9,950,209 | B2 | 4/2018 | Yim et al. |
| 9,956,450 | B2 | 5/2018 | Gavriel et al. |
| 9,959,902 | B2 | 5/2018 | McNamee |
| 9,960,980 | B2 | 5/2018 | Wilson |
| 9,962,081 | B2 | 5/2018 | Mensinger et al. |
| 9,962,305 | B2 | 5/2018 | Yamada et al. |
| 9,962,576 | B2 | 5/2018 | Anderson |
| 9,965,059 | B2 | 5/2018 | Myers et al. |
| 9,967,614 | B2 | 5/2018 | McCarthy, III |
| 9,968,821 | B2 | 5/2018 | Finlayson et al. |
| 9,968,823 | B2 | 5/2018 | Cutler |
| 9,974,997 | B2 | 5/2018 | Cei |
| 9,977,874 | B2 | 5/2018 | Aragones et al. |
| 9,983,011 | B2 | 5/2018 | Mountain |
| 9,986,315 | B2 | 5/2018 | Oleson et al. |
| 9,987,513 | B2 | 6/2018 | Yim et al. |
| 9,987,517 | B1 | 6/2018 | Kuo |
| 9,989,507 | B2 | 6/2018 | Benn |
| 9,993,680 | B2 | 6/2018 | Gordon |
| 9,993,683 | B2 | 6/2018 | Moschel |
| 9,996,066 | B2 | 6/2018 | Beals |
| 10,004,406 | B2 | 6/2018 | Yuen et al. |
| 10,004,656 | B2 | 6/2018 | Whalen et al. |
| 10,004,940 | B2 | 6/2018 | Badarneh |
| 10,008,090 | B2 | 6/2018 | Yuen et al. |
| 10,013,986 | B1 | 7/2018 | Bhaya et al. |
| 10,015,216 | B2 | 7/2018 | Wang et al. |
| 10,016,655 | B2 | 7/2018 | Lagree |
| 10,021,188 | B2 | 7/2018 | Oleson et al. |
| 10,022,589 | B2 | 7/2018 | Case, Jr. et al. |
| 10,022,590 | B2 | 7/2018 | Foley et al. |
| 10,029,143 | B1 | 7/2018 | Milstein |
| 10,029,172 | B2 | 7/2018 | Galasso et al. |
| 10,035,010 | B1 | 7/2018 | Wagstaff |
| 10,037,053 | B2 | 7/2018 | Malhotra |
| 10,038,952 | B2 | 7/2018 | Labrosse et al. |
| 2001/0001303 | A1 | 5/2001 | Ohsuga et al. |
| 2001/0008053 | A1 | 7/2001 | Belli |
| 2001/0016542 | A1 | 8/2001 | Yoshimura |
| 2001/0024998 | A1 | 9/2001 | Novak |
| 2001/0027266 | A1 | 10/2001 | Hautala |
| 2001/0028350 | A1 | 10/2001 | Matsuoka et al. |
| 2001/0049320 | A1 | 12/2001 | Cohen |
| 2001/0051564 | A1 | 12/2001 | Iund |
| 2001/0053883 | A1 | 12/2001 | Yoshimura et al. |
| 2002/0004191 | A1 | 1/2002 | Tice et al. |
| 2002/0004439 | A1 | 1/2002 | Galbraith et al. |
| 2002/0013717 | A1 | 1/2002 | Ando |
| 2002/0016235 | A1 | 2/2002 | Ashby et al. |
| 2002/0019298 | A1 | 2/2002 | Eschenbach |
| 2002/0022551 | A1 | 2/2002 | Watterson et al. |
| 2002/0022555 | A1 | 2/2002 | Nesci |
| 2002/0024521 | A1 | 2/2002 | Goden |
| 2002/0025888 | A1 | 2/2002 | Germanton |
| 2002/0026130 | A1 | 2/2002 | West |
| 2002/0026292 | A1 | 2/2002 | Isami |
| 2002/0031756 | A1 | 3/2002 | Holtz |
| 2002/0039952 | A1 | 4/2002 | Clem |
| 2002/0042328 | A1 | 4/2002 | Yoo |
| 2002/0042912 | A1 | 4/2002 | Iijima |
| 2002/0043909 | A1 | 4/2002 | Nielsen |
| 2002/0045519 | A1 | 4/2002 | Watterson |
| 2002/0047867 | A1 | 4/2002 | Mault |
| 2002/0049121 | A1 | 4/2002 | Anderson |
| 2002/0049122 | A1 | 4/2002 | Mercado |

(56) References Cited

U.S. PATENT DOCUMENTS

2002/0054244 A1 5/2002 Holtz
2002/0055418 A1 5/2002 Pyles et al.
2002/0055419 A1 5/2002 Hinnebusch
2002/0055420 A1 5/2002 Stearns et al.
2002/0055422 A1 5/2002 Airmet
2002/0055857 A1 5/2002 Mault
2002/0060335 A1 5/2002 Edgar
2002/0062236 A1 5/2002 Murashita
2002/0066735 A1 6/2002 Hewlitt et al.
2002/0068887 A1 6/2002 Kikumoto
2002/0068991 A1 6/2002 Fitzsimmons, Jr.
2002/0070954 A1 6/2002 Lang
2002/0077219 A1 6/2002 Cohen
2002/0077221 A1 6/2002 Dalebout et al.
2002/0083122 A1 6/2002 Lemchen
2002/0086779 A1 7/2002 Wilkinson
2002/0088337 A1 7/2002 Devecka
2002/0091043 A1 7/2002 Rexach
2002/0091796 A1 7/2002 Higginson
2002/0094914 A1 7/2002 Maresh et al.
2002/0106617 A1 8/2002 Hersh
2002/0107058 A1 8/2002 Namba et al.
2002/0109710 A1 8/2002 Holtz et al.
2002/0111541 A1 8/2002 Bibl et al.
2002/0115536 A1 8/2002 Hojo
2002/0116266 A1 8/2002 Marshall
2002/0128119 A1 9/2002 Arai
2002/0128127 A1 9/2002 Chen
2002/0138023 A1 9/2002 Kume et al.
2002/0142887 A1 10/2002 O'Malley
2002/0142890 A1 10/2002 Ohrt
2002/0145091 A1 10/2002 Talish
2002/0147078 A1 10/2002 Wu
2002/0151413 A1 10/2002 Dalebout
2002/0155416 A1 10/2002 Barton
2002/0156351 A1 10/2002 Sagel
2002/0156387 A1 10/2002 Dardik
2002/0160883 A1 10/2002 Dugan
2002/0164929 A1 11/2002 Pinson
2002/0169634 A1 11/2002 Nishi
2002/0171070 A1 11/2002 Shim
2002/0173407 A1 11/2002 Bowman
2002/0173412 A1 11/2002 Stearns
2002/0187879 A1 12/2002 Ball
2002/0193214 A1 12/2002 Ish
2002/0194604 A1 12/2002 Sanchez et al.
2002/0198084 A1 12/2002 Stearns et al.
2002/0198776 A1 12/2002 Nara
2003/0004424 A1 1/2003 Birnbaum
2003/0013072 A1 1/2003 Thomas
2003/0021273 A1 1/2003 Fouquet
2003/0027690 A1 2/2003 Miller
2003/0032524 A1 2/2003 Lamar et al.
2003/0032535 A1 2/2003 Wang
2003/0033600 A1 2/2003 Cliff et al.
2003/0040348 A1 2/2003 Martens
2003/0041076 A1 2/2003 Lucovsky
2003/0043986 A1 3/2003 Creamer et al.
2003/0043989 A1 3/2003 Creamer et al.
2003/0044021 A1 3/2003 Wilkinson
2003/0045403 A1 3/2003 Watterson et al.
2003/0045406 A1 3/2003 Stone
2003/0060331 A1 3/2003 Polk
2003/0060344 A1 3/2003 David
2003/0063133 A1 4/2003 Foote et al.
2003/0065561 A1 4/2003 Brown et al.
2003/0069108 A1 4/2003 Rubinstein
2003/0073545 A1 4/2003 Liu
2003/0078138 A1 4/2003 Toyama
2003/0083177 A1 5/2003 Tung
2003/0088196 A1 5/2003 Steve
2003/0092532 A1 5/2003 Giannelli et al.
2003/0092540 A1 5/2003 Gillen
2003/0092542 A1 5/2003 Bartholomew et al.
2003/0096675 A1 5/2003 Wang
2003/0097878 A1 5/2003 Farringdon et al.
2003/0100406 A1 5/2003 Millington
2003/0104907 A1 6/2003 Sankrithi
2003/0104908 A1 6/2003 Tung
2003/0105390 A1 6/2003 Alessandri
2003/0115157 A1 6/2003 Circenis
2003/0119635 A1 6/2003 Arbuckle
2003/0125165 A1 7/2003 Trevino
2003/0126593 A1 7/2003 Mault
2003/0128186 A1 7/2003 Laker
2003/0134714 A1 7/2003 Oishi et al.
2003/0134718 A1 7/2003 Kim
2003/0138761 A1 7/2003 Pesnell
2003/0139254 A1 7/2003 Chang
2003/0142951 A1 7/2003 Tsurugai
2003/0148853 A1 8/2003 Alessandri
2003/0148857 A1 8/2003 Yu
2003/0149344 A1 8/2003 Nizan
2003/0153434 A1 8/2003 Dalebout
2003/0153436 A1 8/2003 Ho
2003/0153848 A1 8/2003 Talish
2003/0153849 A1 8/2003 Huckle
2003/0158014 A1 8/2003 Valentin-Sivico
2003/0163287 A1 8/2003 Vock et al.
2003/0165802 A1 9/2003 Murphy
2003/0166434 A1 9/2003 Lopez-Santillana et al.
2003/0171189 A1 9/2003 Kaufman
2003/0171190 A1 9/2003 Rice
2003/0171192 A1 9/2003 Wu
2003/0176815 A1 9/2003 Baba et al.
2003/0181289 A1 9/2003 Oscar Moavro
2003/0181291 A1 9/2003 Ogawa
2003/0181293 A1 9/2003 Baatz
2003/0183027 A1 10/2003 Koch
2003/0195089 A1 10/2003 Schroeder
2003/0197110 A1 10/2003 Cui
2003/0207237 A1 11/2003 Glezerman
2003/0208113 A1 11/2003 Mault et al.
2003/0211449 A1 11/2003 Seiller
2003/0211916 A1 11/2003 Capuano
2003/0212536 A1 11/2003 Wang
2003/0214530 A1 11/2003 Wang
2003/0216228 A1 11/2003 Rast
2003/0220143 A1 11/2003 Shteyn et al.
2003/0222419 A1 12/2003 Geary
2003/0224337 A1 12/2003 Shum et al.
2003/0227473 A1 12/2003 Shih
2003/0232707 A1 12/2003 Dalebout et al.
2003/0236153 A1 12/2003 Pan et al.
2004/0005958 A1 1/2004 Kamen et al.
2004/0005959 A1 1/2004 Takizawa
2004/0005961 A1 1/2004 Iund
2004/0008220 A1 1/2004 Snyder et al.
2004/0010420 A1 1/2004 Rooks
2004/0012335 A1 1/2004 Shon et al.
2004/0014014 A1 1/2004 Hess
2004/0014567 A1 1/2004 Mendel
2004/0014571 A1 1/2004 Haynes
2004/0018915 A1 1/2004 Reyes
2004/0018917 A1 1/2004 Corbalis
2004/0018918 A1 1/2004 Reyes
2004/0019654 A1 1/2004 Powers
2004/0023759 A1 2/2004 Duncan et al.
2004/0023761 A1 2/2004 Emery
2004/0023762 A1 2/2004 Lull
2004/0023766 A1 2/2004 Slone
2004/0023778 A1 2/2004 Kusumoto et al.
2004/0025754 A1 2/2004 Dye
2004/0027368 A1 2/2004 Snyder et al.
2004/0029645 A1 2/2004 Chen
2004/0030762 A1 2/2004 Silverthorne
2004/0033865 A1 2/2004 Wu
2004/0043871 A1 3/2004 Chang
2004/0043873 A1 3/2004 Wilkinson et al.
2004/0046692 A1 3/2004 Robson
2004/0051392 A1 3/2004 Badarneh
2004/0053748 A1 3/2004 Lo et al.
2004/0054350 A1 3/2004 Shaughnessy
2004/0058784 A1 3/2004 Roberts

(56) References Cited

U.S. PATENT DOCUMENTS

| | | | |
|---|---|---|---|
| 2004/0063549 | A1 | 4/2004 | Kuo |
| 2004/0067821 | A1 | 4/2004 | Kehrbaum |
| 2004/0067822 | A1 | 4/2004 | Sher |
| 2004/0067833 | A1 | 4/2004 | Talish |
| 2004/0072652 | A1 | 4/2004 | Alessandri et al. |
| 2004/0072657 | A1 | 4/2004 | Arguilez |
| 2004/0077462 | A1 | 4/2004 | Brown |
| 2004/0077463 | A1 | 4/2004 | Rodgers |
| 2004/0077975 | A1 | 4/2004 | Zimmerman |
| 2004/0078208 | A1 | 4/2004 | Burwell |
| 2004/0082444 | A1 | 4/2004 | Golesh |
| 2004/0092367 | A1 | 5/2004 | Corbalis |
| 2004/0092849 | A1 | 5/2004 | Talish |
| 2004/0095516 | A1 | 5/2004 | Rohlicek |
| 2004/0097331 | A1 | 5/2004 | Zillig |
| 2004/0100484 | A1 | 5/2004 | Barrett |
| 2004/0102291 | A1 | 5/2004 | Eschenbach |
| 2004/0102931 | A1 | 5/2004 | Ellis |
| 2004/0103146 | A1 | 5/2004 | Park |
| 2004/0103432 | A1 | 5/2004 | Barrett |
| 2004/0114768 | A1 | 6/2004 | Luo |
| 2004/0116837 | A1 | 6/2004 | Yamaguchi |
| 2004/0116899 | A1 | 6/2004 | Shaughnessy |
| 2004/0117072 | A1 | 6/2004 | Takeda |
| 2004/0117214 | A1 | 6/2004 | Shea |
| 2004/0127285 | A1 | 7/2004 | Kavana |
| 2004/0127334 | A1 | 7/2004 | Heppert |
| 2004/0127335 | A1 | 7/2004 | Watterson |
| 2004/0127336 | A1 | 7/2004 | Lapcevic |
| 2004/0132583 | A1 | 7/2004 | Ohrt et al. |
| 2004/0132586 | A1 | 7/2004 | Leighton et al. |
| 2004/0132587 | A1 | 7/2004 | Leighton et al. |
| 2004/0136750 | A1 | 7/2004 | Yoshioka et al. |
| 2004/0138030 | A1 | 7/2004 | Wang |
| 2004/0142800 | A1 | 7/2004 | Gerschefske |
| 2004/0144626 | A1 | 7/2004 | Saeki |
| 2004/0147375 | A1 | 7/2004 | Stevens |
| 2004/0152566 | A1 | 8/2004 | Yeh |
| 2004/0155622 | A1 | 8/2004 | Mayhew et al. |
| 2004/0157546 | A1 | 8/2004 | Fantaay |
| 2004/0157706 | A1 | 8/2004 | Miller |
| 2004/0160336 | A1 | 8/2004 | Hoch |
| 2004/0162188 | A1 | 8/2004 | Watterson |
| 2004/0162189 | A1 | 8/2004 | Hickman |
| 2004/0162191 | A1 | 8/2004 | Ercanbrack |
| 2004/0162194 | A1 | 8/2004 | Habing |
| 2004/0162195 | A1 | 8/2004 | Habing |
| 2004/0163574 | A1 | 8/2004 | Schoenbach |
| 2004/0166999 | A1 | 8/2004 | Dodge |
| 2004/0171460 | A1 | 9/2004 | Park |
| 2004/0171464 | A1 | 9/2004 | Ashby et al. |
| 2004/0171465 | A1 | 9/2004 | Hald |
| 2004/0176215 | A1 | 9/2004 | Gramaccioni |
| 2004/0176217 | A1 | 9/2004 | Watterson |
| 2004/0177531 | A1 | 9/2004 | Dibenedetto et al. |
| 2004/0180719 | A1 | 9/2004 | Feldman |
| 2004/0180760 | A1 | 9/2004 | Rufino |
| 2004/0181972 | A1 | 9/2004 | Csorba |
| 2004/0186390 | A1 | 9/2004 | Ross et al. |
| 2004/0187628 | A1 | 9/2004 | Stevens |
| 2004/0192514 | A1 | 9/2004 | Piaget et al. |
| 2004/0198555 | A1 | 10/2004 | Anderson |
| 2004/0198559 | A1 | 10/2004 | Grossi |
| 2004/0198571 | A1 | 10/2004 | Howell et al. |
| 2004/0204294 | A2 | 10/2004 | Wilkinson |
| 2004/0208943 | A1 | 10/2004 | Miketin |
| 2004/0210661 | A1 | 10/2004 | Thompson |
| 2004/0214693 | A1 | 10/2004 | Piaget et al. |
| 2004/0215958 | A1 | 10/2004 | Ellis |
| 2004/0220017 | A1 | 11/2004 | Gordon |
| 2004/0224740 | A1 | 11/2004 | Ball et al. |
| 2004/0224825 | A1 | 11/2004 | Giannelli et al. |
| 2004/0224827 | A1 | 11/2004 | Ashley |
| 2004/0225239 | A1 | 11/2004 | Yamamoto |
| 2004/0225532 | A1 | 11/2004 | Gadiyak |
| 2004/0229730 | A1 | 11/2004 | Ainsworth et al. |
| 2004/0230138 | A1 | 11/2004 | Inoue et al. |
| 2004/0242378 | A1 | 12/2004 | Pan |
| 2004/0242379 | A1 | 12/2004 | Juva |
| 2004/0242380 | A1 | 12/2004 | Kuivala |
| 2004/0242388 | A1 | 12/2004 | Kusminsky |
| 2004/0248699 | A1 | 12/2004 | Colley |
| 2004/0248707 | A1 | 12/2004 | Rodgers |
| 2004/0248713 | A1 | 12/2004 | Campanaro |
| 2004/0254020 | A1 | 12/2004 | Dragusin |
| 2004/0256524 | A1 | 12/2004 | Beck et al. |
| 2004/0259689 | A1 | 12/2004 | Wilkins et al. |
| 2004/0266587 | A1 | 12/2004 | Miller |
| 2005/0003338 | A1 | 1/2005 | Norcott et al. |
| 2005/0003931 | A1 | 1/2005 | Mills et al. |
| 2005/0003933 | A1 | 1/2005 | Kau |
| 2005/0008992 | A1 | 1/2005 | Westergaard et al. |
| 2005/0009668 | A1 | 1/2005 | Savettiere |
| 2005/0012622 | A1 | 1/2005 | Sutton |
| 2005/0013433 | A1 | 1/2005 | Ghassabian |
| 2005/0014571 | A1 | 1/2005 | Varner |
| 2005/0015281 | A1 | 1/2005 | Clark et al. |
| 2005/0020887 | A1 | 1/2005 | Goldberg |
| 2005/0023292 | A1 | 2/2005 | Market et al. |
| 2005/0025615 | A1 | 2/2005 | Gabrys et al. |
| 2005/0026750 | A1 | 2/2005 | Oglesby et al. |
| 2005/0026752 | A1 | 2/2005 | Lull et al. |
| 2005/0026811 | A1 | 2/2005 | Mjalli |
| 2005/0032610 | A1 | 2/2005 | Nelson |
| 2005/0032611 | A1 | 2/2005 | Webber |
| 2005/0037898 | A1 | 2/2005 | Chang |
| 2005/0037904 | A1 | 2/2005 | Chang |
| 2005/0038698 | A1 | 2/2005 | Lukose |
| 2005/0038699 | A1 | 2/2005 | Lillibridge |
| 2005/0043145 | A1 | 2/2005 | Anderson et al. |
| 2005/0043146 | A1 | 2/2005 | Lo et al. |
| 2005/0043155 | A1 | 2/2005 | Yannitte |
| 2005/0044210 | A1 | 2/2005 | Ku |
| 2005/0048461 | A1 | 3/2005 | Lahteenmaki |
| 2005/0049117 | A1 | 3/2005 | Rodgers |
| 2005/0049121 | A1 | 3/2005 | Dalebout |
| 2005/0054254 | A1 | 3/2005 | Erickson et al. |
| 2005/0054492 | A1 | 3/2005 | Neff |
| 2005/0054940 | A1 | 3/2005 | Almen |
| 2005/0060238 | A1 | 3/2005 | Gravina et al. |
| 2005/0062841 | A1 | 3/2005 | Rivera-Cintron |
| 2005/0064994 | A1 | 3/2005 | Matsumoto |
| 2005/0071462 | A1 | 3/2005 | Bodin et al. |
| 2005/0071463 | A1 | 3/2005 | Bodin et al. |
| 2005/0075213 | A1 | 4/2005 | Arick |
| 2005/0075217 | A1 | 4/2005 | Stevens |
| 2005/0075222 | A1 | 4/2005 | Adley |
| 2005/0075903 | A1 | 4/2005 | Piccionelli |
| 2005/0079905 | A1 | 4/2005 | Martens |
| 2005/0085344 | A1 | 4/2005 | Eschenbach |
| 2005/0085352 | A1 | 4/2005 | Baxter |
| 2005/0090770 | A1 | 4/2005 | Chen |
| 2005/0096187 | A1 | 5/2005 | Hsu |
| 2005/0096189 | A1 | 5/2005 | Chen |
| 2005/0101445 | A1 | 5/2005 | Chen |
| 2005/0101463 | A1 | 5/2005 | Chen |
| 2005/0102172 | A1 | 5/2005 | Sirmans |
| 2005/0107216 | A1 | 5/2005 | Lee et al. |
| 2005/0107220 | A1 | 5/2005 | Wang |
| 2005/0107226 | A1 | 5/2005 | Monda |
| 2005/0107723 | A1 | 5/2005 | Wehman et al. |
| 2005/0107726 | A1 | 5/2005 | Oyen |
| 2005/0112601 | A1 | 5/2005 | Hassibi |
| 2005/0113158 | A1 | 5/2005 | Sterchi et al. |
| 2005/0113652 | A1 | 5/2005 | Stark et al. |
| 2005/0113723 | A1 | 5/2005 | Ueyama |
| 2005/0124463 | A1 | 6/2005 | Yeo et al. |
| 2005/0124471 | A1 | 6/2005 | Wilkinson |
| 2005/0129903 | A1 | 6/2005 | Carr |
| 2005/0130807 | A1 | 6/2005 | Cutler |
| 2005/0131319 | A1 | 6/2005 | Der Meer |
| 2005/0132838 | A1 | 6/2005 | Lin |
| 2005/0143226 | A1 | 6/2005 | Heidecke |
| 2005/0143228 | A1 | 6/2005 | Lee |

(56) References Cited

U.S. PATENT DOCUMENTS

2005/0148398 A1 7/2005 Lochtefeld et al.
2005/0148439 A1 7/2005 Wu
2005/0148440 A1 7/2005 Denton
2005/0148442 A1 7/2005 Watterson
2005/0148443 A1 7/2005 Watterson
2005/0159273 A1 7/2005 Chen
2005/0159277 A1 7/2005 Mcvay
2005/0159278 A1 7/2005 Mcvay
2005/0159712 A1 7/2005 Andersen
2005/0160141 A1 7/2005 Galley
2005/0164832 A1 7/2005 Maschke
2005/0164837 A1 7/2005 Anderson
2005/0164838 A1 7/2005 Watterson
2005/0164839 A1 7/2005 Watterson
2005/0167907 A1 8/2005 Curkendall et al.
2005/0170935 A1 8/2005 Manser
2005/0170936 A1 8/2005 Quinn
2005/0172311 A1 8/2005 Hjelt et al.
2005/0178210 A1 8/2005 Lanham
2005/0181347 A1 8/2005 Barnes et al.
2005/0181911 A1 8/2005 Porth
2005/0187704 A1 8/2005 Peters
2005/0192162 A1 9/2005 Pan
2005/0192163 A1 9/2005 Pan et al.
2005/0195094 A1 9/2005 White
2005/0196737 A1 9/2005 Mann
2005/0202862 A1 9/2005 Shuman et al.
2005/0202934 A1 9/2005 Olrik et al.
2005/0209050 A1 9/2005 Bartels
2005/0209051 A1 9/2005 Santomassimo et al.
2005/0209052 A1 9/2005 Ashby
2005/0209056 A1 9/2005 Daly
2005/0209060 A1 9/2005 Lull
2005/0209061 A1 9/2005 Crawford et al.
2005/0209062 A1 9/2005 Anderson et al.
2005/0209887 A1 9/2005 Pollner
2005/0210169 A1 9/2005 Chou
2005/0212202 A1 9/2005 Meyer
2005/0213442 A1 9/2005 Sako
2005/0215335 A1 9/2005 Marquardt
2005/0215397 A1 9/2005 Watterson
2005/0227811 A1 10/2005 Shum et al.
2005/0227820 A1 10/2005 Dyer et al.
2005/0228245 A1 10/2005 Quy
2005/0228883 A1 10/2005 Brown
2005/0233859 A1 10/2005 Takai
2005/0233861 A1 10/2005 Hickman
2005/0233864 A1 10/2005 Smith et al.
2005/0233866 A1 10/2005 Miyamaru et al.
2005/0233871 A1 10/2005 Anders
2005/0238182 A1 10/2005 Shih et al.
2005/0239600 A1 10/2005 Liang
2005/0239601 A1 10/2005 Thomas
2005/0239607 A1 10/2005 Chang
2005/0240444 A1 10/2005 Wooten
2005/0245358 A1 11/2005 Mercado
2005/0245370 A1 11/2005 Boland
2005/0245431 A1 11/2005 Demmer et al.
2005/0250622 A1 11/2005 Chang
2005/0255970 A1 11/2005 Wu
2005/0261609 A1 11/2005 Collings et al.
2005/0264112 A1 12/2005 Tanaka et al.
2005/0266961 A1 12/2005 Shum et al.
2005/0269601 A1 12/2005 Tsubaki
2005/0272561 A1 12/2005 Cammerata
2005/0272562 A1 12/2005 Alessandri et al.
2005/0272564 A1 12/2005 Pyles et al.
2005/0272577 A1 12/2005 Olson
2005/0274188 A1 12/2005 Cabanis et al.
2005/0277520 A1 12/2005 Van Waes
2005/0281963 A1 12/2005 Cook
2005/0283911 A1 12/2005 Roussy
2005/0288155 A1 12/2005 Yang
2005/0288954 A1 12/2005 McCarthy et al.
2006/0003869 A1 1/2006 Huang et al.
2006/0003872 A1 1/2006 Chiles et al.
2006/0004265 A1 1/2006 Pulkkinen et al.
2006/0006005 A1 1/2006 Dumornay
2006/0009332 A1 1/2006 Jones
2006/0013351 A1 1/2006 Crider
2006/0019224 A1 1/2006 Behar et al.
2006/0019802 A1 1/2006 Caird
2006/0019804 A1 1/2006 Young
2006/0020174 A1 1/2006 Matsumura
2006/0020556 A1 1/2006 Hamnen
2006/0020990 A1 1/2006 McEneaney
2006/0034161 A1 2/2006 Muller
2006/0035755 A1 2/2006 Dalebout
2006/0035757 A1 2/2006 Mueller et al.
2006/0035758 A1 2/2006 Rogozinski
2006/0035768 A1 2/2006 Kowallis
2006/0035774 A1 2/2006 Marks
2006/0040244 A1 2/2006 Kain
2006/0040246 A1 2/2006 Ding et al.
2006/0040793 A1 2/2006 Martens
2006/0040797 A1 2/2006 Chang
2006/0040798 A1 2/2006 Weier et al.
2006/0046807 A1 3/2006 Sanchez
2006/0046898 A1 3/2006 Harvey
2006/0046905 A1 3/2006 Doody, Jr.
2006/0047447 A1 3/2006 Brady et al.
2006/0052220 A1 3/2006 Jackson et al.
2006/0052727 A1 3/2006 Palestrant
2006/0053586 A1 3/2006 Chase
2006/0053587 A1 3/2006 Chase
2006/0058155 A1 3/2006 Kumar
2006/0058158 A1 3/2006 McAvoy
2006/0058159 A1 3/2006 Eschenbach
2006/0058162 A1 3/2006 Vieno et al.
2006/0063644 A1 3/2006 Yang
2006/0063980 A1 3/2006 Hwang et al.
2006/0068978 A1 3/2006 Moon
2006/0069102 A1 3/2006 Leban et al.
2006/0075544 A1 4/2006 Kriesel
2006/0079381 A1 4/2006 Cornejo
2006/0079800 A1 4/2006 Martikka et al.
2006/0084551 A1 4/2006 Volpe, Jr.
2006/0084851 A1 4/2006 Lee et al.
2006/0089238 A1 4/2006 Huang et al.
2006/0094569 A1 5/2006 Day
2006/0094570 A1 5/2006 Schneider
2006/0097453 A1 5/2006 Feldman
2006/0100069 A1 5/2006 Dibble et al.
2006/0100546 A1 5/2006 Silk
2006/0104047 A1 5/2006 Guzman
2006/0105888 A1 5/2006 Piane, Jr.
2006/0106424 A1 5/2006 Bachem
2006/0111944 A1 5/2006 Sirmans, Jr.
2006/0116558 A1 6/2006 Jang
2006/0122034 A1 6/2006 Chen
2006/0122038 A1 6/2006 Chou Lin
2006/0122044 A1 6/2006 Ho
2006/0122468 A1 6/2006 Tavor
2006/0122474 A1 6/2006 Teller et al.
2006/0123814 A1 6/2006 Choi et al.
2006/0128533 A1 6/2006 Ma
2006/0128534 A1 6/2006 Roque
2006/0129432 A1 6/2006 Choi et al.
2006/0132070 A1 6/2006 Heydt et al.
2006/0135274 A1 6/2006 Henry
2006/0135322 A1 6/2006 Rocker
2006/0142665 A1 6/2006 Garay et al.
2006/0148622 A1 7/2006 Chen
2006/0151303 A1 7/2006 Motoda
2006/0155576 A1 7/2006 Deluz
2006/0160639 A1 7/2006 Klein
2006/0160665 A1 7/2006 Tai
2006/0160666 A1 7/2006 Wang
2006/0160667 A1 7/2006 Oglesby et al.
2006/0161455 A1 7/2006 Anastasia
2006/0161621 A1 7/2006 Rosenberg
2006/0161656 A1 7/2006 Sorvisto
2006/0161850 A1 7/2006 Seaberg
2006/0166737 A1 7/2006 Bentley

(56) References Cited

U.S. PATENT DOCUMENTS

2006/0166790 A1 7/2006 Wang
2006/0166791 A1 7/2006 Liao
2006/0166799 A1 7/2006 Boland et al.
2006/0172862 A1 8/2006 Badarneh et al.
2006/0173556 A1 8/2006 Rosenberg
2006/0173828 A1 8/2006 Rosenberg
2006/0179044 A1 8/2006 Rosenberg
2006/0179056 A1 8/2006 Rosenberg
2006/0183602 A1 8/2006 Astilean
2006/0183606 A1 8/2006 Parmater
2006/0183980 A1 8/2006 Yang
2006/0184427 A1 8/2006 Singh
2006/0186197 A1 8/2006 Rosenberg
2006/0189439 A1 8/2006 Baudhuin
2006/0189440 A1 8/2006 Gravagne
2006/0189446 A1 8/2006 Rogus
2006/0189462 A1 8/2006 Pearson et al.
2006/0189854 A1 8/2006 Webb et al.
2006/0194679 A1 8/2006 Hatcher
2006/0195361 A1 8/2006 Rosenberg
2006/0198613 A1 9/2006 Lee
2006/0199155 A1 9/2006 Mosher
2006/0199701 A1 9/2006 May et al.
2006/0199706 A1 9/2006 Wehrell
2006/0203972 A1 9/2006 Hays
2006/0205349 A1 9/2006 Passier et al.
2006/0205564 A1 9/2006 Peterson
2006/0205568 A1 9/2006 Huang
2006/0205569 A1 9/2006 Watterson
2006/0205571 A1 9/2006 Krull
2006/0211549 A1 9/2006 Nohejl
2006/0217231 A1 9/2006 Parks et al.
2006/0217236 A1 9/2006 Watterson
2006/0217245 A1 9/2006 Golesh et al.
2006/0218253 A1 9/2006 Hays
2006/0223635 A1 10/2006 Rosenberg
2006/0223637 A1 10/2006 Rosenberg
2006/0223674 A1 10/2006 Korkie
2006/0223678 A1 10/2006 Maclean
2006/0223680 A1 10/2006 Chang
2006/0223681 A1 10/2006 Loane
2006/0224051 A1 10/2006 Teller et al.
2006/0228683 A1 10/2006 Jianping
2006/0229058 A1 10/2006 Rosenberg
2006/0229163 A1 10/2006 Waters
2006/0229164 A1 10/2006 Einav
2006/0229170 A1 10/2006 Ozawa et al.
2006/0232147 A1 10/2006 Cheng
2006/0234832 A1 10/2006 Toyama et al.
2006/0234838 A1 10/2006 Dalebout et al.
2006/0234840 A1 10/2006 Watson
2006/0240947 A1 10/2006 Qu
2006/0240951 A1 10/2006 Wang
2006/0240959 A1 10/2006 Huang
2006/0244187 A1 11/2006 Downey
2006/0247095 A1 11/2006 Rummerfield
2006/0247098 A1 11/2006 Raniere
2006/0247109 A1 11/2006 Powell
2006/0248965 A1 11/2006 Wyatt
2006/0250524 A1 11/2006 Roche
2006/0251638 A1 11/2006 Guenzler-Pukall
2006/0252600 A1 11/2006 Grogan
2006/0252602 A1 11/2006 Brown
2006/0252608 A1 11/2006 Kang et al.
2006/0252616 A1 11/2006 Gerschefske
2006/0253010 A1 11/2006 Brady et al.
2006/0253210 A1 11/2006 Rosenberg
2006/0256007 A1 11/2006 Rosenberg
2006/0256008 A1 11/2006 Rosenberg
2006/0258513 A1 11/2006 Routley
2006/0258515 A1 11/2006 Kang et al.
2006/0259275 A1 11/2006 Maschke
2006/0259574 A1 11/2006 Rosenberg
2006/0262752 A1 11/2006 Moore et al.
2006/0264286 A1 11/2006 Hodjat
2006/0264299 A1 11/2006 Farinelli et al.
2006/0264306 A1 11/2006 Tischler
2006/0264730 A1 11/2006 Stivoric et al.
2006/0265469 A1 11/2006 Estrade
2006/0269251 A1 11/2006 Hsu
2006/0270522 A1 11/2006 Yonehana et al.
2006/0271286 A1 11/2006 Rosenberg
2006/0276306 A1 12/2006 Pan et al.
2006/0279294 A1 12/2006 Cehelnik
2006/0281603 A1 12/2006 Hickman
2006/0281604 A1 12/2006 Stewart et al.
2006/0281605 A1 12/2006 Lo
2006/0283050 A1 12/2006 Carnes et al.
2006/0287089 A1 12/2006 Addington et al.
2006/0287147 A1 12/2006 Kriesel
2006/0287161 A1 12/2006 Dalebout
2006/0287163 A1 12/2006 Wang
2006/0288846 A1 12/2006 Logan
2006/0293153 A1 12/2006 Porth
2006/0293154 A1 12/2006 Graber
2006/0293608 A1 12/2006 Rothman et al.
2006/0293617 A1 12/2006 Einav et al.
2007/0000154 A1 1/2007 Dibenedetto
2007/0004561 A1 1/2007 Yoo
2007/0004562 A1 1/2007 Pan et al.
2007/0004565 A1 1/2007 Gebhardt
2007/0004569 A1 1/2007 Cao
2007/0004736 A1 1/2007 Kubo
2007/0005395 A1 1/2007 Singh
2007/0006489 A1 1/2007 Case et al.
2007/0010383 A1 1/2007 Pertegaz-Esteban
2007/0011027 A1 1/2007 Melendez
2007/0011391 A1 1/2007 Kim et al.
2007/0011920 A1 1/2007 DiBenedetto et al.
2007/0013655 A1 1/2007 Rosenberg et al.
2007/0014422 A1 1/2007 Wesemann et al.
2007/0015633 A1 1/2007 Gerschefske et al.
2007/0015635 A1 1/2007 Donner
2007/0015636 A1 1/2007 Molter
2007/0015752 A1 1/2007 Hangauer, Jr.
2007/0016444 A1 1/2007 Holkkola
2007/0016930 A1 1/2007 Wesemann et al.
2007/0026958 A1 2/2007 Barasch et al.
2007/0026999 A1 2/2007 Merolle et al.
2007/0027000 A1 2/2007 Shirai et al.
2007/0027002 A1 2/2007 Clark et al.
2007/0027003 A1 2/2007 Clark
2007/0028749 A1 2/2007 Basson
2007/0032345 A1 2/2007 Padmanabhan
2007/0032351 A1 2/2007 Reyes
2007/0032353 A1 2/2007 Wilkins et al.
2007/0032481 A1 2/2007 Dvorak
2007/0033012 A1 2/2007 Rosenberg
2007/0033068 A1 2/2007 Rao
2007/0033069 A1 2/2007 Rao
2007/0034625 A1 2/2007 Pacheco
2007/0037667 A1 2/2007 Gordon
2007/0038038 A1 2/2007 Stivoric et al.
2007/0038137 A1 2/2007 Arand et al.
2007/0038153 A1 2/2007 Basson
2007/0042866 A1 2/2007 Skilken
2007/0042871 A1 2/2007 Wu et al.
2007/0049384 A1 3/2007 King et al.
2007/0049461 A1 3/2007 Kim et al.
2007/0049462 A1 3/2007 Asukai et al.
2007/0049464 A1 3/2007 Chou
2007/0049465 A1 3/2007 Wu
2007/0049466 A1 3/2007 Hubbard
2007/0049467 A1 3/2007 Lin
2007/0049470 A1 3/2007 Pyles et al.
2007/0051369 A1 3/2007 Choi et al.
2007/0054778 A1 3/2007 Blanarovich
2007/0054790 A1 3/2007 Dodge et al.
2007/0060408 A1 3/2007 Schultz et al.
2007/0060446 A1 3/2007 Asukai et al.
2007/0060449 A1 3/2007 Lo
2007/0060450 A1 3/2007 Lo
2007/0060451 A1 3/2007 Lucas
2007/0060898 A1 3/2007 Shaughnessy

(56) References Cited

U.S. PATENT DOCUMENTS

2007/0061314 A1 3/2007 Rosenberg
2007/0063033 A1 3/2007 Silverbrook et al.
2007/0066448 A1 3/2007 Pan et al.
2007/0072156 A1 3/2007 Kaufman et al.
2007/0072748 A1 3/2007 Lee
2007/0072752 A1 3/2007 Koch
2007/0074617 A1 4/2007 Vergo
2007/0075127 A1 4/2007 Rosenberg
2007/0079691 A1 4/2007 Turner
2007/0083095 A1 4/2007 Rippo et al.
2007/0083323 A1 4/2007 Rosenberg
2007/0083975 A1 4/2007 Senegal
2007/0087906 A1 4/2007 Rodgers, Jr.
2007/0087907 A1 4/2007 Rodgers, Jr.
2007/0087908 A1 4/2007 Pan et al.
2007/0093360 A1 4/2007 Neff
2007/0093369 A1 4/2007 Bocchicchio
2007/0100595 A1 5/2007 Earles
2007/0100666 A1 5/2007 Stivoric et al.
2007/0106484 A1 5/2007 Sweatman et al.
2007/0109491 A1 5/2007 Howell et al.
2007/0111753 A1 5/2007 Vock
2007/0111858 A1 5/2007 Dugan
2007/0111866 A1 5/2007 McVay et al.
2007/0117680 A1 5/2007 Neff
2007/0117683 A1 5/2007 Ercanbrack et al.
2007/0117693 A1 5/2007 Ilioi
2007/0122786 A1 5/2007 Relan et al.
2007/0123389 A1 5/2007 Martin
2007/0123390 A1 5/2007 Mathis
2007/0123395 A1 5/2007 Ellis
2007/0123396 A1 5/2007 Ellis
2007/0124762 A1 5/2007 Chickering et al.
2007/0129220 A1 6/2007 Bardha
2007/0129907 A1 6/2007 Demon
2007/0131409 A1 6/2007 Asahi
2007/0135264 A1 6/2007 Rosenberg
2007/0135267 A1 6/2007 Wang
2007/0135268 A1 6/2007 Wang
2007/0135269 A1 6/2007 Wang
2007/0135738 A1 6/2007 Bonutti
2007/0136093 A1 6/2007 Rankin et al.
2007/0137307 A1 6/2007 Gruben
2007/0137331 A1 6/2007 Kachouh
2007/0140403 A1 6/2007 Yuguchi et al.
2007/0142175 A1 6/2007 Morgan
2007/0142177 A1 6/2007 Simms et al.
2007/0142179 A1 6/2007 Terao et al.
2007/0142183 A1 6/2007 Chang
2007/0142187 A1 6/2007 Kolomeir
2007/0146347 A1 6/2007 Rosenberg
2007/0149362 A1 6/2007 Lee et al.
2007/0149363 A1 6/2007 Wang
2007/0149364 A1 6/2007 Blau
2007/0150188 A1 6/2007 Rosenberg
2007/0151489 A1 7/2007 Byrne
2007/0153639 A1 7/2007 Lafever
2007/0155277 A1 7/2007 Amitai et al.
2007/0155495 A1 7/2007 Goo
2007/0155589 A1 7/2007 Feldman
2007/0156335 A1 7/2007 McBride et al.
2007/0161459 A1 7/2007 Watson
2007/0161466 A1 7/2007 Oglesby et al.
2007/0161468 A1 7/2007 Yanagisawa et al.
2007/0162823 A1 7/2007 Lin et al.
2007/0167291 A1 7/2007 Kuo
2007/0167292 A1 7/2007 Kuo
2007/0167293 A1 7/2007 Nally
2007/0169381 A1 7/2007 Gordon
2007/0173355 A1 7/2007 Klein
2007/0176035 A1 8/2007 Campbell
2007/0179023 A1 8/2007 Dyer
2007/0179359 A1 8/2007 Goodwin
2007/0180737 A1 8/2007 DiBenedetto et al.
2007/0184953 A1 8/2007 Luberski et al.
2007/0189544 A1 8/2007 Rosenberg
2007/0190508 A1 8/2007 Dalton
2007/0191141 A1 8/2007 Weber
2007/0191190 A1 8/2007 Kuo
2007/0191197 A1 8/2007 Vittone
2007/0197193 A1 8/2007 Zhou
2007/0197274 A1 8/2007 Dugan
2007/0197345 A1 8/2007 Wallace et al.
2007/0197346 A1 8/2007 Seliber
2007/0197353 A1 8/2007 Hundley
2007/0197355 A1 8/2007 Brown
2007/0197920 A1 8/2007 Adams
2007/0201727 A1 8/2007 Birrell et al.
2007/0202992 A1 8/2007 Grasshoff
2007/0202994 A1 8/2007 Alessandri
2007/0202995 A1 8/2007 Roman
2007/0203004 A1 8/2007 Campanaro et al.
2007/0204430 A1 9/2007 Chase
2007/0207733 A1 9/2007 Wong et al.
2007/0208280 A1 9/2007 Talish
2007/0208392 A1 9/2007 Kuschner et al.
2007/0208530 A1 9/2007 Vock
2007/0213110 A1 9/2007 Rosenberg
2007/0213126 A1 9/2007 Deutsch et al.
2007/0213178 A1 9/2007 Lemmela
2007/0213183 A1 9/2007 Menektchiev
2007/0214630 A1 9/2007 Kim
2007/0218432 A1 9/2007 Glass
2007/0219057 A1 9/2007 Fleishman
2007/0219058 A1 9/2007 Fleishman
2007/0219059 A1 9/2007 Schwartz
2007/0219063 A1 9/2007 Anderson
2007/0219066 A1 9/2007 Wang
2007/0219068 A1 9/2007 Korfmacher
2007/0219074 A1 9/2007 Pride
2007/0219457 A1 9/2007 Lo
2007/0225118 A1 9/2007 Giorno
2007/0225119 A1 9/2007 Schenk
2007/0225120 A1 9/2007 Schenk
2007/0225126 A1 9/2007 Yoo
2007/0225127 A1 9/2007 Pan et al.
2007/0225622 A1 9/2007 Huang et al.
2007/0227409 A1 10/2007 Chu
2007/0232450 A1 10/2007 Hanoun
2007/0232452 A1 10/2007 Hanoun
2007/0232453 A1 10/2007 Hanoun
2007/0232455 A1 10/2007 Hanoun
2007/0232461 A1 10/2007 Jenkins et al.
2007/0232463 A1 10/2007 Wu
2007/0232467 A1 10/2007 Puzey
2007/0233743 A1 10/2007 Rosenberg
2007/0238580 A1 10/2007 Wang
2007/0238582 A1 10/2007 Lee
2007/0239479 A1 10/2007 Arrasvuori
2007/0243974 A1 10/2007 Li
2007/0243979 A1 10/2007 Hand
2007/0245258 A1 10/2007 Ginggen et al.
2007/0245612 A1 10/2007 Tresenfeld
2007/0247320 A1 10/2007 Morahan
2007/0249467 A1 10/2007 Hong et al.
2007/0249468 A1 10/2007 Chen
2007/0249471 A1 10/2007 Nurre
2007/0254778 A1 11/2007 Ashby
2007/0260161 A1 11/2007 Trandafir
2007/0260482 A1 11/2007 Nurmela
2007/0265146 A1 11/2007 Kowalczewski
2007/0270294 A1 11/2007 Sheets
2007/0270663 A1 11/2007 Ng et al.
2007/0270667 A1 11/2007 Coppi et al.
2007/0270721 A1 11/2007 Ananny et al.
2007/0270726 A1 11/2007 Chou
2007/0271065 A1 11/2007 Gupta et al.
2007/0271116 A1 11/2007 Wysocki et al.
2007/0271387 A1 11/2007 Lydon et al.
2007/0272011 A1 11/2007 Chapa, Jr.
2007/0275825 A1 11/2007 O'brien
2007/0275826 A1 11/2007 Niemimaki et al.
2007/0275830 A1 11/2007 Lee
2007/0276870 A1 11/2007 Rosenberg

(56) References Cited

U.S. PATENT DOCUMENTS

2007/0281828 A1 12/2007 Rice
2007/0281831 A1 12/2007 Wang
2007/0283853 A1 12/2007 Sun
2007/0284495 A1 12/2007 Charles
2007/0287141 A1 12/2007 Milner
2007/0287597 A1 12/2007 Cameron
2007/0287601 A1 12/2007 Burck et al.
2007/0287930 A1 12/2007 Sutton
2007/0288204 A1 12/2007 Gienke et al.
2007/0288251 A1 12/2007 Ebrom et al.
2007/0288331 A1 12/2007 Ebrom et al.
2007/0288476 A1 12/2007 Flanagan, III
2007/0288969 A1 12/2007 Prum
2007/0293781 A1 12/2007 Sims et al.
2007/0296313 A1 12/2007 Wang
2007/0298405 A1 12/2007 Ebrom et al.
2007/0298935 A1 12/2007 Badarneh
2007/0298937 A1 12/2007 Shah
2008/0001772 A1 1/2008 Saito
2008/0001866 A1 1/2008 Martin
2008/0004162 A1 1/2008 Chen
2008/0004163 A1 1/2008 Husted
2008/0005276 A1 1/2008 Frederick
2008/0009275 A1 1/2008 Werner
2008/0015061 A1 1/2008 Klein
2008/0015087 A1 1/2008 Negrin
2008/0015088 A1 1/2008 Del Monaco
2008/0015089 A1 1/2008 Hurwitz
2008/0015094 A1 1/2008 Casagrande
2008/0015477 A1 1/2008 Talish et al.
2008/0018211 A1 1/2008 Dye
2008/0020898 A1 1/2008 Pyles et al.
2008/0020902 A1 1/2008 Arnold
2008/0020907 A1 1/2008 Lin
2008/0026658 A1 1/2008 Kriesel
2008/0026838 A1 1/2008 Dunstan et al.
2008/0027337 A1 1/2008 Dugan
2008/0027673 A1 1/2008 Trumm
2008/0032864 A1 2/2008 Hakki
2008/0032865 A1 2/2008 Wu
2008/0032870 A1 2/2008 Wu
2008/0032871 A1 2/2008 Yeh
2008/0037375 A1 2/2008 Ellner et al.
2008/0039301 A1 2/2008 Halbridge
2008/0045384 A1 2/2008 Matsubara
2008/0046246 A1 2/2008 Hakki
2008/0051256 A1 2/2008 Ashby et al.
2008/0051258 A1 2/2008 Schmehl et al.
2008/0051260 A1 2/2008 Simonson et al.
2008/0051261 A1 2/2008 Lewis
2008/0051274 A1 2/2008 Greene
2008/0051919 A1 2/2008 Sakai et al.
2008/0051993 A1 2/2008 Graham
2008/0057889 A1 3/2008 Jan
2008/0058169 A1 3/2008 Fox
2008/0058170 A1 3/2008 Giannascoli et al.
2008/0058176 A1 3/2008 Webber et al.
2008/0059064 A1 3/2008 Werner
2008/0062818 A1 3/2008 Plancon et al.
2008/0064571 A1 3/2008 Lee
2008/0064572 A1 3/2008 Nardone
2008/0067302 A1 3/2008 Olivera
2008/0068559 A1 3/2008 Howell et al.
2008/0070755 A1 3/2008 Mckee
2008/0070756 A1 3/2008 Chu
2008/0070765 A1 3/2008 Brown et al.
2008/0076637 A1 3/2008 Gilley et al.
2008/0076639 A1 3/2008 Fon
2008/0076969 A1 3/2008 Kraft
2008/0076972 A1 3/2008 Dorogusker et al.
2008/0077489 A1 3/2008 Gilley et al.
2008/0077619 A1 3/2008 Gilley et al.
2008/0082311 A1 4/2008 Meijer et al.
2008/0085819 A1 4/2008 Yang et al.
2008/0086318 A1 4/2008 Gilley et al.
2008/0089551 A1 4/2008 Heather et al.
2008/0090703 A1 4/2008 Rosenberg
2008/0096726 A1 4/2008 Riley et al.
2008/0096745 A1 4/2008 Perry
2008/0097633 A1 4/2008 Jochelson et al.
2008/0098797 A1 5/2008 Considine
2008/0103023 A1 5/2008 Chung
2008/0103024 A1 5/2008 Habing
2008/0103030 A1 5/2008 Watson et al.
2008/0103034 A1 5/2008 Mihara et al.
2008/0108481 A1 5/2008 Limma
2008/0108917 A1 5/2008 Joutras et al.
2008/0109121 A1 5/2008 Takeda
2008/0109243 A1 5/2008 Ebrom et al.
2008/0109295 A1 5/2008 McConochie et al.
2008/0109310 A1 5/2008 Ebrom et al.
2008/0109841 A1 5/2008 Healther et al.
2008/0109851 A1 5/2008 Healther et al.
2008/0114291 A1 5/2008 Muri et al.
2008/0116655 A1 5/2008 Pate et al.
2008/0119332 A1 5/2008 Roman
2008/0119333 A1 5/2008 Bowser
2008/0119337 A1 5/2008 Wilkins
2008/0120436 A1 5/2008 Cowgill et al.
2008/0129825 A1 6/2008 DeAngelis et al.
2008/0132386 A1 6/2008 Helie
2008/0132798 A1 6/2008 Hong et al.
2008/0139370 A1 6/2008 Charnitski
2008/0141135 A1 6/2008 Mason et al.
2008/0146334 A1 6/2008 Kil
2008/0146336 A1 6/2008 Feldman
2008/0146416 A1 6/2008 Mueller et al.
2008/0146890 A1 6/2008 LeBoeuf et al.
2008/0146892 A1 6/2008 LeBoeuf et al.
2008/0147502 A1 6/2008 Baker
2008/0153670 A1 6/2008 Mckirdy
2008/0153671 A1 6/2008 Ogg et al.
2008/0153677 A1 6/2008 Webber et al.
2008/0153682 A1 6/2008 Chen et al.
2008/0155077 A1 6/2008 James
2008/0161163 A1 7/2008 Stewart et al.
2008/0161166 A1 7/2008 Lo
2008/0161168 A1 7/2008 Hsiao
2008/0161170 A1 7/2008 Lumpee
2008/0161653 A1 7/2008 Lin et al.
2008/0167535 A1 7/2008 Stivoric et al.
2008/0167536 A1 7/2008 Teller
2008/0167958 A1 7/2008 Balaban et al.
2008/0171636 A1 7/2008 Usui et al.
2008/0171640 A1 7/2008 Chang
2008/0171643 A1 7/2008 Baudhuin
2008/0171922 A1 7/2008 Teller
2008/0171945 A1 7/2008 Dotter
2008/0172328 A1 7/2008 Ajilian
2008/0176655 A1 7/2008 James
2008/0176713 A1 7/2008 Olivera Brizzio
2008/0176717 A1 7/2008 Wang
2008/0176718 A1 7/2008 Wang
2008/0176721 A1 7/2008 Boren
2008/0179214 A1 7/2008 Hall
2008/0182685 A1 7/2008 Marty et al.
2008/0182724 A1 7/2008 Guthrie
2008/0182732 A1 7/2008 Webber et al.
2008/0183049 A1 7/2008 Karkanias et al.
2008/0183052 A1 7/2008 Teller
2008/0187689 A1 8/2008 Dierkens et al.
2008/0188354 A1 8/2008 Pauws et al.
2008/0188362 A1 8/2008 Chen
2008/0189733 A1 8/2008 Apostolopoulos
2008/0190745 A1 8/2008 Taniguchi et al.
2008/0191864 A1* 8/2008 Wolfson ..... G06F 3/011
340/524
2008/0195258 A1 8/2008 Schendel
2008/0200287 A1 8/2008 Marty et al.
2008/0200310 A1 8/2008 Tagliabue
2008/0200312 A1 8/2008 Tagliabue
2008/0200314 A1 8/2008 Dalebout et al.
2008/0200778 A1 8/2008 Taskinen
2008/0204225 A1 8/2008 Kitchen

(56) References Cited

U.S. PATENT DOCUMENTS

2008/0207401 A1 8/2008 Harding et al.
2008/0207402 A1 8/2008 Fisher et al.
2008/0207407 A1 8/2008 Yeh
2008/0214358 A1 9/2008 Ogg et al.
2008/0214359 A1 9/2008 Niva et al.
2008/0214364 A1 9/2008 Maresh
2008/0214903 A1 9/2008 Orbach
2008/0214971 A1 9/2008 Talish
2008/0216717 A1 9/2008 Jones
2008/0218307 A1 9/2008 Schoettle
2008/0220941 A1 9/2008 Shaw
2008/0221487 A1* 9/2008 Zohar ..... A61B 5/103 600/595
2008/0224988 A1 9/2008 Whang
2008/0228110 A1 9/2008 Berme
2008/0229875 A1 9/2008 Ray
2008/0234023 A1 9/2008 Mullahkhel et al.
2008/0234110 A1 9/2008 Webber et al.
2008/0234111 A1 9/2008 Packham
2008/0234113 A1 9/2008 Einav
2008/0242510 A1 10/2008 Topel
2008/0242511 A1 10/2008 Munoz et al.
2008/0242512 A1 10/2008 Kim
2008/0242513 A1 10/2008 Skilken et al.
2008/0244870 A1 10/2008 Chase
2008/0245944 A1 10/2008 Chase
2008/0248926 A1 10/2008 Cole et al.
2008/0248935 A1 10/2008 Solow
2008/0249736 A1 10/2008 Prstojevich
2008/0250729 A1 10/2008 Kriesel
2008/0253378 A1 10/2008 Curry
2008/0254420 A1 10/2008 Nerenberg
2008/0254947 A1 10/2008 Mackay
2008/0255430 A1 10/2008 Alexandersson et al.
2008/0255794 A1 10/2008 Levine
2008/0261636 A1 10/2008 Lau et al.
2008/0261774 A1 10/2008 Fisher
2008/0261776 A1 10/2008 Skiba
2008/0261778 A1 10/2008 Chuang
2008/0262381 A1 10/2008 Kolen
2008/0262392 A1 10/2008 Ananny et al.
2008/0267444 A1 10/2008 Simons-Nikolova et al.
2008/0269016 A1 10/2008 Ungari et al.
2008/0269017 A1 10/2008 Ungari
2008/0269024 A1 10/2008 Lin
2008/0273008 A1 11/2008 Chang
2008/0279896 A1 11/2008 Heinen et al.
2008/0280732 A1 11/2008 Jones
2008/0280733 A1 11/2008 Dickie et al.
2008/0280734 A1 11/2008 Dickie et al.
2008/0280735 A1 11/2008 Dickie et al.
2008/0287262 A1 11/2008 Chou
2008/0293023 A1 11/2008 Diehl
2008/0295129 A1 11/2008 Laut
2008/0296883 A1 12/2008 Burkhardtsmaier
2008/0300109 A1 12/2008 Karkanias et al.
2008/0300110 A1 12/2008 Smith et al.
2008/0300114 A1 12/2008 Dalebout
2008/0300115 A1 12/2008 Erlandson
2008/0300116 A1 12/2008 Eder
2008/0300914 A1 12/2008 Karkanias et al.
2008/0305934 A1 12/2008 Medina
2008/0305936 A1 12/2008 Cao
2008/0306762 A1 12/2008 James
2008/0312039 A1 12/2008 Bucay-Bissu
2008/0312041 A1 12/2008 Schwabe et al.
2008/0312047 A1 12/2008 Feng
2008/0315371 A1 12/2008 Tang et al.
2008/0318737 A1 12/2008 Chu
2008/0319787 A1 12/2008 Stivoric
2008/0319796 A1 12/2008 Stivoric
2008/0319855 A1 12/2008 Stivoric
2009/0001831 A1 1/2009 Cho et al.
2009/0005224 A1 1/2009 Davis et al.
2009/0011907 A1 1/2009 Radow
2009/0017991 A1 1/2009 Hung
2009/0018000 A1 1/2009 Brown
2009/0023553 A1 1/2009 Shim
2009/0023554 A1 1/2009 Shim
2009/0023556 A1 1/2009 Daly
2009/0024233 A1 1/2009 Shirai et al.
2009/0027925 A1 1/2009 Kanouda et al.
2009/0028005 A1 1/2009 You et al.
2009/0029831 A1 1/2009 Weier
2009/0036276 A1 2/2009 Loach
2009/0040231 A1 2/2009 Sano et al.
2009/0040301 A1 2/2009 Sandler et al.
2009/0041298 A1 2/2009 Sandler et al.
2009/0042174 A1 2/2009 Aries
2009/0042696 A1 2/2009 Wang
2009/0042698 A1 2/2009 Wang
2009/0043531 A1 2/2009 Kahn et al.
2009/0047645 A1 2/2009 Dibenedetto et al.
2009/0048044 A1 2/2009 Oleson et al.
2009/0048073 A1 2/2009 Roimicher
2009/0048079 A1 2/2009 Nalley
2009/0048493 A1 2/2009 James et al.
2009/0048939 A1 2/2009 Williams
2009/0049092 A1 2/2009 Capio et al.
2009/0053682 A1 2/2009 Stern
2009/0054207 A1 2/2009 Lin et al.
2009/0054214 A1 2/2009 Kadar
2009/0054751 A1 2/2009 Babashan et al.
2009/0061870 A1 3/2009 Finkelstein et al.
2009/0062072 A1 3/2009 Packham
2009/0062080 A1 3/2009 Guy
2009/0062598 A1 3/2009 Haisma et al.
2009/0069156 A1 3/2009 Veli-Pekka Kurunmäki et al.
2009/0069159 A1 3/2009 Wang
2009/0069722 A1 3/2009 Flaction et al.
2009/0075781 A1 3/2009 Schwarzberg et al.
2009/0075784 A1 3/2009 Hoggan
2009/0076335 A1 3/2009 Schwarzberg et al.
2009/0076903 A1 3/2009 Schwarzberg et al.
2009/0080808 A1 3/2009 Hagen
2009/0082176 A1 3/2009 Watterson et al.
2009/0082880 A1 3/2009 Saunders
2009/0085873 A1 4/2009 Betts et al.
2009/0088248 A1 4/2009 Stevens
2009/0088299 A1 4/2009 Chen
2009/0088301 A1 4/2009 Alling
2009/0093341 A1 4/2009 James
2009/0093346 A1 4/2009 Nelson et al.
2009/0093347 A1 4/2009 Wang
2009/0098980 A1 4/2009 Waters
2009/0098981 A1 4/2009 Del Giorno
2009/0100718 A1 4/2009 Gerber
2009/0105047 A1 4/2009 Guidi et al.
2009/0105049 A1 4/2009 Miller
2009/0105052 A1 4/2009 Dalebout et al.
2009/0105548 A1 4/2009 Bart
2009/0105560 A1 4/2009 Solomon
2009/0109346 A1 4/2009 Viarani et al.
2009/0111656 A1 4/2009 Sullivan et al.
2009/0111658 A1 4/2009 Juan
2009/0111663 A1 4/2009 Kuo
2009/0111664 A1 4/2009 Kau
2009/0111665 A1 4/2009 Wang
2009/0111666 A1 4/2009 Wang
2009/0117890 A1 5/2009 Jacobsen et al.
2009/0118098 A1 5/2009 Yeh
2009/0118099 A1 5/2009 Fisher
2009/0118103 A1 5/2009 Ellis
2009/0119032 A1 5/2009 Meyer
2009/0120208 A1 5/2009 Meyer
2009/0120210 A1 5/2009 Phillips et al.
2009/0124460 A1 5/2009 Chen
2009/0124463 A1 5/2009 Lin
2009/0124464 A1 5/2009 Kastelic
2009/0124465 A1 5/2009 Wang
2009/0124466 A1 5/2009 Zhang
2009/0128342 A1 5/2009 Cohen
2009/0128516 A1 5/2009 Rimon et al.
2009/0131225 A1 5/2009 Burdea

(56) References Cited

U.S. PATENT DOCUMENTS

2009/0137367 A1 5/2009 Hendrickson et al.
2009/0144080 A1 6/2009 Gray et al.
2009/0144084 A1 6/2009 Neumaier
2009/0149299 A1 6/2009 Tchao et al.
2009/0149721 A1 6/2009 Yang
2009/0150178 A1 6/2009 Sutton et al.
2009/0156363 A1 6/2009 Guidi et al.
2009/0156364 A1 6/2009 Simeoni
2009/0156369 A1 6/2009 Rodgers, Jr.
2009/0158871 A1 6/2009 Chuo
2009/0163262 A1 6/2009 Kang
2009/0163323 A1 6/2009 Bocchicchio
2009/0163326 A1 6/2009 Wang
2009/0163327 A1 6/2009 Huang et al.
2009/0163334 A1 6/2009 Gibson et al.
2009/0170663 A1 7/2009 Cox et al.
2009/0170667 A1 7/2009 Irving et al.
2009/0170672 A1 7/2009 Mcmullen
2009/0171229 A1 7/2009 Saldarelli
2009/0174558 A1 7/2009 White
2009/0176526 A1 7/2009 Altman
2009/0176581 A1 7/2009 Barnes et al.
2009/0176623 A1 7/2009 Chen
2009/0176625 A1 7/2009 Giannelli et al.
2009/0176628 A1 7/2009 Radding et al.
2009/0177068 A1 7/2009 Stivoric et al.
2009/0180646 A1 7/2009 Vulfson et al.
2009/0181826 A1 7/2009 Turner
2009/0181828 A1 7/2009 Rodgers, Jr.
2009/0181829 A1 7/2009 Wu
2009/0181830 A1 7/2009 Wu
2009/0181831 A1 7/2009 Kuo
2009/0181833 A1 7/2009 Cassidy
2009/0191988 A1 7/2009 Klein
2009/0192391 A1 7/2009 Lovitt et al.
2009/0192871 A1 7/2009 Deacon et al.
2009/0193344 A1 7/2009 Smyers
2009/0195350 A1 8/2009 Tsern et al.
2009/0197739 A1 8/2009 Hashimoto
2009/0197740 A1 8/2009 Julskjaer et al.
2009/0203501 A1 8/2009 Rodgers, Jr.
2009/0204422 A1 8/2009 James
2009/0204668 A1 8/2009 Huang
2009/0205482 A1 8/2009 Shirai et al.
2009/0209393 A1 8/2009 Crater et al.
2009/0210078 A1 8/2009 Crowley
2009/0215594 A1 8/2009 Panaiotov
2009/0216629 A1 8/2009 James
2009/0217178 A1 8/2009 Niyogi et al.
2009/0221404 A1 9/2009 Dorogusker et al.
2009/0221405 A1 9/2009 Wang
2009/0221407 A1 9/2009 Hauk
2009/0227424 A1 9/2009 Hirata et al.
2009/0227429 A1 9/2009 Baudhuin
2009/0227432 A1 9/2009 Pacheco
2009/0232420 A1 9/2009 Eisenberg et al.
2009/0233769 A1 9/2009 Pryor
2009/0233771 A1 9/2009 Quatrochi et al.
2009/0238400 A1 9/2009 Im
2009/0239714 A1 9/2009 Sellers
2009/0240858 A1 9/2009 Takebayashi
2009/0246746 A1* 10/2009 Roerdink ..... A61H 3/00
434/255
2009/0247366 A1 10/2009 Frumer
2009/0253109 A1 10/2009 Anvari
2009/0253554 A1 10/2009 Mcintosh
2009/0253559 A1 10/2009 Maresh
2009/0257323 A1 10/2009 Soltani
2009/0258710 A1 10/2009 Quatrochi et al.
2009/0258758 A1 10/2009 Hickman
2009/0258763 A1 10/2009 Richter
2009/0262088 A1 10/2009 Moll-Carrillo et al.
2009/0263772 A1 10/2009 Root
2009/0264258 A1 10/2009 Lo
2009/0264260 A1 10/2009 Piaget et al.
2009/0265649 A1 10/2009 Schlossberg et al.
2009/0267783 A1 10/2009 Vock et al.
2009/0269728 A1 10/2009 Verstegen et al.
2009/0270226 A1 10/2009 Watterson
2009/0270743 A1 10/2009 Dugan
2009/0278707 A1 11/2009 Biggins et al.
2009/0280964 A1 11/2009 Lin
2009/0282080 A1 11/2009 Schlossberg et al.
2009/0286653 A1 11/2009 Wiber
2009/0288887 A1 11/2009 Chen
2009/0292178 A1 11/2009 Ellis et al.
2009/0293319 A1 12/2009 Avni
2009/0298649 A1 12/2009 Dyer et al.
2009/0309891 A1 12/2009 Karkanias et al.
2009/0312151 A1 12/2009 Thieberger
2009/0312158 A1 12/2009 Trevino et al.
2009/0312658 A1 12/2009 Thieberger
2010/0003647 A1 1/2010 Brown et al.
2010/0009809 A1 1/2010 Carrington
2010/0009810 A1 1/2010 Trzecieski
2010/0015585 A1 1/2010 Baker
2010/0016127 A1 1/2010 Farnsworth et al.
2010/0016129 A1 1/2010 Chou
2010/0016742 A1 1/2010 James
2010/0017402 A1 1/2010 Fleming et al.
2010/0019593 A1 1/2010 Ritchey
2010/0022354 A1 1/2010 Fisher
2010/0024590 A1 2/2010 O'neill
2010/0031803 A1 2/2010 Lozada et al.
2010/0032533 A1 2/2010 Chen et al.
2010/0034665 A1 2/2010 Zhong et al.
2010/0036736 A1 2/2010 McGee et al.
2010/0038149 A1 2/2010 Corel
2010/0041000 A1 2/2010 Glass
2010/0041516 A1 2/2010 Kodama
2010/0041522 A1 2/2010 Dalebout et al.
2010/0050082 A1 2/2010 Katz et al.
2010/0056339 A1 3/2010 Chen
2010/0056340 A1 3/2010 Ellis
2010/0056876 A1 3/2010 Ellis
2010/0062818 A1 3/2010 Haughay, Jr. et al.
2010/0062904 A1 3/2010 Crawford et al.
2010/0062914 A1 3/2010 Splane
2010/0063426 A1 3/2010 Planke
2010/0064255 A1 3/2010 Rottler et al.
2010/0068684 A1 3/2010 Sabel
2010/0069202 A1 3/2010 Olsen
2010/0075812 A1 3/2010 Piaget et al.
2010/0076278 A1 3/2010 van der Zande et al.
2010/0077564 A1 4/2010 Saier et al.
2010/0079291 A1 4/2010 Kroll et al.
2010/0081116 A1 4/2010 Barasch et al.
2010/0081548 A1 4/2010 Labedz
2010/0087298 A1 4/2010 Zaccherini
2010/0087701 A1 4/2010 Berka et al.
2010/0088023 A1 4/2010 Werner
2010/0093492 A1 4/2010 Watterson et al.
2010/0093493 A1 4/2010 Eldridge
2010/0099437 A1 4/2010 Moerdijk
2010/0099541 A1 4/2010 Patel
2010/0099954 A1 4/2010 Dickinson et al.
2010/0105527 A1 4/2010 Johnson
2010/0112536 A1 5/2010 Claassen et al.
2010/0113222 A1 5/2010 Radow
2010/0113223 A1 5/2010 Chiles et al.
2010/0113948 A1 5/2010 Yang et al.
2010/0120585 A1 5/2010 Quy
2010/0125026 A1 5/2010 Zavadsky et al.
2010/0125029 A1 5/2010 Nielson et al.
2010/0125183 A1 5/2010 Vayalattu et al.
2010/0130337 A1 5/2010 Stewart
2010/0137049 A1 6/2010 Epstein
2010/0137105 A1 6/2010 McLaughlin
2010/0137106 A1 6/2010 Oshima et al.
2010/0144496 A1 6/2010 Schmidt
2010/0144501 A1 6/2010 Berhanu
2010/0146055 A1 6/2010 Hannuksela
2010/0152546 A1 6/2010 Behan et al.
2010/0156625 A1 6/2010 Ruha

(56) References Cited

U.S. PATENT DOCUMENTS

2010/0156760 A1 6/2010 Cheswick
2010/0160013 A1 6/2010 Sanders
2010/0160014 A1 6/2010 Galasso et al.
2010/0160115 A1 6/2010 Morris et al.
2010/0164579 A1 7/2010 Acatrinei
2010/0167801 A1 7/2010 Karkanias et al.
2010/0167876 A1 7/2010 Cheng
2010/0167881 A1 7/2010 Day
2010/0167883 A1 7/2010 Grind
2010/0173276 A1 7/2010 Vasin
2010/0173755 A1 7/2010 P Erez De Lazarraga
2010/0175634 A1 7/2010 Chang et al.
2010/0177016 A1* 7/2010 Zeng ..... G06F 3/1431 345/1.1
2010/0179035 A1 7/2010 Carnahan
2010/0179883 A1 7/2010 Devolites
2010/0182436 A1 7/2010 Boman et al.
2010/0184565 A1 7/2010 Avellino
2010/0184568 A1 7/2010 Schippers
2010/0188405 A1 7/2010 Haughay, Jr. et al.
2010/0190610 A1 7/2010 Pryor
2010/0190615 A1 7/2010 Baker et al.
2010/0191462 A1 7/2010 Kobuya et al.
2010/0192715 A1 8/2010 Aircelle
2010/0197462 A1 8/2010 Piane, Jr.
2010/0197465 A1 8/2010 Stevenson
2010/0204013 A1 8/2010 Chen
2010/0208038 A1 8/2010 Kutliroff et al.
2010/0208082 A1 8/2010 Buchner et al.
2010/0210418 A1 8/2010 Park
2010/0211439 A1 8/2010 Marci et al.
2010/0216536 A1 8/2010 Gagner
2010/0216599 A1 8/2010 Watterson
2010/0216600 A1 8/2010 Noffsinger
2010/0216603 A1 8/2010 Somers
2010/0216606 A1 8/2010 Liao
2010/0216607 A1 8/2010 Mueller
2010/0217096 A1 8/2010 Nanikashvili
2010/0217099 A1 8/2010 Leboeuf
2010/0217102 A1 8/2010 LeBoeuf et al.
2010/0222165 A1 9/2010 Nurnberg et al.
2010/0222178 A1 9/2010 Shea
2010/0222182 A1 9/2010 Park
2010/0227542 A1 9/2010 Goldmann
2010/0227740 A1 9/2010 Liu
2010/0234184 A1 9/2010 Le Page
2010/0234185 A1 9/2010 Watt et al.
2010/0234693 A1 9/2010 Srinivasan et al.
2010/0235667 A1 9/2010 Mucignat et al.
2010/0240458 A1 9/2010 Gaiba et al.
2010/0240495 A1 9/2010 Law
2010/0240945 A1 9/2010 Bikko
2010/0241018 A1 9/2010 Vogel
2010/0242246 A1 9/2010 Dalebout et al.
2010/0243514 A1 9/2010 Samain et al.
2010/0247081 A1 9/2010 Victoria Pons
2010/0248899 A1 9/2010 Bedell et al.
2010/0248900 A1 9/2010 Ashby
2010/0248901 A1 9/2010 Martens
2010/0251454 A1 10/2010 Kiernan
2010/0255884 A1 10/2010 Konkka et al.
2010/0255955 A1 10/2010 Hickman
2010/0255959 A1 10/2010 Dalebout et al.
2010/0255965 A1 10/2010 Chen
2010/0259043 A1 10/2010 Balsamo
2010/0261580 A1 10/2010 Lannon
2010/0263476 A1 10/2010 Peschmann
2010/0267524 A1 10/2010 Stewart et al.
2010/0271367 A1 10/2010 Vaden et al.
2010/0273610 A1 10/2010 Johnson
2010/0274100 A1 10/2010 Behar
2010/0279822 A1 11/2010 Ford
2010/0279823 A1 11/2010 Waters
2010/0281463 A1 11/2010 Estrade
2010/0283601 A1 11/2010 Tai et al.
2010/0285933 A1 11/2010 Nalley
2010/0289466 A1 11/2010 Telefus
2010/0289772 A1 11/2010 Miller
2010/0292050 A1 11/2010 DiBenedetto et al.
2010/0292599 A1 11/2010 Oleson et al.
2010/0292600 A1 11/2010 Dibenedetto et al.
2010/0298098 A1 11/2010 Ercan
2010/0298655 A1 11/2010 McCombie et al.
2010/0298656 A1 11/2010 McCombie et al.
2010/0298661 A1 11/2010 McCombie et al.
2010/0300272 A1 12/2010 Scherf
2010/0302142 A1 12/2010 French
2010/0302250 A1 12/2010 Hoebel
2010/0304931 A1 12/2010 Stumpf
2010/0304932 A1 12/2010 Kolman et al.
2010/0311552 A1 12/2010 Sumners
2010/0312596 A1 12/2010 Saffari et al.
2010/0320956 A1 12/2010 Lumsden et al.
2010/0324387 A1 12/2010 Moon
2010/0327603 A1 12/2010 Suaan
2011/0003663 A1 1/2011 Chiu et al.
2011/0003664 A1 1/2011 Richard
2011/0009240 A1 1/2011 Chiu et al.
2011/0009249 A1 1/2011 Campanaro et al.
2011/0015039 A1 1/2011 Shea
2011/0015041 A1 1/2011 Shea
2011/0015468 A1 1/2011 Aarts et al.
2011/0017168 A1 1/2011 Gilpatrick
2011/0021319 A1 1/2011 Nissila et al.
2011/0021323 A1 1/2011 Wu
2011/0021325 A1 1/2011 Summers
2011/0021953 A1 1/2011 Sanematsu et al.
2011/0028277 A1 2/2011 Merli
2011/0028282 A1 2/2011 Sbragia
2011/0032105 A1 2/2011 Hoffman et al.
2011/0034300 A1 2/2011 Hall
2011/0039659 A1 2/2011 Kim et al.
2011/0046519 A1 2/2011 Raheman
2011/0053131 A1 3/2011 Regnier
2011/0054242 A1 3/2011 Bender
2011/0054270 A1 3/2011 Derchak
2011/0054272 A1 3/2011 Derchak
2011/0054359 A1 3/2011 Sazonov et al.
2011/0054809 A1 3/2011 Templeman
2011/0056328 A1 3/2011 Ko
2011/0061515 A1 3/2011 Turner
2011/0061840 A1 3/2011 Goldmann
2011/0063114 A1 3/2011 Ikoyan
2011/0065371 A1 3/2011 Leff
2011/0065373 A1 3/2011 Goldmann
2011/0065551 A1 3/2011 Eschenbach
2011/0066056 A1 3/2011 Huang
2011/0067361 A1 3/2011 Sloan
2011/0072955 A1 3/2011 Turner
2011/0073743 A1 3/2011 Shamie
2011/0075835 A1 3/2011 Hill
2011/0077055 A1 3/2011 Pakula et al.
2011/0082006 A1 4/2011 Ishii
2011/0082007 A1 4/2011 Birrell
2011/0082010 A1 4/2011 Dyer
2011/0082011 A1 4/2011 Ellis
2011/0082013 A1 4/2011 Bastian
2011/0082015 A1 4/2011 Dreissigacker et al.
2011/0082397 A1 4/2011 Alberts
2011/0086707 A1 4/2011 Loveland
2011/0086743 A1 4/2011 Stewart
2011/0087076 A1 4/2011 Brynelsen et al.
2011/0087137 A1 4/2011 Hanoun
2011/0087445 A1 4/2011 Sobolewski
2011/0087446 A1 4/2011 Redmond
2011/0090092 A1 4/2011 Birrell et al.
2011/0091842 A1 4/2011 Dugan
2011/0092343 A1 4/2011 Habing
2011/0092779 A1 4/2011 Chang et al.
2011/0093100 A1 4/2011 Ramsay
2011/0096764 A1 4/2011 Tunioli et al.
2011/0098157 A1 4/2011 Whalen et al.
2011/0098615 A1 4/2011 Whalen et al.
2011/0105278 A1 5/2011 Fabbri

(56) References Cited

U.S. PATENT DOCUMENTS

2011/0105279 A1 5/2011 Herranen
2011/0105920 A1 5/2011 Haataja
2011/0106597 A1 5/2011 Ferdman et al.
2011/0109283 A1 5/2011 Kapels et al.
2011/0112771 A1 5/2011 French
2011/0117529 A1 5/2011 Barash
2011/0118084 A1 5/2011 Tsai et al.
2011/0118086 A1 5/2011 Radow
2011/0118089 A1 5/2011 Ellis
2011/0118090 A1 5/2011 Ellis
2011/0124466 A1 5/2011 Nishimura
2011/0124469 A1 5/2011 Uhlir
2011/0124476 A1 5/2011 Holley
2011/0124978 A1 5/2011 Williams
2011/0125063 A1 5/2011 Shalon et al.
2011/0131005 A1 6/2011 Ueshima et al.
2011/0136627 A1 6/2011 Williams
2011/0140904 A1 6/2011 Kashi
2011/0143769 A1 6/2011 Jones et al.
2011/0143898 A1 6/2011 Trees
2011/0152032 A1 6/2011 Barnett
2011/0152033 A1 6/2011 Yang
2011/0152037 A1 6/2011 Tsou
2011/0152038 A1 6/2011 Freitag
2011/0152039 A1 6/2011 Hendrickson et al.
2011/0152635 A1 6/2011 Morris et al.
2011/0152696 A1 6/2011 Ryan
2011/0163939 A1 7/2011 Tam et al.
2011/0164044 A1 7/2011 Huang
2011/0164175 A1 7/2011 Chung et al.
2011/0165995 A1 7/2011 Paulus
2011/0165996 A1 7/2011 Paulus
2011/0165997 A1 7/2011 Reich
2011/0165998 A1 7/2011 Lau et al.
2011/0167447 A1 7/2011 Wong
2011/0172058 A1 7/2011 Deaconu
2011/0172059 A1 7/2011 Watterson et al.
2011/0172060 A1 7/2011 Morales et al.
2011/0172062 A1 7/2011 Miller
2011/0175744 A1 7/2011 Englert et al.
2011/0175989 A1 7/2011 Islam
2011/0176943 A1 7/2011 Tran et al.
2011/0177919 A1 7/2011 Tamari
2011/0179068 A1 7/2011 O'brien
2011/0181420 A1 7/2011 Mack et al.
2011/0183307 A1 7/2011 Shum et al.
2011/0184225 A1 7/2011 Whitall et al.
2011/0184247 A1 7/2011 Contant et al.
2011/0188269 A1 8/2011 Hosotani
2011/0188668 A1 8/2011 Donaldson
2011/0191123 A1 8/2011 Buzynski
2011/0195819 A1 8/2011 Shaw
2011/0199393 A1 8/2011 Nurse et al.
2011/0199799 A1 8/2011 Hui et al.
2011/0201476 A1 8/2011 Solomon
2011/0201481 A1 8/2011 Lo
2011/0202236 A1 8/2011 Galasso et al.
2011/0205164 A1 8/2011 Hansen et al.
2011/0214148 A1 9/2011 Gossweiler, III et al.
2011/0218086 A1 9/2011 Boren
2011/0221672 A1 9/2011 Osterhout et al.
2011/0222375 A1 9/2011 Tsubata et al.
2011/0224057 A1 9/2011 Wu
2011/0224498 A1 9/2011 Banet et al.
2011/0229862 A1 9/2011 Parikh
2011/0230732 A1 9/2011 Edman et al.
2011/0237396 A1 9/2011 Lu
2011/0237399 A1 9/2011 Toback
2011/0238217 A1 9/2011 Kume
2011/0242425 A1* 10/2011 Zeng ..... H04N 5/04
348/705
2011/0245633 A1 10/2011 Goldberg et al.
2011/0247530 A1 10/2011 Coffman
2011/0251021 A1 10/2011 Zavadsky et al.
2011/0252597 A1 10/2011 Burris et al.
2011/0256988 A1 10/2011 Weier
2011/0257797 A1 10/2011 Burris et al.
2011/0263384 A1 10/2011 Drazan
2011/0263385 A1 10/2011 Shea
2011/0264305 A1 10/2011 Choe
2011/0267196 A1 11/2011 Hu et al.
2011/0269517 A1 11/2011 Englert et al.
2011/0269604 A1 11/2011 Tseng
2011/0270135 A1 11/2011 Dooley
2011/0273552 A1 11/2011 Wang et al.
2011/0275482 A1 11/2011 Brodess et al.
2011/0275485 A1 11/2011 Eschenbach
2011/0275489 A1 11/2011 Apau
2011/0275499 A1 11/2011 Eschenbach
2011/0276312 A1 11/2011 Shalon et al.
2011/0281691 A1 11/2011 Ellis
2011/0283188 A1 11/2011 Farrenkopf et al.
2011/0283231 A1 11/2011 Richstein et al.
2011/0295083 A1 12/2011 Doelling et al.
2011/0308919 A1 12/2011 Hahn
2011/0311955 A1 12/2011 Forsten et al.
2011/0312473 A1 12/2011 Chu et al.
2011/0319229 A1 12/2011 Corbalis et al.
2011/0319230 A1 12/2011 Brendle
2011/0320380 A1 12/2011 Zahn et al.
2012/0004074 A1 1/2012 Schelzig
2012/0004075 A1 1/2012 Kissel et al.
2012/0004076 A1 1/2012 Fenster
2012/0004080 A1 1/2012 Webb
2012/0010048 A1 1/2012 Bayerlein et al.
2012/0010053 A1 1/2012 Bayerlein et al.
2012/0015778 A1 1/2012 Lee et al.
2012/0015779 A1 1/2012 Powch et al.
2012/0015784 A1 1/2012 Reed
2012/0020135 A1 1/2012 McCune
2012/0021873 A1* 1/2012 Brunner ..... A63B 22/0235
482/9
2012/0021875 A1 1/2012 Karl
2012/0024237 A1 2/2012 Rice
2012/0028761 A1 2/2012 Dorogusker et al.
2012/0029666 A1 2/2012 Crowley et al.
2012/0032062 A1 2/2012 Newville
2012/0032896 A1 2/2012 Vesely
2012/0035487 A1 2/2012 Werner et al.
2012/0036557 A1 2/2012 Li
2012/0046144 A1 2/2012 Lin et al.
2012/0050818 A1 3/2012 Watanabe
2012/0055718 A1 3/2012 Chen
2012/0065031 A1 3/2012 Buzzanco
2012/0071301 A1 3/2012 Kaylor et al.
2012/0078127 A1 3/2012 McDonald et al.
2012/0079429 A1 3/2012 Stathacopoulos et al.
2012/0079529 A1 3/2012 Harris et al.
2012/0081531 A1 4/2012 DeAngelis et al.
2012/0083669 A1 4/2012 Abujbara
2012/0083705 A1 4/2012 Yuen et al.
2012/0084807 A1 4/2012 Thompson et al.
2012/0084811 A1 4/2012 Thompson
2012/0084812 A1 4/2012 Thompson et al.
2012/0088633 A1 4/2012 Crafton
2012/0088634 A1 4/2012 Heidecke
2012/0088638 A1 4/2012 Lull
2012/0088640 A1 4/2012 Wissink
2012/0090446 A1 4/2012 Moreno
2012/0092327 A1 4/2012 Adhikari
2012/0096357 A1 4/2012 Folgner et al.
2012/0096405 A1 4/2012 Seo
2012/0105867 A1 5/2012 Komatsu
2012/0108397 A1 5/2012 Tsai
2012/0108402 A1 5/2012 Rodgers, Jr.
2012/0108914 A1 5/2012 Bravomalo
2012/0113029 A1 5/2012 Ye et al.
2012/0115695 A1 5/2012 Watterson et al.
2012/0116550 A1 5/2012 Hoffman et al.
2012/0116684 A1 5/2012 Ingrassia et al.
2012/0116806 A1 5/2012 Stark et al.
2012/0122063 A1 5/2012 Chen et al.
2012/0125559 A1 5/2012 Fadell et al.
2012/0129139 A1 5/2012 Partovi

(56) References Cited

U.S. PATENT DOCUMENTS

2012/0132877 A1 5/2012 Wang
2012/0133192 A1 5/2012 Simpson
2012/0143358 A1 6/2012 Adams et al.
2012/0149996 A1 6/2012 Stivoric et al.
2012/0153015 A1 6/2012 Gomez et al.
2012/0157265 A1 6/2012 Kao
2012/0159563 A1 6/2012 Gomez et al.
2012/0165162 A1 6/2012 Lu
2012/0165703 A1 6/2012 Bottum
2012/0169603 A1 7/2012 Peterson et al.
2012/0174608 A1 7/2012 Kumamoto et al.
2012/0174833 A1 7/2012 Early
2012/0176483 A1* 7/2012 Border ..... G02B 27/017 348/54
2012/0178590 A1 7/2012 Lu
2012/0178591 A1 7/2012 Remelius
2012/0179278 A1 7/2012 Riley et al.
2012/0187012 A1 7/2012 TeVault et al.
2012/0190502 A1 7/2012 Paulus et al.
2012/0190504 A1 7/2012 Lee et al.
2012/0190507 A1 7/2012 Murray
2012/0202656 A1 8/2012 Dorsay
2012/0208153 A1 8/2012 Bolla et al.
2012/0212505 A1 8/2012 Burroughs et al.
2012/0214590 A1 8/2012 Newhouse et al.
2012/0217758 A1 8/2012 Chen
2012/0218184 A1 8/2012 Wissmar
2012/0225412 A1 9/2012 Wagner
2012/0228385 A1 9/2012 Deluca
2012/0230504 A1 9/2012 Kuroda
2012/0233002 A1 9/2012 Abujbara
2012/0237906 A9 9/2012 Glass
2012/0237911 A1 9/2012 Watterson
2012/0238800 A1 9/2012 Naujokat et al.
2012/0238851 A1 9/2012 Kamen et al.
2012/0242774 A1 9/2012 Numano et al.
2012/0248263 A1 10/2012 Grotenhuis
2012/0251983 A1 10/2012 Golden
2012/0252580 A1 10/2012 Dugan
2012/0253234 A1 10/2012 Yang et al.
2012/0253487 A1 10/2012 Dugan
2012/0253489 A1 10/2012 Dugan
2012/0258433 A1 10/2012 Hope et al.
2012/0263892 A1 10/2012 Rodgers
2012/0268592 A1 10/2012 Aragones et al.
2012/0270705 A1 10/2012 Lo
2012/0271121 A1 10/2012 Della Torre et al.
2012/0271143 A1 10/2012 Aragones et al.
2012/0277040 A1 11/2012 Vincent et al.
2012/0277891 A1 11/2012 Aragones et al.
2012/0285986 A1 11/2012 Irvin
2012/0290109 A1 11/2012 Engelberg et al.
2012/0293141 A1 11/2012 Zhang et al.
2012/0295764 A1 11/2012 Brammer
2012/0296455 A1 11/2012 Ohnemus et al.
2012/0298017 A1 11/2012 Chen
2012/0300515 A1 11/2012 Carletti et al.
2012/0302408 A1 11/2012 Burger
2012/0306643 A1 12/2012 Dugan
2012/0313776 A1 12/2012 Utter, II
2012/0315986 A1 12/2012 Walling
2012/0315987 A1 12/2012 Walling
2012/0316406 A1 12/2012 Rahman et al.
2012/0316455 A1 12/2012 Rahman et al.
2012/0316456 A1 12/2012 Rahman et al.
2012/0316458 A1 12/2012 Rahman et al.
2012/0317024 A1 12/2012 Rahman et al.
2012/0319604 A1 12/2012 Walters
2012/0322623 A1 12/2012 Lai
2012/0322628 A1 12/2012 Gautier
2012/0323496 A1 12/2012 Burroughs
2012/0326873 A1 12/2012 Utter, II
2012/0329027 A1 12/2012 Lewolt
2012/0329611 A1 12/2012 Bouchard
2013/0002533 A1 1/2013 Burroughs et al.
2013/0004010 A1 1/2013 Royer
2013/0009993 A1 1/2013 Horseman
2013/0011818 A1 1/2013 Shum et al.
2013/0012363 A1 1/2013 Eschenbach
2013/0014155 A1 1/2013 Clarke et al.
2013/0015945 A1 1/2013 Chang
2013/0017888 A1 1/2013 King et al.
2013/0017929 A1 1/2013 Hendrickson et al.
2013/0018494 A1 1/2013 Amini
2013/0018668 A1 1/2013 Goldberg et al.
2013/0029807 A1 1/2013 Amsel
2013/0034671 A1 2/2013 George
2013/0035209 A1 2/2013 Gilley et al.
2013/0035612 A1 2/2013 Mason et al.
2013/0040271 A1 2/2013 Rytky et al.
2013/0040783 A1 2/2013 Duda et al.
2013/0041590 A1 2/2013 Burich et al.
2013/0041617 A1 2/2013 Pease et al.
2013/0044521 A1 2/2013 Zhao et al.
2013/0050973 A1 2/2013 Rohrbach
2013/0053218 A1 2/2013 Barker
2013/0053222 A1 2/2013 Lo
2013/0053717 A1 2/2013 Vandine et al.
2013/0053990 A1 2/2013 Ackland
2013/0059697 A1 3/2013 Chuang
2013/0061714 A1 3/2013 Hsiung
2013/0065680 A1 3/2013 Zavadsky
2013/0073093 A1 3/2013 Songkakul
2013/0083003 A1 4/2013 Perez et al.
2013/0085038 A1 4/2013 Fischer
2013/0090565 A1 4/2013 Quy
2013/0092647 A1 4/2013 Chen
2013/0095959 A1 4/2013 Marty
2013/0095978 A1 4/2013 Sauter
2013/0097635 A1 4/2013 Yerli
2013/0105565 A1 5/2013 Kamprath
2013/0106684 A1 5/2013 Weast et al.
2013/0108995 A1 5/2013 DePasqua et al.
2013/0116091 A1 5/2013 Fritz
2013/0116092 A1 5/2013 Martinez et al.
2013/0116095 A1 5/2013 Hsieh
2013/0116514 A1 5/2013 Kroner et al.
2013/0123073 A1 5/2013 Olson et al.
2013/0127636 A1 5/2013 Aryanpur et al.
2013/0129217 A1 5/2013 Gupta
2013/0130868 A1 5/2013 Hou
2013/0130869 A1 5/2013 Hou
2013/0135115 A1 5/2013 Johnson et al.
2013/0137552 A1 5/2013 Kemp et al.
2013/0139736 A1 6/2013 Flaherty
2013/0141235 A1 6/2013 Utter, II
2013/0143717 A1 6/2013 Wang
2013/0143721 A1 6/2013 Dalebout
2013/0144464 A1 6/2013 Dorogusker et al.
2013/0147411 A1 6/2013 Pang et al.
2013/0148861 A1 6/2013 Ferlatte et al.
2013/0150214 A1 6/2013 Wu
2013/0154441 A1 6/2013 Redmond
2013/0158368 A1 6/2013 Pacione et al.
2013/0165195 A1 6/2013 Watterson
2013/0165297 A1 6/2013 Daly
2013/0172151 A1 7/2013 Wang
2013/0172152 A1 7/2013 Watterson
2013/0173156 A1 7/2013 Wither et al.
2013/0174273 A1 7/2013 Grab et al.
2013/0177884 A1 7/2013 Root
2013/0178334 A1 7/2013 Brammer
2013/0182781 A1 7/2013 Matsutani
2013/0184843 A1 7/2013 Ellis et al.
2013/0185003 A1 7/2013 Carbeck et al.
2013/0190136 A1 7/2013 Watterson et al.
2013/0190143 A1 7/2013 Greenhill et al.
2013/0190657 A1 7/2013 Flaction et al.
2013/0191034 A1 7/2013 Weast et al.
2013/0196821 A1 8/2013 Watterson et al.
2013/0196822 A1 8/2013 Watterson et al.
2013/0196826 A1 8/2013 Colledge
2013/0196827 A1 8/2013 Chang
2013/0203557 A1 8/2013 Su

(56) References Cited

U.S. PATENT DOCUMENTS

2013/0203561 A1 8/2013 Lee et al.
2013/0208576 A1 8/2013 Loree, IV et al.
2013/0209972 A1 8/2013 Carter et al.
2013/0210578 A1 8/2013 Birrell
2013/0210581 A1 8/2013 Watterson et al.
2013/0210582 A1 8/2013 Del Toro et al.
2013/0211858 A1 8/2013 Ohnemus et al.
2013/0216982 A1 8/2013 Bennett et al.
2013/0216990 A1 8/2013 Chu et al.
2013/0225377 A1 8/2013 Lee et al.
2013/0228063 A1 9/2013 Turner
2013/0228422 A1 9/2013 Mathieu
2013/0231219 A1 9/2013 Huang
2013/0231226 A1 9/2013 Bonutti
2013/0231575 A1 9/2013 Erkkila et al.
2013/0233097 A1 9/2013 Hayner
2013/0237383 A1 9/2013 Chen
2013/0241696 A1 9/2013 Fabrizio
2013/0245966 A1 9/2013 Burroughs et al.
2013/0260965 A1 10/2013 Chia et al.
2013/0263418 A1 10/2013 Johnson, Jr.
2013/0267385 A1 10/2013 Watterson et al.
2013/0267386 A1 10/2013 Her
2013/0273509 A1 10/2013 Mutti
2013/0274040 A1 10/2013 Coza et al.
2013/0274067 A1 10/2013 Watterson et al.
2013/0274069 A1 10/2013 Watterson et al.
2013/0274071 A1 10/2013 Wang
2013/0274587 A1 10/2013 Coza et al.
2013/0274635 A1 10/2013 Coza et al.
2013/0274904 A1 10/2013 Coza et al.
2013/0280682 A1 10/2013 Levine et al.
2013/0282157 A1 10/2013 Shin et al.
2013/0282447 A1 10/2013 Himanen et al.
2013/0288223 A1 10/2013 Watterson et al.
2013/0289886 A1 10/2013 Ricks
2013/0289932 A1 10/2013 Baechler
2013/0290364 A1 10/2013 Minvielle
2013/0297642 A1 11/2013 Minvielle
2013/0298019 A1 11/2013 Henderson
2013/0303837 A1 11/2013 Berka et al.
2013/0310221 A1 11/2013 Zuber
2013/0310230 A1 11/2013 Norris
2013/0310658 A1 11/2013 Ricks
2013/0316830 A1 11/2013 Sedzin et al.
2013/0324368 A1 12/2013 Aragones et al.
2013/0325394 A1 12/2013 Yuen et al.
2013/0328416 A1 12/2013 Whitworth et al.
2013/0337974 A1 12/2013 Yanev et al.
2013/0337981 A1 12/2013 Habing
2013/0338802 A1 12/2013 Winsper et al.
2013/0345978 A1 12/2013 Lush et al.
2013/0346043 A1 12/2013 Mewes et al.
2014/0011645 A1 1/2014 Johnson et al.
2014/0024499 A1 1/2014 Watterson
2014/0026788 A1 1/2014 Kallio, III et al.
2014/0031174 A1 1/2014 Huang
2014/0031703 A1 1/2014 Rayner et al.
2014/0038781 A1 2/2014 Foley
2014/0039329 A1 2/2014 Kampman et al.
2014/0039840 A1 2/2014 Yuen et al.
2014/0045656 A1 2/2014 Zhang
2014/0051552 A1 2/2014 Habing et al.
2014/0052280 A1 2/2014 Yuen et al.
2014/0056461 A1 2/2014 Afshar
2014/0058806 A1 2/2014 Guenette et al.
2014/0063180 A1 3/2014 Sharma
2014/0066264 A1 3/2014 Haddon
2014/0069838 A1 3/2014 Minvielle
2014/0073488 A1 3/2014 Wu
2014/0074265 A1 3/2014 Arginsky
2014/0077494 A1 3/2014 Sutkowski
2014/0080678 A1 3/2014 Wu
2014/0085077 A1 3/2014 Luna et al.
2014/0087923 A1 3/2014 Warren
2014/0089836 A1 3/2014 Damani et al.
2014/0094941 A1 4/2014 Ellis et al.
2014/0099614 A1 4/2014 Hu et al.
2014/0100464 A1 4/2014 Kaleal et al.
2014/0102340 A1 4/2014 Kooistra
2014/0106322 A1 4/2014 Durand
2014/0113779 A1 4/2014 Loach
2014/0121065 A1 5/2014 Dalebout
2014/0121066 A1 5/2014 Huang et al.
2014/0121471 A1 5/2014 Walker
2014/0125618 A1 5/2014 Panther et al.
2014/0129240 A1 5/2014 Zhang
2014/0134582 A1 5/2014 Konishi
2014/0135173 A1 5/2014 Watterson
2014/0135631 A1 5/2014 Brumback et al.
2014/0139450 A1 5/2014 Levesque et al.
2014/0141396 A1 5/2014 Spratt
2014/0141939 A1 5/2014 Wu
2014/0142403 A1 5/2014 Brumback et al.
2014/0145935 A1 5/2014 Sztuk
2014/0147829 A1 5/2014 Jerauld
2014/0150042 A1 5/2014 Pacor et al.
2014/0156041 A1 6/2014 Martin
2014/0156084 A1 6/2014 Rahman et al.
2014/0156228 A1 6/2014 Molettiere et al.
2014/0156308 A1 6/2014 Ohnemus et al.
2014/0156645 A1 6/2014 Brust et al.
2014/0162230 A1 6/2014 Akopian
2014/0163429 A1 6/2014 Tropper et al.
2014/0164611 A1 6/2014 Molettiere et al.
2014/0171266 A1 6/2014 Hawkins, III et al.
2014/0171272 A1 6/2014 Hawkins, III et al.
2014/0172873 A1 6/2014 Varoglu et al.
2014/0173660 A1 6/2014 Correa et al.
2014/0180480 A1 6/2014 Lee et al.
2014/0187383 A1 7/2014 Martin
2014/0194254 A1 7/2014 Huang et al.
2014/0194260 A1 7/2014 Campanaro et al.
2014/0195103 A1 7/2014 Nassef
2014/0197946 A1 7/2014 Park et al.
2014/0200691 A1 7/2014 Lee et al.
2014/0203943 A1 7/2014 Kates
2014/0205980 A1 7/2014 Braier et al.
2014/0206506 A1 7/2014 Huang
2014/0212857 A1 7/2014 Sullivan et al.
2014/0213416 A1 7/2014 Wang
2014/0214446 A1 7/2014 Pera, Jr.
2014/0220514 A1 8/2014 Waldron et al.
2014/0221160 A1 8/2014 Hardy et al.
2014/0221165 A1 8/2014 Chuang
2014/0221168 A1 8/2014 Chen
2014/0221784 A1 8/2014 Pacione et al.
2014/0221854 A1 8/2014 Wai
2014/0222173 A1 8/2014 Giedwoyn et al.
2014/0228118 A1 8/2014 Hardy et al.
2014/0228649 A1 8/2014 Rayner et al.
2014/0235411 A1 8/2014 Dailey
2014/0248998 A1 9/2014 Lu et al.
2014/0249440 A1 9/2014 Banet
2014/0257535 A1 9/2014 Morris et al.
2014/0257537 A1 9/2014 Stroupe et al.
2014/0261362 A1 9/2014 Boehner
2014/0265072 A1 9/2014 Chiu
2014/0265690 A1 9/2014 Henderson
2014/0266939 A1 9/2014 Baringer et al.
2014/0270375 A1 9/2014 Canavan et al.
2014/0272894 A1 9/2014 Grimes et al.
2014/0273858 A1 9/2014 Panther et al.
2014/0274564 A1 9/2014 Greenbaum
2014/0274574 A1 9/2014 Shorten et al.
2014/0274579 A1 9/2014 Olson
2014/0275852 A1 9/2014 Hong et al.
2014/0275854 A1 9/2014 Venkatraman et al.
2014/0277637 A1 9/2014 Ventura et al.
2014/0278139 A1 9/2014 Hong et al.
2014/0278218 A1 9/2014 Chang
2014/0278220 A1 9/2014 Yuen
2014/0288390 A1 9/2014 Hong et al.
2014/0288438 A1 9/2014 Venkatraman et al.

(56) References Cited

U.S. PATENT DOCUMENTS

2014/0288680 A1 9/2014 Hoffman et al.
2014/0303508 A1* 10/2014 Plotnik-Peleg ..... A61B 5/744 600/483
2014/0308629 A1 10/2014 Dugan
2014/0309085 A1 10/2014 Watterson et al.
2014/0309086 A1 10/2014 Chuang
2014/0316192 A1 10/2014 de Zambotti et al.
2014/0335490 A1 11/2014 Baarman et al.
2014/0336796 A1 11/2014 Agnew
2014/0338120 A1 11/2014 Baugh et al.
2014/0349257 A1 11/2014 Connor
2014/0351150 A1 11/2014 Ainsworth et al.
2014/0358012 A1 12/2014 Richards et al.
2014/0358473 A1 12/2014 Goel et al.
2014/0360413 A1 12/2014 Schenk
2014/0363797 A1 12/2014 Hu et al.
2014/0363800 A1 12/2014 Peng
2014/0371032 A1 12/2014 Peng
2014/0371033 A1 12/2014 Mortensen et al.
2014/0371035 A1 12/2014 Mortensen et al.
2014/0371887 A1 12/2014 Hoffman et al.
2014/0380167 A1 12/2014 Bloch et al.
2015/0001048 A1 1/2015 Koppes et al.
2015/0003621 A1 1/2015 Trammell
2015/0004579 A1 1/2015 Shelton
2015/0004580 A1 1/2015 Shum et al.
2015/0011362 A1 1/2015 Oh et al.
2015/0016623 A1 1/2015 Trammell
2015/0018989 A1 1/2015 Chen
2015/0019135 A1 1/2015 Kacyvenski et al.
2015/0025660 A1 1/2015 Prassler et al.
2015/0031964 A1 1/2015 Bly et al.
2015/0044648 A1 2/2015 White et al.
2015/0048807 A1 2/2015 Fan et al.
2015/0051051 A1 2/2015 Liu et al.
2015/0065273 A1 3/2015 Lake
2015/0065301 A1 3/2015 Oteman
2015/0069738 A1 3/2015 Knight
2015/0079562 A1 3/2015 Yeh et al.
2015/0080181 A1* 3/2015 Skulman ..... A63B 24/0075 482/3
2015/0081209 A1 3/2015 Yeh et al.
2015/0081210 A1 3/2015 Yeh et al.
2015/0082408 A1 3/2015 Yeh et al.
2015/0087478 A1 3/2015 Zhang et al.
2015/0092972 A1 4/2015 Lai et al.
2015/0097700 A1 4/2015 Holthouse
2015/0099952 A1 4/2015 Lain et al.
2015/0105220 A1 4/2015 Hong
2015/0105881 A1 4/2015 Guerrero et al.
2015/0106868 A1 4/2015 Lo
2015/0114916 A1 4/2015 Tambornino et al.
2015/0118657 A1 4/2015 Shrake et al.
2015/0119197 A1 4/2015 Liu
2015/0126873 A1 5/2015 Connor
2015/0135284 A1 5/2015 Bogard
2015/0140534 A1* 5/2015 Brunner ..... A63B 22/025 434/255
2015/0141202 A1 5/2015 Ellis et al.
2015/0151160 A1 6/2015 Balakrishnan et al.
2015/0154452 A1 6/2015 Bentley et al.
2015/0157918 A1 6/2015 Tracy
2015/0165269 A1 6/2015 Herrala et al.
2015/0168365 A1 6/2015 Connor
2015/0173652 A1* 6/2015 Brunner ..... A61B 5/112 482/7
2015/0181314 A1 6/2015 Swanson
2015/0182781 A1 7/2015 Watterson
2015/0182782 A1 7/2015 Cutler
2015/0182787 A1 7/2015 Liu et al.
2015/0186609 A1 7/2015 Utter, II
2015/0190679 A1 7/2015 Carbone
2015/0192929 A1 7/2015 Rihn et al.
2015/0199494 A1 7/2015 Koduri et al.
2015/0201722 A1 7/2015 Brouard
2015/0202487 A1 7/2015 Wu
2015/0209610 A1 7/2015 Dalebout et al.
2015/0209617 A1 7/2015 Hsiao
2015/0224363 A1 8/2015 Clark et al.
2015/0238815 A1 8/2015 Lee
2015/0246751 A1 9/2015 Spivack et al.
2015/0248844 A1 9/2015 Ellis et al.
2015/0250304 A1 9/2015 Dalebout
2015/0250420 A1 9/2015 Longinotti-Buitoni et al.
2015/0251047 A1 9/2015 Maanitty
2015/0251048 A1 9/2015 Dalebout
2015/0251055 A1 9/2015 Ashby
2015/0253210 A1 9/2015 Ashby et al.
2015/0255002 A1 9/2015 Harris et al.
2015/0258382 A1 9/2015 Nolan et al.
2015/0258384 A1 9/2015 Suzuki
2015/0262459 A1 9/2015 Munro et al.
2015/0265903 A1 9/2015 Kolen et al.
2015/0269354 A1 9/2015 Klassen
2015/0272262 A1 10/2015 Escamilla
2015/0272473 A1 10/2015 Zafiroglu
2015/0273272 A1 10/2015 Wang
2015/0288926 A1 10/2015 Glass et al.
2015/0290490 A1 10/2015 Badarneh
2015/0295397 A1 10/2015 Lin et al.
2015/0296020 A1 10/2015 Granqvist et al.
2015/0305961 A1 10/2015 Broerman et al.
2015/0306456 A1 10/2015 Pasini et al.
2015/0310062 A1 10/2015 Wang et al.
2015/0314184 A1 11/2015 Moya Saez
2015/0318015 A1 11/2015 Bose et al.
2015/0320588 A1 11/2015 Connor
2015/0324751 A1 11/2015 Orenstein et al.
2015/0327804 A1 11/2015 Lefever et al.
2015/0331449 A1 11/2015 Ng
2015/0335288 A1 11/2015 Toth et al.
2015/0335941 A1 11/2015 Lo
2015/0339946 A1 11/2015 Pacione et al.
2015/0342815 A1 12/2015 Watson
2015/0346994 A1 12/2015 Chanyontpatanakul
2015/0351690 A1 12/2015 Toth et al.
2015/0352396 A1 12/2015 Dalebout
2015/0352401 A1 12/2015 Johnson
2015/0352402 A1 12/2015 Arnold et al.
2015/0352404 A1 12/2015 Schwenger
2015/0360133 A1 12/2015 Maccallum et al.
2015/0364026 A1 12/2015 Rubin et al.
2015/0364058 A1 12/2015 Lagree
2015/0366746 A1 12/2015 Ashby
2015/0367158 A1 12/2015 Pretz et al.
2015/0367176 A1 12/2015 Bejestan et al.
2015/0369326 A1 12/2015 Modrezejewski et al.
2015/0370320 A1 12/2015 Connor
2015/0375030 A1 12/2015 Yang et al.
2015/0379239 A1 12/2015 Basta et al.
2015/0379891 A1 12/2015 Wallace
2015/0381736 A1 12/2015 Seltzer
2016/0001122 A1 1/2016 Dalebout et al.
2016/0008650 A1 1/2016 Jue et al.
2016/0012749 A1 1/2016 Connor
2016/0016035 A1 1/2016 Hao
2016/0018119 A1 1/2016 Desmet et al.
2016/0027325 A1 1/2016 Malhotra
2016/0038785 A1 2/2016 Netter
2016/0047446 A1 2/2016 Hung
2016/0051184 A1 2/2016 Wisbey et al.
2016/0058245 A1 3/2016 Smith et al.
2016/0059077 A1 3/2016 Paul et al.
2016/0059078 A1 3/2016 Liao
2016/0059079 A1 3/2016 Watterson
2016/0061300 A1 3/2016 Aoto et al.
2016/0063615 A1 3/2016 Watterson
2016/0066818 A1 3/2016 Cowley et al.
2016/0067537 A1 3/2016 Bayerlein et al.
2016/0071014 A1 3/2016 Brand et al.
2016/0074701 A1 3/2016 Wiener
2016/0074705 A1 3/2016 Wiener
2016/0077547 A1 3/2016 Aimone et al.
2016/0089569 A1 3/2016 Blahnik

(56) References Cited

U.S. PATENT DOCUMENTS

2016/0096064 A1 4/2016 Gatti
2016/0107029 A1 4/2016 Kim et al.
2016/0112684 A1 4/2016 Connor
2016/0114205 A1 4/2016 Giunchi
2016/0114211 A1 4/2016 Schmidt
2016/0121161 A1 5/2016 Mountain
2016/0136483 A1 5/2016 Reich
2016/0148535 A1 5/2016 Ashby
2016/0148536 A1 5/2016 Ashby
2016/0151603 A1 6/2016 Shouldice et al.
2016/0157740 A1 6/2016 Kampman et al.
2016/0166881 A1 6/2016 Ridgel et al.
2016/0171110 A1 6/2016 Gao et al.
2016/0175643 A1 6/2016 Kueker et al.
2016/0184625 A1 6/2016 Chang
2016/0184635 A1 6/2016 Kwon
2016/0193518 A1 7/2016 Baxter
2016/0206922 A1 7/2016 Dalebout et al.
2016/0211841 A1 7/2016 Harrison
2016/0219968 A1 8/2016 Martin
2016/0232811 A9 8/2016 Connor
2016/0249365 A1 8/2016 Harel
2016/0250519 A1 9/2016 Watterson
2016/0253918 A1 9/2016 Watterson
2016/0256082 A1 9/2016 Ely et al.
2016/0256745 A1 9/2016 Brammer
2016/0263426 A1 9/2016 Mueller et al.
2016/0279462 A1 9/2016 Sutherland
2016/0279470 A1 9/2016 Hampton
2016/0287930 A1 10/2016 Moser
2016/0296053 A1 10/2016 Bakhsh
2016/0303421 A1 10/2016 Tyger et al.
2016/0317861 A1 11/2016 Dalebout
2016/0317866 A1 11/2016 Fung
2016/0321932 A1 11/2016 Mitchell
2016/0339288 A1 11/2016 Li
2016/0339290 A1 11/2016 Eisenblaetter
2016/0346595 A1 12/2016 Dalebout et al.
2016/0346598 A1 12/2016 Manzke et al.
2016/0346599 A1 12/2016 Dalebout et al.
2016/0346616 A1 12/2016 Kirby et al.
2016/0351070 A1 12/2016 Aillon-Sohl
2016/0367851 A1 12/2016 Astilean et al.
2016/0367857 A1 12/2016 Aragones et al.
2016/0371998 A1 12/2016 Fazeel
2016/0375307 A1 12/2016 Durham
2016/0375308 A1 12/2016 Anderson
2017/0001075 A1 1/2017 Butler, Jr. et al.
2017/0007886 A1 1/2017 Alessandri
2017/0011210 A1 1/2017 Cheong et al.
2017/0014661 A1 1/2017 Lin
2017/0020440 A1 1/2017 Flitsch et al.
2017/0036106 A1 2/2017 Stechschulte et al.
2017/0050069 A1 2/2017 Ky
2017/0050102 A1 2/2017 Kelly
2017/0056709 A1 3/2017 Ercanbrack et al.
2017/0056711 A1 3/2017 Dalebout et al.
2017/0056716 A1 3/2017 Cutler
2017/0056726 A1 3/2017 Dalebout et al.
2017/0063567 A1 3/2017 Tanaka et al.
2017/0065187 A1 3/2017 Hsieh et al.
2017/0065947 A1 3/2017 Haney et al.
2017/0068782 A1 3/2017 Pillai et al.
2017/0082983 A1 3/2017 Katzer et al.
2017/0093451 A1 3/2017 Chen et al.
2017/0097717 A1 4/2017 Anisetti et al.
2017/0100636 A1 4/2017 Umetsu et al.
2017/0104425 A1 4/2017 Meloche
2017/0113093 A1 4/2017 Bellavista et al.
2017/0120102 A1 5/2017 Chen
2017/0128772 A1 5/2017 Lin et al.
2017/0128783 A1 5/2017 Hasegawa et al.
2017/0128784 A1 5/2017 Molins et al.
2017/0136280 A1 5/2017 Lee
2017/0136288 A1 5/2017 Huang
2017/0136289 A1 5/2017 Frank
2017/0136291 A1 5/2017 Huang
2017/0136293 A1 5/2017 Caccia
2017/0136301 A1 5/2017 Cameron
2017/0136339 A1 5/2017 Habiche
2017/0144051 A1 5/2017 Oleson et al.
2017/0164876 A1 6/2017 Hyde et al.
2017/0165523 A1 6/2017 Chou
2017/0180535 A1 6/2017 Esenwein et al.
2017/0189745 A1 7/2017 Hamilton et al.
2017/0193578 A1 7/2017 Watterson
2017/0216660 A1 8/2017 Lernihan
2017/0225034 A1 8/2017 Kass et al.
2017/0235922 A1 8/2017 Weast et al.
2017/0252623 A1 9/2017 Sharifi
2017/0252641 A1 9/2017 Morimura et al.
2017/0266483 A1 9/2017 Dalebout et al.
2017/0266503 A1 9/2017 Watterson et al.
2017/0266532 A1 9/2017 Watterson
2017/0266533 A1 9/2017 Dalebout
2017/0266534 A1 9/2017 Watterson
2017/0266535 A1 9/2017 Watterson
2017/0270820 A1 9/2017 Ashby
2017/0274237 A1 9/2017 Chang
2017/0274242 A1 9/2017 Corbalis
2017/0311817 A9 11/2017 Hsieh et al.
2017/0319898 A1 11/2017 Dalmia
2017/0326411 A1 11/2017 Watterson
2017/0333755 A1 11/2017 Rider
2017/0340917 A1 11/2017 Chang
2017/0354846 A1 12/2017 Von Rueckmann
2017/0364661 A1 12/2017 Hamilton, II et al.
2017/0365048 A1 12/2017 Hamilton, II et al.
2017/0368442 A1 12/2017 Baudhuin
2018/0001135 A1 1/2018 Powell
2018/0008865 A9 1/2018 Lannon et al.
2018/0036572 A1 2/2018 Hsu
2018/0036585 A1 2/2018 Powell
2018/0056105 A1 3/2018 Ho
2018/0056111 A1 3/2018 Chiang et al.
2018/0084817 A1 3/2018 Capell et al.
2018/0085630 A1 3/2018 Capell et al.
2018/0085654 A1 3/2018 Black et al.
2018/0089396 A1 3/2018 Capell et al.
2018/0092603 A1 4/2018 Duan et al.
2018/0099116 A1 4/2018 Ashby
2018/0099179 A1 4/2018 Chatterton et al.
2018/0099180 A1 4/2018 Wilkinson
2018/0099181 A1 4/2018 Powell et al.
2018/0099184 A1 4/2018 Eder
2018/0099205 A1 4/2018 Watterson
2018/0104533 A1 4/2018 Powell et al.
2018/0109838 A1 4/2018 Garcia et al.
2018/0111018 A1 4/2018 Lee
2018/0111034 A1 4/2018 Watterson
2018/0116599 A1 5/2018 Bastide et al.
2018/0117383 A1 5/2018 Workman
2018/0117385 A1 5/2018 Watterson et al.
2018/0117388 A1 5/2018 Porter
2018/0117393 A1 5/2018 Ercanbrack
2018/0117419 A1 5/2018 Jackson
2018/0147440 A1 5/2018 Lin
2018/0154205 A1 6/2018 Watterson
2018/0154206 A1 6/2018 Kim
2018/0154208 A1 6/2018 Powell et al.

* cited by examiner

COORDINATED DISPLAYS IN AN EXERCISE DEVICE

RELATED APPLICATIONS

This application claims priority to U.S. Patent Application Ser. No. 62/310,343 titled "Coordinated Displays in An Exercise Device" and filed on 18 Mar. 2016, which application is herein incorporated by reference for all that it discloses.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Typically, the human body can adequately supply enough oxygen to meet the body's demands at the intensity levels involved with aerobic exercise. Popular forms of aerobic exercise include running, jogging, swimming, and cycling among others activities. In contrast, anaerobic exercise typically involves high intensity exercises over a short duration of time. Popular forms of anaerobic exercise include strength training and short distance running.

Many choose to perform aerobic exercises indoors, such as in a gym or their home. Often, a user uses an aerobic exercise machine to have an aerobic workout indoors. One type of aerobic exercise machine is a treadmill, which is a machine that has a running deck attached to a support frame. The running deck can support the weight of a person using the machine. The running deck incorporates a tread belt that is driven by a motor. A user can run or walk in place on the tread belt by running or walking at the tread belt's speed. The speed and other operations of the treadmill are generally controlled through a control module that is also attached to the support frame and within a convenient reach of the user. The control module can include a display, buttons for increasing or decreasing a speed of the conveyor belt, controls for adjusting a tilt angle of the running deck, or other controls. Other popular exercise machines that allow a user to perform aerobic exercises indoors include elliptical machines, rowing machines, stepper machines, and stationary bikes to name a few.

One type of treadmill is disclosed in U.S. Patent Publication No. 2009/0209393 issued to Bradley A. Crater. In this reference, a simulated display of a treadmill's console is described. According to one embodiment, the console displays a visual representation of the course over which the user is running. By way of example and not limitation, the course may be displayed with video footage that corresponds to the user's location on the course, by using still pictures, or by using computer-generated simulations of the course. For example, a video display of the course could assist a marathon runner who is preparing for the Boston Marathon. By seeing a visual representation of the course, a runner could identify landmarks and aid stations that would assist him in feeling comfortable in running the actual race being simulated at a future date.

SUMMARY

In one embodiment, an exercise device includes a frame, an upright portion of the frame, a movable element connected to the frame and movable in the performance of an exercise, a first display connected to the upright portion of the frame, and a second display connected to the frame.

The second display may be adjacent to the movable element.

The second display may be below at least a portion of the movable element.

The exercise device may further include an exercise deck where the exercise deck includes a first pulley connected to a front portion of the deck, a second pulley connected to a rear portion of the deck, and a tread belt surrounding the first pulley and the second pulley. The tread belt may surround at least a portion of the second display.

The images depicted in the first display and the second display may be coordinated.

The exercise device may include a video splitter that outputs a first video stream to the first display and a second video stream to the second display.

The first video stream and the second video stream may be identical.

The first video stream may contain at least some data that does not overlap with the data in the second video stream.

The first video stream may contain overlapping data with the second stream, and the overlapping data is delayed from presentation in the second display from when the overlapping data is displayed in the first display.

The overlapping data may depict a scene and where the delay causes the effect of having the scene appear to transfer from the first display to the second display.

The frame may include a first rail, a first track defined in the first rail, a second rail space apart at a distance from the first rail, a second track defined in the second rail, a slatted running track. The slatted running track may include multiple slats and multiple pins holding the multiple slats together to form the slatted running track. A first end of the multiple pins may inserted into and follows the first track, and a second end of the multiple pins may be inserted into and follows the second track.

The movable element may be a foot pedal.

The exercise device may be a rowing machine.

The exercise device may be a stationary bicycle.

The display may be covered with a transparent plastic film.

In one embodiment, an exercise device includes an upright structure, a first display connected to the upright structure, and an exercise deck connected to the upright structure. The exercise deck includes a first pulley connected to a front portion of the exercise deck, a second pulley connected to a rear portion of the exercise deck, a tread belt surrounding the first pulley and the second pulley, and a second display is incorporated into the deck and is adjacent to or below a portion of the tread belt. Images depicted in the first display and the second display are coordinated.

The exercise device may include a video splitter that outputs a first video stream to the first display and a second video stream to the second display.

The first video stream may contain overlapping data with the second stream, and the overlapping data is delayed from presentation in the second display from when the overlapping data is displayed in the first display.

The overlapping data may depict a scene and where the delay causes the effect of having the scene appear to transfer from the first display to the second display.

In one embodiment, an exercise device includes an upright structure, a first display connected to the upright structure, and an exercise deck connected to the upright structure. The exercise deck includes a first pulley connected to a front portion of the exercise deck, a second pulley connected to a rear portion of the exercise deck, a tread belt surrounding the first pulley and the second pulley, and a second display is surrounded by the tread belt. The exercise device further includes a processor and memory where the memory including programmed instructions that, when executed, cause the processor to output a first video stream to the first display, output a second video stream to the second display, and delay overlapping data between the first video stream and the second video stream from presentation in the second display from when the overlapping data is presented in the first display to cause the effect of having the scene appear to transfer from the first display to the second display.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

Figure 1:
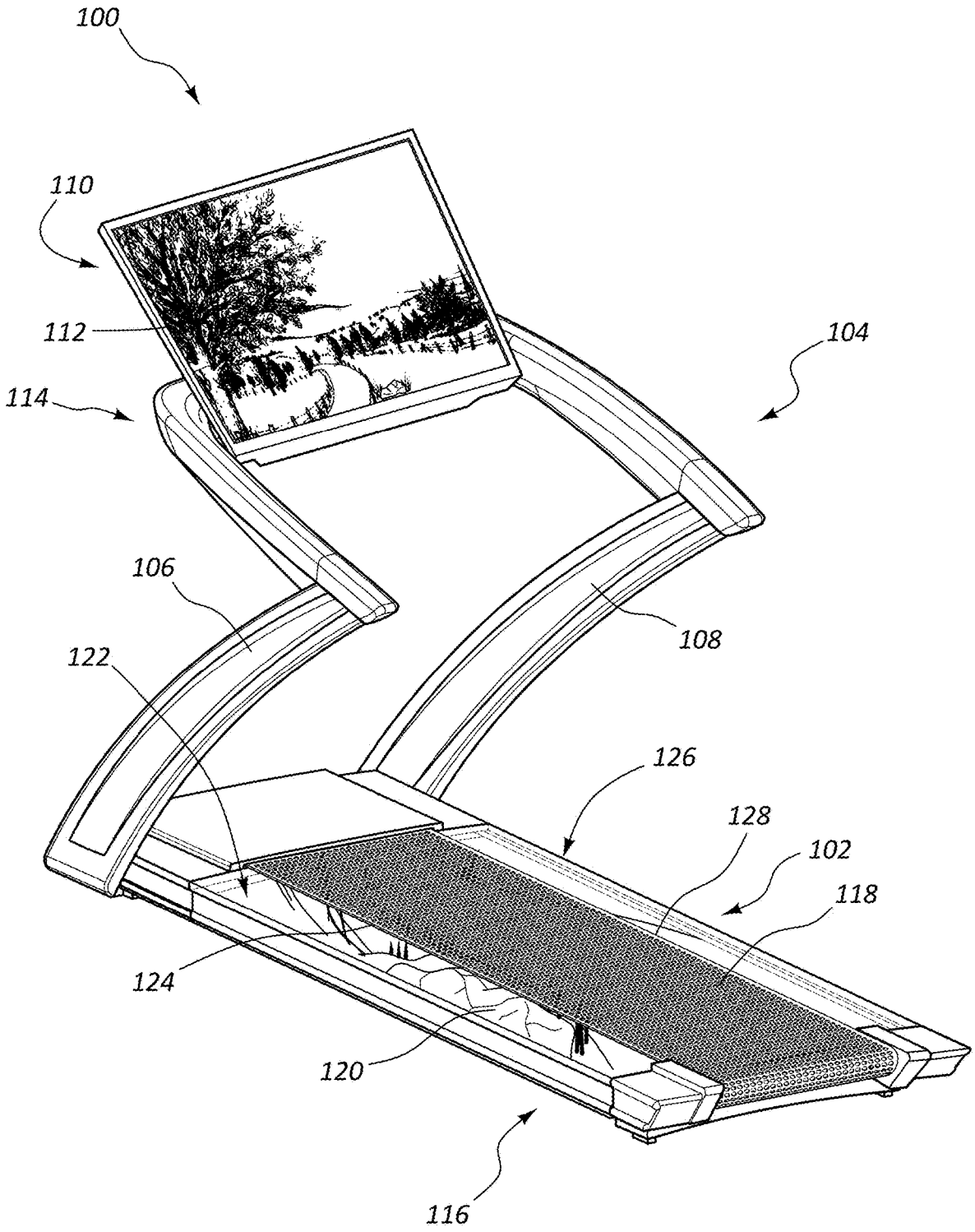
FIG. 1 illustrates a perspective view of an example of a treadmill in accordance with the present disclosure.

Particularly, with reference to the figures, FIG. 1 illustrates a perspective view of an example of a treadmill 100. In this example, the treadmill 100 includes an exercise deck 102 and an upright structure 104. The upright structure 104 includes a first post 106 and a second post 108. The first post 106 and the second post 108 support a console 110. A display 112 is incorporated into the console 110.

The exercise deck 102 includes a platform. A first pulley (not shown) is incorporated into a front portion 114 of the exercise deck 102, and a second pulley (not shown) is connected to a rear portion 116 of the exercise deck 102 opposite the first pulley. A tread belt 118 surrounds the first pulley and the second pulley. In the example of FIG. 1, the first and second pulleys are obscured from view underneath portions of a top surface of the platform. The platform may have a length along its longest dimension and a width that is transverse the length. The platform's edges along both the width and the length have a wide section on which the user can stand.

The platform also includes a display screen 120 integrated into the platform. This display screen 120 may be used to display information associated with the workout, with the user, with local news, with other types of information, or combinations thereof. In some cases, the deck display screen is controlled through the console, a remote device, or an input mechanism incorporated into the deck. The display screen 120 may also be surrounded by the tread belt 118. In some cases, the display screen 120 is wider than the tread belt 118. In this situation, the display screen 120 includes a first portion 122 adjacent a first edge 124 of the tread belt 118 that is unobscured from view, and a second portion 126 adjacent a first edge 128 of the tread belt 118 that is unobscured from view. In this example, the display screen 120 spans the inside surface of the tread belt 118.

Figure 2:
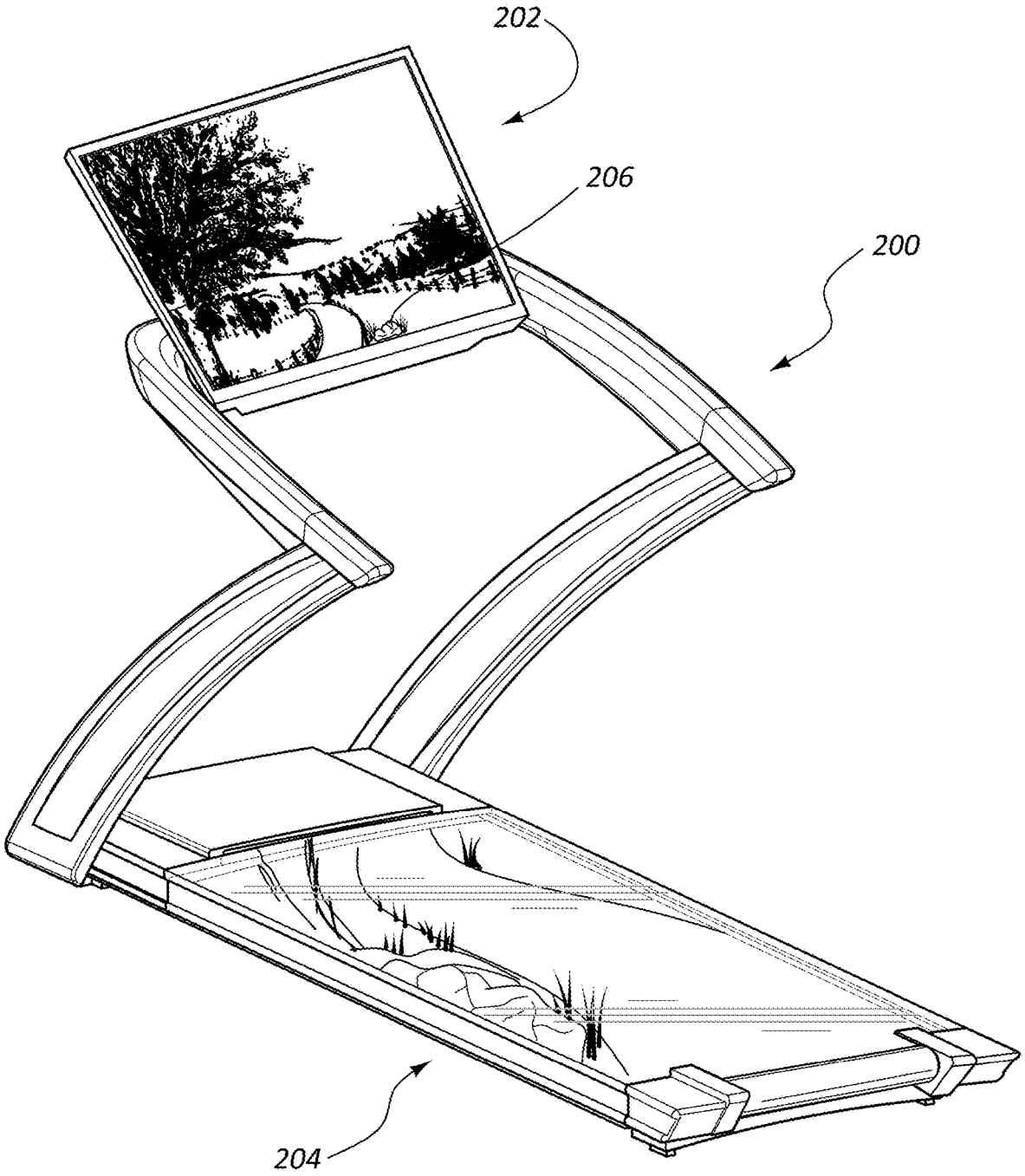
FIG. 2 illustrates a perspective view of an example of a treadmill in accordance with the present disclosure.

FIG. 2 depicts an example of treadmill 200 with a console display 202 and a deck display 204. In this example, a tread belt is removed for illustrative purposes. The console display 202 and the deck display 204 may collectively operate in an extended view that depicts different portions of the same scenery. In this example, the same trail is depicted in the console display and the deck display, but the console display 202 presents a first portion of the trail and the deck display 204 presents a second portion of the same trail.

Figure 3:
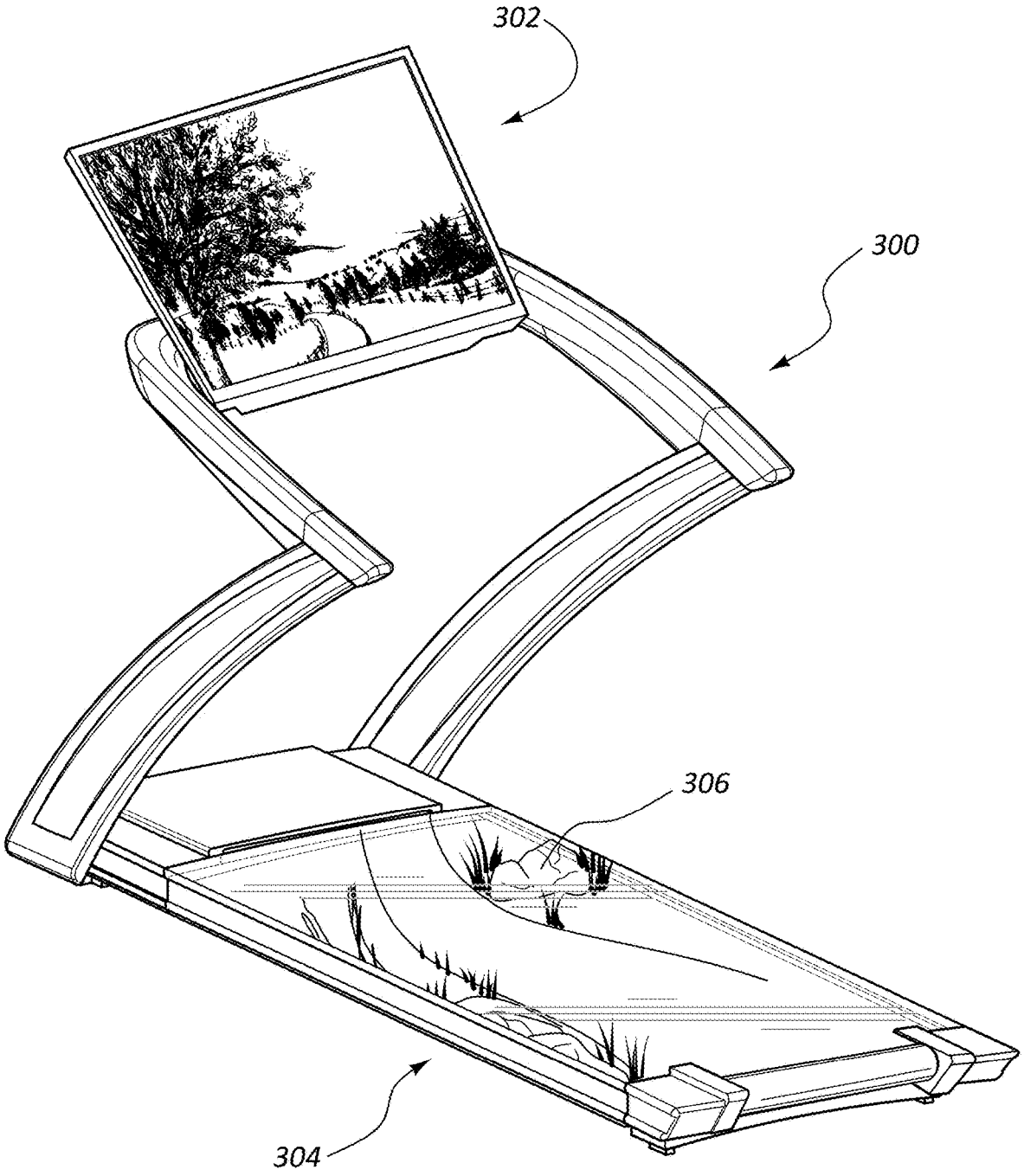
FIG. 3 illustrates a perspective view of an example of a treadmill in accordance with the present disclosure.

FIG. 3 depicts an example of a treadmill 300 as the user progresses along the trail depicted in the console display 302 and the deck display 304. For example, the rock (depicted in FIG. 2, 206), which was previously presented in the console display 302 is now presented in the deck display 304.

Figure 4:
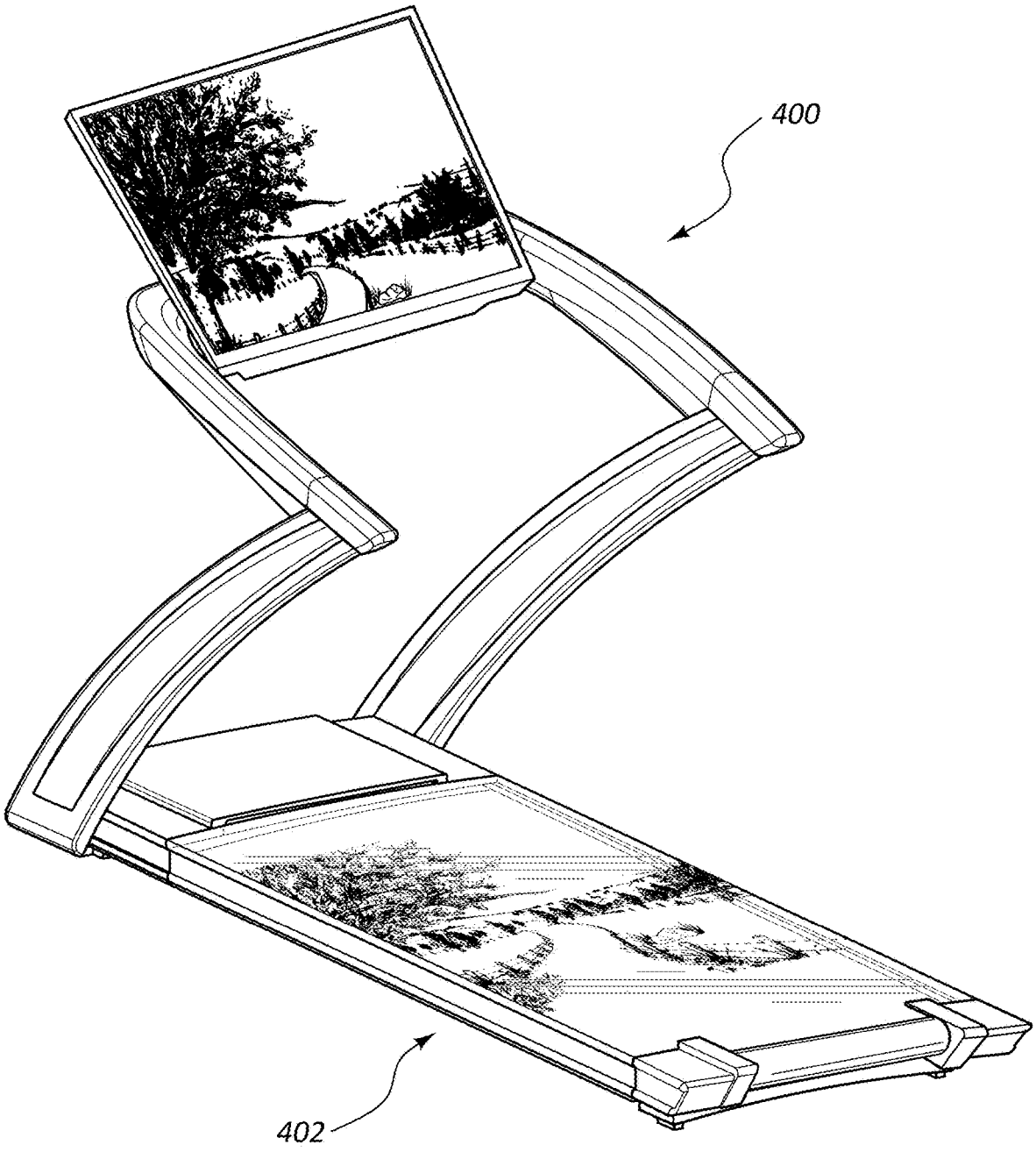
FIG. 4 illustrates a perspective view of an example of a treadmill in accordance with the present disclosure.

FIG. 4 depicts an example where the same content presented in the console display 400 is also presented in the deck display 402.

Figure 5:
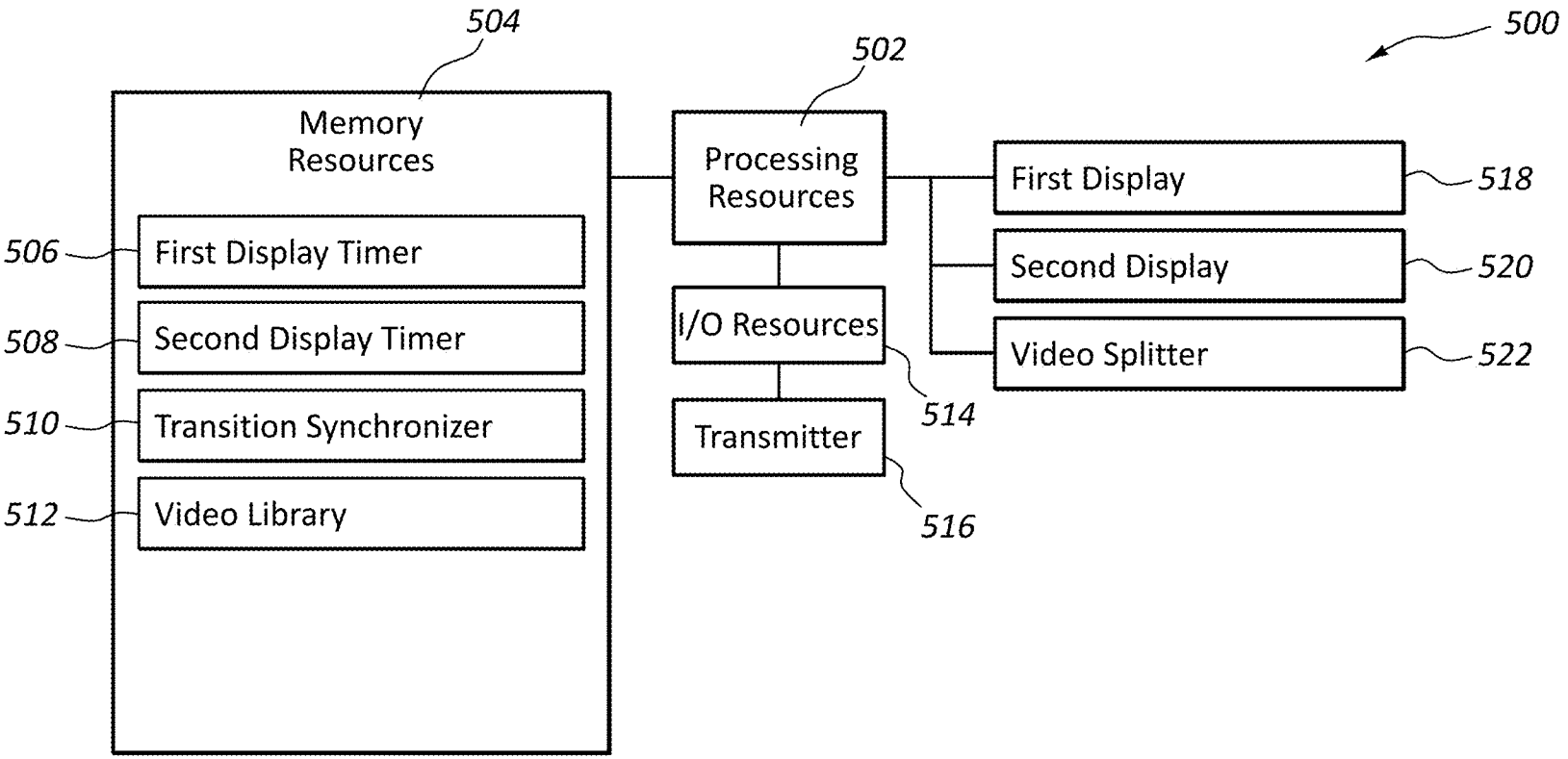
FIG. 5 illustrates a block diagram of an example of a coordinating system in accordance with the present disclosure.

FIG. 5 depicts an example of a coordinating system 500. In this example, the coordinating system 500 includes processing resources 502 and memory resources 504. The memory resources 504 may cause the processing resources 502 to carry out functions programmed in the memory resources 504. In this example, the memory resources 504 include a first display timer 506, a second display timer 508, a transition synchronizer 510, and a video library 512.

The processing resources 502 may be in communication with I/O resources 514, which may include a receiver, a transmitter 516, a transceiver, another type of communication device, or combinations thereof. Further, the processing resources 502 may be in communication with the first display 518, the second display 520, and a video splitter 522, another type of device, or combinations thereof.

Figure 6:
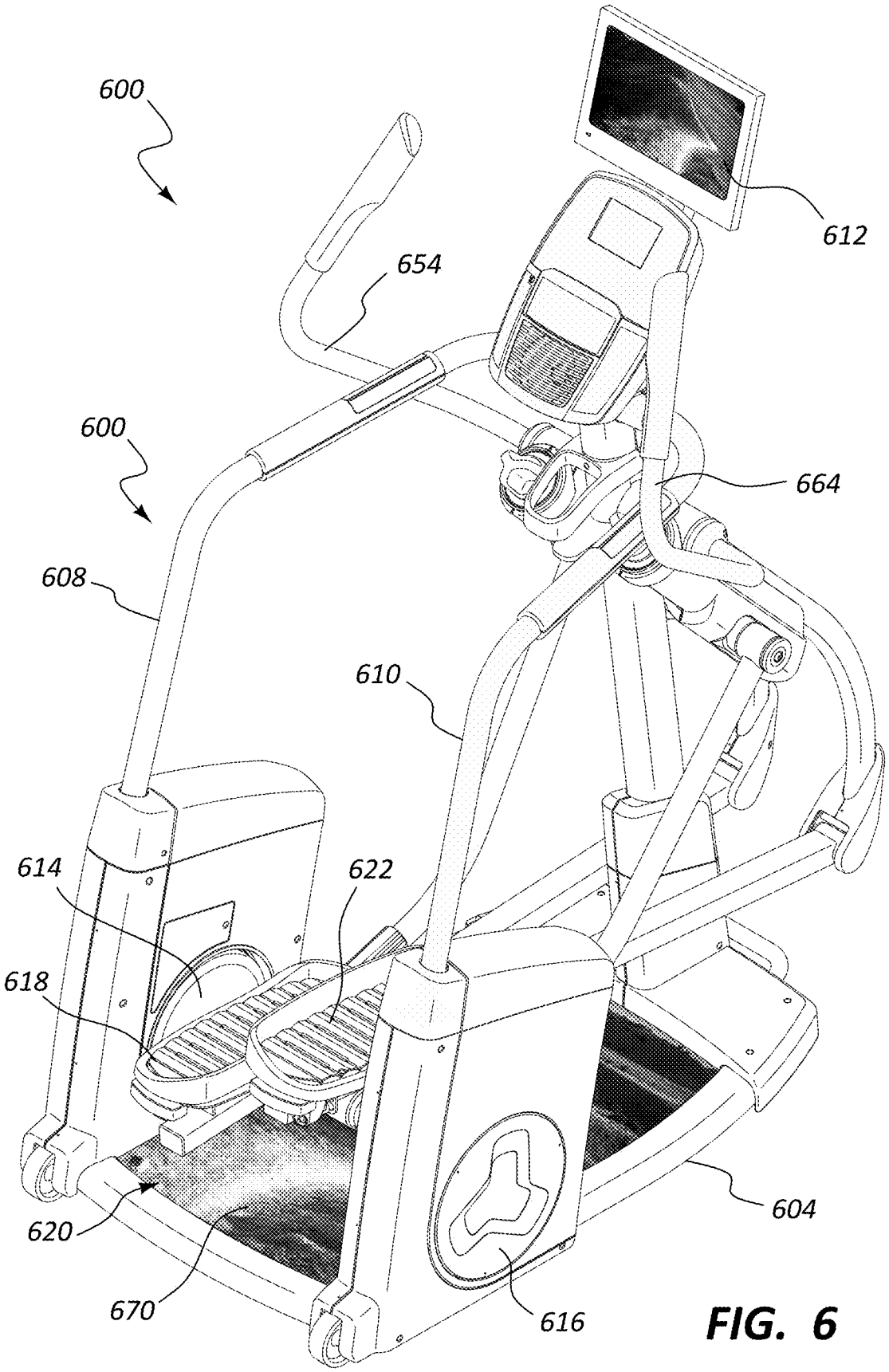
FIG. 6 illustrates a top view of an example of a display incorporated into an elliptical trainer in accordance with the present disclosure.

FIG. 6 depicts an example of an elliptical trainer 600. The elliptical trainer 600 includes a frame 602 attached to a base 604. The frame 602 includes a first post 608 and a second post 610. An upright console 612 is connected to the first and second posts 608, 610. The first frame post 608 incorporates a first flywheel 614, and the second frame post 610 incorporates a second flywheel 616. The first flywheel 614 is connected to a first pedal assembly 618 through a crank assembly 620, and the second flywheel 616 is connected to a second pedal assembly 622 through the crank assembly 620.

The crank assembly 620 includes a first crank arm connected to the first flywheel 614 and a second crank arm connected to the second flywheel 616. Each of the first crank arm and the second crank arm include a roller that supports the weight of the pedal assemblies 618, 622 and a user standing thereon.

Each of the first pedal assembly 618 and the second pedal assembly 622 include a pedal beam, and a pedal is connected to the pedal beam. The pedal may include a gripping surface to grip a user's shoe as a user executes an exercise with the elliptical trainer 600. The pedal may be bolted or otherwise fastened to the pedal beam.

A front end of the pedal beam of the first pedal assembly 618 is connected to a first arm lever 652 that connects to the frame 602 at a first pivot connection. The first pivot connection is also attached to a first handle section 656 which is accessible to the user as the user is performing an exercise with the exercise machine 600. The pedal beam of the second pedal assembly 622 is connected to a second arm lever 660 that connects to the frame 602 at a second pivot connection. The second pivot connection is also attached to a second handle section 664 which is also accessible to the user as the user is performing an exercise with the elliptical trainer 600. As the pedal beams move, the first and second handle sections 656, 664 move accordingly.

The console 612 may contain a display and controls. The controls may allow the user to specify a resistance level to be applied by the resistance mechanism, such as the first and second flywheels 614, 616. In some examples, the controls may also be used to control other operating parameters of the exercise machine, such as incline, side to side tilt, resistance, speaker volume, programmed exercise routines, other parameters, or combinations thereof. The display may show selected parameters to the user. Additionally, the display may be capable of presenting the user's physiological parameters, timers, clocks, scenery, routes, other types of information, or combinations thereof.

Further, a display 670 is incorporated into the base 604. In this example, the display 670 is below the pedals assemblies 618, 622, the crank assembly 620, and the flywheels 614, 616. As the user exercises on the elliptical trainer 600, the user can view portions of simulated scenery and/or other types of information presented in the base's display 670. While this example has been described with two display screens, in other examples, the elliptical trainer may include just a single display screen that is incorporated into the exercise machine's base, located beneath the crank assembly, and/or located beneath the upright portion.

Figure 7:
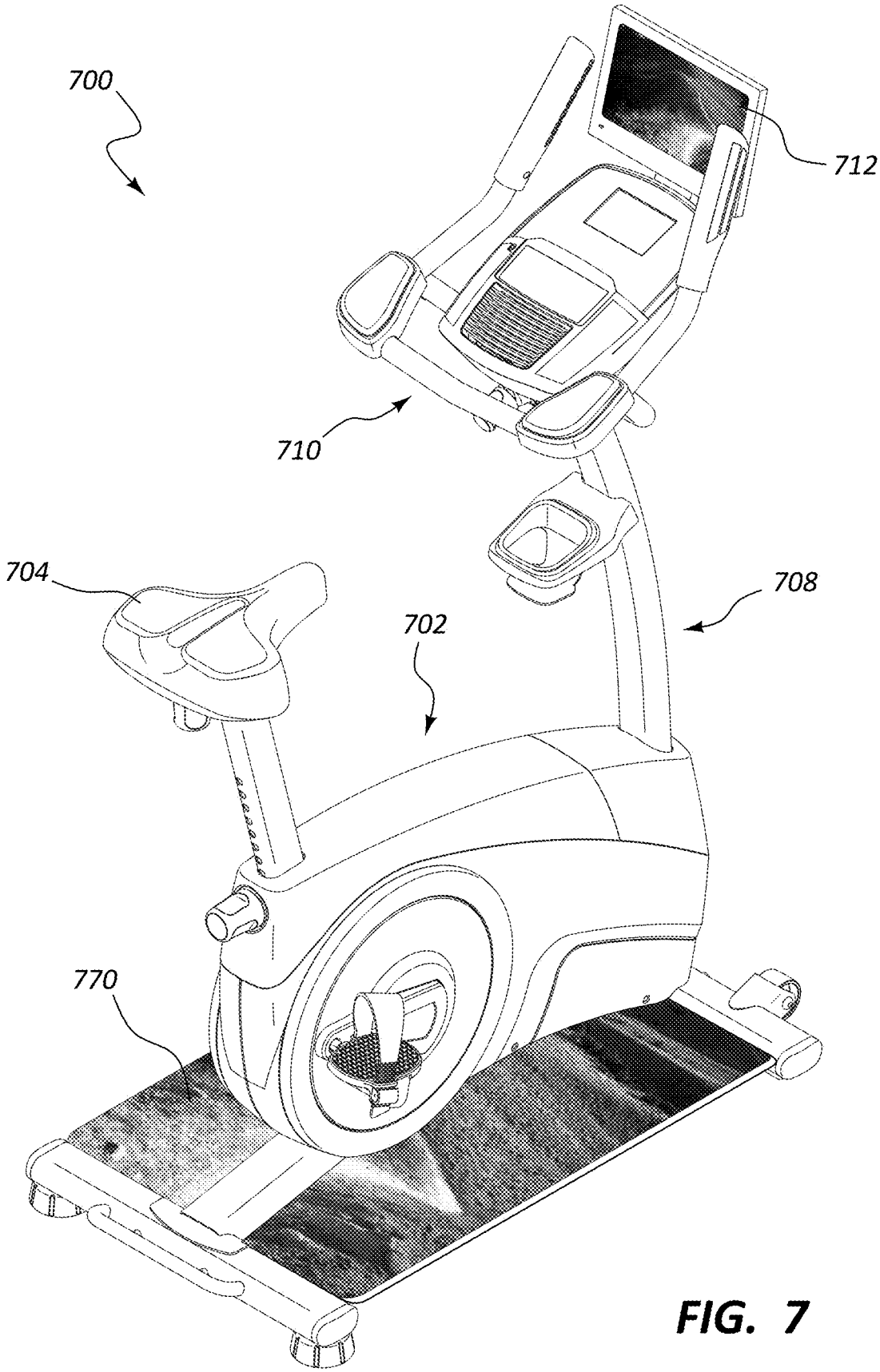
FIG. 7 illustrates a top view of an example of a display incorporated into a stationary bicycle in accordance with the present disclosure.

FIG. 7 depicts an example of a stationary bicycle 700. In this example, the stationary bicycle 700 includes a frame 702 and a crank assembly 704 attached to the frame 702. A seat 706 is also attached to the frame 702 and positioned above the crank assembly 704. The stationary bicycle 700 also includes an upright portion 708, and a console 710 with a first display 712 is attached to the upright portion 708.

A second display 714 is positioned underneath at least a portion of the frame 702. In this example, the second display 714 is attached below the crank assembly 704. While this example has been described with just two displays, in some examples, the stationary bicycle includes just a single display located beneath the crank assembly and/or located beneath an upright portion of the stationary bicycle.

Figure 8:
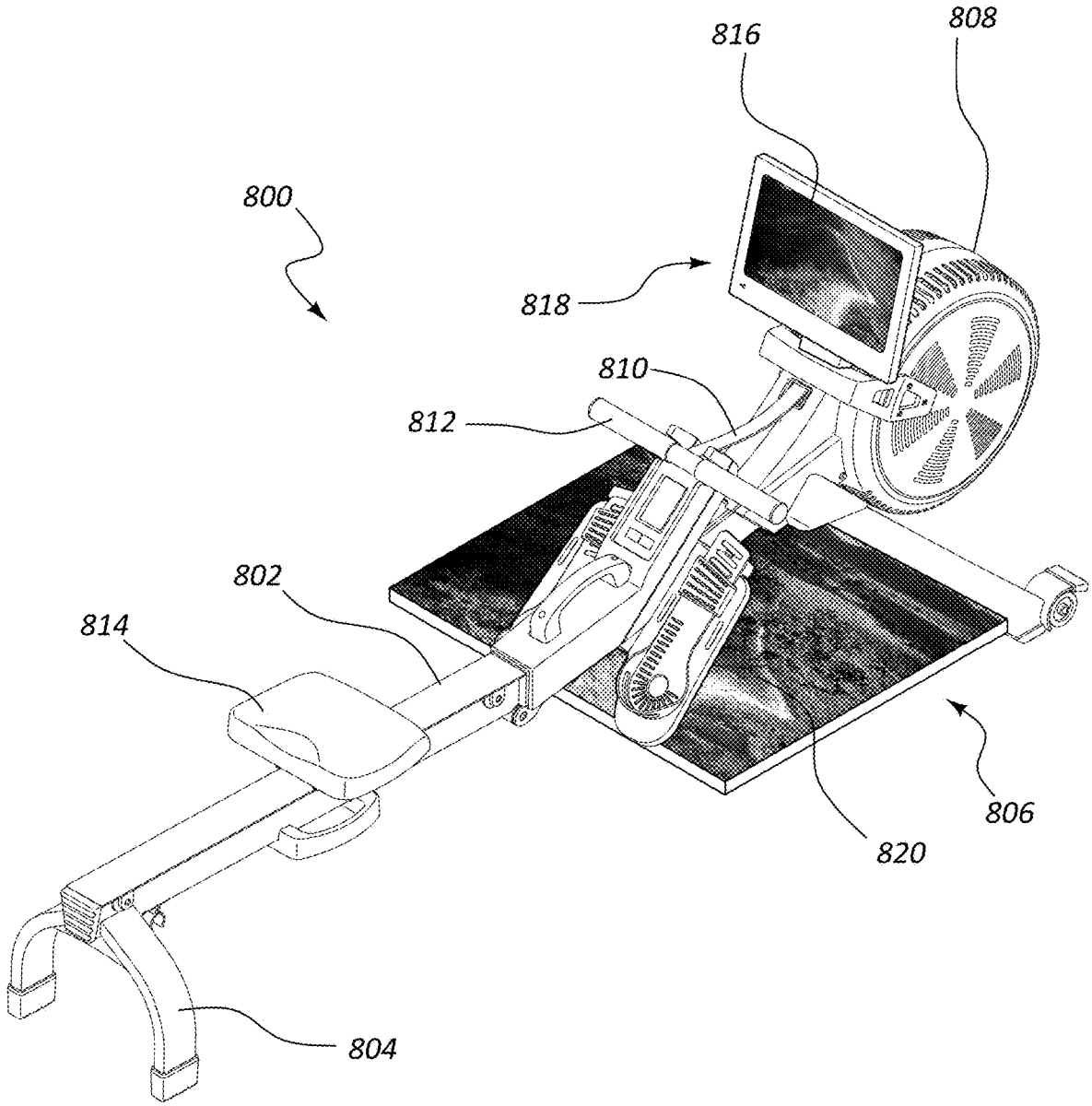
FIG. 8 illustrates a top view of an example of a display incorporated into a rowing machine in accordance with the present disclosure.

FIG. 8 depicts an example of a rowing machine 800. In this example, the rowing machine 800 includes a main frame member 802 supported by rear supports 804 and a front cross member 806. A flywheel 808 is incorporated into a front portion of the rowing machine 800. A pull cable 810 is connected to the flywheel 808 at a first cable end, and a handle 812 is connected to the pull cable 810 at a second cable end. A seat 814 is slidably attached to the main frame member 802.

A first display screen 816 is attached to a console 818 of the rowing machine 800. A second display screen 820 is attached to the rowing machine 800 beneath the main frame member 802. In this example, the second display screen 820 is located beneath the resistance mechanism (i.e. the flywheel). While this example is depicted with two displays, in other examples, the rowing machine includes a single display located beneath the main frame member 802.

Figure 9:
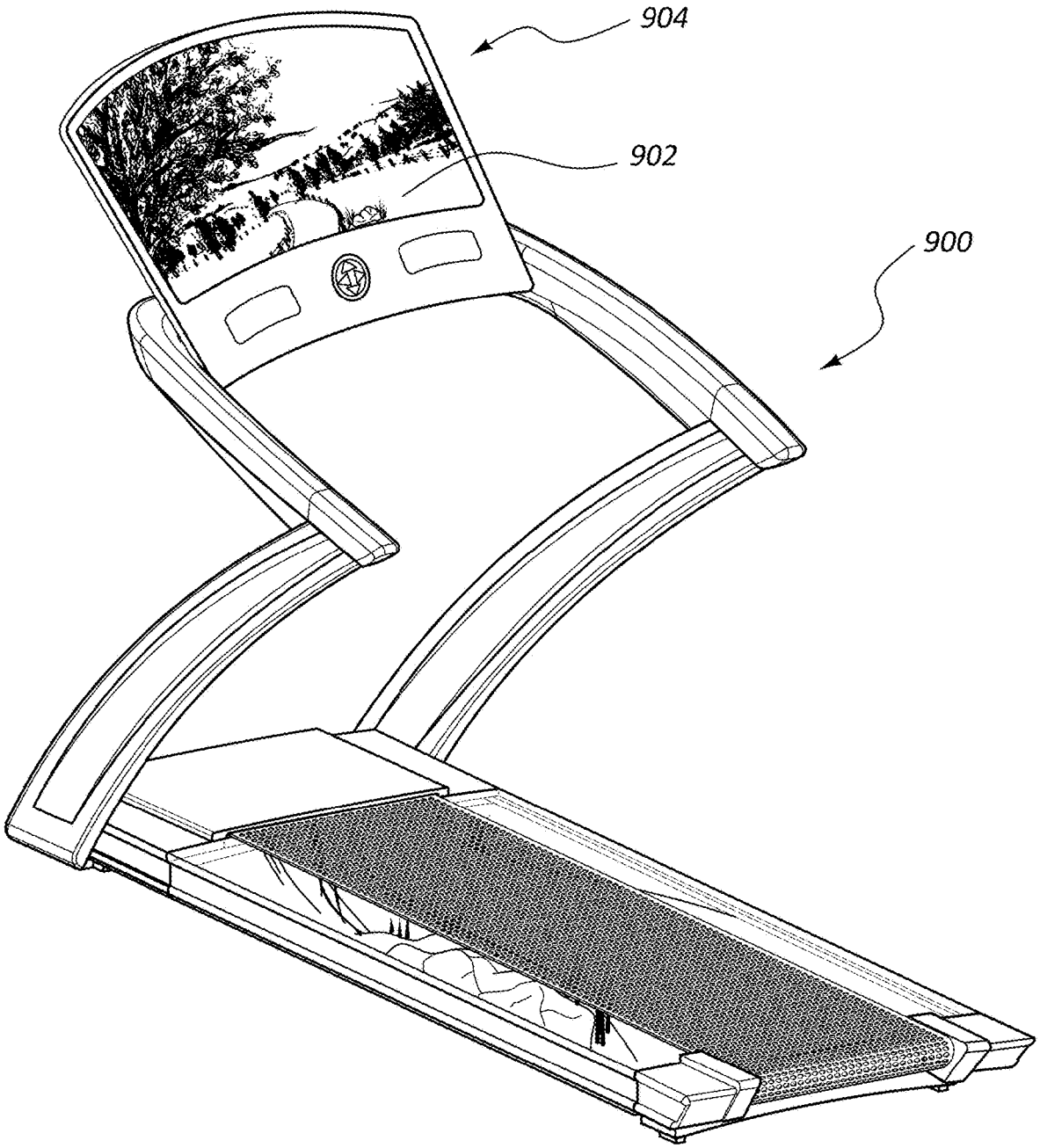
FIG. 9 illustrates a perspective view of an example of a treadmill in accordance with the present disclosure.

FIG. 9 depicts an example of a treadmill 900 with a console display 902 having an inwardly curved screen 904. In this example, the scenery depicted in the console display 902 may create a more realistic feel that the user is in the simulated environment.

Figure 10:
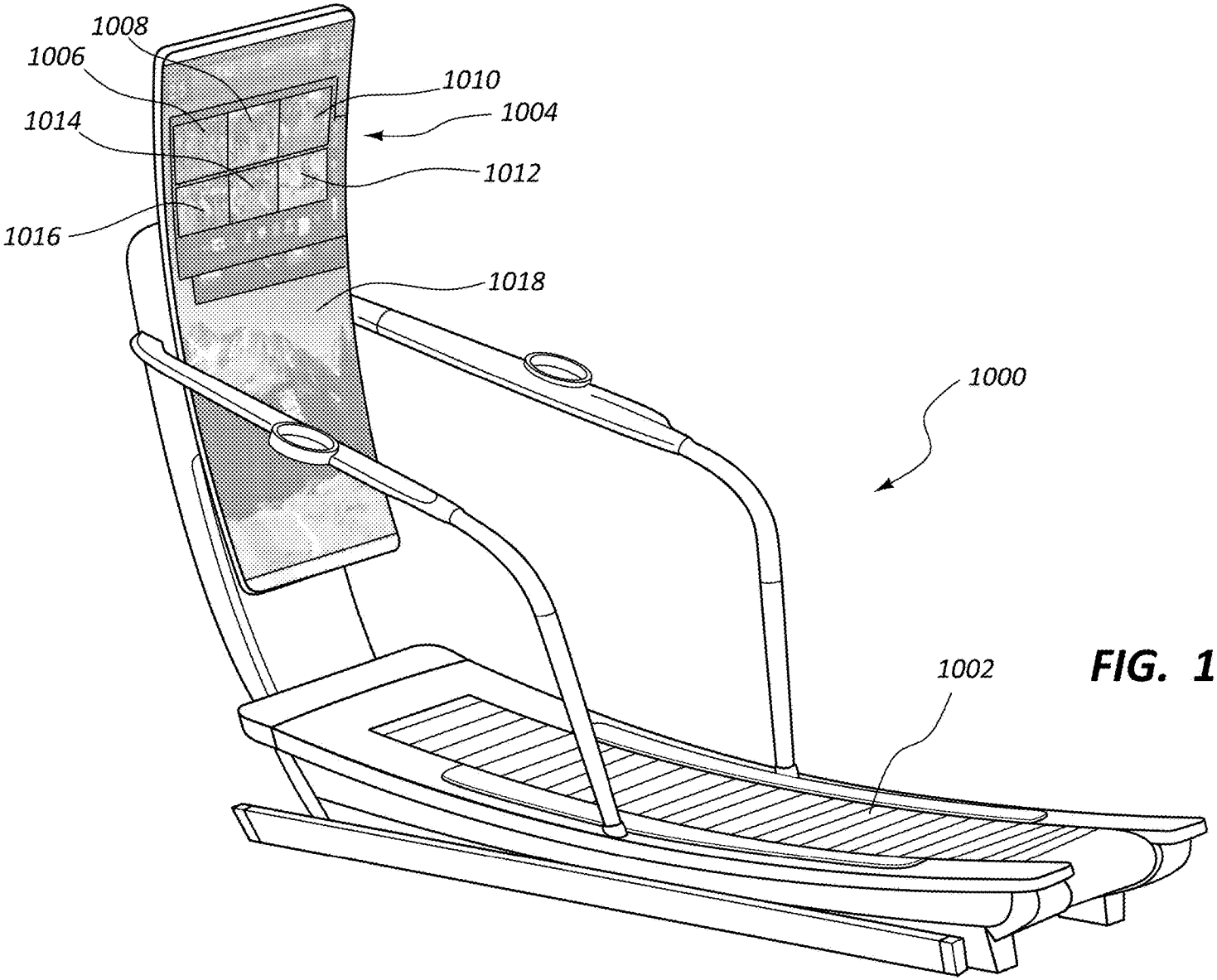
FIG. 10 illustrates a perspective view of an example of a treadmill in accordance with the present disclosure.

FIG. 10 depicts an example of a treadmill 1000 with a slatted running track 1002. Also, in this example, the treadmill 1000 includes a console screen 1004 with multiple displays. A first display 1006 depicts scenery. In this example, the other displays 1008, 1010, 1012, 1014, 1016, 1018 each depict different content. At least some of the content in one of the other displays 1008, 1010, 1012, 1014, 1016, 1018 is coordinated with the content in the first display 1006. In this example, the console screen 1004 also includes an inwardly curved surface.

General Description

In general, the invention disclosed herein may provide a user with a treadmill that has several advantages over conventional treadmills. The treadmill may include a running deck that has first pulley in a front portion of a platform and a second pulley incorporated into a rear portion of the platform. A tread belt may surround the first and second pulley. A motor can be attached to either the first or the second pulley so that as the motor rotates its shaft, the connected pulley rotates with the motor causing the tread belt to move.

The platform may have a length along its longest dimension and a width that is transverse the length. The width of the tread belt may span just a portion of the treadmill deck's platform. In this circumstance, the deck is wider than the tread belt. Thus, a first portion of the deck may extend past a first side of the tread belt, and a second portion of the deck may extend past a second side of the tread belt.

In some examples, the treadmill may include an upright structure. The deck may be connected to the upright structure so that the upright structure is oriented transversely to the deck. An incline mechanism may be incorporated into the treadmill so that the deck can change its incline orientation with respect to the upright structure. In some cases, the deck can be oriented at an inclined orientation, a declined orientation, or a neutral orientation. Further, in some instances, the treadmill deck has the capability of tilting from side to side.

A console may be connected to the upright structure. The console may include a display, an input mechanism, a cooling mechanism, a retention area for holding an object (e.g. mobile device, book, water bottle, etc.,), or combinations thereof. The console's display may present various types of information to the user.

The input mechanism provides the user means to communicate with the treadmill. For instance, the user may select a tread belt speed, a pre-programmed workout, a climate setting, an incline orientation, a tilt orientation, an entertainment setting, and so forth, with the input mechanisms. The input mechanisms may include a touch screen, a push button, a dial, a lever, a microphone, another type of input mechanism, or combinations thereof.

For example, the console may present physiological information about the user, like the user's heart rate. Also, the console may also depict the type of programmed workout selected, the tread belt's speed, the distance traveled by the user, another type of parameter, or combinations thereof. In some cases, the console's display may depict scenery to provide a feel that the user is exercising outdoors. In some cases, the orientation of the deck's platform may be synched with the scenery so that the deck mimics the terrain depicted in the display. For example, the platform may be inclined when the display depicts that the path is going uphill, or the platform may be declined when the display depicts that the path is going downhill.

In some embodiments of the invention, a second display is incorporated into the deck's platform. This deck display may be positioned under the tread belt, adjacent to the tread belt, to the side of the tread belt, forward of the tread belt, rearward of the tread belt, or combinations thereof.

The second display may be a digital display. In this circumstance, the display may be in communication with a processor and memory. The memory may store video files that can be depicted in the deck's display. In some circumstances, the video files include scenery files or other types of files. The display may also be in communication with a remote device that streams or downloads video files to the display. In some cases, the deck's display may be used to display information associated with the workout, with the user, with local news, with other types of information, or combinations thereof. In some examples, the treadmill's operational parameters can be presented in the display screen.

Any appropriate type of display may be incorporated into the deck. A non-exhaustive list of display types that may be used in accordance with the principles described in this disclosure, include cathode ray displays, liquid crystal displays, flat panel displays, stereo displays, plasma displays, electronically modulated optical displays, color display, monochrome displays, touch displays, electroluminescent panels, light emitting diodes displays, nano-emissive displays, quantum dot displays, digital light processing displays, active matrix displays, other types of displays, or combinations thereof.

The display screen may be made of any appropriate type of material that can withstand a user standing on it. This material may include Kevlar®, plastic, or another type of material. Further, the display screen may also be covered with a transparent coating that protects the screen from abrasion, dropped objects, or other types of contact.

In one embodiment, the display incorporated into the deck is located subjacent to at least a portion of the tread belt. In this circumstance, the tread belt may be perforated or have other types of openings that allow the display to be visible through the tread belt. In another example, at least a portion of the tread belt is transparent and/or translucent, which allows the user to see at least a portion of the display when the tread belt rotates or when the tread belt is not moving with respect to the deck.

In some examples, the display is wider than the tread belt. In this example, a first portion of the display extends beyond the edge of the tread belt's first side and a second portion of the display extends beyond the edge of the tread belt's second side. In this example, portions of scenery or other information depicted with the deck's display can be visible on the exposed portions of the display on either side of the tread belt. In this situation, the tread belt surrounds just a portion of the display incorporated into the deck.

In some cases, the deck includes more than one display. A first display may be positioned adjacent to a first edge of the tread belt, and a second display may be positioned adjacent to a second edge of the tread belt. In this situation, the edges of the first and second deck displays terminate before reaching the tread belt. In other words, the tread belt may not overlap these first and second deck displays. These first and second deck displays may be aligned with the orientation the deck. In other words, these displays may be situated lengthwise along the deck and/or aligned with the length of the tread belt. In some examples, at least one of the first and second deck displays span at least 10 percent of the deck's length, at least 20 percent of the deck's length, at least 30 percent of the deck's length, at least 40 percent of the deck's length, at least 50 percent of the deck's length, at least 60 percent of the deck's length, at least 70 percent of the deck's length, at least 80 percent of the deck's length, another percentage of the deck's length, or combinations thereof. In some examples, the deck includes at least one deck display, which is located on just one side of the deck.

The deck display may include a presentation side where the display presents content and is visible to the user. The deck display may also include a back side, which is facing downward and is not visible to the user when the treadmill is in operation. The tread belt includes an outer surface on which the user makes contact during the performance of an exercise, an inner surface which makes contact with the display and pulleys. The inner surface of the tread belt may surround the presentation side of the deck display and also surround the back side of the deck display.

In those situations where the tread belt includes perforations or other types of openings formed in the tread belt, the perforations may be defined in the outer surface and in the inner surface of the tread belt. The perforation may extend from the tread belt's outer surface to the tread belt's inner surface. Thus, the perforation may penetrate through the entire thickness of the tread belt. The perforations may be included along an edge of the tread belt, in the center of the tread belt, along a width of the tread belt, in patterns in the tread belt, arranged in another manner in the tread belt, or combinations thereof.

In other examples, the tread belt includes at least one window of transparent material. In some cases, the windows include a transparent material that fills the perforations so that the presentation side of the deck's display is visible. By incorporating the windows into the tread belt, the presentation side of the deck's display is protected from dirt, dust, or other types of particles that may reach the display through the perforations. In other examples, the tread belt is made of a material where the entire tread belt is transparent. But, in other examples, just portions of the tread belt are transparent.

The presentation side of the display may have a low friction surface so that the tread belt may slide along the presentation side without a substantial drag. In those examples where the tread belt includes perforations or another type of openings defined in the tread belt, the perforations may include a perforation edge formed between a wall of the perforation and the inner surface of the tread belt. The perforation edge may be constructed to wipe away debris, dirt, dust, excess lubricant, or other substances that may obscure the view of the deck's display. In some cases, the perforation edge is shaped so that debris or other substances are caught by the perforation edge, which moves the debris or other substances along with the tread belt and off of the display. In some cases, the inner surface of the tread belt may be lined with a soft material that can collect dust or other types of particles. This lining may be a fabric, a soft material, or another type of material that can collect debris while having a low likelihood of scratching the display.

In examples where the tread belt is constructed to clean the display as the tread belt moves, any appropriate mechanism for cleaning the tread belt may be used. A wiper may be disposed adjacent to an exit side of the display that wipes off the debris or other substances collected in the perforations or the tread belt's inner surface. In other cases, a blower may direct a gas (e.g. air) over the regions of the tread belt's inner surface to remove the debris. In other cases, a chemical may be applied to the inner surface to clean the inner surface as the tread belt moves off of the display. In yet other examples, the inner surface of the tread belt may pass over a magnet to remove debris with magnetic properties from off of the tread belt's inner surface.

In some cases, a lubricant is applied between the inner surface of the tread belt and the presentation side of the display screen. In these situations, the lubricant may be a transparent lubricant that maintains the visibility of the display screen.

In yet another example, the deck may include multiple displays. In this type of example, a first deck display may be incorporated into the region of the deck's platform that is adjacent to a first edge of the tread belt, and a second deck display may be incorporated into the region of the deck's platform that is adjacent to a second edge of the tread belt. In examples with two deck display screens, the deck display screens may depict the same images or they may depict different images.

In examples where the console includes sensors that measure the user's physiological information, this measured information may be transmitted to the deck display through a wireless transmission protocol. In other examples, the display incorporated into the deck may be hardwired to the sensors located in the console.

The treadmill may also be in communication with a remote device over a network, such as the internet. The user may access the records of his or her exercise history, previous workouts, exercise recommendations, personal information, or combinations thereof The remote device may record the workout information and/or the physiological information associated with the workout. An example of a user program that may be compatible with the principles described herein can be found at www.ifit.com, which is administered through Icon Health and Fitness, Inc. located in Logan, Utah, U.S.A. In other cases, the remote device includes video files or other types of files with other types of information.

The information received from the remote device may be displayed in the console's display, in the deck's display, or combinations thereof. In some examples, all of the information is sent to both the console's display and to the deck's display. In this situation, both the displays in the console and the deck may show the same information. In other examples, the information from the remote device is separated into parts. In this situation, at least a portion of the information can be sent to the console's display and another portion of the information can be sent to the display in the deck. Under these circumstances, the console's display and the deck's display may present different information. Where the console display and the deck display present different information, some of the information depicted in each of the screens may overlap with each other.

In some embodiments, the treadmill simulates an outdoor trail on which the user is exercising. The console's display depicts the type of scenery that a runner would likely see if he or she were running on the simulated outdoor trail. This type of scenery may include the trail ahead of the user, the background scenery, landmarks in the distance, animals, vegetation, other types of scenery, the horizon, and combinations. In some cases, the deck's display screen may depict the exact same scenery as is depicted in the console's display. In some other examples, the deck's display may depict just a subset of the scenery, but not the same scenery as depicted in the console's display. For example, the scenery depicted in the deck's display may include just the scenery that is likely to be viewed by a user if the user were running on the simulated trail. In this example, the user may see the scenery from a top view in the deck's display whereas the user see the same scenery from a side view in the console's display. The top view of the scenery may include the trail, the vegetation around the trail, rocks, landmarks near the trail, just scenery that is close to the running path, other types of scenery, or combinations thereof.

In some circumstances, the console's display screen and the deck's display screen are coordinated. In this situation, the scenery from the console's display may flow to the deck's display as the user progresses along the simulated trail. For example, the console's display may depict a side view of a rock next to the running path, as the user progresses along the trail, the rock appears to get closer to the user. At some point along the user's progression, the side view of the rock transitions from the off of the console's display screen to the deck screen where the rock is seen from a top view. While this example describes an image of a rock transitioning from the console's display to the deck's display, images of any other appropriate type of scenery can transition from the console display to the deck display. In some case, the scenery in the deck's display is depicted from a side view as well.

For purposes of this disclosure, the term "coordinated" generally refers to the information depicted in the first display having a relationship with the information depicted in the second display. As illustrated above, the relationship between the information in the first display and the information in the second display is that at least some of the information from the first display transitions to the second display. In this situation, the overlapping information that was presented in the first display is also shown in the second display, but the presentation of the overlapping information in the second display is delayed in time. This is one example of coordination between the first display and the second display. Further, coordinated display screens may include presenting the same information in both screens at the same time. In other examples, coordinated display screens may include causing the second display screen to be an extension of the first display screen.

In other examples, a relationship between the information depicted in the first and second display screens may be a relationship where the first display screen depicts an overview of a simulated course to be traveled by the user, and the second display depicts scenery of the simulated course. In this situation, the content depicted in the first and second displays convey information about the same course, although the type of content presented in the first and second displays are different.

A splitter may divide portions of a video feed (e.g. from a remote device or internal memory) to send some of the video data to the console's display while sending other data to the deck's display. In some cases, the splitter may cause the video data to be sent to each of the deck's display and the console's display at the same time. In other situations, the splitter may cause the separated video data to be sent to the deck display at a delayed time from the time that the splitter sends the video information to the console's display. In this case, some of the same scenery may be shown in both the console's display and the deck's display, but the scenery may be depicted in the deck's display at a later time than when it is depicted in the console's display. In yet other examples, the video feed to the console's display and the video feed to the deck's display may be separate and independent video feeds. In this example, the scenery or information depicted in the deck and console displays may be different. But, in other examples, the scenery depicted in the deck and console displays may depict the same simulated surroundings even though video feeds are from different, independent files.

While the examples above have been described with reference to a treadmill with a console display and a deck display, the treadmill may include a deck display without the console display. Further, while these principles have been described with respect to a treadmill, a display located below the movable element of the exercise device may be incorporated into other types of exercise machines.

For example, a display may be incorporated below the feet pedals in an elliptical trainer or a stationary bicycle. In these examples, the user has the advantage of having a display beneath him or her during the performance of the exercise thereby helping the user feel more like he or her is actually in a virtual setting. Further, the elliptical or stationary bike may present information to the user through a display located beneath his or her feet. In some examples, the top view images of a road or bicycle trail may be depicted in the displays located beneath, proximate, and/or subjacent to the foot pedals. In another example, the display may be incorporated into a rowing machine where the display is located beneath the slidable seat, the resistance mechanism, or another component of the rowing machine. In this example, the display may simulate ocean, river, and/or lake water as though the user were rowing on these bodies of water.

The deck displays, displays incorporated in the base of the elliptical trainer, displays located beneath resistance elements, displays located beneath pedals, displays located beneath rowing mechanisms, or other types of displays described above may include an ability to move. In some cases, these displays be may incline, decline, rotate, twist, tilt from side to side, or otherwise move. In some cases, these displays move in response to events occurring in the simulated workout. For example, the displays may incline as the user is simulated to travel up steep a portion of an outdoor trail. In cases where the display is a deck display in a treadmill, the deck displays may move with the deck. But in some cases, the deck display may move independent of the deck.

The coordinating system may include a combination of hardware and programmed instructions for executing the functions of the coordinating system. The coordinating system may include processing resources that are in communication with memory resources. Processing resources include at least one processor and other resources used to process the programmed instructions. As described herein, the memory resources may represent generally any memory capable of storing data such as programmed instructions or data structures used by the coordinating system.

The processing resources may include I/O resources that are capable of being in communication with a remote device that stores the user information, eating history, workout history, external resources, databases, or combinations thereof. The remote device may be a mobile device, a cloud based device, a computing device, another type of device, or combinations thereof. In some examples, the system communicates with the remote device through a mobile device which relays communications between the coordinating system and the remote device. In other examples, the mobile device has access to information about the user. The remote device may collect information about the user throughout the day, such as tracking calories, exercise, activity level, sleep, other types of information, or combination thereof.

The remote device may execute a program that can provide useful information to the coordinating system. An example of a program that may be compatible with the principles described herein includes the iFit program which is available through www.ifit.com identified above. An example of a program that may be compatible with the principles described in this disclosure is described in U.S. Pat. No. 7,980,996 issued to Paul Hickman. U.S. Pat. No. 7,980,996 is herein incorporated by reference for all that it discloses. In some examples, the user information accessible through the remote device includes the user's age, gender, body composition, height, weight, health conditions, other types of information, or combinations thereof.

The processing resources, memory resources, and remote devices may communicate over any appropriate network and/or protocol through the input/output resources. In some examples, the input/output resources includes a transmitter, a receiver, a transceiver, or another communication device for wired and/or wireless communications. For example, these devices may be capable of communicating using the ZigBee protocol, Z-Wave protocol, BlueTooth protocol, Wi-Fi protocol, Global System for Mobile Communications (GSM) standard, another standard, or combinations thereof. In other examples, the user can directly input some information into the tracking system through a digital input/output mechanism, a mechanical input/output mechanism, another type of mechanism, or combinations thereof.

The memory resources may include a computer readable storage medium that contains computer readable program code to cause tasks to be executed by the processing resources. The computer readable storage medium may be a tangible and/or non-transitory storage medium. The computer readable storage medium may be any appropriate storage medium that is not a transmission storage medium. A non-exhaustive list of computer readable storage medium types includes non-volatile memory, volatile memory, random access memory, write only memory, flash memory, electrically erasable program read only memory, magnetic based memory, other types of memory, or combinations thereof.

The memory resources may include a first display timer that represents programmed instructions that, when executed, cause the processing resources to control the timing of the content presented in the first display. Also, the memory resources may include a second display timer that represents programmed instructions that, when executed, cause the processing resources to control the timing of the content presented in the second display.

In some cases, the video content for both the first and second displays is from the same video file. The content in the video file may contain timing markers that can be used to coordinate the presentation of the content in the first and second displays. In those examples where the first and second displays present the same content at the same pace, the timing markers can be synchronized to be displayed at the same time. In those examples, where the content is to be presented in the first display and then presented in the second display a short time later, the second display can be instructed to present the content so that the timing markers are delayed from presentation in the second display by a predetermined time amount from when the corresponding timing markers are displayed in the first display.

In some examples, a portion of the content from the video file is directed to the first display for presentation and another portion of the content is directed towards the second display for presentation with the assistance of a video splitter. In this example, the timing markers can be coordinated so that the content in the first and second displays are presented at the appropriate time in relation to each other.

Further, the memory resources may be part of an installation package. In response to installing the installation package, the programmed instructions of the memory resources may be downloaded from the installation package's source, such as a portable medium, a server, a remote network location, another location, or combinations thereof. Portable memory media that are compatible with the principles described herein include DVDs, CDs, flash memory, portable disks, magnetic disks, optical disks, other forms of portable memory, or combinations thereof. In other examples, the program instructions are already installed. Here, the memory resources can include integrated memory such as a hard drive, a solid state hard drive, or the like.

In some examples, the processing resources and the memory resources are located within the exercise device, the first display, the second display, an external device, another type of device, or combinations thereof. The memory resources may be part of any of these device's main memory, caches, registers, non-volatile memory, or elsewhere in their memory hierarchy. Alternatively, the memory resources may be in communication with the processing resources over a network. Further, data structures, such as libraries or databases containing user and/or workout information, may be accessed from a remote location over a network connection while the programmed instructions are located locally. Thus, the coordinating system may be implemented with the exercise device, a mobile device, a wearable computing device, a head mounted device, a server, a collection of servers, a networked device, a watch, or combinations thereof.

In some examples, the treadmill includes a console display that has an inwardly curved screen. In these examples, the scenery depicted in the console display can create a more realistic feel that the user is in the simulated environment.

Further, the treadmill may include a slatted running track incorporated into the deck. In some examples, the slatted running track is used in lieu of a tread belt. Also, in this type of example, at least some of the track's slats are supported with a rigid member that extends from a first track formed in a first side wall of deck's platform to a second track formed in a second side wall of deck's platform. The slats may be flexibly coupled to each other. In one specific example, the slats can be joined with a hinge joint.

In some cases, the slatted running track is driven by a motor. In other examples, the slatted running track is self-powered by the user. In instances where the slatted running track is self-powered, the slatted running track may be connected to a flywheel to maintain the track's inertia as the user runs.

In some cases, the treadmill includes a console screen with multiple displays. A first display in the console screen may depict scenery, a top view of an exercise course, a physiological parameter of the user, an operating parameter of the treadmill (e.g. speed, incline, side tilt angle, user temperature, climate temperature, time of day, distance traveled, another parameter, local news, entertainment, or combinations there). In these types of example, the other displays may each depict different content or similar content to the first display. In some instances, the user may select which content is depicted in which display. For instance, if the largest display is the first display, the user may select the content from one of the other displays to be depicted in the first display. In one particular example, at least some of the content in one of the other displays may be coordinated with the content in the first display or one of the other displays.

What is claimed is:

1. An exercise device comprising:

a frame;

an upright portion of the frame;

a first display connected to the upright portion of the frame;

an exercise deck included in the frame, the exercise deck including:

a first pulley connected to a front portion of the exercise deck, a second pulley connected to a rear portion of the exercise deck, a second display incorporated into the exercise deck, and a tread belt surrounding the first pulley and the second pulley, surrounding at least a portion of the second display, and movable in a performance of an exercise, a first portion of the second display extending beyond a first edge of a first side of the tread belt and a second portion of the second display extending beyond a second edge of a second side of the tread belt; and a video splitter device configured to divide a video feed into a first video feed and a second video feed, and configured to output the first video feed to the first display and the second video feed to the second display.

2. The exercise device of claim 1, wherein the first video feed contains some overlapping data that overlaps with the second video feed and some non-overlapping data that does not overlap with the second video feed, and the overlapping data is delayed from presentation in the second display from when the overlapping data is displayed in the first display.

3. The exercise device of claim 2, wherein the overlapping data depicts scenery and wherein the delaying causes an effect of having the scenery appear to transfer from the first display to the second display.

4. The exercise device of claim 1, wherein the second display is adjacent to at least a portion of the tread belt.

5. The exercise device of claim 1, wherein the second display is below at least a portion of the tread belt.

6. The exercise device of claim 1, wherein the first display and the second display are configured to depict coordinated images.

7. The exercise device of claim 1, wherein the first video feed and the second video feed are identical.

8. The exercise device of claim 1, wherein the first video feed contains at least some data that does not overlap with data in the second video feed.

9. The exercise device of claim 1, wherein the second display is covered with a transparent plastic film.

10. An exercise device comprising:

an upright structure;

a first display connected to the upright structure; and an exercise deck connected to the upright structure, the exercise deck including:

a first pulley connected to a front portion of the exercise deck, a second pulley connected to a rear portion of the exercise deck, a tread belt surrounding the first pulley and the second pulley, and a second display is incorporated into the exercise deck and is adjacent to or below a portion of the tread belt, a first portion of the second display extending beyond a first edge of a first side of the tread belt and a second portion of the second display extending beyond a second edge of a second side of the tread belt;

wherein the first display and the second display are configured to depict coordinated images.

11. The exercise device of claim 10, further including a video splitter device configured to divide a video feed into a first video feed and a second video feed, and configured to output the first video feed to the first display and the second video feed to the second display.

12. The exercise device of claim 11, wherein the first video feed contains some overlapping data that overlaps with the second video feed and some non-overlapping data that does not overlap with the second video feed, and the overlapping data is delayed from presentation in the second display from when the overlapping data is displayed in the first display.

13. The exercise device of claim 12, wherein the overlapping data depicts scenery and wherein the delaying causes an effect of having the scenery appear to transfer from the first display to the second display.

14. The exercise device of claim 11, wherein the first video feed and the second video feed are identical.

15. The exercise device of claim 10, wherein the second display is covered with a transparent plastic film.

16. An exercise device comprising:

an upright structure;

a first display connected to the upright structure; and an exercise deck connected to the upright structure, the exercise deck including:

a first pulley connected to a front portion of the exercise deck, a second pulley connected to a rear portion of the exercise deck, a tread belt surrounding the first pulley and the second pulley, a second display incorporated into the exercise deck and surrounded by at least a portion of the tread belt, and a video splitter device configured to divide a video feed into a first video feed and a second video feed, and configured to output the first video feed to the first display and the second video feed to the second display;

a processor and memory, the memory including programmed instructions that, when executed, cause the processor to:

output the first video feed to the first display via the video splitter device, output the second video feed to the second display via the video splitter device, and delay overlapping data between the first video feed and the second video feed from presentation in the second display from when the overlapping data is presented in the first display to cause an effect of having scenery appear to transfer from the first display to the second display.

17. The exercise device of claim 16, wherein a first portion of the second display extends beyond a first edge of a first side of the tread belt and a second portion of the second display extends beyond a second edge of a second side of the tread belt.

18. The exercise device of claim 16, wherein the second display is covered with a transparent plastic film.

* * * * *